US012239890B2

(12) United States Patent
Johnson et al.

(10) Patent No.: US 12,239,890 B2
(45) **Date of Patent: *Mar. 4, 2025**

(54) GOLF CLUB HEAD

(71) Applicant: Taylor Made Golf Company, Inc, Carlsbad, CA (US)

(72) Inventors: Matthew Johnson, Carlsbad, CA (US); David Bennett, Carlsbad, CA (US); Joseph Hoffman, Carlsbad, CA (US); Joseph R. Nielson, Vista, CA (US); Nathan T. Sargent, Oceanside, CA (US); Christopher J. Harbert, Carlsbad, CA (US); Jared Guttmann, Oceanside, CA (US); Christian R. Wester, San Diego, CA (US); Jake Feuerstein, San Diego, CA (US); Mattieu Bovee, Oceanside, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 298 days.

This patent is subject to a terminal disclaimer.

(21) Appl. No.: 17/722,632

(22) Filed: Apr. 18, 2022

(65) Prior Publication Data

US 2022/0323834 A1 Oct. 13, 2022

Related U.S. Application Data

(63) Continuation of application No. 17/145,024, filed on Jan. 8, 2021, now Pat. No. 11,331,548, which is a (Continued)

(51) Int. Cl.
*A63B 53/04* (2015.01)
*A63B 53/02* (2015.01)
(Continued)

(52) U.S. Cl.
CPC ..... *A63B 53/0466* (2013.01); *A63B 53/02* (2013.01); *A63B 53/06* (2013.01);
(Continued)

(58) Field of Classification Search
CPC ..... A63B 53/0466; A63B 2053/0491; A63B 53/0408; A63B 53/0433; A63B 53/0437;
(Continued)

(56) References Cited

U.S. PATENT DOCUMENTS 5,997,415 A 12/1999 Wood
6,773,360 B2 8/2004 Willett et al.
(Continued)

OTHER PUBLICATIONS

Kozuchowski, Callaway Big Bertha and Big Bertha Alpha drivers, Golf RX, Dec. 2, 2013, download available at http://www.golfwrx.com/154230/callaway-big-bertha-and-big-bertha-alpha-drivers/ on May 2, 2018.

(Continued)

*Primary Examiner* — Sebastiano Passaniti
(74) *Attorney, Agent, or Firm* — Kunzler Bean & Adamson

(57) ABSTRACT

Disclosed herein is a golf club head comprising at least one crown opening and at least one crown insert attached to the body and covering the at least one crown opening. The golf club head further comprises at least one sole opening and at least one sole insert attached to the body and covering the at least one sole opening. The golf club head additionally includes at least one weight member configured to clamp first and second ledges at selected locations along a sliding weight track. The golf club head also comprise a coefficient of restitution (COR) feature located on the sole of the golf club head. The at least one crown insert is formed from a composite material having a density between 1 g/cc and 2
(Continued)

g/cc. The at least one sole insert is formed from a composite material having a density between 1 g/cc and 2 g/cc.

22 Claims, 56 Drawing Sheets

Related U.S. Application Data continuation of application No. 17/100,438, filed on Nov. 20, 2020, now Pat. No. 11,712,606, which is a continuation of application No. 15/860,534, filed on Jan. 2, 2018, now Pat. No. 10,874,914, which is a continuation-in-part of application No. 15/259,026, filed on Sep. 7, 2016, now Pat. No. 10,086,240, which is a continuation-in-part of application No. 15/255,638, filed on Sep. 2, 2016, now Pat. No. 10,035,049, which is a continuation-in-part of application No. 15/087,002, filed on Mar. 31, 2016, now Pat. No. 9,914,027.

(60) Provisional application No. 62/440,886, filed on Dec. 30, 2016, provisional application No. 62/205,601, filed on Aug. 14, 2015.

(51) Int. Cl.
*A63B 53/06* (2015.01)
*A63B 53/08* (2015.01)
*A63B 60/04* (2015.01)
*A63B 60/50* (2015.01)
*A63B 60/52* (2015.01)

(52) U.S. Cl.
CPC ..... *A63B 53/08* (2013.01); *A63B 60/04* (2015.10); *A63B 60/50* (2015.10); *A63B 60/52* (2015.10); *A63B 53/025* (2020.08); *A63B 53/026* (2020.08); *A63B 53/027* (2020.08); *A63B 53/0408* (2020.08); *A63B 53/0412* (2020.08); *A63B 53/0433* (2020.08); *A63B 53/0437* (2020.08); *A63B 53/045* (2020.08); *A63B 2053/0495* (2013.01); *A63B 2209/00* (2013.01); *A63B 2209/02* (2013.01)

(58) Field of Classification Search
CPC ..... A63B 60/54; A63B 60/04; A63B 53/06; A63B 53/025; A63B 53/026; A63B 53/027; A63B 2209/02
USPC ..... 473/324–350, 287–292
See application file for complete search history.

(56) References Cited

U.S. PATENT DOCUMENTS 6,800,038 B2 10/2004 Willett et al.
6,824,475 B2 11/2004 Burnett et al.
6,969,326 B2 11/2005 De Shiell et al.
6,997,820 B2 2/2006 Willett et al.
7,140,974 B2 11/2006 Chao et al.
7,166,040 B2 1/2007 Chao et al.
7,186,190 B1 3/2007 Beach et al.
7,223,180 B2 5/2007 Willett et al.
7,261,646 B2 8/2007 De Shiell et al.
7,267,620 B2 9/2007 Chao et al.
7,407,447 B2 8/2008 Beach et al.
7,410,425 B2 8/2008 Willett et al.
7,410,426 B2 8/2008 Willett et al.
7,419,441 B2 9/2008 Hoffman et al.
7,448,963 B2 11/2008 Beach et al.
7,452,285 B2 11/2008 Chao et al.
7,530,901 B2 * 5/2009 Imamoto ..... A63B 53/0466 473/347
7,530,904 B2 5/2009 Beach et al.
7,540,811 B2 6/2009 Beach et al.
7,568,985 B2 8/2009 Beach et al.
7,578,753 B2 8/2009 Beach et al.
7,582,024 B2 9/2009 Shear
7,591,738 B2 9/2009 Beach et al.
7,621,823 B2 11/2009 Beach et al.
7,628,707 B2 12/2009 Beach et al.
7,628,712 B2 12/2009 Chao et al.
7,632,194 B2 12/2009 Beach et al.
7,691,008 B2 * 4/2010 Oyama ..... A63B 60/02 473/345
7,713,142 B2 5/2010 Hoffman et al.
7,717,804 B2 5/2010 Beach et al.
7,717,805 B2 5/2010 Beach et al.
7,744,484 B1 6/2010 Chao et al.
RE41,577 E 8/2010 McLean
7,775,905 B2 8/2010 Beach et al.
7,846,041 B2 12/2010 Beach et al.
7,874,936 B2 1/2011 Chao et al.
7,874,937 B2 1/2011 Chao et al.
7,874,938 B2 1/2011 Chao et al.
7,963,861 B2 6/2011 Beach et al.
RE42,544 E 7/2011 Chao et al.
7,985,146 B2 7/2011 Lin et al.
7,993,216 B2 * 8/2011 Lee ..... A63B 53/0466 473/345
8,012,038 B1 9/2011 Beach et al.
8,025,587 B2 9/2011 Beach et al.
8,096,897 B2 1/2012 Beach et al.
8,192,303 B2 6/2012 Ban
8,235,831 B2 8/2012 Beach et al.
8,303,431 B2 11/2012 Beach et al.
8,337,319 B2 12/2012 Sargent et al.
8,353,786 B2 1/2013 Beach et al.
8,430,763 B2 4/2013 Beach et al.
8,444,505 B2 5/2013 Beach et al.
8,529,368 B2 * 9/2013 Rice ..... A63B 60/00 473/345
8,550,934 B2 * 10/2013 Evans ..... A63B 53/06 473/409
8,608,591 B2 12/2013 Chao et al.
8,628,434 B2 1/2014 Chao et al.
8,734,271 B2 5/2014 Beach et al.
8,870,678 B2 10/2014 Beach et al.
9,033,821 B2 5/2015 Beach et al.
9,174,096 B2 11/2015 Sargent et al.
9,211,453 B1 12/2015 Foster et al.
9,259,625 B2 2/2016 Sargent et al.
9,561,413 B2 2/2017 Nielson et al.
9,675,856 B1 6/2017 Gibbs et al.
9,795,840 B2 10/2017 Greensmith et al.
9,914,028 B1 3/2018 Cleghorn et al.
9,962,584 B2 5/2018 Nielson et al.
10,035,049 B1 7/2018 Nielson et al.
10,046,212 B2 8/2018 Sargent et al.
10,086,240 B1 10/2018 Hoffman et al.
10,188,916 B2 * 1/2019 Harbert ..... A63B 60/00
10,569,144 B2 2/2020 Nielson et al.
10,576,335 B2 3/2020 Greaney et al.
10,751,585 B2 * 8/2020 Johnson ..... A63B 53/06
10,843,048 B1 11/2020 Hoffman et al.
10,874,914 B2 12/2020 Johnson et al.
11,077,344 B2 8/2021 Nielson et al.
11,179,610 B2 11/2021 Sargent et al.
11,331,547 B2 5/2022 Hoffman et al.
11,642,576 B2 * 5/2023 Wester ..... A63B 53/0466 473/345
11,964,192 B2 4/2024 Hoffman et al.
2007/0049415 A1 * 3/2007 Shear ..... A63B 53/0466 473/349
2008/0149267 A1 6/2008 Chao et al.
2009/0042667 A1 * 2/2009 Lin ..... A63B 53/0466 473/345
2009/0088269 A1 4/2009 Beach et al.
2009/0163289 A1 6/2009 Chao et al.
2011/0152000 A1 6/2011 Sargent et al.

(56) References Cited

U.S. PATENT DOCUMENTS

| | | | | |
|---|---|---|---|---|
| 2011/0159986 | A1* | 6/2011 | Chao | A63B 53/0466 473/345 |
| 2011/0312437 | A1 | 12/2011 | Sargent et al. | |
| 2012/0071264 | A1 | 3/2012 | Beach et al. | |
| 2012/0122601 | A1 | 5/2012 | Beach et al. | |
| 2012/0202615 | A1* | 8/2012 | Beach | A63B 60/52 473/345 |
| 2012/0220387 | A1* | 8/2012 | Beach | A63B 53/02 473/307 |
| 2012/0258818 | A1 | 10/2012 | Beach et al. | |
| 2013/0123040 | A1 | 5/2013 | Willett et al. | |
| 2014/0080628 | A1 | 3/2014 | Sargent et al. | |
| 2014/0080629 | A1* | 3/2014 | Sargent | A63B 53/045 473/336 |
| 2014/0113739 | A1* | 4/2014 | Jertson | A63B 53/04 473/409 |
| 2015/0375070 | A1 | 12/2015 | Beach et al. | |
| 2016/0001146 | A1 | 1/2016 | Sargent et al. | |
| 2016/0023060 | A1 | 1/2016 | Harbert et al. | |
| 2016/0023063 | A1 | 1/2016 | Willet et al. | |
| 2016/0059093 | A1 | 3/2016 | Nielson et al. | |
| 2016/0059094 | A1 | 3/2016 | Mata et al. | |
| 2017/0072277 | A1 | 3/2017 | Mata et al. | |
| 2020/0324182 | A1 | 10/2020 | Bennett et al. | |
| 2021/0121746 | A1 | 4/2021 | Johnson et al. | |

OTHER PUBLICATIONS

Procedure for Measuring the Club Head Size of Wood Clubs, United States Golf Association and R&A Rules Limited, Revision 1.0.0, Nov. 21, 2003, pp. 1-6.

Hopley, Callaway Great Big Bertha Driver Review, Golfalot, Aug. 4, 2015. download available at http://www.golfalot.com/equipment-reviews/callaway-great-big-bertha-driver-review-3308.aspx on Oct. 11, 2018.

* cited by examiner

GOLF CLUB HEAD

CROSS-REFERENCE TO RELATED APPLICATIONS

This application is a continuation of U.S. patent application Ser. No. 17/100,438, filed Nov. 20, 2020, which is a continuation of U.S. patent application Ser. No. 15/860,534, filed Jan. 2, 2018, which claims the benefit of U.S. Provisional Patent Application No. 62/440,886, filed Dec. 30, 2016, and is a continuation-in-part of U.S. patent application Ser. No. 15/259,026, filed Sep. 7, 2016, which is a continuation-in-part of U.S. patent application Ser. No. 15/255,638, filed Sep. 2, 2016, which is a continuation-in-part of U.S. patent application Ser. No. 15/087,002, filed on Mar. 31, 2016, which application claims the benefit of U.S. Provisional Patent Application No. 62/205,601, filed on Aug. 14, 2015, all of which are incorporated herein by reference in their entireties. This application is related to U.S. patent application Ser. No. 15/859,071, filed Dec. 29, 2017, which is incorporated herein by reference in its entirety.

FIELD

This disclosure relates generally to golf clubs, and more particularly to a head of a golf club with a comparatively low vertical positioning of a center of gravity of the golf club head relative to a crown height of the golf club head.

BACKGROUND

Modern "wood-type" golf clubs (notably, "drivers," "fairway woods," and "utility or hybrid clubs"), are generally called "metalwoods" since they tend to be made of strong, lightweight metals, such as titanium. An exemplary metalwood golf club, such as a driver or fairway wood, typically includes a hollow shaft and a club head coupled to a lower end of the shaft. Most modern versions of club heads are made, at least in part, from a lightweight but strong metal, such as a titanium alloy. In most cases, the golf club head is includes a hollow body to which a face plate, or face portion, is attached or integrally formed. The face portion has a front surface, known as a striking face, configured to contact the golf ball during a proper golf swing.

Center-of-gravity (CG) and mass moments of inertia critically affect a golf club head's performance, such as launch angle and flight trajectory on impact with a golf ball, among other characteristics.

A mass moment of inertia is a measure of a club head's resistance to twisting about the golf club head's center-of-gravity, for example on impact with a golf ball. In general, a moment of inertia of a mass about a given axis is proportional to the square of the distance of the mass away from the axis. In other words, increasing distance of a mass from a given axis results in an increased moment of inertia of the mass about that axis. Higher golf club head moments of inertia result in lower golf club head rotation on impact with a golf ball, particularly on "off-center" impacts with a golf ball, e.g., mis-hits. Lower rotation in response to a mis-hit results in a player's perception that the club head is forgiving. Generally, one measure of "forgiveness" can be defined as the ability of a golf club head to reduce the effects of mis-hits on flight trajectory and shot distance, e.g., hits resulting from striking the golf ball at a less than ideal impact location on the golf club head. Greater forgiveness of the golf club head generally equates to a higher probability of hitting a straight golf shot. Moreover, higher moments of inertia typically result in greater ball speed on impact with the golf club head, which can translate to increased golf shot distance.

Most fairway wood club heads are intended to hit the ball directly from the ground, e.g., the fairway, although many golfers also use fairway woods to hit a ball from a tee. Accordingly, fairway woods are subject to certain design constraints to maintain playability. For example, compared to typical drivers, which are usually designed to hit balls from a tee, fairway woods often have a relatively shallow head height, providing a relatively lower center of gravity and a smaller top view profile for reducing contact with the ground. Such fairway woods inspire confidence in golfers for hitting from the ground. Also, fairway woods typically have a higher loft than most drivers, although some drivers and fairway woods share similar lofts. For example, most fairway woods have a loft greater than or equal to about 13 degrees, and most drivers have a loft between about 7 degrees and about 15 degrees.

Faced with constraints such as those just described, golf club manufacturers often must choose to improve one performance characteristic at the expense of another. For example, some conventional golf club heads offer increased moments of inertia to promote forgiveness while at the same time incurring a higher than desired CG-position and increased club head height. Club heads with high CG and/or large height might perform well when striking a ball positioned on a tee, such is the case with a driver, but not when hitting from the turf. Thus, conventional golf club heads that offer increased moments of inertia for forgiveness often do not perform well as a fairway wood club head.

Although traditional fairway wood club heads generally have a low CG relative to most traditional drivers, such clubs usually also suffer from correspondingly low mass moments of inertia. In part due to their relatively low CG, traditional fairway wood club heads offer acceptable launch angle and flight trajectory when the club head strikes the ball at or near the ideal impact location on the ball striking face. But because of their low mass moments of inertia, traditional fairway wood club heads are less forgiving than club heads with high moments of inertia, which heretofore have been drivers. As already noted, conventional golf club heads that have increased mass moments of inertia, and thus are more forgiving, have a relatively high CG.

Accordingly, to date, golf club designers and manufacturers have not offered golf club heads with high moments of inertia for improved forgiveness and low center-of-gravity.

A continual challenge to improving performance in woods is generating ballspeed. In addition to the center of gravity and center of gravity projection, the geometry of the face and clubhead play a major role in determining initial ball velocity.

SUMMARY

The subject matter of the present application has been developed in response to the present state of the art, and in particular, in response to the shortcomings of golf clubs and associated golf club heads, that have not yet been fully solved by currently available techniques. Accordingly, the subject matter of the present application has been developed to provide a golf club and golf club head that overcome at least some of the above-discussed shortcomings of prior art techniques.

Disclosed herein is a golf club head comprising a body having a face, a crown and a sole together defining an interior cavity. The body has a sliding weight track with first and second opposing ledges extending within the sliding weight track. The golf club head also comprises at least one crown opening and at least one crown insert attached to the body and covering the at least one crown opening. The golf club head further comprises at least one sole opening and at least one sole insert attached to the body and covering the at least one sole opening. The golf club head additionally includes at least one weight member configured to clamp the first and second ledges at selected locations along the sliding weight track. The at least one weight member is located entirely external to the interior cavity of the body and comprises an outer member, an inner member, and a threaded fastening bolt that connects the outer member to the inner member. The golf club head also comprise a coefficient of restitution (COR) feature located on the sole of the golf club head. The at least one crown insert is formed from a composite material having a density between 1 g/cc and 2 g/cc. The at least one sole insert is formed from a composite material having a density between 1 g/cc and 2 g/cc. The preceding subject matter of this paragraph characterizes example 1 of the present disclosure.

At least one of the inner member and the outer member are noncircular and shaped to prevent rotation upon tightening the threaded fastening bolt. The preceding subject matter of this paragraph characterizes example 2 of the present disclosure, wherein example 2 also includes the subject matter according to example 1, above.

The outer member comprises a central protrusion that extends into a space between the first and second ledges. The outer member further comprises first and second recessed surfaces on opposite sides of the central protrusion. The first recessed surface is configured to contact the first ledge and the second recessed surface being configured to contact the second ledge. The preceding subject matter of this paragraph characterizes example 3 of the present disclosure, wherein example 3 also includes the subject matter according to any one of examples 1 or 2, above.

When the at least one weight member is secured to the sliding weight track the outer member engages an outward facing surface of the at least one ledge and the inner member engages an inward-facing surface of the at least one ledge. The threaded fastening bolt has a threaded shaft that extends through a first aperture of the outer member and engages mating threads located in a second aperture of the inner member. The preceding subject matter of this paragraph characterizes example 4 of the present disclosure, wherein example 4 also includes the subject matter according to example 3, above.

The at least one crown insert has a thickness ranging from about 0.195 mm to about 0.9 mm. The preceding subject matter of this paragraph characterizes example 5 of the present disclosure, wherein example 5 also includes the subject matter according to any one of examples 1-4, above.

The at least one sole insert has a thickness ranging from about 0.195 mm to about 0.9 mm. The preceding subject matter of this paragraph characterizes example 6 of the present disclosure, wherein example 6 also includes the subject matter according to any one of examples 1-5, above.

The body is formed of steel. The preceding subject matter of this paragraph characterizes example 7 of the present disclosure, wherein example 7 also includes the subject matter according to any one of examples 1-6, above.

The body is formed of titanium. The preceding subject matter of this paragraph characterizes example 8 of the present disclosure, wherein example 8 also includes the subject matter according to any one of examples 1-6, above.

The crown insert is comprised of at least four plies of uni-tape standard modulus graphite. The preceding subject matter of this paragraph characterizes example 9 of the present disclosure, wherein example 9 also includes the subject matter according to any one of examples 1-8, above.

The at least four plies being oriented at any combination of 0°, +45°, −45° and 90°. The preceding subject matter of this paragraph characterizes example 10 of the present disclosure, wherein example 10 also includes the subject matter according to example 9, above.

The sole insert is comprised of at least four plies of uni-tape standard modulus graphite. The preceding subject matter of this paragraph characterizes example 11 of the present disclosure, wherein example 11 also includes the subject matter according to any one of examples 1-10, above.

The at least four plies being oriented at any combination of 0°, +45°, −45° and 90°. The preceding subject matter of this paragraph characterizes example 12 of the present disclosure, wherein example 12 also includes the subject matter according to any one of examples 1-10, above.

The at least one crown insert and the at least one sole insert each has a thickness ranging from about 0.195 mm to about 0.9 mm. The at least one crown insert and the at least one sole insert are comprised of at least four plies of uni-tape standard modulus graphite being oriented at any combination of 0°, +45°, −45° and 90°. The preceding subject matter of this paragraph characterizes example 13 of the present disclosure, wherein example 13 also includes the subject matter according to any one of examples 1-8, above.

The body is formed of steel. The preceding subject matter of this paragraph characterizes example 14 of the present disclosure, wherein example 14 also includes the subject matter according to example 13, above.

The body is formed of titanium. The preceding subject matter of this paragraph characterizes example 15 of the present disclosure, wherein example 15 also includes the subject matter according to example 13, above.

The golf club head further comprises a heel opening located on a heel end of the body. The heel opening is configured to receive a fastening member. The golf club head further comprises a head-shaft connection system including a sleeve that is secured by the fastening member in a locked position. The head-shaft connection system is configured to allow the golf club head to be adjustably attachable to a golf club shaft in a plurality of different positions resulting in an adjustability range of different combinations of loft angle, face angle, or lie angle. The preceding subject matter of this paragraph characterizes example 16 of the present disclosure, wherein example 16 also includes the subject matter according to any one of examples 1-15, above.

The COR feature is a channel. The preceding subject matter of this paragraph characterizes example 17 of the present disclosure, wherein example 17 also includes the subject matter according to any one of examples 1-16, above.

The COR feature is a through slot. The preceding subject matter of this paragraph characterizes example 18 of the present disclosure, wherein example 18 also includes the subject matter according to any one of examples 1-16, above.

The golf club head has a volume between 130 cm3 and 220 cm3. The preceding subject matter of this paragraph characterizes example 19 of the present disclosure, wherein example 19 also includes the subject matter according to any one of examples 1-18, above.

Also disclosed herein is a golf club head comprising a body having a face, a crown and a sole together defining an interior cavity. The body comprises a sliding weight track with first and second opposing ledges extending within the sliding weight track. The golf club head also comprises at least one weight member movably positioned within the sliding weight track and configured to clamp the first and second ledges at selected locations along the sliding weight track. The golf club head additionally comprises a coefficient of restitution (COR) feature located on the sole of the golf club head. The COR feature is a through slot. The golf club head further comprises a heel opening located on a heel end of the body. The heel opening is configured to receive a fastening member. The golf club head additionally comprises a head-shaft connection system including a sleeve that is secured by the fastening member in a locked position. The head-shaft connection system is configured to allow the golf club head to be adjustably attachable to a golf club shaft in a plurality of different positions resulting in an adjustability range of different combinations of loft angle, face angle, or lie angle. At least a portion of the sliding weight track is located on a heel side of the body and at least a portion of the sliding weight track is located on a toe side of the body. A single tool is used for adjusting the at least one weight and the head-shaft connection system. Over at least a portion of the sliding weight track a width of the sliding weight track is between about 8 mm and about 20 mm, and a depth of the sliding weight track is be between about 6 mm and about 20 mm. The golf club head has a weight between about 210 grams and 240 grams, a Delta 1 value less than 14 mm, and a CGz less than-3 mm. The golf club head has a volume between 80 cm3 and 220 cm3. The preceding subject matter of this paragraph characterizes example 20 of the present disclosure.

Adjusting the position of the at least one weight member within the sliding weight track produces a change in the head origin y-axis (CGy) coordinate of between 2.0 mm and 6.0 mm throughout the adjustability range. The preceding subject matter of this paragraph characterizes example 21 of the present disclosure, wherein example 21 also includes the subject matter according to example 20, above.

Adjusting the position of the at least one weight member within the sliding weight track produces a change in the head origin y-axis (CGy) coordinate of less than 1.0 mm throughout the adjustability range, and produces a change in the head origin x-axis (CGx) coordinate of at least 4.0 mm throughout the adjustability range. The preceding subject matter of this paragraph characterizes example 22 of the present disclosure, wherein example 22 also includes the subject matter according to example 20, above.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The following describes embodiments of golf club heads in the context of a driver-type golf club, but the principles, methods and designs described may be applicable in whole or in part to fairway woods, utility clubs (also known as hybrid clubs) and the like.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 13:
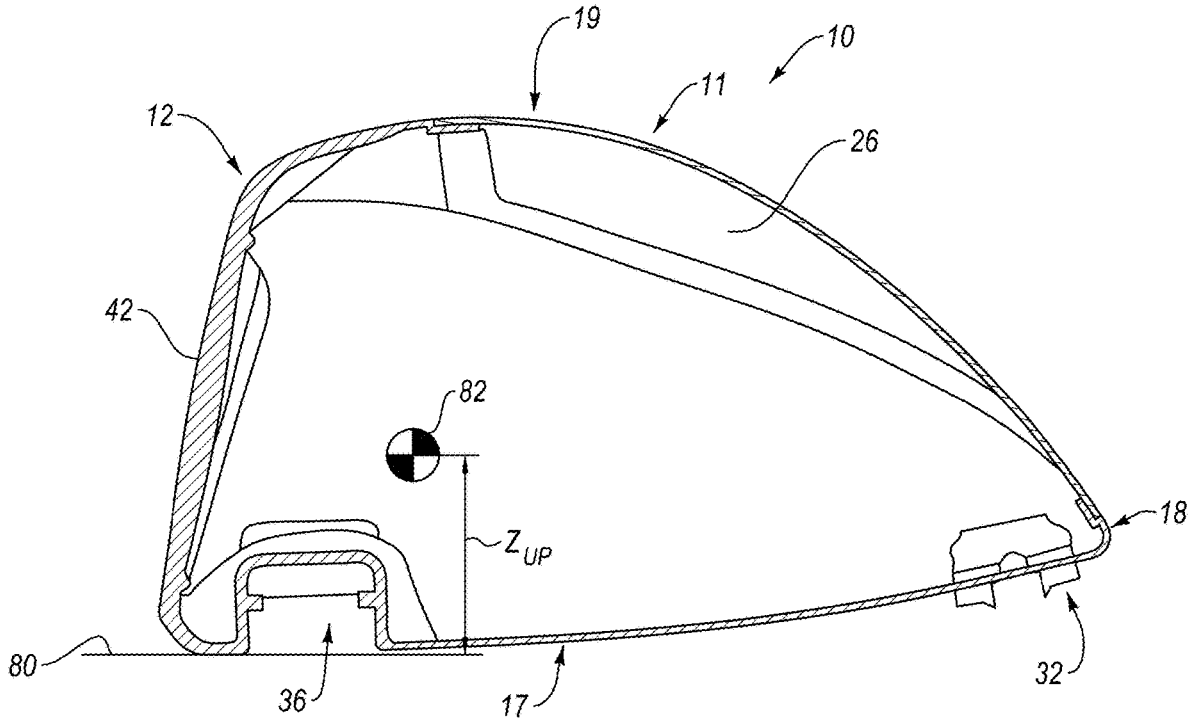
FIG. 13 is a cross-sectional side elevation view of the golf club head of FIG. 11, taken along a longitudinal midplane of the golf club head, according to one or more examples of the present disclosure.
Figure 14:
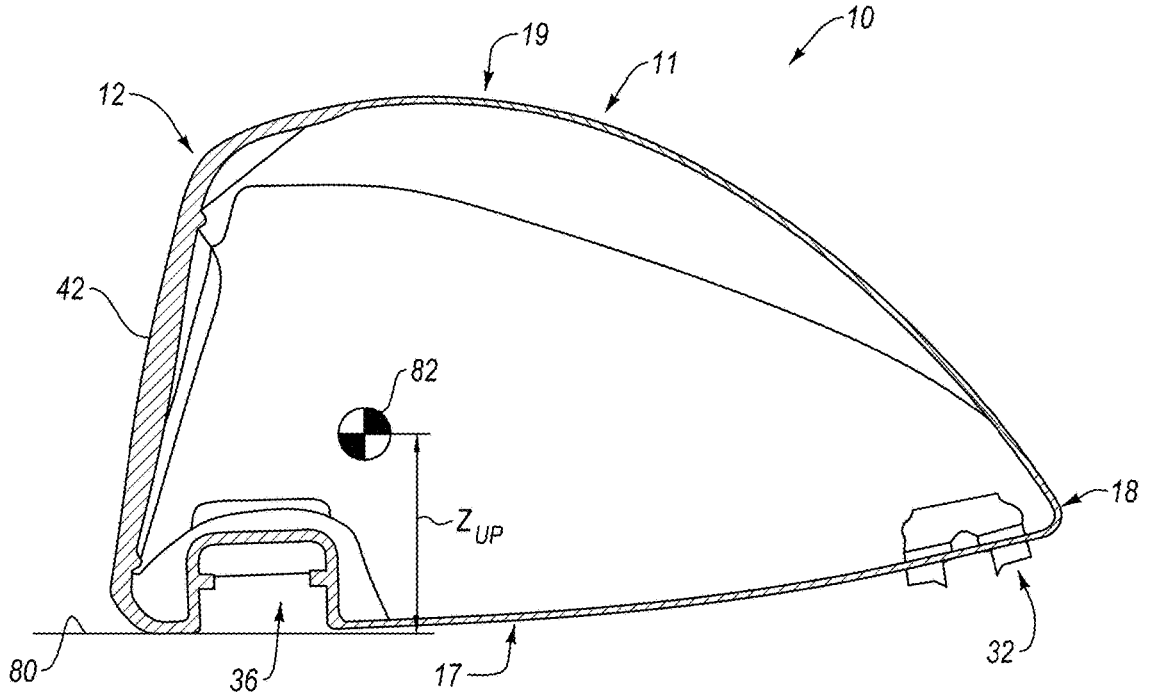
FIG. 14 is a cross-sectional side elevation view of yet another golf club head, taken along a longitudinal midplane of the golf club head, according to one or more examples of the present disclosure.
Figure 15:
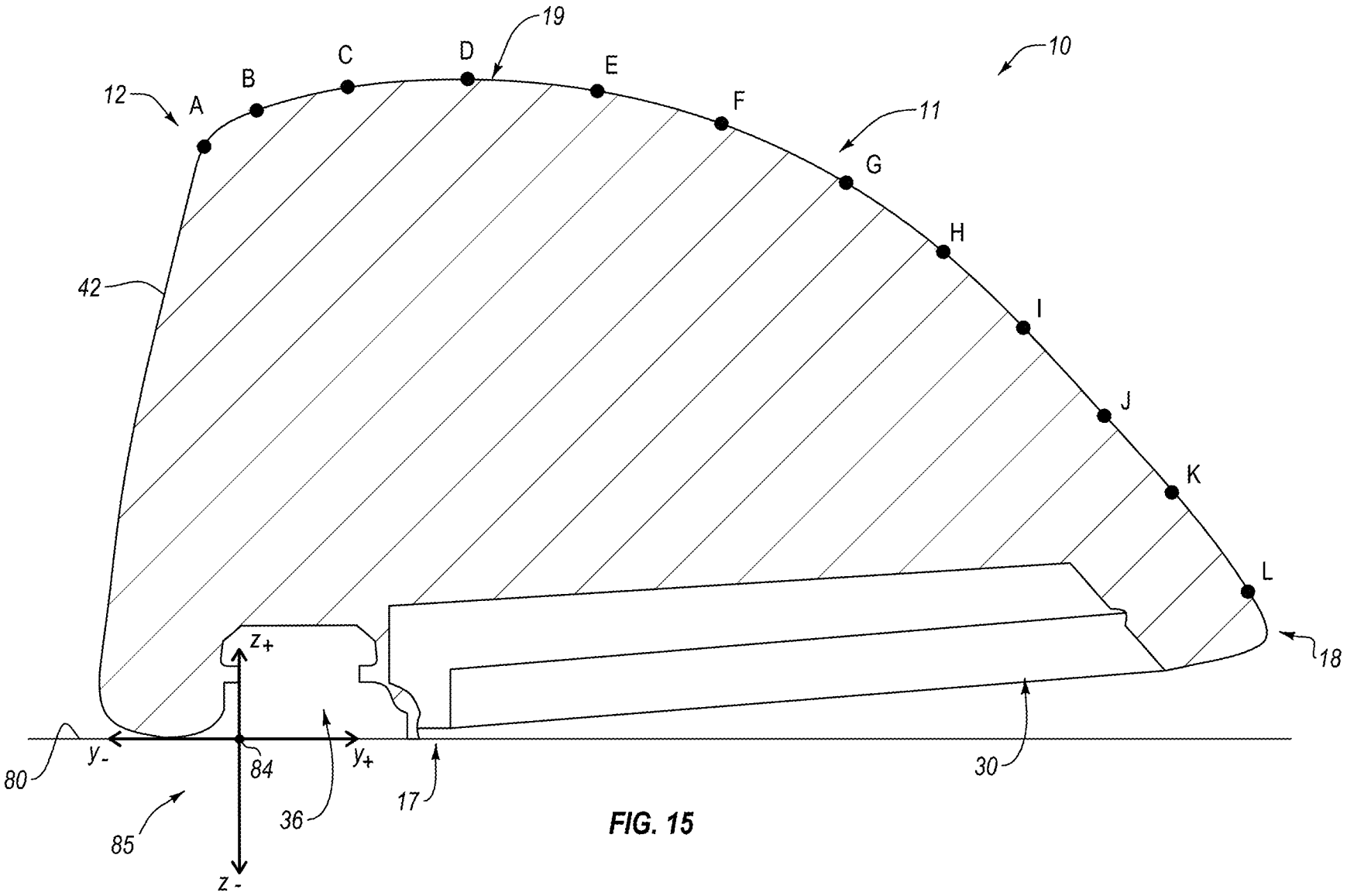
FIG. 15 is a cross-sectional side elevation view of an outer periphery of another golf club head, taken along a longitudinal midplane of the golf club head, according to one or more examples of the present disclosure.

FIGS. 11-16 are examples that show a club head in the address position i.e. the club head is positioned such that the hosel axis is at a 60 degree lie angle relative to a ground plane and the club face is square relative to an imaginary target line. As shown in FIG. 15, positioning the club head in the reference position lends itself to using a club head origin coordinate system 85 for making various measurements. Additionally, the USGA methodology may be used to measure the various parameters described throughout this application including head height, club head center of gravity (CG) location, and moments of inertia (MOI) about the various axes.

For further details or clarity, the reader is advised to refer to the measurement methods described in the '946 App and the USGA procedure. Notably, however, the origin and axes used in this application may not necessarily be aligned or oriented in the same manner as those described in the '946 App or the USGA procedure. Further details are provided below on locating the club head origin coordinate system 85.

Some of the golf club heads described herein may include driver-type golf club heads with a relatively large striking face area of at least 3500 mm^2, preferably at least 3800 mm^2, and even more preferably at least 3900 mm^2. Additionally, the driver-type golf club heads may include a center of gravity (CG) projection proximate center face that may be at most 3 mm above or below center face, and preferably may be at most 1 mm above or below center face as measured along a vertical axis (z-axis). Moreover, the driver-type golf club heads may have a relatively high moment of inertia about the vertical z-axis e.g. Izz>350 kg-mm^2 and preferably Izz>400 kg-mm^2, a relatively high moment of inertia about the horizontal x-axis e.g. Ixx>200 kg-mm^2 and preferably Ixx>250 kg-mm^2, and preferably a ratio of Ixx/Izz>0.55.

A club head exhibiting the above features is difficult to design because the above parameters are often competing and lead to various problems and unintended consequences such that maximizing one parameter often penalizes another parameter. For example, increasing the striking face area increases the drag on the club head creating an aerodynamic penalty. The aerodynamic penalty may be solved by increasing the peak crown height of the club head relative to the face height such that a peak crown height to face height ratio is at least 1.12 or more. However, this may help reduce the aerodynamic penalty, but raises the CG of club head causing the CG to project high on the face and well above center face.

Importantly, the CG projection is typically the ideal impact location to maximize ball speed and ideally the CG projection and center face coincide or are at least proximate one another. However, for most club heads to date the CG projection and center face do not coincide and are nowhere near coinciding, the delta between the two is often more than 4 mm. A high CG projection that is well above center face is a ball speed penalty causing a loss in distance. Unfortunately, most driver-type golf club heads suffer from a high CG projection and especially those regarded as aerodynamic due to the increased mass above center face. An additional problem created by a high CG projection is that a ball struck at center face will have increased backspin due to gear effect, which also causes a loss in distance. Another problem with a high CG projection is the CG projection is closer to the face to crown transition which is a very stiff portion of the face. Similarly, a high CG projection projects above the most flexible portion of the face resulting in a coefficient of restitution (COR) penalty. Accordingly, the additional crown mass located above the face to achieve an aerodynamic club head is a CG penalty, ball speed penalty, a spin penalty, and a COR penalty.

Some of the multiple embodiments described below solve the above identified problems while achieving a golf club head with a relatively large striking face area, a CG projection proximate center face, and a relatively high moment of inertia about the x-axis and z-axis. Additionally, solving the above problems led to the unexpected discovery of the importance of Zup (an overlooked parameter in the design of driver-type golf club heads) relative to half the peak crown height (half head height). Zup measures the center of gravity relative to the ground plane along a vertical axis when the club head is in the address position. Zup is an important consideration in the design of fairway woods and irons because these clubs are used to strike golf balls resting on the ground. However, Zup is generally regarded as irrelevant to and not considered at all in designing driver-type golf club heads because these club heads are used to strike golf balls resting on a tee.

Another unexpected discovery was the importance of half head height, and measuring various parameters relative to half head height. Up to this point, the inventors in designing driver-type golf club heads had measured most parameters relative to center face. However, in designing a driver-type golf club head placement of center face can be manipulated and more importantly center face may be difficult to consistently locate when measuring a physical golf club head. Whereas head height and half head height are more readily measured on a physical golf club head.

Realizing the importance of half head height led to a further unexpected discovery, which was the importance of measuring CG projection relative to half head height rather than center face. The inventors also discovered that the club head and its variations were in unchartered territory with respect to Zup relative to half head height, CG projection relative to half head height, and other parameters relative to half head height because no other club heads exhibited these unique parameters to their knowledge. As stated above, at least some of the embodiments described below solve the above identified problems while achieving a golf club head with a relatively large striking face area, a CG projection proximate center face, and a relatively high moment of inertia about the x-axis and z-axis.

In one example, a golf club head 10 is shown in FIGS. 1-10. The golf club head 10 includes a body 11 and a face portion 42 coupled to the body 11. Furthermore, the golf club head 10 defines a toe region 14 and a heel region 16, opposite the toe region 14. The body 11 of the golf club head 10 includes a forward region 12 and a rearward region 18, opposite the forward region 12. The face portion 42 is coupled to the body 11 at the forward region 12 of the body 11. The body 11 of the golf club head 10 additionally includes a sole portion 17, defining a bottom of the golf club head 10, and a crown portion 19, opposite the sole portion 17 and defining a top of the golf club head 10. Also, the body 11 of the golf club head 10 includes a skirt portion 21 that defines a transition region where the body 11 of the golf club head 10 transitions between the crown portion 19 and the sole portion 17. Accordingly, the skirt portion 21 is located between the crown portion 19 and the sole portion 17.

Figure 17:
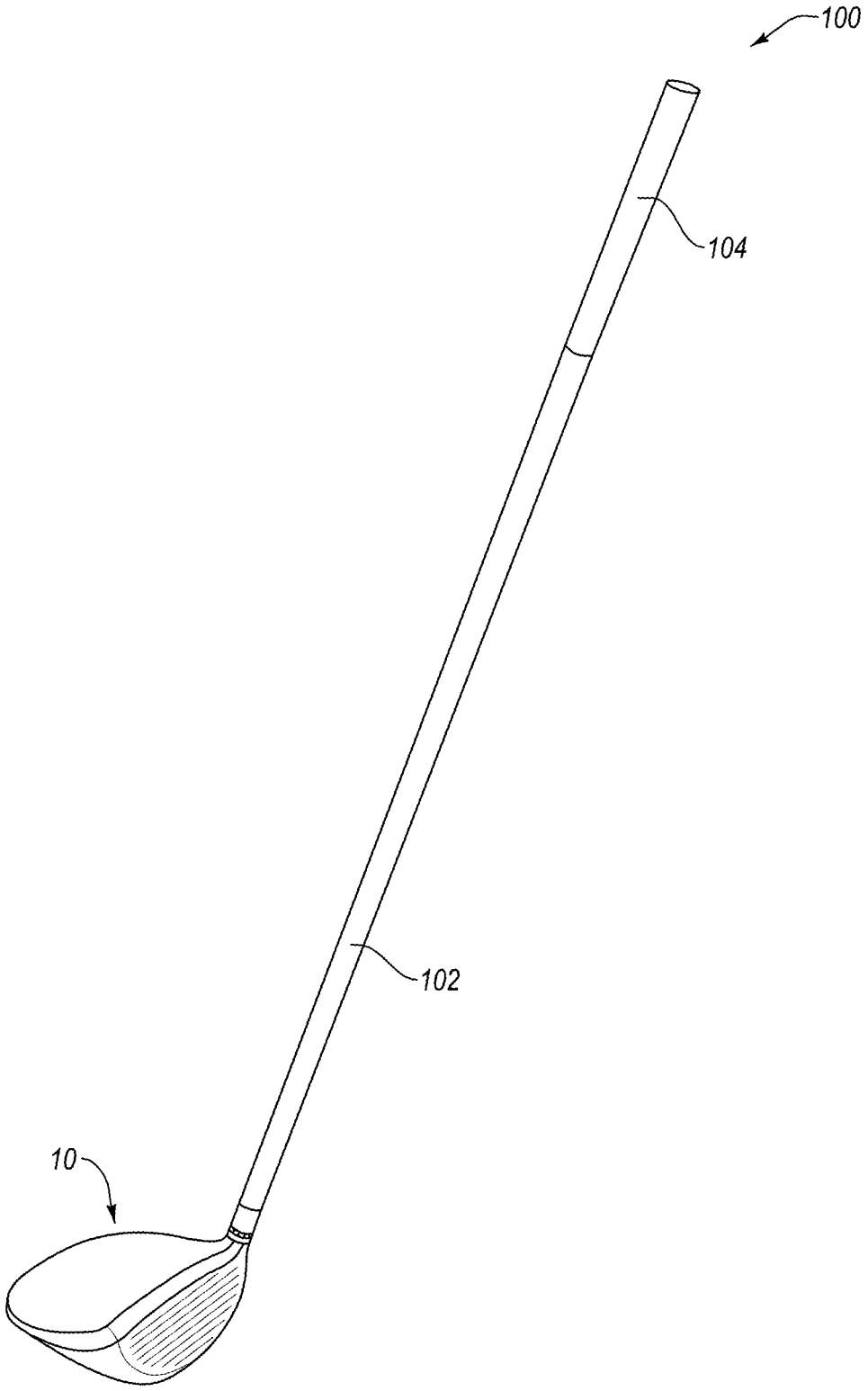
FIG. 17 is a perspective view of a golf club, according to one or more examples of the present disclosure.

The golf club head 10 also includes a hosel 20 extending from the heel region 16 of the golf club head 10. As shown in FIG. 17, a shaft 102 of a golf club 100 may be attached directly to the hosel 20 or, alternatively, attached indirectly to the hosel 20, such as via a flight control technology (FCT) component 22 (e.g., an adjustable lie/loft assembly) coupled with the hosel 20 (see, e.g., FIG. 2). The golf club 100 also includes a grip 104 fitted around a distal end or free end of the shaft 102. The grip 104 of the golf club 100 helps promote the handling of the golf club 100 by a user during a golf swing. The golf club head 100 includes a hosel axis 91, which is coaxial with the shaft 102, defining a central axis of the hosel 20.

In some embodiments, such as shown in FIGS. 1-10, the body 11 of the golf club head 10 includes a frame 24 to which one or more inserts of the body 11 are coupled. For example, the crown portion 19 of the body 11 includes a crown insert 26 coupled to a top side of the frame 24. Similarly, the sole portion 17 of the body 11 includes a sole insert 28 coupled to a bottom side of the frame 24. The golf club head 10 also includes a rear weight track 30 (or rearward weight track 30 or front-to-rear weight track 30) located in the sole portion 17 of the body 11 of the golf club head 10. The rear weight track 30 defines a track to which a weight 32 (or weight assembly 32) is slidably mounted. In some implementations, the weight 32 is slidably mounted to the rear weight track 30 with fastening means, such as a screw 34. In some implementations, the weight 32 has a multi-piece design. For example, the weight 32 may have first and second weight elements **32*a*, 32*b* coupled together to form the weight 32. In some implementations, the weight 32 may be secured to the rear weight track 30 by clamping a portion of the track, such as at least one ledge, such that the fastening means is put in tension i.e. a tension system. Additionally or alternatively, the weight 32 may be secured to the rear weight track 30 by compressing against a portion of the track such that the fastening means is put in compression i.e. a compression system. However, the weight 32 can take forms other than as shown, such as a single-piece design, and can be movably mounted to the rear weight track 30 in ways other than as shown. The rear weight track 30 allows the weight 32 to be selectively loosened and tightened for slidable adjustment forward and rearward along the weight track to adjust the effective CG 82 (see, e.g., FIGS. 9 and 10) of the golf club head is in a forward-to-rearward direction. By adjusting the CG 82 of the golf club head 10 forward or rearward, the performance characteristics of the golf club head 10 are adjusted, which promotes an adjustment to the flight characteristics of a golf ball struck by the golf club head 10**, such as the topspin and backspin characteristics of the golf ball.

Figure 18:
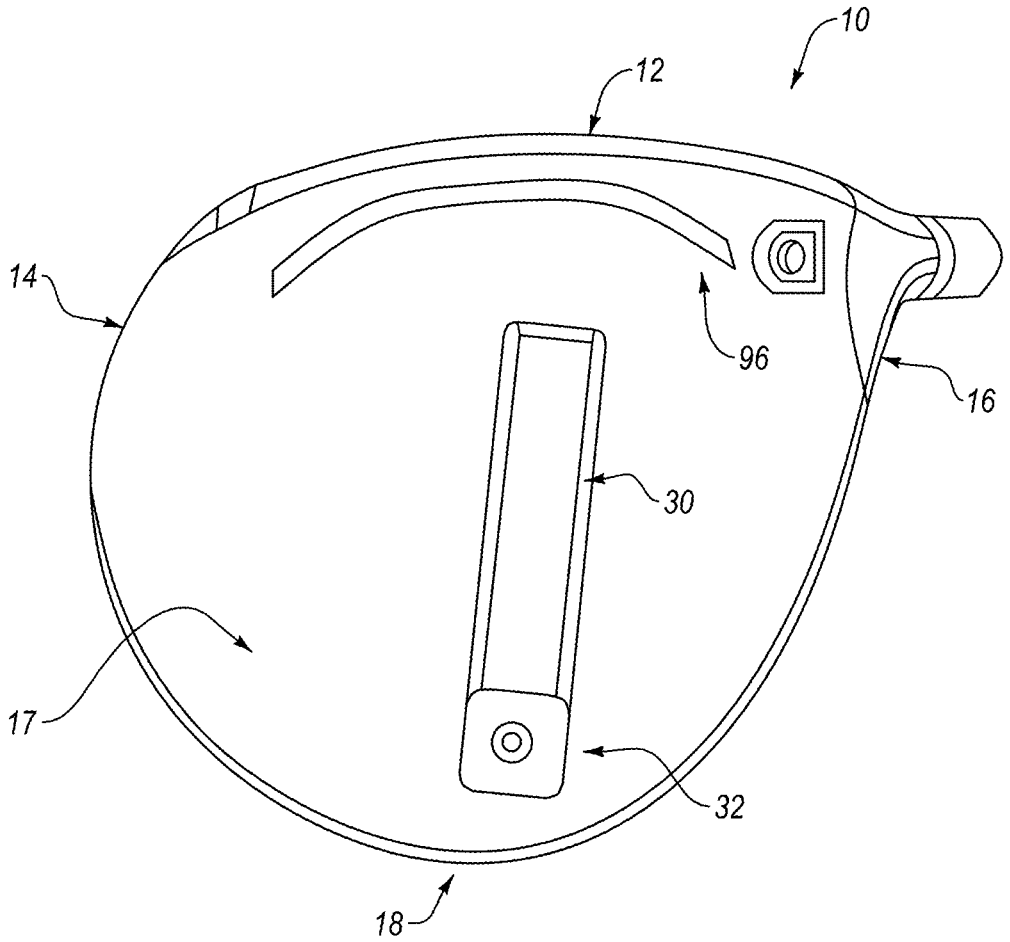
FIG. 18 is a bottom view of another golf club head, according to one or more examples of the present disclosure.
Figure 19:
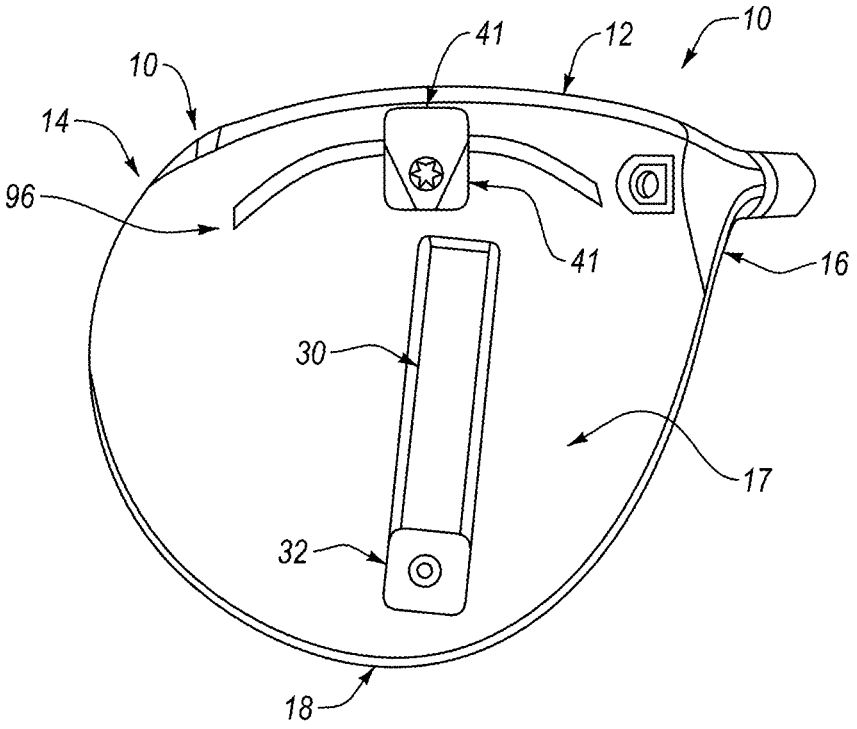
FIG. 19 is a bottom view of yet another golf club head, according to one or more examples of the present disclosure.
Figure 20:
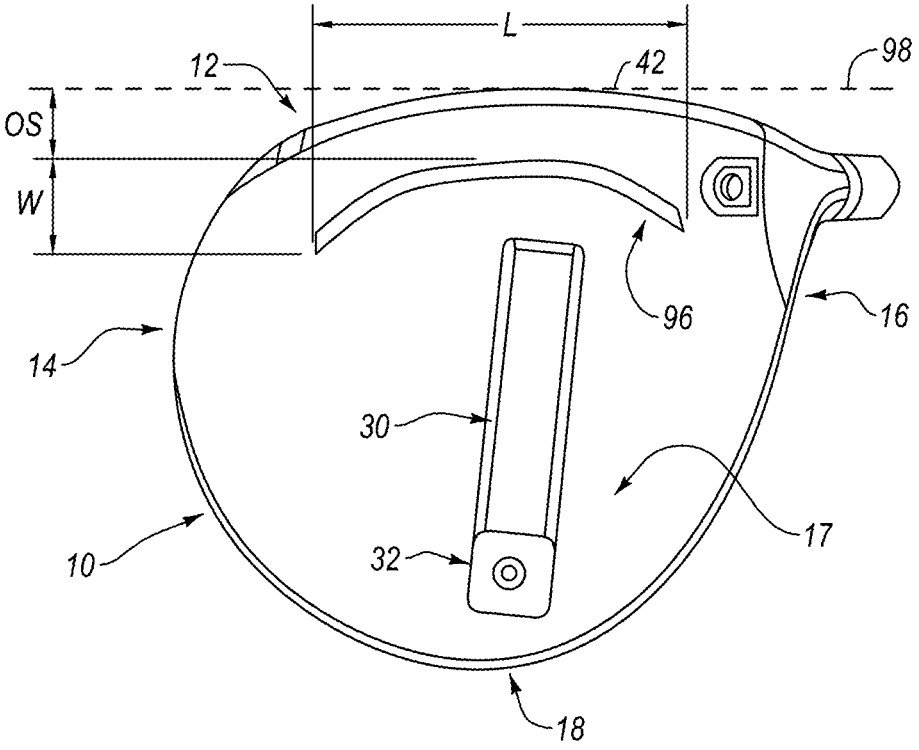
FIG. 20 is a bottom view of the golf club head of FIG. 18, indicating various dimensions associated with a coefficient of restitution (COR) feature of the golf club head, according to one or more examples of the present disclosure.

In some embodiments, as shown in FIGS. 18-20, the rear weight track 30 may be at an angle relative to a midplane of the golf club head 10, as defined below. The particular angle of the rear weight track 30 would depend on the geometry of the golf club head 10. In some embodiments, angling the track 30 may help reduce any draw or fade bias compared to a track parallel the y-axis of golf club head especially when shifting the weight along the rearward track. The angle of the rearward track 30 may be between about 0 degrees and about 180 degrees, such as between about 20 degrees and about 160 degrees, such as between about 40 degrees and about 140 degrees, such as between about 60 degrees and about 120 degrees, such as between about 70 degrees and about 110 degrees.

As discussed in more detail below, a rear weight track 30 provides a user with additional adjustability. Moving the weight closer to the striking face may produce a lower spinning ball due to a lower and more forward CG. This would also allow a user to increase club head loft, which in general higher lofted clubs are considered to be "easier" to hit. Moving the weight rearward towards the rear of the club allows for increased MOI and a higher spinning ball. Clubs with higher MOI are generally considered "easier" to hit. Accordingly, the rear weight track 30 allows for at least both spin and MOI adjustment.

As shown, the rear weight track 30 may include at least one weight assembly in any of various positions along the rear weight track 30, such as forward or rearward. More than one weight may be used in any one of the positions and/or there may be several weight ports strategically placed on the club head body. For example, the golf club head 10 may include a toe weight port and a heel weight port. A user could then move more weight to either the toe or heel to promote either a draw or fade bias. Additionally, splitting discretionary weight between a forward and rearward position produces a higher MOI club, whereas moving all the weight to the forward portion of the club produces a golf club with a low and forward CG. Accordingly, a user could select between a "forgiving" higher MOI club, or a club that produces a lower spinning ball.

Figure 2:
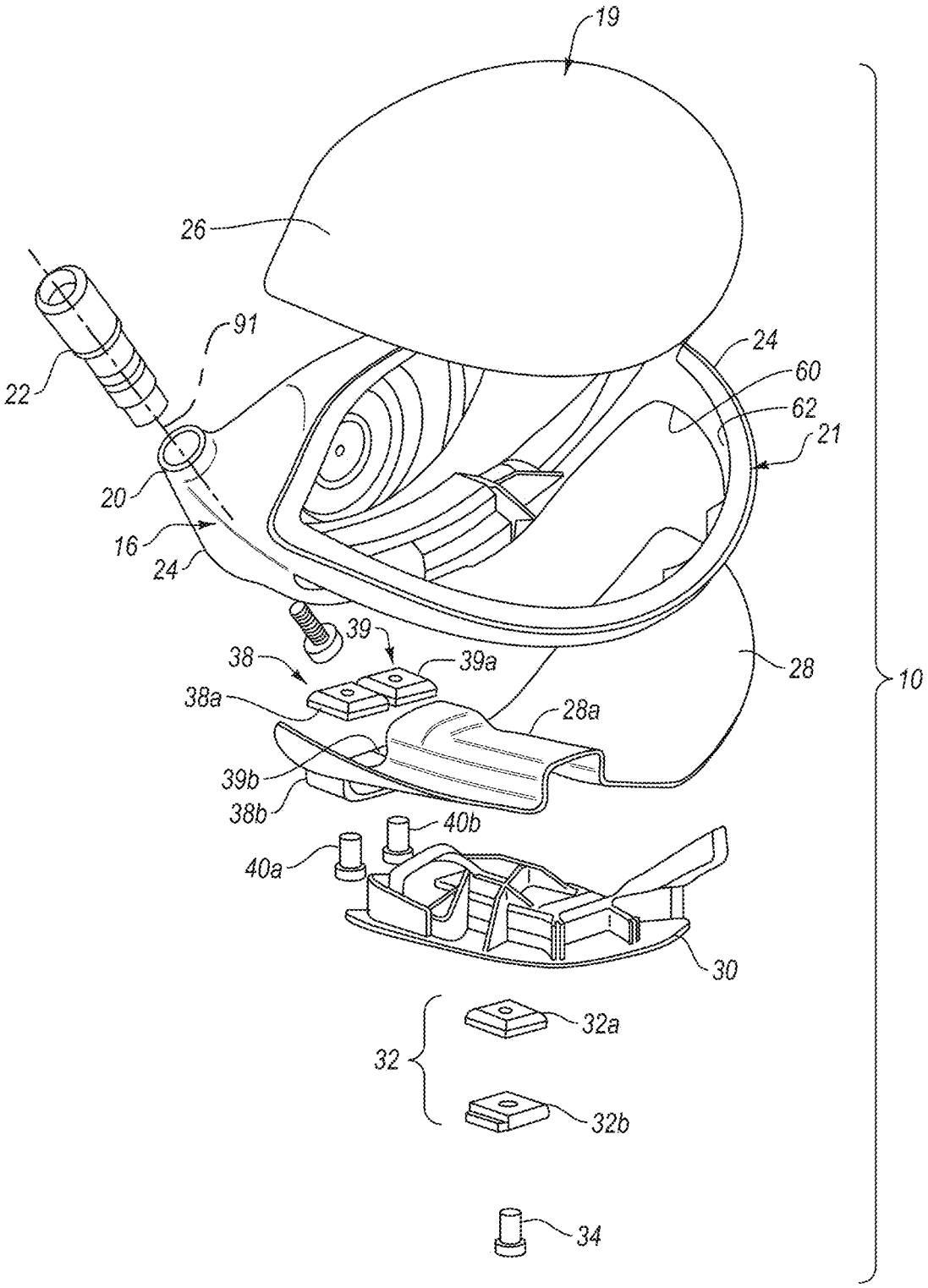
FIG. 2 is an exploded perspective view from a top of the golf club head of FIG. 1, according to one or more examples of the present disclosure.

Referring to FIG. 2, the frame 24 of the body 11 includes a forward or lateral weight track 36 (or forward or lateral channel 36) integrally formed with the frame 24 at the forward region 12 and along the sole portion 17 of the body 11. The lateral weight track 36 extends generally parallel to, but offset from, the face portion 42 of the golf club head 10 and generally perpendicular to the weight track 30. The lateral weight track 36 defines a track or port to which at least one weight may be slidably mounted. In one example, as shown in FIG. 2, the weight includes a first weight 38 (or weight assembly 38) having two pieces 38*a*, 38*b*, and a second weight 39 (or weight assembly 39) having two pieces 39*a*, 39*b*. Each of the first and second weights 38, 39 are fastened by fastening means, such as respective screws 40*a*, 40*b*, to the lateral weight track 36. In some implementations, the first and second weights 38, 39 may be secured to the rear weight track 30 by clamping a portion of the track, such as at least one ledge, such that the fastening means is put in tension i.e. a tension system. Additionally or alternatively, the first and second weights 38, 39 may be secured to the rear weight track 30 by compressing against a portion of the track such that the fastening means is put in compression i.e. a compression system. The first and second weights 38, 39 can take other shapes than as shown, can be mounted in other ways, and can take the form of a single-piece design or multi-piece design (e.g., more than two pieces).

Figure 1:
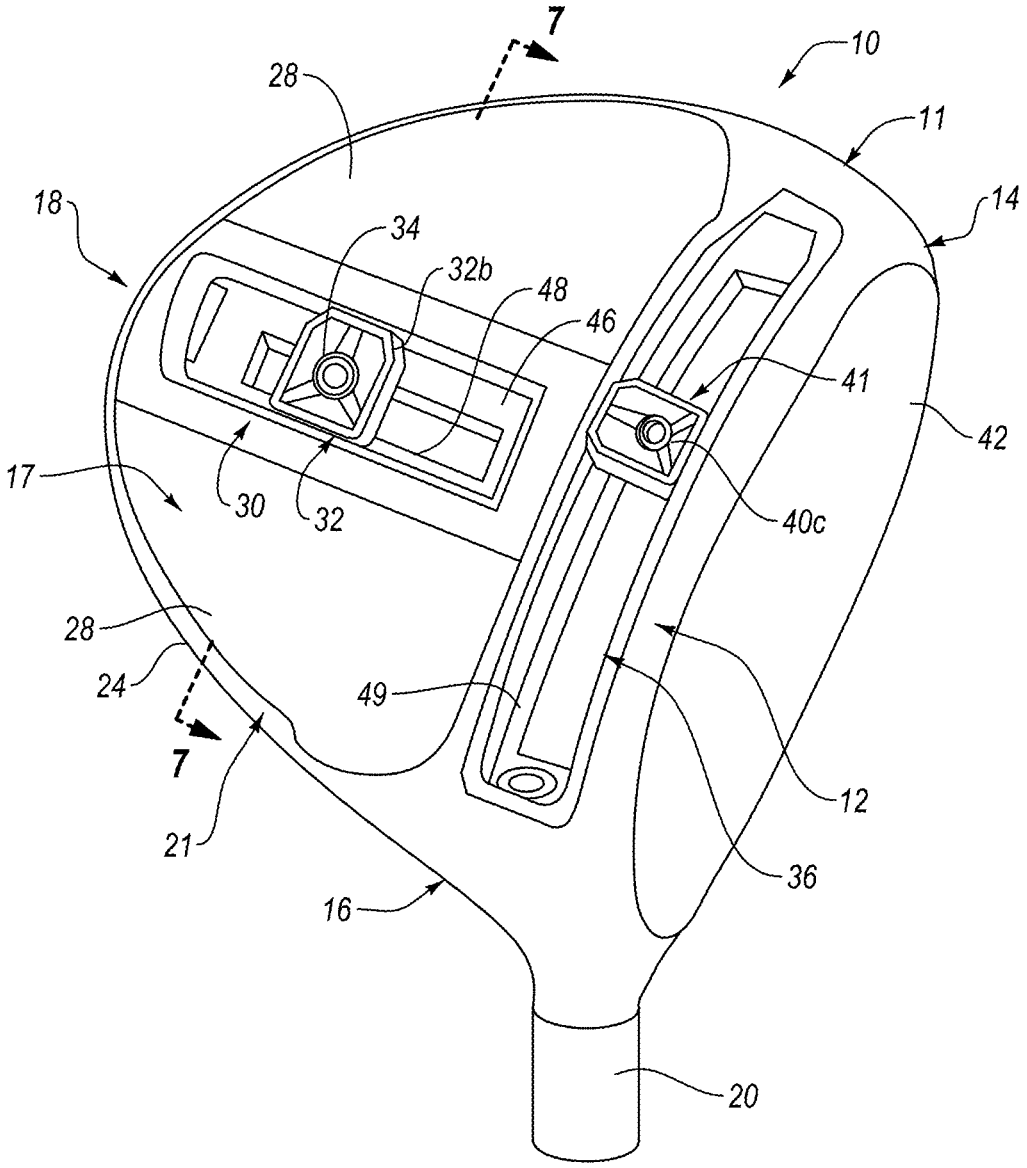
FIG. 1 is a perspective view from a bottom of a golf club head, according to one or more examples of the present disclosure.
Figure 3:
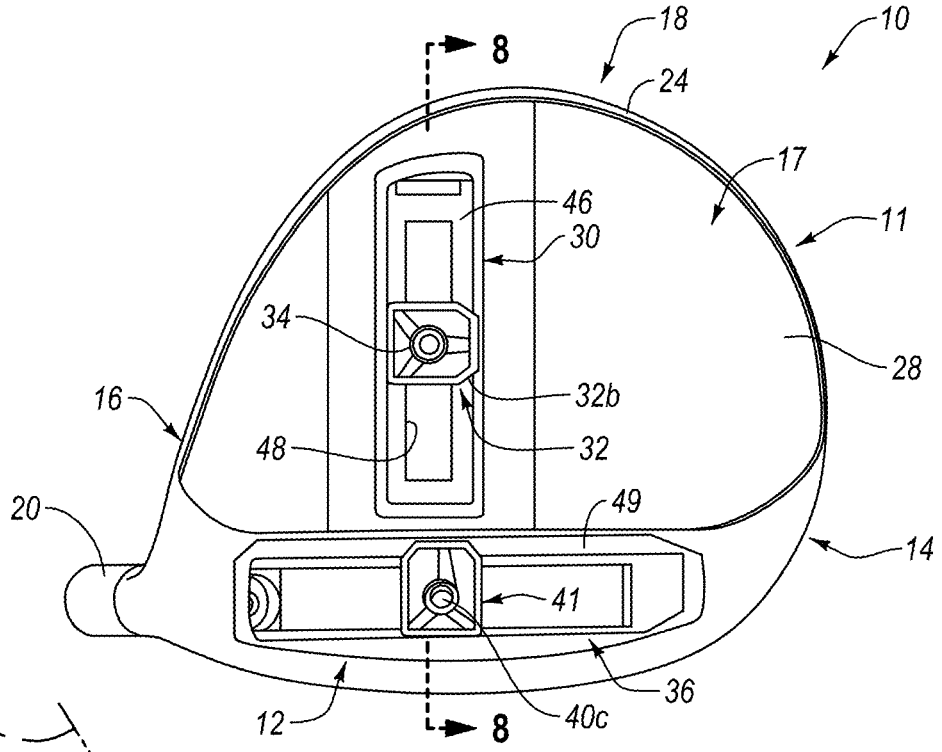
FIG. 3 is bottom view of the golf club head of FIG. 1, according to one or more examples of the present disclosure.

According to another example, as shown in FIGS. 1 and 3, only a single weight 41 (or weight assembly 41) may be slidably mounted to the lateral weight track 36. The weight 41 may include only a single weight element, two weight elements (such as two stacked weight elements 41*a*, 41*b* fastened together by a screw 40*c*), or more than two weight elements.

The lateral weight track 36 allows one or more weights to be selectively loosened and tightened for slidable adjustment laterally, in the heel-to-toe direction, to adjust the effective CG 82 of the golf club head 10 in the heel-to-toe direction. By adjusting the CG 82 of the golf club head 10 laterally, the performance characteristics of the golf club head 10 are adjusted, which promotes an adjustment to the flight characteristics of a golf ball struck by the golf club head 10, such as the sidespin characteristics of the golf ball. Notably, the use of two weights (e.g., first and second weights 38, 39), that are independently adjustable relative to each other, allows for adjustment and interplay between the weights. For example, both weights can be positioned fully in the toe region 14, fully in the heel region 16, spaced apart a maximum distance from each other, with one weight fully in the toe region 14, and the other weight fully in the heel region 16, positioned together in the center or intermediate location of the lateral weight track 36, or in other weight location patterns. Additionally or alternatively, the first and second weights 38, 39 may be secured to the rear weight track 30 such that there may be two or more weights located in the rear weight track 30. Additionally or alternatively, each of the first and second weights 38, 39 may be interchangeable with the weight 32.

Figure 10A:
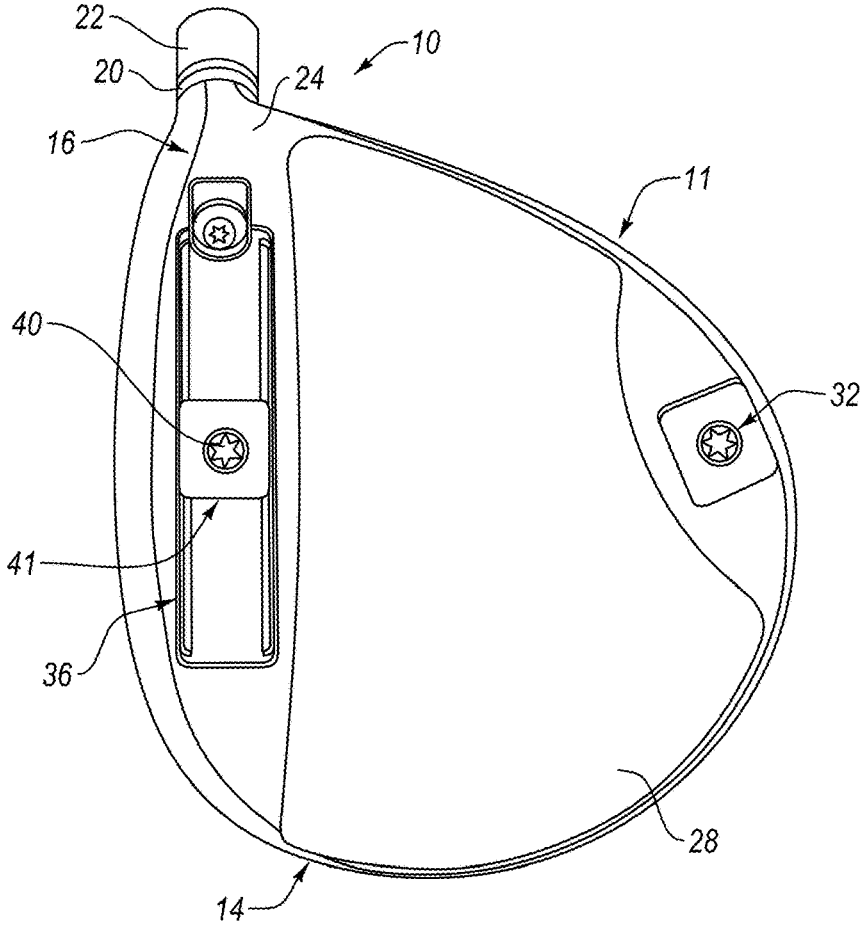
FIG. 10A is a bottom view of the golf club head of FIG. 9A, according to one or more examples of the present disclosure.
Figure 10B:
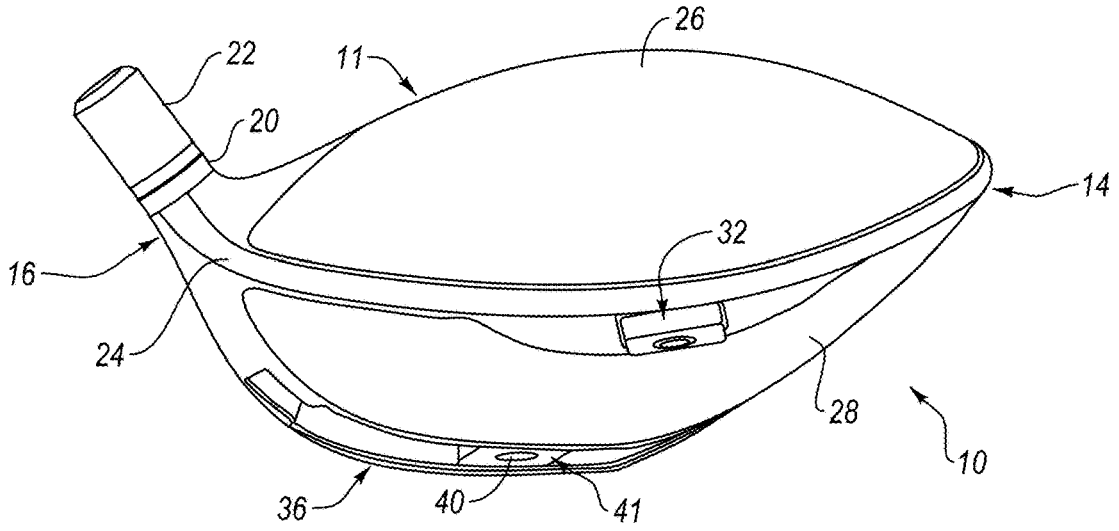
FIG. 10B is a rear view of the golf club head of FIG. 9A, according to one or more examples of the present disclosure.

In some embodiments, as shown in FIGS. 1, 3, and 10A, the lateral weight track or forward channel 36 is offset from the face portion 42 by a forward channel offset distance, which is the minimum distance between a first vertical plane passing through a center 93 of the striking face 43 and the forward channel 36 at the same x-axis coordinate as the center 93 of the striking face 43, between about 5 mm and about 50 mm, such as between about 5 mm and about 35 mm, such as between about 5 mm and about 30 mm, such as between about 5 mm and about 20 mm, or such as between about 5 mm and about 15 mm. Similarly, the rearward track 30 is offset from the face portion 42 by a rearward track offset distance, which is the minimum distance between a first vertical plane passing through the center 93 of the striking face 43 and the rearward track: 30 at the same x-axis coordinate as the center 93 of the striking face 43, between about 5 mm and about 50 mm, such as between about 5 mm and about 40 mm, such as between about 5 mm and about 30 mm, or such as between about 10 mm and about 30 mm.

In certain embodiments, both the forward channel 36 and rearward track 30 have a certain channel/track width. Channel/track width may be measured as the horizontal distance between a first channel wall and a second channel wall. For both the forward channel 36 and rearward track 30, the widths may be between about 5 mm and about 20 mm, such as between about 10 mm and about 18 mm, or such as between about 12 mm and about 16 mm. According to some embodiments, the depth of the channel or track (i.e., the vertical distance between the bottom channel wall and an imaginary plane containing the regions of the sole adjacent the front and rear edges of the channel) may be between about 6 mm and about 20 mm, such as between about 8 mm and about 18 mm, or such as between about 10 mm and about 16 mm.

Additionally, both the forward channel 36 and rearward track 30 have a certain channel/track length. Channel/track length may be measured as the horizontal distance between a third channel wall and a fourth channel wall. For both the forward channel 36 and rearward track 30, their lengths may be between about 30 mm and about 120 mm, such as between about 50 mm and about 100 mm, or such as between about 60 mm and about 90 mm. Additionally, or alternatively, the length of the forward channel 36 may be represented as a percentage of the striking face length. For example, the forward channel 36 may be between about 30% and about 100% of the striking face length, such as between about 50% and about 90%, or such as between about 60% and about 80% mm of the striking face length.

In some instances, the forward channel 36 may hold a sliding weight, or it may be a feature to improve and/or increase the coefficient of restitution (COR) across the face. In regards to a COR feature, the channel may take on various forms such as a channel or through slot, as will be described in more detail below.

Each of the golf club heads disclosed herein may have a volume equal to the volumetric displacement of the club head body. In other words, for a golf club head with one or more weight ports within the head, it is assumed that the weight ports are either not present or are "covered" by regular, imaginary surfaces, such that the club head volume is not affected by the presence or absence of ports. A golf club head of the present application can be configured to have a head volume between about 110 $cm^3$ and about 600 $cm^3$. In more particular embodiments, the head volume may be between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$.

In the case of a driver, the golf club head may have a volume between about 300 $cm^3$ and about 460 $cm^3$, and a total mass between about 145 g and about 245 g. In the case of a fairway wood, the golf club head may have a volume between about 100 $cm^3$ and about 250 $cm^3$, and a total mass between about 145 g and about 260 g. In the case of a utility or hybrid club the golf club head 10 may have a volume between about 60 $cm^3$ and about 150 $cm^3$, and a total mass between about 145 g and about 280 g.

Although in some examples of the golf club head 10, the body 11 does not include inserts (e.g., the body 11 forms a one-piece monolithic construction), according to certain examples of the golf club head 10, the body 11 includes one or more inserts fixedly secured to the frame 24. For example, the frame 24 of the body 11 may have at least one of a sole opening 60, sized and configured to receive a sole insert 28, or a crown opening 62, sized and configured to receive a crown insert 26. More specifically, the sole opening 60 receives and fixedly secures the sole insert 28, which may have the rear weight track 30 joined thereto (as described below). Similarly, the crown opening 62 receives and fixedly secures the crown insert 26. The sole and crown openings 60, 62 are each formed to have a peripheral edge or recess to seat, respectively, the sole insert 28 and crown insert 26, such that the sole and crown inserts 28, 26 are either flush with the frame 24 to provide a smooth seamless outer surface or, alternatively, slightly recessed.

Though not shown, the frame 24 may have a face opening, at a forward region 12 of the body 11, to receive and fixedly secure the face portion 42 of the golf club head 10. The face portion 42 can be fixedly secured to the face opening of the frame 24 by welding, braising, soldering, screws, or other coupling means. The face portion 42 can be made from any of various materials, such as, for example, metals, metal alloys, fiber-reinforced polymers, and the like. In some implementations, the face portion may be integrally formed.

The frame 24 of the body 11 may be made from a variety of different types of materials. According to one example, the frame 24 may be made from a metal material, such as a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), aluminum and aluminum alloys (including but not limited to 3000 series alloys, 5000 series alloys, 6000 series alloys, such as 6061-T6, and 7000 series alloys, such as 7075), or the like. The frame 24 may be formed by conventional casting, metal stamping, or other known manufacturing processes. In certain examples, the frame 24 may be made of non-metal materials. Generally, the frame 24 provides a framework or skeleton of the golf club head 10 to strengthen the golf club head 10 in areas of high stress caused by the impact of a golf ball with the face portion 42. Such areas include a transition region where the golf club head 10 transitions from the face portion 42 to the crown portion 19, sole portion 17, and skirt portion 21 of the body 11.

In one embodiment, the sole insert 28 and/or crown insert 26 may be made from a polymer or fiber-reinforced polymer (e.g., composite material). The polymer can be any of various polymers, such as thermoplastic or thermoset materials. The fibers of the fiber-reinforced polymer or composite material can be any of various fibers, such as carbon fiber or glass fiber. One exemplary material from which the sole insert 28 and/or crown insert 26 may be made from is a thermoplastic continuous carbon fiber composite laminate material having long, aligned carbon fibers in a PPS (polyphenylene sulfide) matrix or base.

A commercial example of a fiber-reinforced polymer, from which the sole insert 28 and/or crown insert 26 may be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 $g/m^2$.

Another commercial example of a fiber-reinforced polymer, from which the sole insert 28 and/or crown insert 26, is made is TEPEX® DYNALITE 208. This material also has a carbon fiber volume range of 42 to 57%, including a 45% volume in one example, and a weight of 200 $g/m^2$. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 28 and crown insert 26. After the crown insert 26 and sole insert 28 are formed (separately, in some implementations) by the thermoforming process, each is cooled and removed from the matched die. In some implementations, the crown insert 26 and/or sole insert 28 are shown as having a uniform thickness, which facilitates use of the thermoforming process and ease of manufacture. However, in other implementations the crown insert 26 and/or sole insert 28 may have a variable thickness to strengthen select local areas of the insert by, for example, adding additional plies in select areas to enhance durability, acoustic properties, or other properties of the respective inserts.

As shown in FIG. 2, the crown insert 26 and sole insert 28 each has a complex three-dimensional shape and curvature corresponding generally to a desired shape and curvature of the crown portion 19 and sole portion 17 of the golf club head 10. It will be appreciated that other types of club heads, such as fairway wood-type clubs, may be manufactured using one or more of the principles, methods, and materials described herein.

In an alternative embodiment, the sole insert 28 and/or crown insert 26 can be made by a process other than thermoforming, such as injection molding or thermosetting. In a thermoset process, the sole insert 28 and/or crown insert 26 may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the sole insert 28 and/or crown insert 26. Each insert is cooled and removed from its respective mold.

The carbon fiber reinforcement material for the sole insert 28 and/or crown insert 26, made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California.

In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

According to one embodiment, the weight track 30, which can have a more complex shape with more three-dimensional features than the sole insert 28, may be made from the same, similar, or at least compatible material as the sole insert 28 to allow the rear weight track 30 to be injection molded, overmolded, or insert molded over the sole insert 28 to bond together the rear weight track 30 and sole insert 28. In one example, the crown insert 26, sole insert 28, and rear weight track 30 are made from compatible materials capable of bonding well to one another such as polymeric materials having a common matrix or base, or at least complementary matrices. For example, the crown insert 26 and/or sole insert 28 may be made from continuous fiber composite material well suited for thermoforming while the rear weight track 30 may be made of short fiber composite material well suited for injection molding (including insert molding and overmolding), with each having a common matrix. One example of a material suitable for injection molding is a thermoplastic carbon fiber composite material having short, chopped fibers in a polyphenylene sulfide (PPS) base or matrix. For example, the material of the rear weight track 30 may include 30% short carbon fibers (by volume) having a length of about 1/10 inch, which reinforces the PPS matrix. Another example of a commercial material that may be used for the rear weight track 30 is RTP 1385 UP, made by RTP Company. Other examples include nylon, RTP 285, RTP 4087 UP and RTP 1382 UP.

In one example, the sole insert 28 and rear weight track 30 are bonded together by placing the sole insert 28 in a mold and injection molding the track 30 over the sole insert 28. The injection molding process creates a strong fusion-like bond between the sole insert 28 and rear weight track 30 due to their material compatibility.

In an alternative example, in which the sole insert 28 may be formed using a thermosetting material, the sole insert 28 and rear weight track 30 are not compatible materials and will not bond well if left untreated. Accordingly, before the injection molding, insert molding, or overmolding step, the sole insert 28 preferably may be coated with a heat activated adhesive, such as, for example, ACA 30-114, manufactured by Akron Coating & Adhesive, Inc. ACA 30-114 is a heat-activated water-borne adhesive having a saturated polyurethane with an epoxy resin derivative and adhesion promoter designed from non-polar adherents. It will be appreciated that other types of heat-activated adhesives also may be used. After the coating step, the sole insert 28 may be then placed in a mold and the material of the rear weight track 30 may be overmolded (or injection molded) over the sole insert 28 as described above. During the injection molding step, heat activates the adhesive coating on the sole insert 28 to promote bonding between the sole insert 28 and the weight track 30.

After the sole insert 28 and rear weight track 30 are bonded together, and the crown insert 26 is formed, they are joined to the frame 24 in a manner that creates a strong integrated construction adapted to withstand normal stress, loading, and wear and tear expected of commercial golf clubs. For example, each of the sole insert 28 and crown insert 26 may be bonded to the frame 24 using epoxy adhesive, with the crown insert 26 seated in and overlying the crown opening 62 and the sole insert 28 seated in and overlying the sole opening 60. Alternative attachment methods include bolts, rivets, snap fit, adhesives, and other known joining methods or any combination thereof may be used to couple the crown insert 26 and the sole insert 28 with the frame 24.

Figure 4:
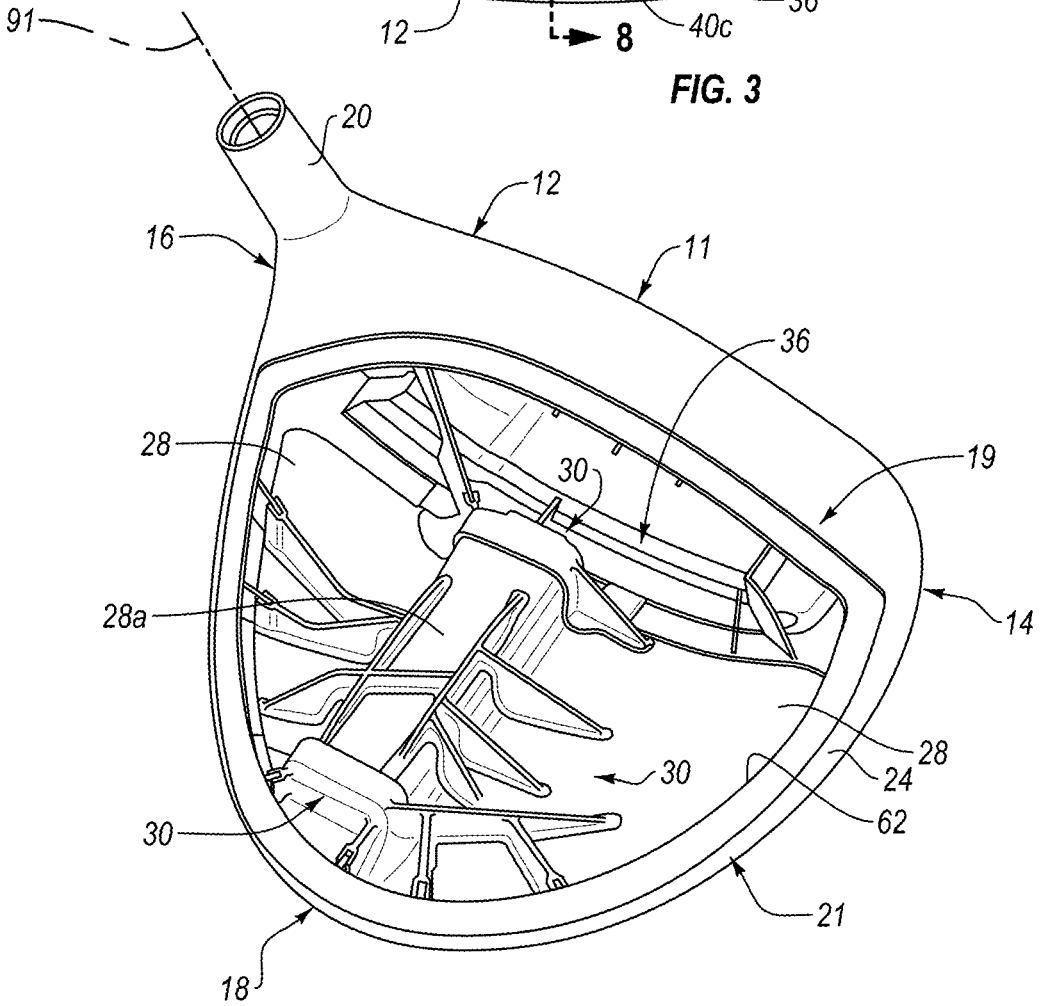
FIG. 4 is a perspective view from a top of the golf club head of FIG. 1, shown with a crown insert removed, according to one or more examples of the present disclosure.

FIG. 4 shows the head with the crown insert 26 removed, and provides a view of the hollow interior of the head from the top. Additionally, FIG. 4 illustrates how the rear weight track 30 includes internal ribs, supports and other features overmolded on the sole insert 28. For example, the rear weight track 30 may include various supports wrapping over a central ridge 28*a* of the sole insert, fore-aft supporting ribs along the top of the ridge 28*a*, and lateral ribs extending outwardly from the central ridge 28*a*. It can be seen that the overmolding process allows the weight track and other intricate features and details to be incorporated into the design of the golf club head 10. For example, in addition to the performance benefits provided by the weight track 30, the various ribs and features shown in FIG. 4 can provide structural support and additional rigidity for the golf club head 10 and also modify and even fine tune the acoustic properties of the golf club head 10. The sound and modal frequencies emitted by the golf club head 10 when it strikes the ball are very important to the sensory experience of the golfer and provides functional feedback as to where the ball impact occurs on the striking face 43 (and whether the ball is well struck).

Figure 5:
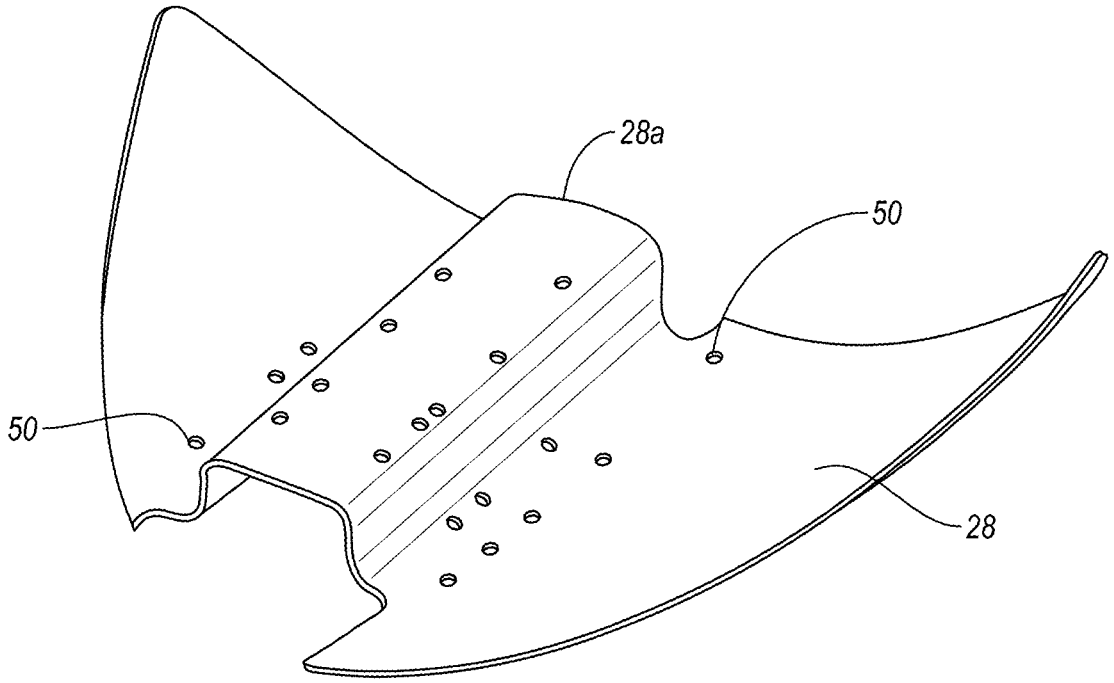
FIG. 5 is a perspective view of a sole insert of the golf club head of FIG. 1, according to one or more examples of the present disclosure.

FIG. 5 shows the sole insert 28, including its central rib or ridge 28*a*, before the rear weight track 30 has been overmolded thereto. The ridge 28*a* may be centrally located on the sole insert and extends generally from front to back to provide additional structural support for the sole of the golf club head. The ridge 28*a* also provides an elongate weight recess or port on its outer surface within which to seat the fore-aft weight track 30. The sole insert may include a plurality of through holes 50 in various locations to provide a flow path for injection mold melt during the injection molding step and create a mechanical interlock between the sole insert 28 and overmolded weight track 30, thereby forming the sole insert unit.

Figure 6:
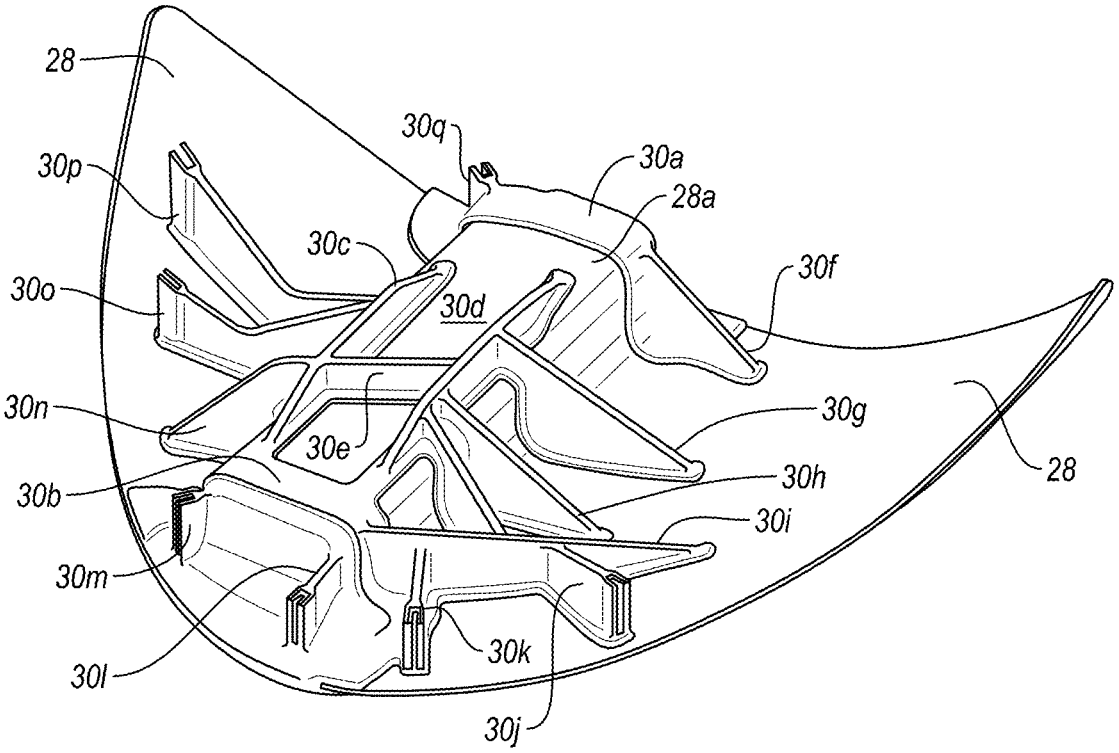
FIG. 6 is a perspective view of a sole insert and a weight track of the golf club head of FIG. 1, according to one or more examples of the present disclosure.

FIG. 6 shows in greater detail the sole insert 28 with the overmolded rear weight track 30 joined thereto. It can be seen (especially in the context of the other figures) that the rear weight track 30 wraps around both sides (interior and exterior) of the sole insert 28. In addition to a weight installation channel 48 and peripheral ledge (or rail) 46 overmolded on the outer surface of the sole insert 28, the rear weight track 30 also preferably includes one or more ribs and other features on the interior surface of the sole insert. For example, FIG. 6 shows reinforcing supports 30*a*, 30*b* draped over opposite ends of the ridge 28*a*, parallel fore-aft extending ribs 30*c*, 30*d* tracking along the top of the ridge 28*a*, cross-rib 30*e* connecting the ribs 30*c*, 30*d*, and various lateral and other ribs 30*f*, 30*g*, 30*h*, 30*i*, 30*j*, 30*k*, 30*l*, 30*m*, 30*n*, 30*o*, 30*p*, and 30*q*, which are all interconnected to form a reinforcing network or matrix of supporting ribs and supports to reinforce the sole insert 28 and the golf club head 10. In some embodiments, movement of the at least one weight member within the rear weight track 30 produces a change in a head origin z-axis coordinate of a center-of-gravity of the golf club head of less than between about 0.5 mm and about 2.0 mm (e.g., about 1.0 mm) throughout the adjustability range of the at least one weight member.

Because the ribs are injection molded they can have a wide variety of shapes, sizes, orientations, and locations on the sole insert to adjust and fine tune acoustic properties of the golf club head. It can be seen in FIG. 6 that the rib network adds rigidity in both the lateral and longitudinal directions and thereby imparts strategically located stiffness to the golf club head. In this regard, some of the ribs, such as ribs 30*j*, 30*k*, 30*l*, 30*m*, 30*o*, 30*p*, and 30*q*, have forked ends to engage mating structural elements on the frame 24, thereby aligning the sole insert 28 for attachment to the frame 24 as well as providing a strong mechanical bond between the sole insert 28 unit and frame 24.

Figure 7:
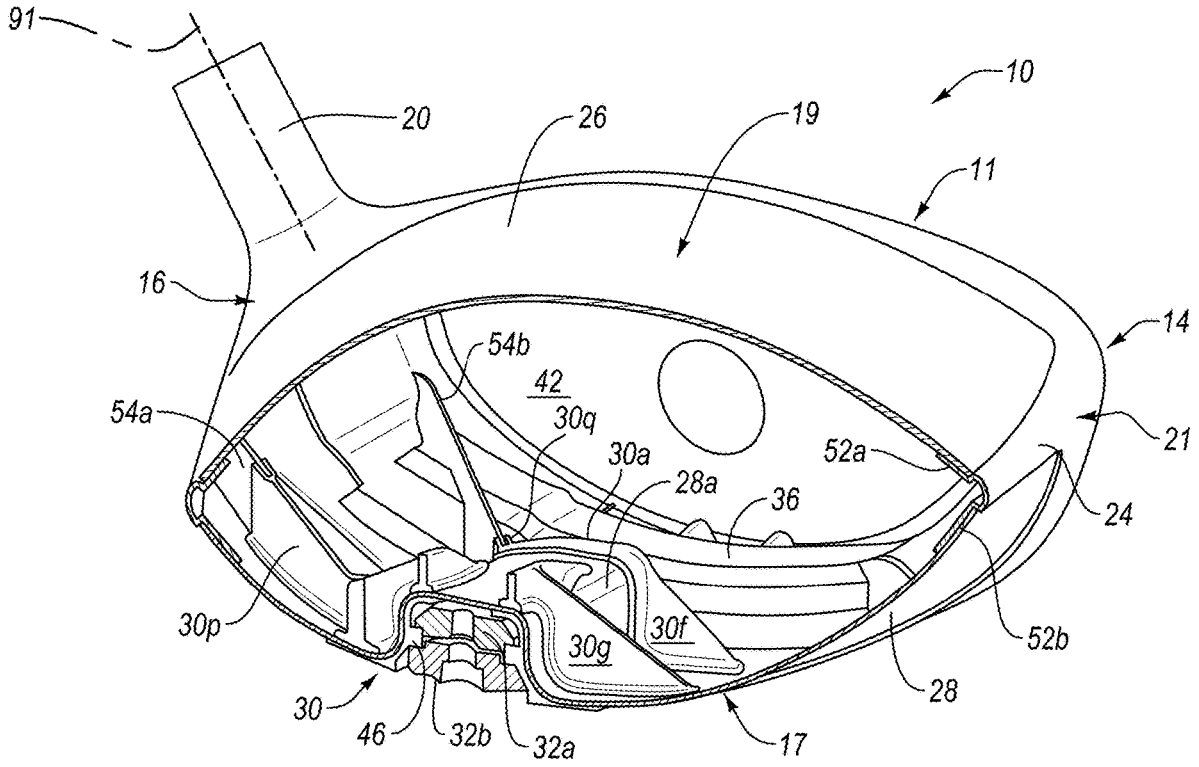
FIG. 7 is a cross-sectional perspective view from a back of the golf club head of FIG. 1, taken along line 7-7 of FIG. 1, according to one or more examples of the present disclosure.

Referring to FIG. 7, the frame 24 preferably includes a recessed seat or ledge 52*a* extending around the crown opening 62 to seat the crown insert 26. Similarly, the frame 24 includes a seat or ledge 52*b* around the sole opening 60 to receive the sole insert 28. The weight elements 32*a*, 32*b* of the weight 32 are shown seated in their respective channels and separated by rail 46. Weight elements 32*a*, 32*b* are shown having aligned bores to receive the screw 34 (see, e.g., FIGS. 1 and 2). The bore of the weight element 32*a* may be threaded such that loosening of the screw 34 separates the weight elements to allow sliding movement forward and rearward within the weight track 30, while tightening the screw 34 pulls the weights together into locking engagement with the rail 46 to prevent sliding movement during play on the golf course.

Figure 8:
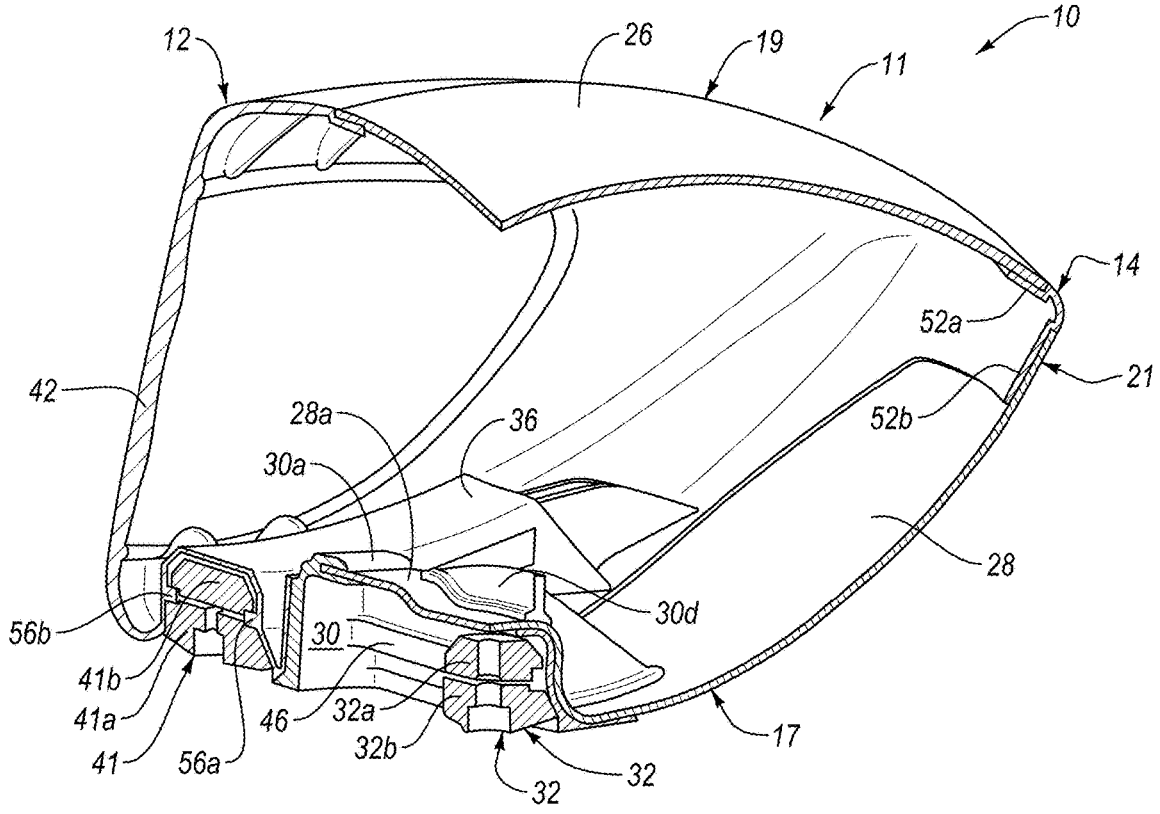
FIG. 8 is a cross-sectional perspective view from a back of the golf club head of FIG. 1, taken along line 7-7 of FIG. 1 and line 8-8 of FIG. 3, according to one or more examples of the present disclosure.
Figure 9A:
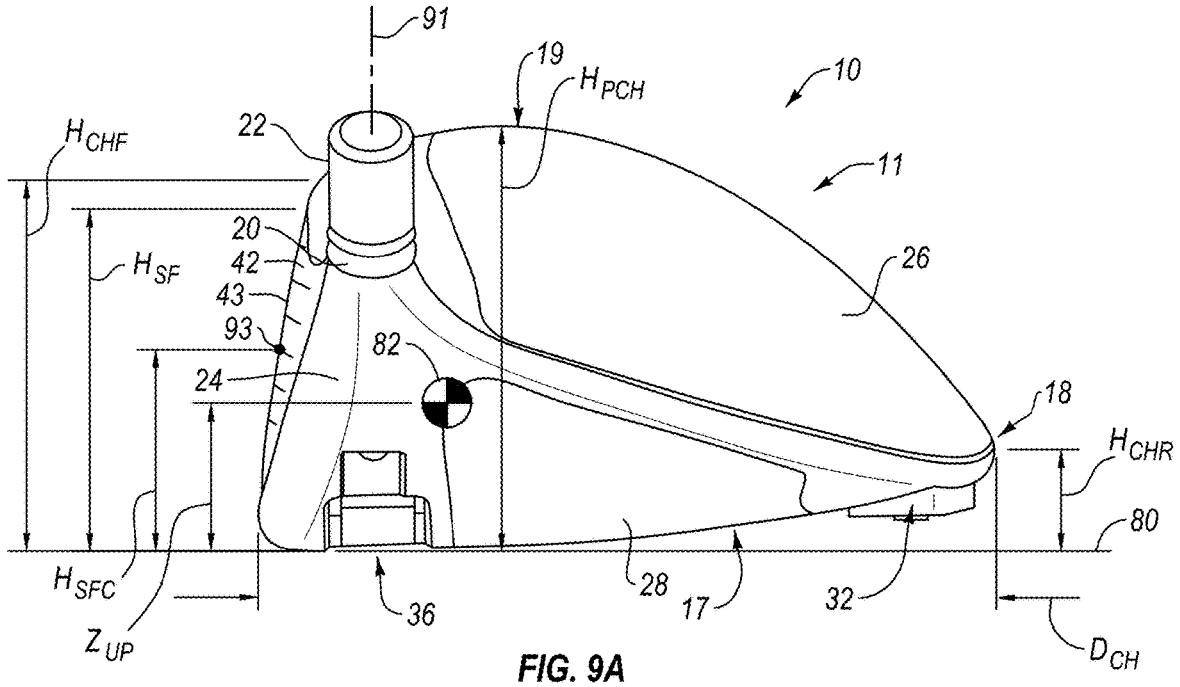
FIG. 9A is an elevational side view from a heel side of another golf club head, according to one or more examples of the present disclosure.
Figure 9B:
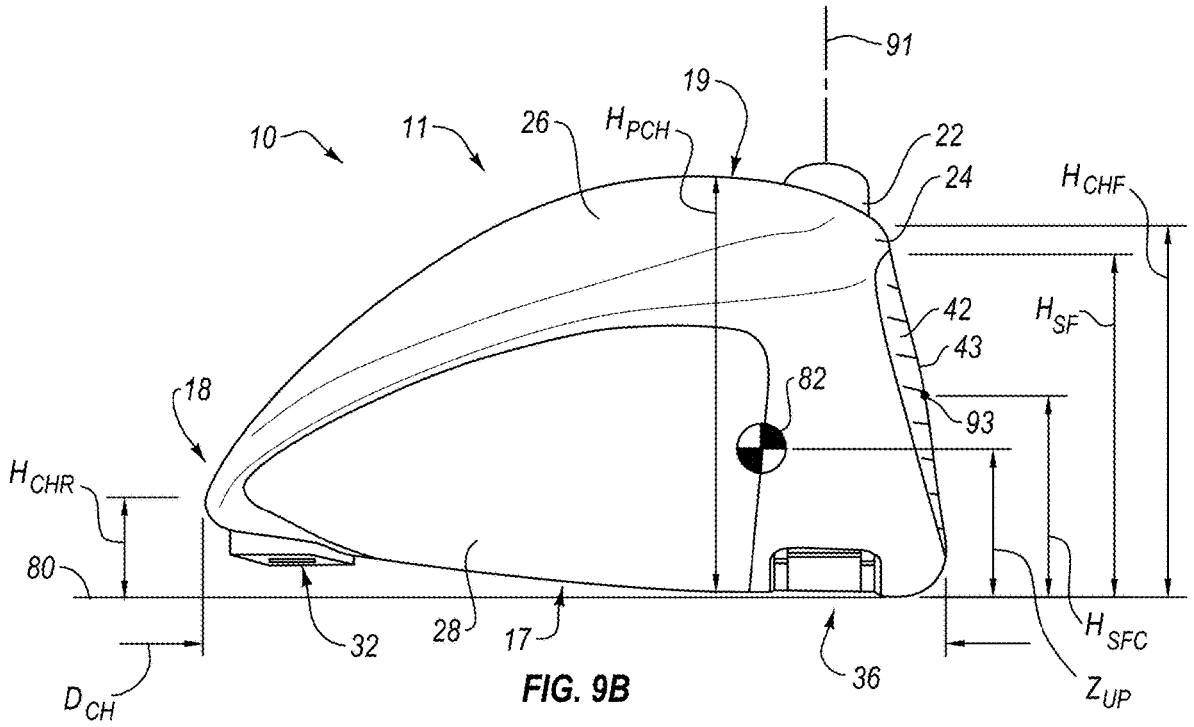
FIG. 9B is an elevational side view from a toe side of the golf club head of FIG. 9A, according to one or more examples of the present disclosure.

As shown in FIG. 8, the rear weight track 30 and a two-piece weight 32 (with weight elements 32*a*, 32*b*) is similar to the weight track 36 and two-piece weight 41 (which includes weight elements 41*a*, 41*b*).

Similar to that mentioned above, in some embodiments, the width of the channels or sliding weight tracks (i.e., the distance between a first channel wall and a second channel wall adjacent to the locations of a first ledge and a second ledge) may be between about 8 mm and about 20 mm, such as between about 10 mm and about 18 mm, or such as between about 12 mm and about 16 mm. Also in line with that mentioned above, in certain embodiments, the depth of the channel (i.e., the vertical distance between a bottom channel wall and an imaginary plane containing the regions of the sole adjacent the ledges of the channel) may be between about 6 mm and about 20 mm, such as between about 8 mm and about 18 mm, or such as between about 10 mm and about 16 mm. Further to that mentioned above, according to some embodiments, the length of the channels (i.e., the horizontal distance between a first end of the channel and a second end of the channel) may be between about 30 mm and about 120 mm, such as between about 50 mm and about 100 mm, or such as between about 60 mm and about 90 mm.

In the embodiments shown, the weight assembly includes three components: an inner member, an outer member, and a fastening bolt. The outer member may be located within an outer portion of the interior channel volume, engaging the outward-facing surfaces of the ledges. The inner member may be located within an inner portion of the interior channel volume, engaging the inward-facing surfaces of the ledges. The fastening bolt has a threaded shaft that extends through a center aperture of the outer member and engages mating threads located in a center aperture of the mass member. This is a tension system for securing the weight assembly. Alternatively, the washer could have the mating threads in a center aperture, and the fastening bolt could go through a center aperture of the mass member and be tightened by a drive on the exposed outer surface of the bolt. In this embodiment, the head of the bolt would be captured on the inner surface of the mass member holding it in place during tightening.

In some embodiments, the washer may be heavier than mass member, and vice versa. Or, the washer and the mass member may have similar masses. An advantage of making the washer heavier than the mass member is an even lower CG. The washer and/or mass member may have a mass in the range of 1 g to 50 g.

The composite sole and weight track disclosed in various embodiments herein overcome manufacturing challenges associated with conventional club heads having titanium or other metal weight tracks, and replace a relatively heavy weight track with a light composite material (freeing up discretionary mass which can be strategically allocated elsewhere within the golf club head). For example, additional ribs can be strategically added to the hollow interior of the golf club head and thereby improve the acoustic properties of the head. Ribs can be strategically located to strengthen or add rigidity to select locations in the interior of the head. Discretionary mass in the form of ribs or other features also can be strategically located in the interior to shift the effective CG 82 fore or aft, toe-ward or heel-ward or both (apart from any further CG 82 adjustments made possible by slidable weight features). Additionally, composite sole and crown inserts 28, 26 provide structural support and stiffness to the golf club head 10, as well as free up discretionary mass that can be allocated elsewhere on the golf club head 10.

As shown in FIGS. 9, 10, 13, and 14, in some embodiments, the golf club head 10 is similar to the golf club head of FIGS. 1-8, with like numbers referring to like elements, but does not include a weight track 30, extending in a forward-to-rearward direction, that allows slidable adjustment of the weight 32 forwardly and rearwardly. Rather, the golf club head 10 in FIGS. 9, 10, 13, and 14 includes a weight 32 in a fixed position at a heel region 16 of the golf club head 10. Accordingly, the golf club head 10 includes a port, formed in the sole portion 17, for receiving and retaining the weight 32, but does not include a rear weight track 30 in the sole portion 17. The mass of the weight 32 can be any of various masses. Moreover, the weight 32 can be replaced with another weight 32 of a different mass. But, the position of the weight 32 on the golf club head 10 is fixed. The golf club head 10 of FIGS. 11 and 12 also is similar to the golf club head 10 of FIGS. 1-10, 13, and 14, with like number referring to like elements.

Figure 11:
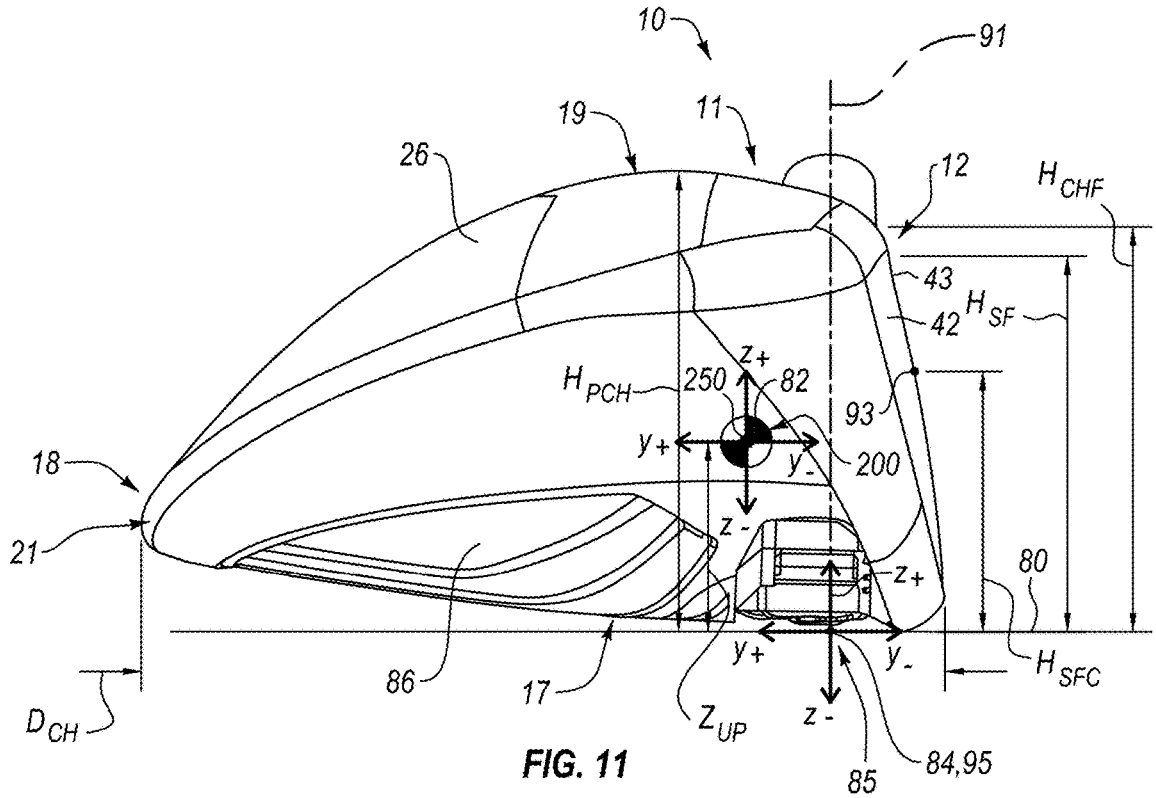
FIG. 11 is an elevational side view from a toe side of a golf club head, according to one or more examples of the present disclosure.
Figure 12:
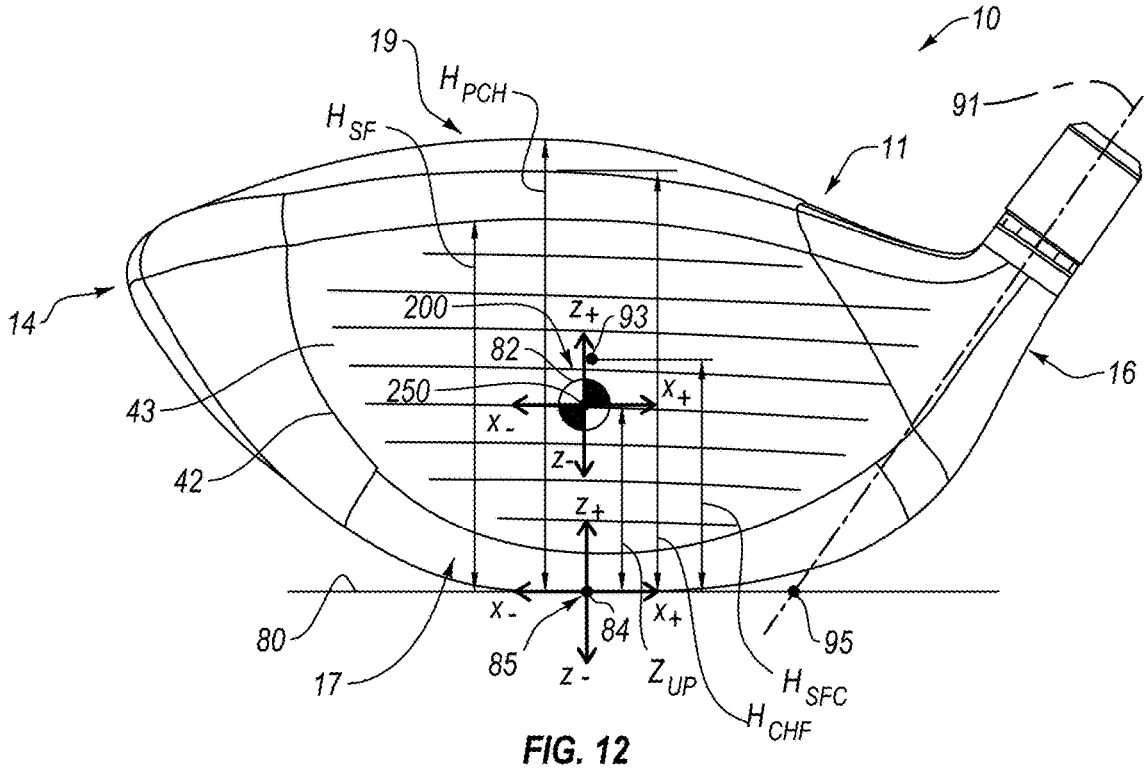
FIG. 12 is an elevational side view from a heel side of the golf club head of FIG. 11, according to one or more examples of the present disclosure.

Additionally, in contrast to the golf club head 10 of FIGS. 1-10, the sole portion 17 of the golf club head 10 of FIGS. 11-13 does not include a sole insert 28 made from a fiber-reinforced polymer. Rather, in one implementation, the sole portion 17 of the golf club head 10 of FIGS. 11-13 includes a sole insert made from a metal or metal alloy, such as titanium, and in another implementation, the sole portion 17 includes a one-piece monolithic construction, made from a metal or metal alloy, such as titanium, instead of a separately attachable sole insert. Accordingly, in at least one embodiment, the crown portion 19 of the golf club head 10 of FIGS. 11-13, may be made from a first material, such as a fiber-reinforced polymer, and the sole portion 17 may be made from a metal or metal alloy, such as titanium. Moreover, in such an embodiment, more than between about 60% and 80% (e.g., about 70%) of the crown portion 19 of the body 11 of the golf club head 10 has a thickness less than about 0.75 mm.

Moreover, in some implementations, in contrast to the golf club head 10 of FIGS. 1-13, the crown portion 19 of the golf club head 10 of FIG. 14 does not include a crown insert 26 made from a fiber-reinforced polymer. Rather, in one implementation, the crown portion 19 of the golf club head 10 of FIG. 14 includes a crown insert made from a metal or metal alloy, such as titanium, and in another implementation, the crown portion 19 includes a one-piece monolithic construction, made from a metal or metal alloy, such as titanium, instead of a separately attachable sole insert. Additionally, the golf club head 10 of FIG. 14 does not include a sole insert 28 made from a fiber-reinforced polymer. Instead, the sole portion 17 of the golf club head 10 of FIG. 14 includes a sole insert made from a metal or metal alloy, such as titanium, and in another implementation, the sole portion 17 includes a one-piece monolithic construction, made from a metal or metal alloy, such as titanium, instead of a separately attachable sole insert. Accordingly, in at least one embodiment, an entirety of the golf club head 10 of FIG. 14, may be made from a metal or metal alloy, such as titanium. Moreover, in such an embodiment, more than between about 60% and 80% (e.g., about 70%) of the crown portion 19 of the body 11 of the golf club head 10 has a thickness less than about 0.75 mm.

Based on the foregoing, the body 11 of the golf club head 10 of the present disclosure has at least one of a crown portion 19 at least partially made from a fiber-reinforced polymer, a sole portion 17 at least partially made from a fiber-reinforced polymer, or a crown portion 19 and a sole portion 17 made entirely from a metal or metal alloy. For example, in certain embodiments, the body 11 of the golf club head 10 has both a crown portion 19 and sole portion 17 at least partially made from a fiber-reinforced polymer, in other embodiments, the body 11 of the golf club head 10 has a crown portion 19 at least partially made from a fiber-reinforced polymer and a sole portion 17 entirely made from a metal or metal alloy, and in yet other embodiments, the body 11 of the golf club head 10 has both a crown portion 19 and sole portion 17 made entirely from a metal or metal alloy. However, as will be explained in more detail below, notwithstanding the variability of the composition of the crown portion 19 and sole portion 17 of the golf club head 10 of the present disclosure, the same type of profile of the crown portion 19 can be common among the various embodiments of the golf club head 10 to cooperatively, along with the composition of the crown portion 19 and sole portion 17, promote certain performance characteristics of the golf club head 10.

As represented only in the golf club head 10 of FIGS. 9-12, but applicable to the golf club head 10 of all FIGS. 1-16, the CG 82 of the golf club head 10 of the present disclosure is the average location of the weight of the golf club head 10, or the point at which the entire weight of the golf club head 10 may be considered as concentrated, so that if supported at this point, the golf club head 10 would remain in equilibrium in any position.

In FIGS. 9-16, the golf club head 10 is in an address position such that the hosel axis 91 is at an angle of approximately 60 degrees relative to an imaginary ground plane 80 and the face angle is substantially square relative to an imaginary target line. The target line may be defined as the horizontal component of a vector normal to the center 93 of the striking face 43. The length (heel-to-toe) and height (sole-to-crown) of the club head are measured according to USGA procedures with the head in the address position and at a 60 degree lie angle. The ground plane 80, as used herein, is assumed to be a level plane. As defined herein, a midplane of the golf club head 10 is a plane that is perpendicular to the ground plane 80 and passes through the center 93 of the striking face 43. Furthermore, when the golf club head 10 is in the address position on the ground, the hosel axis 91 intersects the ground plane 80 at a ground plane intersection point 95.

When the golf club head 10 is in the address position on the ground plane 80, a maximum height $H_{SF}$ of the striking face 43 of the face portion 42 may be at least about 50 mm, such as at least about 52 mm, such as at least about 54 mm, or such as at least about 56 mm. Additionally, a minimum height $H_{SFC}$ from the ground plane to the center 93 of the striking face 43 may be at least about 27 mm, such as at least about 28 mm, such as at least about 29 mm, such as at least about 30 mm, or such as at least about 35 mm. The center 93 may be the geometric center of the striking face 43 defined as the intersection of the midpoints of the height and width of the striking face 43.

Referring to the golf club head 10 of FIGS. 9-12, but applicable to the golf club head 10 of all FIGS. 1-16, a crown height $H_{CHF}$ of a forewardmost point of the crown portion 19 of the body 11 may be greater than about 52 mm, such as greater than about 54 mm, such as greater than about 56 mm, such as greater than about 58 mm, or such as greater than about 60 mm. A peak crown height $H_{PCH}$ of the crown portion 19 may be at least about 62 mm, such as at least about 64 mm, such as at least about 66 mm, or such as at least about 68 mm. Similarly, a crown height $H_{CHR}$ of a rearwardmost point of the crown portion 19 along a midplane may be less than about 23 mm, such as less than about 18 mm, or such as less than about 15 mm. In some implementations, the crown height $H_{CHR}$ of the rearwardmost point of the crown portion 19 may be between 8 mm and 23 mm, such as between 10 mm and 20 mm, such as between 11 mm and 18 mm, or such as between 11 mm and 16 mm.

Again, referring to the golf club head 10 of FIGS. 9-14, but applicable to the golf club head 10 of all FIGS. 1-16, a minimum distance Zup of the CG 82 away from the ground plane 80 may be less than about 27.5 mm, such as less than about 26.5 mm, such as less than about 25.5 mm, or such as less than about 24.5 mm.

The configuration of the crown portion 19, including one or more of the materials from which the crown portion 19 is made or the relatively dramatic profile of the crown portion 19, as will be explained in more detail below, relative to the other portions of the golf club head 10 promotes a relatively low minimum distance Zup of the CG 82 relative to the peak crown height $H_{PCH}$ of the crown portion 19 of the golf club head 10. Such a relationship between minimum distance Zup of the CG 82 relative to the peak crown height $H_{PCH}$ of the crown portion 19 may be achieved by the extra discretionary mass made available, by using a lighter, stiffer material to form at least the crown portion 19 as described above, for placement lower on the golf club head 10. The relationship between the minimum distance Zup of the CG 82 and the peak crown height $H_{PCH}$ of the crown portion 19 can be expressed as the difference between the minimum distance Zup of the CG 82 and half of the peak crown height $H_{PCH}$ (i.e., Zup-0.5$H_{PCH}$).

Figure 21:
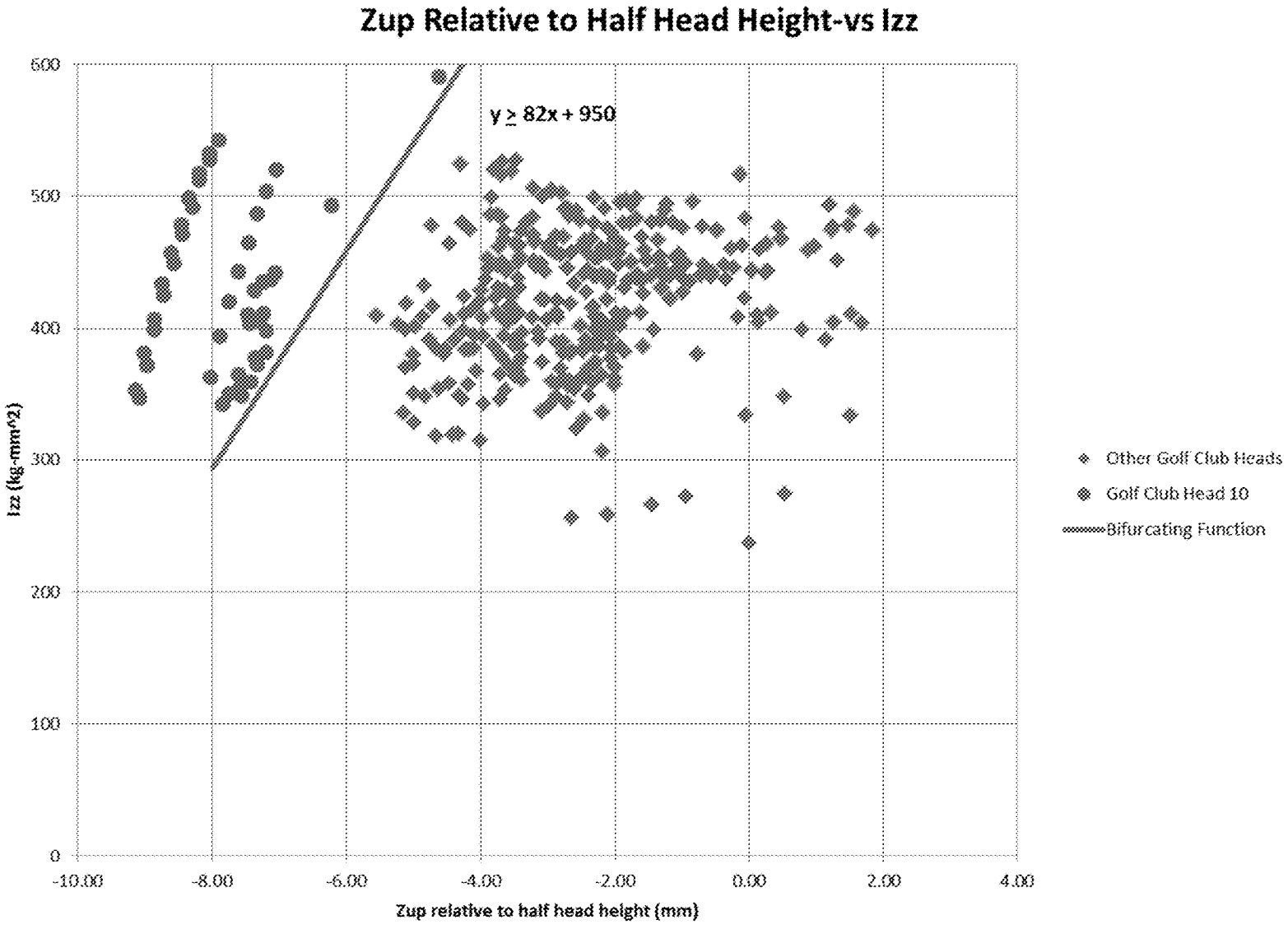
FIG. 21 is a chart showing values for the difference between the minimum distance Zup of the center-of-gravity and half of the peak crown height versus the moment of inertia about the z-axis for some golf club heads of the present disclosure and other golf club heads, according to one or more examples of the present disclosure.

According to some implementations, when the golf club head 10 is in the address position on the ground plane 80, the difference between the minimum distance Zup of the CG 82 and half of the peak crown height $H_{PCH}$ may be less than about-5.75 mm, such as less than about-6.0 mm, such as less than about-6.5 mm, or such as less than about-7.0 mm. In yet further implementations, values for the difference between the minimum distance Zup of the CG 82 and half of the peak crown height $H_{PCH}$ versus the moment of inertia about the z-axis (Izz) for some golf club heads 10 of the present disclosure and other golf club heads, when in the address position on the ground plane 80, are shown in FIG. 21.

Table 1 below lists some but not all of the exemplary data points used to generate the chart shown in FIG. 21. Many of the data points were generated by sweeping a slidable weight from a front portion of a track to a rear portion of a track. Instead of a sliding weight track weight ports could be positioned at the front and rear of the club head to achieve a similar overall change in the extreme positions, but weight ports would not allow for the incremental adjustment as shown in FIG. 21. To achieve incremental adjustment using weight ports would require a significant number of weight ports, which requires additional structure to house the weights and reduces the available discretionary mass. As already explained, the other parameter that varied were the materials used to construct club head 10. For example, in one embodiment the body was formed completely from titanium, in an alternative embodiment the body was formed from titanium and the crown was formed from a composite material, and in yet another alternative embodiment the body was formed from titanium and the crown and sole were formed from a composite material having a density between 1 g/cc and 2 g/cc.

TABLE 1

| | Composite crown and composite sole. | | Composite crown and Ti sole. | | Ti crown and Ti sole. | |
|---|---|---|---|---|---|---|
| Half Head Height (mm) | 33 | 33 | 33 | 33 | 33 | 33 |
| Zup (mm) | 23.91 | 25.09 | 23.86 | 24.96 | 24.97 | 25.96 |
| Zup − Half Head Height (mm) | −9.09 | −7.91 | −9.14 | −8.04 | −8.03 | −7.04 |
| CG Project from Half Head Ht (mm) | −4.7 | −0.3 | −4.7 | −0.6 | −3.3 | 0.3 |
| Izz (kg-mm^2) | 347 | 543 | 353 | 532 | 363 | 520 |
| Delta 1 (mm) | 9.6 | 28.1 | 10.3 | 27.3 | 11.5 | 26.7 |

Various parameters may be adjusted to obtain multiple combinations of head height, Zup, Delta 1, $I_{ZZ}$, and CG projection. For example, Table 2 below shows data for an alternative design and data for a large volume club head having a volume of about 800 cc. This enables the inventors to design golf club heads that fall on the left side of the bifurcating function shown in FIG. 21 i.e. golf club heads that have an Izz that is greater than or equal to 82*(Zup−0.5*head height)+950 kg-mm^2 or y≥82x+950. Similarly, the inventors may also design golf club heads that fall on the left side of the bifurcating function shown in FIG. 22 i.e. golf club heads that have an Izz greater than or equal to 58.3*(CGprojection relative to half head height)+483.3 kg-mm^2 or y≥58.3x+483.3.

TABLE 2

| | Alternate Embodiment Club Head 10 | Large volume club head 10 |
|---|---|---|
| Half Head Height (mm) | 33 | 38 |
| Zup (mm) | 26.73 | 33.27 |
| Zup-Half Head Height (mm) | −6.22 | −4.63 |
| CG Project from Half Head Ht (mm) | −0.5 | 1.4 |
| Izz (kg-mm^2) | 493 | 591 |
| Delta 1 (mm) | 21 | 14.9 |

Referring to the golf club head 10 of FIGS. 9-12, but applicable to the golf club head 10 of all FIGS. 1-16, an overall forward-to-rearward depth $D_{ch}$ of the golf club head 10 may be greater than about 85 mm, such as greater than about 95 mm, such as greater than about 105 mm, or such as greater than about 115 mm.

Figure 16:
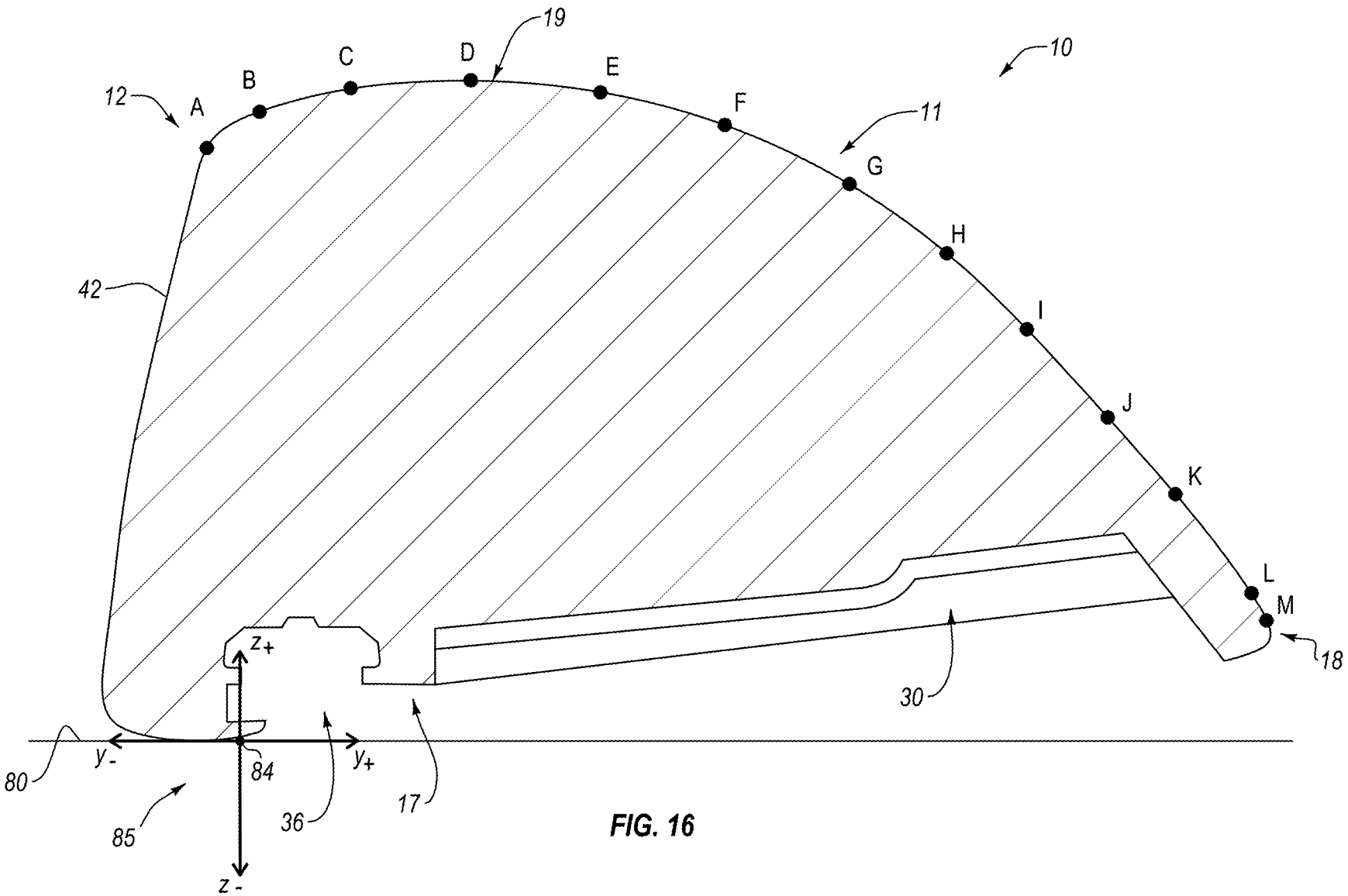
FIG. 16 is a cross-sectional side elevation view of an outer periphery of yet another golf club head, taken along a longitudinal midplane of the golf club head, according to one or more examples of the present disclosure.

Additionally, as shown in FIGS. 15 and 16, a club head origin coordinate system 85, centered around a club head origin 84, can be defined such that the location of various features of the golf club head, including the CG and points on the crown portion 19, can be determined with respect to the club head origin 84. Unless otherwise indicated, the club head origin 84, as defined herein, is the ground plane intersection point 95 projected, in a direction parallel to the ground plane 80 and perpendicular to the midplane, onto the midplane (see, e.g., FIGS. 11 and 12). The y-axis of the club head origin coordinate system 85 passes through the club head origin 84 and extends parallel to or along the midplane. As indicated, the y-axis extends from the club head origin 84 in the positive direction toward the rearward region 18 and extends from the club head origin 84 in the negative direction toward the forward region 12. The z-axis of the club head origin coordinate system 85 passes through the club head origin 84 and extends perpendicularly relative to the y-axis and ground plane 80 and parallel to or along the midplane. As indicated, the z-axis extends from the club head origin 84 in the positive direction toward the crown portion 19, or in a vertically upward direction, and extends from the club head origin 84 in the negative direction in a vertically downward direction. 2. The x-axis of the club head origin coordinate system 85 passes through the club head origin 84 and extends perpendicularly relative to the midplane, y-axis, and z-axis. As indicated, the x-axis extends from the club head origin 84 in the positive direction toward the heel region 16 and extends from the club head origin 84 in the negative direction toward the toe region 14. Thus, for example, and using millimeters as the unit of measure, a CG 82 that is located 3.2 mm from the head origin 84 toward the toe region 14 of the golf club head 10 along the x-axis, 21.7 mm from the head origin 84 toward the rearward region 18 of the golf club head 10 along the y-axis, and 32.1 mm from the head origin 84 toward the crown portion 19 of the golf club head 10 along the z-axis can be expressed as having a head origin x-axis coordinate CGx of −3.2 mm, a Delta 1 coordinate of 21.7 mm as measured along the y-axis, and a Zup coordinate of 32.1 mm as measured along the z-axis.

The CG 82 can also be used to define a CG coordinate system 200 with the CG 82 as the origin of the CG coordinate system 200. For example, as illustrated in FIGS. 11 and 12, the CG coordinate system 200 defined with respect to the CG 82 (i.e., having an origin 250 at the CG 82) includes three axes: a CG z-axis extending through the origin 250 in a generally vertical direction relative to the ground plane 80 when the club head 10 is at normal address position; a CG x-axis extending through the origin 250 in a toe-to-heel direction generally parallel to the striking face 43 (e.g., generally tangential to the striking face 43 at the center 93 of the striking face 43), and generally perpendicular to the CG z-axis; and a CG y-axis extending through the origin 250 in a front-to-back direction and generally perpendicular to the CG x-axis and to the CG z-axis. The CG x-axis and the CG y-axis both extend in generally horizontal directions relative to the ground plane 80 when the club head 10 is at normal address position. The CG x-axis extends in a positive direction from the origin 250 to the heel region 16 of the club head 10. The CG y-axis extends in a positive direction from the origin 250 towards the rearward region 18 of the golf club head 10. The CG z-axis extends in a positive direction from the origin 250 towards the crown portion 19. Thus, the axes of the CG coordinate system 200 are parallel to corresponding axes of the club head origin coordinate system 85. In particular, the CG z-axis is parallel to the z-axis of the club head origin coordinate system 85, the CG x-axis is parallel to x-axis of the club head origin coordinate system 85, and the CG y-axis is parallel to y-axis of the club head origin coordinate system 85.

The profile or shape of the crown portion 19 of the golf club head 10 of the present disclosure is distinct relative to conventional golf club heads. For example, the crown portion 19 has a more dramatic and rapid rise in a height of the crown portion 19, from a forewardmost point or boundary of the crown portion 19 (e.g., immediately adjacent the face portion 42) in a forward-to-rearward direction, relative to the drop in height of the crown portion 19 in the forward-to-rearward direction, than conventional golf club heads. In some implementations, the crown portion 19 can be defined as having a bulbous shape nearer the forewardmost point of the crown portion 19 than the rearwardmost point of the crown portion 19. The profile of the crown portion 19 can be defined according to the height of the crown portion 19 from the ground plane 80 (i.e., crown height), when the golf club head 10 is in the address position on the ground plane 80, relative to a location on the y-axis of the club head origin coordinate system 85. The crown height can be equal to the position of the crown portion 19 relative to or on the z-axis of the golf club head origin coordinate system 85. Referring to FIGS. 15 and 16, the crown heights of the golf club head 10 at different locations (e.g., A-L in FIG. 15 and A-M in FIG. 16) along the y-axis of the club head origin coordinate system 85 are represented. Generally, the peak crown height $H_{PCH}$ of the golf club head 10 is the highest maximum crown height of the golf club head 10 at any location on the golf club head 10 or the distance away from the ground plane 80, in the vertical direction (i.e., z-direction), to the highest point on the golf club head 10 when the golf club head 10 is in the address position on the ground plane 80.

According to one particular embodiment, the maximum crown heights of the golf club head 10 of FIG. 15 at locations A-L on the crown portion 19 with a y-axis coordinate, in the club head origin coordinate system 85, are indicated in Table 3 below. It is noted that the y-axis coordinates associated with the maximum crown heights of Tables 3 and 4 are not necessarily associated with an x-axis coordinate, in the club head origin coordinate system 85, of zero. For example, the location of the maximum crown heights may be off-center relative to the y-axis in the club head origin coordinate system 85, such that x-axis coordinate associated with the y-axis coordinates in the Tables 3 and 4, may be a negative number less than zero (e.g., toe-ward of the origin of the club head origin coordinate system 85) or a positive number greater than zero (e.g., heel-ward of the origin of the club head origin coordinate system 85).

TABLE 3

| Location | Y-axis (mm) | Crown Height (mm) |
|---|---|---|
| A | −6.2555 | 54.0163 |
| B | 0 | 60.5771 |
| C | 10 | 63.1802 |
| D | 20 | 64.1542 |
| E | 30 | 63.4926 |
| F | 40 | 61.2104 |
| G | 50 | 57.2966 |
| H | 60 | 51.7161 |
| I | 70 | 44.2926 |
| J | 80 | 34.908 |
| K | 90 | 23.5885 |
| L | 98 | 11.8734 |

According to another embodiment, the maximum crown heights of the golf club head 10 of FIG. 16 at locations A-M on the crown portion 19 with a y-axis coordinate, in the club head origin coordinate system 85, are indicated in Table 4 below.

TABLE 4

| Location | Y-axis (mm) | Crown Height (mm) |
|---|---|---|
| A | −5.197 | 53.9296 |
| B | 0 | 59.4379 |
| C | 10 | 61.8235 |
| D | 20 | 62.7604 |
| E | 30 | 62.2704 |
| F | 40 | 60.3488 |
| G | 50 | 56.9642 |
| H | 60 | 52.0567 |
| I | 70 | 45.5121 |
| J | 80 | 37.2585 |
| K | 90 | 27.3727 |
| L | 100 | 15.6311 |
| M | 102 | 13.0849 |

The crown heights and y-axis locations of the Tables 3 and 4, presented above, can be analogous to the crown heights and y-axis locations of other embodiments of the golf club head 10. For example, in some embodiments, the crown heights for the golf club head 10 may fall within a range of 52-60 mm at a head origin y-axis coordinate of about-5 mm; a range of 56-62 mm at a head origin y-axis coordinate of about 0 mm; a range of 59-66 mm at a head origin y-axis coordinate of about 10 mm; a range of 61-68 mm at a head origin y-axis coordinate of about 20 mm; a range of 61-68 mm at a head origin y-axis coordinate of about 30 mm; a range of 59-66 mm at a head origin y-axis coordinate of about 40 mm; a range of 56-63 mm at a head origin y-axis coordinate of about 50 mm; a range of 51-57 mm at a head origin y-axis coordinate of about 60 mm; a range of 44-51 mm at a head origin y-axis coordinate of about 70 mm; a range of 34-42 mm at a head origin y-axis coordinate of about 80 mm; a range of 22-31 mm at a head origin y-axis coordinate of about 90 mm; a range of 9-24 mm at a head origin y-axis coordinate of about 100 mm. Importantly, the above ranges are provided as examples of various ranges of heights at various y-axis coordinate locations. Further examples and methods of defining crown height are provided below that may have differing ranges than those specified directly above.

In view of Tables 3 and 4 and the ranges above, and according to at least one implementation, a ratio of the peak crown height to a height of a forwardmost point of the crown portion from the ground plane, when the golf club head is in the address position on the ground plane, may be greater than about 1.00. In other implementations a ratio of the peak crown height to a height of a forwardmost point of the crown portion from the ground plane may be greater than about 1.12, such as greater than about 1.13, such as greater than about 1.14, such as greater than about 1.15, or such as greater than about 1.16. Additionally, according to Tables 3 and 4 and the ranges above, in at least one implementation, a ratio of the peak crown height to a height of a rearwardmost point of the crown portion from the ground plane, when the golf club head is in the address position on the ground plane, may be greater than about 2.8. In other implementations, a ratio of the peak crown height to a height of a rearwardmost point of the crown portion from the ground plane may be greater than about 3.1, such as greater than about 3.3, such as greater than about 3.5, such as greater than about 3.7, such as greater than about 3.9, such as greater than about 4.1, such as greater than about 4.3, such as greater than about 4.5, or such as greater than about 4.7. In addition, the rearwardmost point of the crown ($H_{RCH}$) will generally be less than Zup, such as at least 3 mm less than Zup, such as at least 5 mm less than Zup, such as at least 7 mm less than Zup, such as at least 9 mm less than Zup, or such as at least 11 mm less than Zup. For example, an exemplary embodiment may satisfy the following inequalities $H_{PCH}/H_{RCH}>3.3$, $Zup>H_{RCH}$, and $Zup-0.5*H_{PCH}<-5.75$ and other combinations of the inequalities discussed above.

Figure 23:
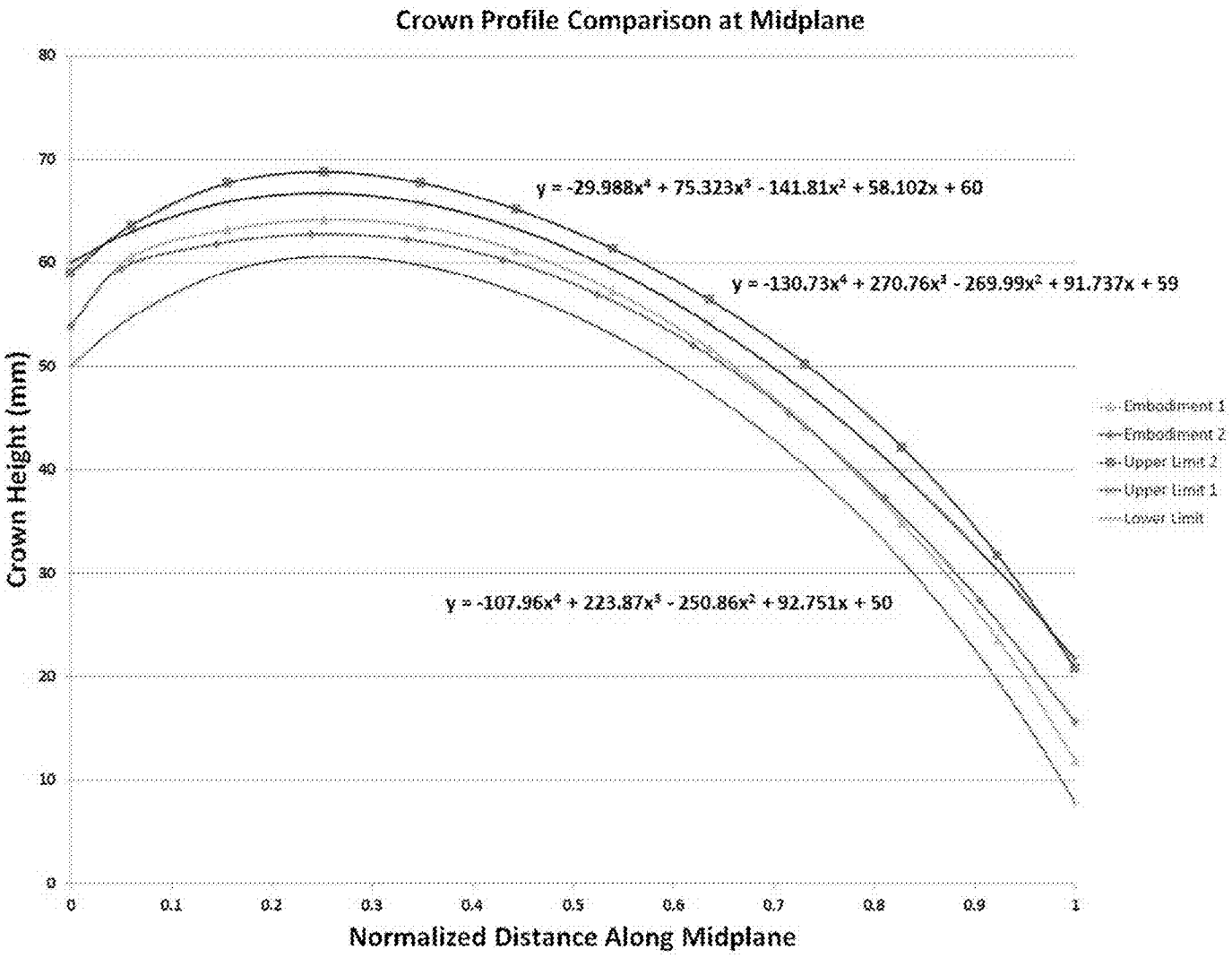
FIG. 23 is a chart showing values for crown height versus normalized location on a crown portion along a midplane for some golf club heads of the present disclosure, according to one or more examples of the present disclosure.

According to one specific embodiment, and referring to FIG. 23, the profile of the crown portion 19 of the golf club head 10 expressed in terms of the crown height $H_{CH}$ (in millimeters) of a percentage of the crown portion 19 of the golf club head 10, along a plane (e.g., midplane) passing through a center of the striking face of the face portion and perpendicular to the ground plane and when the golf club head is in the address position on the ground plane, being between, Equation 1 and Equation 2 as follows:

$$H_{CH}=-130.73x^4+270.76x^3-269.99x^2+91.737x+59 \quad (1)$$

$$H_{CH}=-107.96x^4+223.87x^3-250.86x^2+92.751x+50 \quad (2)$$

where x is a normalized forward-to-rearward depth (e.g., distance) of the crown portion 19 of the golf club head. In one implementation, the percentage of the crown portion 19 of the golf club head 10 having a crown height $H_{CH}$ along the midplane between Equation 1 (e.g., a second upper limit) and Equation 2 (e.g., a lower limit) may be at least 90%, at least 95%, or 100%. The normalized forward-to-rearward depth of the crown portion 19 of the golf club head 10 has a value between 0 and 1, and can be determined by applying the following equation $$(x_i-x_{min})/(x_{max}-x_{min}) \quad (3)$$

where $x_i$ is the depth of the crown portion 19 of the golf club head 10, $x_{min}$ is the start of the crown portion 19 of the golf club head 10, and thus has a value of zero, and $x_{max}$ is the maximum or overall depth of the crown portion 19 of the golf club head 10.

Accordingly, a normalized value of zero corresponds with the transition from the face portion 42 to the crown portion 19 and a normalized value of one corresponds with the transition from the crown portion 19 to the skirt portion 21.

According to another specific embodiment, and again referring to FIG. 23, the profile of the crown portion 19 of the golf club head 10 expressed in terms of the crown height $H_{CH}$ (in millimeters) of a percentage of the crown portion 19 of the golf club head 10, along a plane (e.g., midplane) passing through a center of the striking face of the face portion and perpendicular to the ground plane and when the golf club head is in the address position on the ground plane, being between, Equation 4 below and Equation 2 above:

$$H_{CH}=-29.988x^4+75.323x^3-141.81x^2+58.102x+60 \quad (4)$$

where x is a normalized forward-to-rearward depth of the crown portion 19 of the golf club head. In one implementation, the percentage of the crown portion 19 of the golf club head 10 having a crown height $H_{CH}$ along the midplane between Equation 4 (e.g., a first upper limit) and Equation 2 may be at least 90%, at least 95%, or 100%.

As shown in FIG. 23, 100% of the profiles, along the midplanes, of the crown portions of embodiment 1 of the golf club head described herein (see, e.g., FIGS. 1-10B) and embodiment 2 of the golf club head described herein (see, e.g., FIGS. 24-33*b*) fit between Equation 1 and Equation 2, and between Equation 4 and Equation 2.

In yet another embodiment, the profile of the crown portion 19 of the golf club head 10 expressed in terms of the crown height $H_{CH}$ (in millimeters) of a percentage of the crown portion 19 of the golf club head 10, along the midplane when the golf club head is in the address position on the ground plane, meets the following equation $$-0.0088y^2+0.4467y+x \quad (5)$$

where y is a forward-to-rearward depth of the golf club head 10 i.e. $D_{CH}$ and x may be a value between about 56 and about 62 mm. In one implementation, the percentage of the crown portion 19 of the golf club head 10 having a crown height $H_{CH}$ along the midplane that meets Equation 5 may be at least 90%, at least 95%, or 100%. Values for $D_{CH}$ are specified above.

As shown in FIGS. 9A, 9B, 11, 13-16, and 23, an entirety of the exterior surface of the crown portion 19 if the golf club head 10 described herein may be convex. In other words, in some embodiments, the crown portion 19 of the golf club head 10 described herein may not include any points of inflection.

Further, as used herein, Delta 1 (i.e., D1) is a measure of how far rearward in the body 11 of the golf club head 10 the CG 82 is located. More specifically, Delta 1 is the distance between the CG 82 and the hosel axis along the y-axis of the club head origin coordinate system 85.

It has been observed that smaller values of Delta 1 result in lower projected CGs on the striking face 43 of the golf club head 10. Having the CG project at or near the center face 93 of the golf club head 10 provides better energy transfer for shots struck at center face 93. However, reducing Delta 1 also reduces the forgiveness of the club head 10 (i.e. the moment of inertia about the z-axis (Izz) and the x-axis (Ixx)). Thus, a golf club head designer must find a balance between a low CG projection and club head "forgiveness" or moment of inertia. In the past, golf club head designers have favored a golf club head with a higher moment of inertia over one with a low CG projection. As a result, nearly all USGA conforming golf club heads with large volumes (375 $cm^3$-470 $cm^3$) have a CG that projects well above (6 mm-10 mm) the center face of the golf club head. As defined herein, the CG projection or projected CG point is the point on the striking face 43 that intersects with a line that is normal to a tangent line of the striking face 43 (at the geometric center 93 of the striking face 43) and that passes through the CG 82. This projected CG point can also be referred to as the "zero-torque" point because it indicates the point on the striking face 43 that is centered with the CG 82. Thus, if a golf ball makes contact with the striking face 43 at the projected CG point, the golf club head will not twist about any axis of rotation since no torque is produced by the impact of the golf ball.

By incorporating the geometry described above, the golf club head 10 can achieve a relatively low CG projection (e.g., <4 mm above center face 93), while achieving a relatively high moment of inertia (e.g., Ixx>220 kg-mm^2 and Izz>350 kg-mm^2). The rapidly descending crown shape, the large difference between Zup and half of the peak crown height $H_{PCH}$, crown thickness, and crown material all play a role in achieving a relatively low CG projection and a relatively high moment of inertia. The crown shape allows less of the crown to be above the center face 93 of the golf club head 10, and the crown thickness along with the less dense crown material means the weight above the center face 93 of the golf club head 10 is less of a penalty because it is lighter. Adjusting the location of the discretionary mass in a golf club head, as described above, can provide the desired Delta 1 value. For instance, Delta 1 can be manipulated by varying the mass in front of the CG 82 (e.g., closer to the striking face 43) with respect to the mass behind the CG 82 (e.g., closer to the rearward region 18). That is, by increasing the mass behind the CG with respect to the mass in front of the CG 82, Delta 1 can be increased. In a similar manner, by increasing the mass in front of the CG 82 with the respect to the mass behind the CG 82, Delta 1 can be decreased.

As mentioned above, the position of the CG 82 relative to the head origin of the golf club head 10, expressed in terms of the location of the CG 82 on the club head origin coordinate system 85 centered at the head origin 84 (e.g., CGx (i.e., the position of the CG 82 on the x-axis of the club head origin coordinate system), Delta 1 (i.e., the position of the CG 82 on the y-axis of the club head origin coordinate system), and Zup (i.e., the position of the CG 82 on the z-axis of the club head origin coordinate system)), can be a characteristic of the golf club head 10 that affects the performance of the golf club head 10. The head origin can be the head origin 84 and the club head origin coordinate system can be the club head origin coordinate system 85 as shown in FIGS. 15 and 16. However, in other embodiments, the head origin of the golf club head 10 can be defined in other ways. For example, the CGx and Zup values in Tables 5-7 below are based on a club head origin coordinate system centered at a head origin located at a geometric center of the striking face 43 of the golf club head 10 with x-axis, y-axis, and z-axis parallel to the x-axis, y-axis, and z-axis of the club head origin coordinate system 85.

In addition to the position of the CG 82 of a golf club head 10 with respect to a head origin of the golf club head 10, another property of the golf club head 10 is a projected CG point on the striking face 43 of the golf club head 10. The projected CG point (CG Proj) is the point on the striking face 43 that intersects a line normal to the tangent line of the striking face 43 and passing through the CG 82. Moreover, the projected CG point can also be referred to as a "zero-torque" point because it indicates the point on the striking face 43 that is centered with the CG 82. Thus, if a golf ball makes contact with the striking 43 at the projected CG point, the golf club head 10 will not twist about any axis of rotation since no torque is produced by the impact of the golf ball. A negative number for this property indicates that the projected CG point is below the geometric center of the face.

As introduced above, the moment of inertia (MOI) of the golf club head 10 (i.e., a resistance to twisting) is typically measured about each of the three main axes of a club head origin coordinate system with the CG 82 of the golf club head 10 acting as the origin of the coordinate system. These three axes include a CG z-axis extending through the CG 82 in a generally vertical direction relative to the ground plane 80, when the golf club head 10 is in the address position on the ground plane 80; a CG x-axis extending through the CG 82 in a toe-to-heel direction generally parallel to the striking face 43 and generally perpendicular to the CG z-axis, when the golf club head 10 is in the address position on the ground plane 80; and a CG y-axis extending through the CG 82 in a forward-to-rearward direction and generally perpendicular to the CG x-axis and to the CG z-axis, when the golf club head 10 is in the address position on the ground plane 80. The CG x-axis and the CG y-axis both extend in generally horizontal directions relative to the ground plane 80 and the CG z-axis extends in a generally vertical direction relative to the ground plane 80, when the golf club head 10 is in the address position on the ground plane 80. Thus, the axes of the CG origin coordinate system of the golf club head 10 are parallel to corresponding axes of the club head origin coordinate system (e.g., club head origin coordinate system 85) of the golf club head 10.

The golf club head 10 has an MOI about the CG z-axis (Izz), an MOI about the CG x-axis (Ixx), and a moment of inertia about the CG y-axis (Iyy). The MOI about the CG z-axis, or Izz, and the MOI about the CG x-axis, or Ixx, affects the forgiveness of the golf club head 10 or the ability of the golf club head 10 to reduce negative effects of off-center strikes of a golf ball on the striking face 43. A further description of the coordinate systems for determining CG positions and MOI can be found in U.S. Patent Application Publication No. 2012/0172146 A1, published Jul. 5, 2012, which is incorporated herein by reference.

The moment of inertia about the CG x-axis (Ixx) is calculated by the following equation:

$$Ixx=\int(y^2+z^2)dm \tag{6}$$

where y is the distance from a CG xz-plane of the golf club head 10 to an infinitesimal mass dm and z is the distance from a CG xy-plane of the golf club head 10 to the infinitesimal mass dm. The CG xz-plane is a plane defined by the CG x-axis and the CG z-axis. Similarly, the CG xy-plane is a plane defined by the CG x-axis and the CG y-axis.

The moment of inertia about the CG z-axis (Izz) is calculated by the following equation:

$$Izz=\int(x^2+y^2)dm \tag{7}$$

where x is the distance from a CG yz-plane of the golf club head 10 to an infinitesimal mass dm and y is the distance from the CG xz-plane of the golf club head 10 to the infinitesimal mass dm. The CG yz-plane is a plane defined by the CG y-axis and CG z-axis.

Values of CGx, Delta 1, Ixx, Iyy, CG Proj, and the difference between Zup and half of the peak crown height $H_{PCH}$ for various alternative combination of masses of the front and back weights of the golf club head 10 (with the front weight aligned with a midpoint of the striking face 43 and the back weight at the rearward region 18 of the golf club head 10) having a profile of the crown portion 19 as presented above, according to one embodiment, are shown in Tables 5-7 below. The values indicated in Table 5, below, are for a golf club head 10 having a crown portion 19 with a crown insert 26 made from a fiber-reinforced polymer and a sole portion 17 with a sole insert 28 made from a fiber-reinforced polymer (e.g., the golf club head 10 of FIGS. 1-10), with a volume of 452 $cm^3$, when measured with an open front weight track, and with a total combined mass of the front and back weights of 44 grams.

TABLE 5

| Front Mass (g) | Back Mass (g) | CGx (mm) | Delta 1 (mm) | $I_{xx}$ (kg-mm$^2$) | $I_{zz}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 44 | 0 | 0.41 | 9.6 | 225 | 347 | −4.7 | −9.09 | 0.65 |
| 39.8 | 4.1 | 0.22 | 11.3 | 248 | 372 | −4.3 | −8.98 | 0.67 |
| 35.1 | 9.1 | 0 | 13.4 | 274 | 399 | −3.8 | −8.86 | 0.69 |
| 30 | 14 | −0.24 | 15.5 | 299 | 425 | −3.3 | −8.72 | 0.70 |
| 24.9 | 19 | −0.46 | 17.6 | 321 | 449 | −2.8 | −8.57 | 0.71 |
| 20.1 | 24 | −0.69 | 19.6 | 342 | 471 | −2.3 | −8.45 | 0.73 |
| 15 | 29 | −0.92 | 21.7 | 361 | 492 | −1.8 | −8.3 | 0.73 |
| 9.9 | 34.4 | −1.17 | 24 | 380 | 512 | −1.3 | −8.19 | 0.74 |
| 4.9 | 39.3 | −1.4 | 26 | 396 | 528 | −0.8 | −8.05 | 0.75 |
| 0 | 44.2 | −1.62 | 28.1 | 409 | 543 | −0.3 | −7.91 | 0.75 |

The values indicated in Table 6, below, are for a golf club head 10 having a crown portion 19 with a crown insert 26 made from a fiber-reinforced polymer and a sole portion 17 made entirely from a metal, such as titanium (e.g., the golf club head 10 of FIGS. 11-13), with a volume of 452 $cm^3$, when measured with an open front weight track, and with a total combined mass of the front and back weights of 40.6 grams.

TABLE 6

| Front Mass (g) | Back Mass (g) | CGx (mm) | Delta 1 (mm) | $I_{xx}$ (kg-mm$^2$) | $I_{zz}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 40.5 | 0.0 | −0.09 | 10.3 | 226 | 353 | −4.7 | −9.14 | 0.64 |
| 35.7 | 5.0 | −0.31 | 12.3 | 253 | 381 | −4.2 | −9.02 | 0.66 |
| 30.5 | 10.0 | −0.54 | 14.4 | 279 | 407 | −3.7 | −8.87 | 0.69 |
| 25.4 | 15.3 | −0.78 | 16.6 | 304 | 434 | −3.1 | −8.75 | 0.70 |
| 20.3 | 20.3 | −1.02 | 18.8 | 326 | 457 | −2.6 | −8.61 | 0.71 |
| 15.2 | 25.3 | −1.25 | 20.9 | 346 | 478 | −2.1 | −8.46 | 0.72 |
| 10.0 | 30.7 | −1.49 | 23.1 | 366 | 499 | −1.6 | −8.35 | 0.73 |
| 4.9 | 35.7 | −1.72 | 25.2 | 382 | 517 | −1.1 | −8.2 | 0.74 |
| 0.0 | 40.6 | −1.95 | 27.3 | 396 | 532 | −0.6 | −8.04 | 0.74 |

The values indicated in Table 7, below, are for a golf club head 10 having a crown portion 19 and a sole portion 17 made entirely from a metal, such as titanium (e.g., the golf club head 10 of FIG. 14), with a volume of 452 $cm^3$, when measured with an open front weight track, and with a total combined mass of the front and back weights of 36.1 grams.

TABLE 7

| Front Mass (g) | Back Mass (g) | CGx (mm) | Delta 1 (mm) | $I_{xx}$ (kg-mm$^2$) | $I_{zz}$ (kg-mm$^2$) | CG Proj-0.5 $H_{PCH}$ (mm) | Zup-0.5 $H_{PCH}$ (mm) | Ixx/Izz |
|---|---|---|---|---|---|---|---|---|
| 36.1 | 0 | −0.28 | 11.5 | 238.0 | 363 | −3.3 | −8.03 | 0.66 |
| 30.6 | 5.64 | −0.54 | 13.9 | 267 | 394 | −2.8 | −7.89 | 0.68 |
| 25.4 | 10.75 | −0.78 | 16 | 292 | 420 | −2.3 | −7.75 | 0.70 |
| 20.3 | 15.75 | −1.01 | 18.1 | 314 | 443 | −1.8 | −7.61 | 0.71 |
| 15.2 | 20.75 | −1.24 | 20.2 | 335 | 465 | −1.2 | −7.46 | 0.72 |
| 10.0 | 26.15 | −1.48 | 22.5 | 355 | 487 | −0.7 | −7.34 | 0.73 |
| 4.9 | 31.15 | −1.71 | 24.6 | 371 | 504 | −0.2 | −7.2 | 0.74 |
| 0.0 | 36.05 | −1.94 | 26.7 | 386 | 520 | 0.3 | −7.04 | 0.74 |

Tables 5-7 above illustrate how placement of discretionary mass (e.g., front mass and back mass) can be used to alter various club head parameters including CGx, Delta 1, Ixx, Izz, CG projection, and Zup−0.5$H_{PCH}$. For example, Tables 5-7 focus on how moving weight (e.g., mass) along the y-direction impacts the various parameters. Minimal CGx movement is shown in the tables because the forward weight (i.e., front mass) was left stationary. However, the forward weight may easily be moved along the sliding weight track in either a heel or toe direction to have a more significant impact on CGx.

In some embodiments, the golf club head 10 has a CG 82 with a head origin x-axis coordinate (CGx) between about −10 mm and about 10 mm, such as between about −4 mm and about 9 mm, such as between about −3 mm and about 8 mm, or such as between about −2 mm to about 5 mm.

In some embodiments, the golf club head 10 has a Delta 1 greater than about 9.0 mm and less than about 30 mm, such as between about 11 mm and about 27 mm, such as between about 13 mm and about 25 mm, or such as between about 15 mm and about 23 mm. In some embodiments, the golf club head 10 has at least one movable weight (e.g., back mass) that can be moved from the front of the golf club head 10 to the rear of the golf club head 10 using either front and rear weight ports or a sliding weight track allowing for a Max change (Max Δ) in Delta 1 that may be greater than 2 mm, such as greater than 3 mm, such as greater than 4 mm, such as greater than 5 mm, such as greater than 6 mm, such as greater than 7 mm, or such as greater than 8 mm. In some embodiments, the golf club head 10 has at least one movable weight that can be moved from the front of the golf club to the rear of the golf club using either front and rear weight ports or a sliding weight track allowing for a Max Δ Delta 1 from a first weight position to a second weight position that may be between 1.7 mm and 18.5 mm, such as between 2 mm and 6 mm, or such as between about 2.5 mm and about 5 mm. As illustrated by the tables above several other ranges are possible to achieve.

In addition, Tables 5-7 illustrate the movement of the CG 82 in the x, y, and z directions as the at least one weight location may be adjusted on the club head. As shown there, adjusting the weight front to back has little effect on CGx which ranges from 0.41 mm when the weight is in the forward position to −1.6 mm when the weight is in the rear position, providing a Max ΔCGx of 2.0 mm. In addition, the range of adjustment for CGz is from −5.9 mm when the weight is in the forward position to −4.7 mm when the weight is in the rear position, providing a Max ΔCGz of 1.2 mm. However, if less weight is being moved then the change in CGz will decrease, in some embodiments Max ΔCGz may be less than 1 mm, such as less than 0.8 mm, such as less than 0.7 mm, such as less than 0.6 mm, or such as less than 0.6 mm.

Another important relationship is the ratio of Ixx to Izz. Generally, it is desirable to have the ratio of Ixx to Izz be at least 0.55. As shown in Tables 5-7, the various embodiments were able to achieve a higher ratio than this. As shown, Ixx/Izz may be at least 0.59, such as at least 0.62, such as at least 0.65, such as at least 0.68, such as at least 0.71, or such as at least 0.74. Generally, it is desirable to have Ixx be at least 200 kg-mm^2 and preferably at least 250 kg-mm^2, and Izz be at least 350 kg-mm^2 and preferably at least 400 kg-mm^2. As shown in Tables 5-7, the various embodiments were able to achieve a higher moment of inertia values than this. As shown, Ixx may be at least 225 kg-mm^2, such as at least 250 kg-mm^2, such as at least 275 kg-mm^2, such as at least 300 kg-mm^2, such as at least 325 kg-mm^2, such as at least 350 kg-mm^2, such as at least 375 kg-mm^2, such as at least 390 kg-mm^2, or such as at least 400 kg-mm^2. Similarly, as shown in Tables 5-7 Izz may be at least 325 kg-mm^2, such as at least 350 kg-mm^2, such as at least 375 kg-mm^2, such as at least 400 kg-mm^2, such as at least 425 kg-mm^2, such as at least 450 kg-mm^2, such as at least 475 kg-mm^2, such as at least 490 kg-mm^2, or such as at least 510 kg-mm^2.

As shown in Tables 5-7 and described above, the various embodiments were able to achieve a Zup relative to half head height of less than at least −5.75 mm, such as less than at least −6.0 mm, such as less than at least −6.25 mm, such as less than at least −6.5 mm, such as less than at least −6.75 mm, such as less than at least −7.0 mm, such as less than at least −7.25 mm, such as less than at least −7.50 mm, such as less than at least −7.75 mm, such as less than at least −8.0 mm, such as less than at least −8.25 mm, such as less than at least −8.50 mm, such as less than at least −8.75 mm, or such as less than at least −9.0 mm. As shown in Tables 5-7, the various embodiments were able to achieve a CG projection relative to half head height of less than at least 0.5 mm, such as less than at least 0.0 mm, such as less than at least −0.50 mm, such as less than at least-0.75 mm, such as less than at least −1.0 mm, such as less than at least −1.25 mm, such as less than at least −1.50 mm, such as less than at least −1.75 mm, such as less than at least-2.0 mm, such as less than at least −2.25 mm, such as less than at least −2.5 mm, such as less than at least −2.75 mm, such as less than at least −3.0 mm, such as less than at least-3.25 mm, such as less than at least −3.5 mm, such as less than at least −3.75 mm, such as less than at least −4.0 mm, such as less than at least −4.25 mm, or such as less than at least −4.5 mm.

Figure 22:
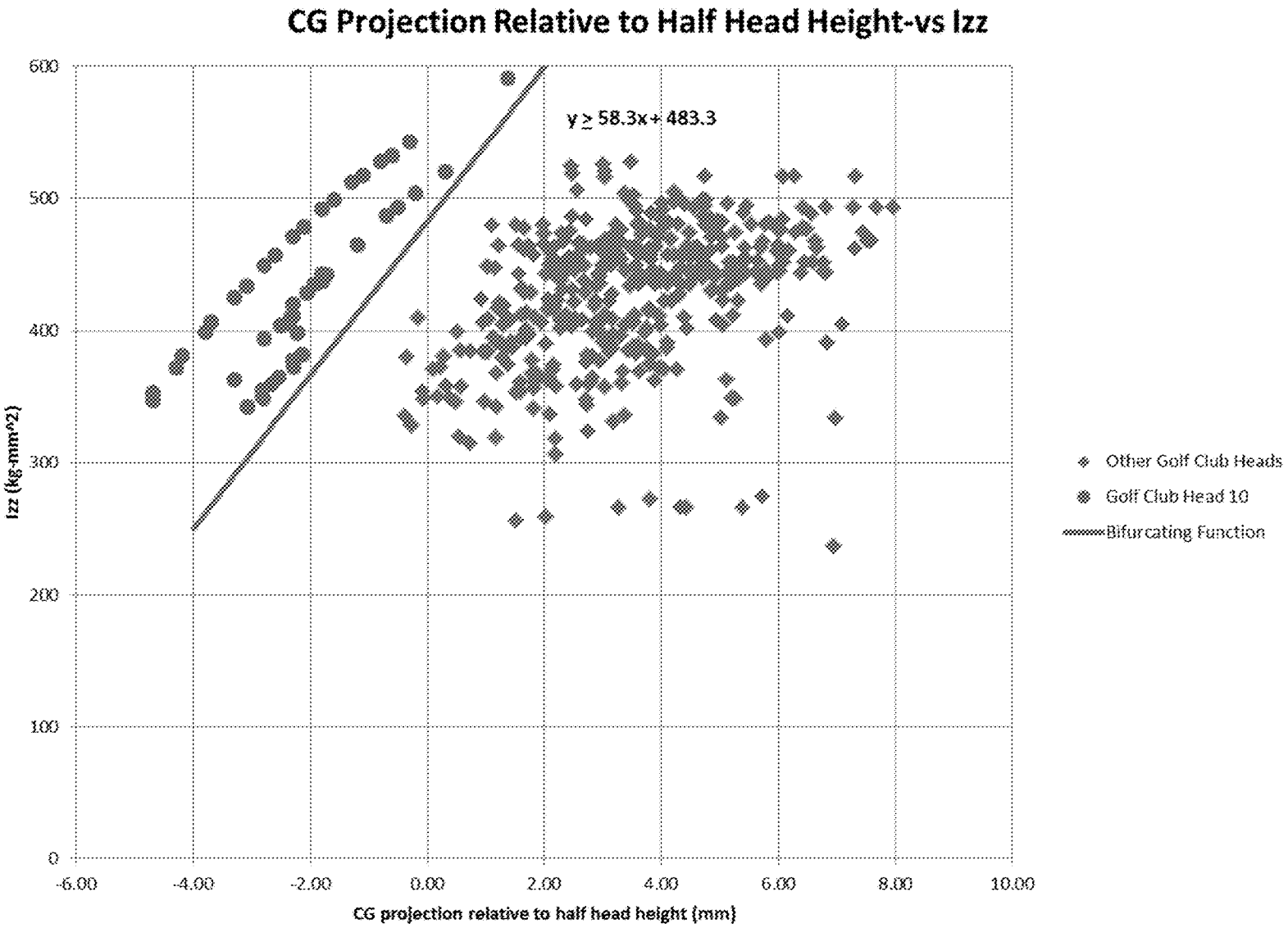
FIG. 22 is a chart showing values for projected center-of-gravity relative to half of the peak crown height versus the moment of inertia about the z-axis for some golf club heads of the present disclosure and other golf club heads, according to one or more examples of the present disclosure.

In some implementations, values for projected CG relative to half of the peak crown height versus the moment of inertia about the z-axis (Izz) for some golf club heads 10 of the present disclosure and other golf club heads, when in the address position on the ground plane 80, are shown in FIG. 22. As defined herein, projected CG relative to half of the peak crown height is defined as the minimum distance of the CG projection of the golf club head 10 away from the ground plane 80 minus half of the peak crown height.

In some embodiments of a golf club head 10 having a weight assembly, such as weight assembly 41, that is adjustably positioned within a substantially heel to toe channel, such as weight track 36 (see, e.g., FIG. 1), the weight assembly can have an origin x-axis coordinate between about −50 mm and about 65 mm, depending upon the location of the weight assembly within the toe channel. In specific embodiments, the weight assembly can have an origin x-axis coordinate between about −45 mm and about 60 mm, or between about −40 mm and about 55 mm, or between about −35 mm and about 50 mm, or between about −30 mm and about 45 mm, or between about −25 mm and about 40 mm, or between about −20 mm and about 35 mm. Thus, in some embodiments, the weight assembly is provided with a maximum x-axis adjustment range (Max Δx) that may be greater than 50 mm, such as greater than 60 mm, such as greater than 70 mm, such as greater than 80 mm, such as greater than 90 mm, such as greater than 100 mm, or such as greater than 110 mm. The heel-toe channel may be designed to be relatively flat such that large adjustments of the weight within the channel would only have a minimal impact on Delta 1 and Zup. For example, throughout the adjustability range of a heel to toe channel, Delta 1 and Zup may change less than 1 mm, less than 0.8 mm, less than 0.7 mm, or less than 0.6 mm.

On the other hand, in some embodiments of the golf club head 10 having a weight assembly, such as weight assembly 32, that is adjustably positioned within a substantially front-to-back channel, such as weight track 30, the weight assembly can have an origin y-axis coordinate between about 10 mm and about 120 mm. More specifically, in certain embodiments, the weight assembly can have an origin y-axis coordinate between about 20 mm and about 110 mm, between about 20 mm and about 100 mm, between about 20 mm and about 90 mm, between about 20 mm and about 80 mm, between about 20 mm and about 70 mm, or between about 20 mm and about 60 mm. Thus, in some embodiments, the weight assembly is provided with a maximum y-axis adjustment range (Max Δy) that may be greater than 40 mm, such as greater than 50 mm, such as greater than 60 mm, such as greater than 70 mm, such as greater than 80 mm, such as greater than 90 mm, or such as greater than 100 mm. The front-to-back channel may be also designed to be relatively flat such that large adjustments of the weight within the channel would only have a minimal impact on CGx and Zup. For example, throughout the adjustability range of a front-to-back channel CGx and Zup may change less than 1 mm, less than 0.8 mm, less than 0.7 mm, or less than 0.6 mm.

Additionally, or alternatively, as described above, a front-to-back channel may be angled relative to the striking face 43 to promote either a draw or fade bias by shifting CGx heelward or toeward. For example, a weight assembly in a front-to-back channel that may be angled between about 15 degrees and 45 degrees relative to the striking face 43 and the y-plane can have an origin y-axis coordinate between about 10 mm and about 90 mm and an origin x-axis coordinate between about −40 mm and about 40 mm, such as a x-axis coordinate between about −20 mm and about 40 mm, such as a x-axis coordinate between about 0 mm and about 40 mm, or such as a x-axis coordinate between about −10 mm and about 40 mm. In the example of an angled sliding weight track, the weight track may still be designed such that movement of the weight throughout the adjustability range has minimal impact on Zup, such as Zup may change less than 1 mm, less than 0.8 mm, less than 0.7 mm, or less than 0.6 mm.

As mentioned above, the golf club head 10 may have a rearwardly positioned weight assembly, such as weight assembly 32 of FIGS. 9A-10B, that may be fixed and a forwardly positioned weight assembly, such as weight assembly 41 that may be slidable. In some embodiments, the mass of the at least one fixed weight assembly or at least one slidable weight assembly may be between about 5 g and about 25 g, such as between about 7 g and about 20 g, or such as between about 9 g and about 15 g. In some alternative embodiments, the mass of the at least one fixed weight assembly or at least one slidable weight assembly may be between about 5 g and about 45 g, such as between about 9 g and about 35 g, such as between about 9 g and about 30 g, or such as between about 9 g and about 25 g.

In some embodiments, the golf club head 10 can be configured to have constraints relating to the product of the mass of the weight assembly and the relative distances that the weight assembly can be adjusted in the origin x-direction and/or origin y-direction. One such constraint can be defined as the mass of the weight assembly (MWA) multiplied by the maximum x-axis adjustment range (Max Δx). According to some embodiments, the value of the product of MWA×(Max Δx) may be between about 250 g mm and about 4950 g·mm. In specific embodiments, the value of the product of MWA×(Max Δx) may be between about 500 g mm and about 4950 g·mm, or between about 1000 g·mm and about 4950 g mm, or between about 1500 g·mm and about 4950 g·mm, or between about 2000 g·mm and about 4950 g mm, or between about 2500 g·mm and about 4950 g mm, or between about 3000 g·mm and about 4950 g·mm, or between about 3500 g mm and about 4950 g·mm, or between about 4000 g·mm and about 4950 g·mm.

In some embodiments, the golf club head 10 can be configured to have constraints relating to the product of the mass of the weight assembly and the relative distances that the weight assembly can be adjusted in the origin x-direction and/or origin y-direction. One such constraint can be defined as the mass of the weight assembly (MWA) multiplied by the maximum y-axis adjustment range (Max Δy). According to some embodiments, the value of the product of MWA×(Max Δy) may be between about 250 g·mm and about 4950 g·mm. In specific embodiments, the value of the product of MWA×(Max Δy) may be between about 500 g mm and about 4950 g·mm, or between about 1000 g·mm and about 4950 g mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g mm, or between about 4000 g·mm and about 4950 g·mm.

According to some embodiments, the golf club head 10 of the present disclosure includes at least one coefficient of restitution (COR) feature located on the sole portion of the body 11 of the golf club head 10. The COR of the golf club head 10 is a measurement of the energy loss or retention between the golf club head 10 and a golf ball when the golf ball is struck by the golf club head 10. Desirably, the COR of the golf club head 10 is high to promote the efficient transfer of energy from the golf club head 10 to the ball during impact with the ball. Accordingly, the COR feature of the golf club head 10 promotes an increase in the COR of the golf club head 10.

In some implementations of the golf club head 10, the COR feature is one or more of a channel, slot, or some other member configured to increase the COR of the golf club head 10. Generally, the COR feature, such as the channel or slot, increases the COR of the golf club head 10 by increasing or enhancing the perimeter flexibility of the striking face 43 of the golf club head 10. According to certain implementations, the COR feature may be located in the forward region 12 of the sole portion 17 of the body 11, adjacent to or near to a forwardmost edge of the sole portion 17.

Further details concerning the channel of the COR feature of the golf club head 10 can be found in U.S. patent application Ser. Nos. 13/338,197, 13/469,031, 13/828,675, filed Dec. 27, 2011, May 10, 2012, and Mar. 14, 2013, respectively, and incorporated herein by reference in their entirety. Additional details concerning the slot of the COR feature of the golf club head 10 can be found in U.S. patent application Ser. No. 13/839,727, filed Mar. 15, 2013, and incorporated herein by reference in its entirety. Yet further details concerning the COR feature of the golf club head 10 can be found in U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

Referring to FIG. 18, the golf club head 10, in one embodiment, includes a rear weight track 30 and a COR feature in the form of a forward slot 96. The forward slot 96 allows for greater perimeter flexibility thereby maintaining and/or increasing COR across the striking face 43 of the golf club head 10. Additionally, or alternatively, toe and heel weight ports may be included in this embodiment.

According to another embodiment, as shown in FIG. 19, the golf club head includes a rear weight track 30, a forward slot 96, and a forward weight 41. The forward slot 96 enhances the COR across the striking face 43 of the golf club head 10. The forward weight 41, which can be a non-sliding weight non-movably fixed on the forward region 12 of golf club head 10, provides additional weight in the forward region 12 of the golf club head 10. The forward weight 41 overhangs the forward slot 96 in one implementation. As discussed above, the forward weight 41 can allow for a high MOI club by moving the sliding weight 32 to the rearward position, or a low and forward CG golf club by moving the sliding weight 32 to the forward position. Additionally, or alternatively, toe and heel weight ports may be included in this embodiment.

The forward slot 96 shown in FIGS. 18 and 19, may be a through-slot as discussed above and in U.S. patent application Ser. No. 13/839,727. As indicated in FIG. 20, the forward slot 96 may have a width (W), length (L), and perimeter. In some embodiments, the width of the forward slot 96 may be between about 5 mm and about 20 mm, such as between about 10 mm and about 18 mm, such as between about 12 mm and about 16 mm, or it may be larger or smaller. The length of the forward slot 96 may be between about 30 mm and about 120 mm, such as between about 50 mm and about 100 mm, such as between about 60 mm and about 90 mm, or it may be larger or smaller. Additionally, or alternatively, the length of the slot may be represented as a percentage of a length of the striking face 43. For example, the forward slot 96 may be between about 30% and about 100% of the striking face length, such as between about 50% and about 90%, or such as between about 60% and about 80% mm of the length of the striking face 43. The perimeter of the forward slot 96 may be between about 70 mm and about 280 mm, such as between about 120 mm and about 240 mm, such as between about 160 mm and about 200 mm, or it may be larger or smaller.

Referring still to FIG. 20, an offset (OS) between a vertical plane 98 intersecting the center 93 of the striking face 43 and the forward slot 96 at the same x-axis coordinate as the center 93 of the striking face 43 may be between about 5 mm and about 25 mm, such as between about 8 mm and about 18 mm, or such as between about 10 mm and about 15 mm.

The forward slot 96 may be made up of curved sections, or several segments that may be a combination of curved and straight segments. Furthermore, the forward slot 96 may be machined or cast into the head. Although shown in the sole portion 17 of the golf club head 10, the forward slot 96 may be incorporated into the crown portion 19 of the golf club head 10.

The forward slot 96 or channel may be filled with a material to prevent dirt and other debris from entering the slot or channel and possibly the cavity of the golf club head 10 when the slot is a through-slot. The filling material may be any relatively low modulus materials including polyurethane, elastomeric rubber, polymer, various rubbers, foams, and fillers. The plugging material should not substantially prevent deformation of the golf club head 10 when in use as this would counteract the perimeter flexibility.

The golf club head 10 of the present disclosure may include other features to promote the performance characteristics of the golf club head 10. For example, the golf club head 10, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 10 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 10 includes aerodynamic shape features similar to those described in more detail in U.S. Patent Application Publication No. 2013/0123040A1, the entire contents of which are incorporated herein by reference in their entirety.

In certain implementations, the golf club head 10 includes removable shaft features similar to those described in more detail in U.S. Pat. No. 8,303,431, the contents of which are incorporated by reference herein in in their entirety.

According to yet some implementations, the golf club head 10 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677, the entire contents of which are incorporated by reference herein in their entirety.

Additionally, in some implementations, the golf club head 10 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

According to certain implementations, the golf club head 10 includes variable thickness face portion features similar to those described in more detail in U.S. patent application Ser. No. 12/006,060; and U.S. Pat. Nos. 6,997,820; 6,800,038; and 6,824,475, which are incorporated herein by reference in their entirety.

In some implementations, the golf club head 10 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club, such as golf club head 10, includes one or more of the following steps: (1) forming a frame having a sole opening, forming a composite laminate sole insert, injection molding a thermoplastic composite head component over the sole insert to create a sole insert unit, and joining the sole insert unit to the frame; (2) providing a composite head component, which is a weight track capable of supporting one or more slidable weights; (3) forming a sole insert from a thermoplastic composite material having a matrix compatible for bonding with a weight track; (4) forming a sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (5) forming both a sole insert and a weight track from thermoplastic composite materials having a compatible matrix; (6) forming a sole insert from a thermosetting material, coating a sole insert with a heat activated adhesive, and forming a weight track from a thermoplastic material capable of being injection molded over the sole insert after the coating step; (7) forming a frame from a material selected from the group consisting of titanium, one or more titanium alloys, aluminum, one or more aluminum alloys, steel, one or more steel alloys, and any combination thereof; (8) forming a frame with a crown opening, forming a crown insert from a composite laminate material, and joining the crown insert to the frame such that the crown insert overlies the crown opening; (9) selecting a composite head component from the group consisting of one or more ribs to reinforce the head, one or more ribs to tune acoustic properties of the head, one or more weight ports to receive a fixed weight in a sole portion of the golf club head, one or more weight tracks to receive a slidable weight, and combinations thereof; (10) forming a sole insert and a crown insert from a continuous carbon fiber composite material; (11) forming a sole insert and a crown insert by thermosetting using materials suitable for thermosetting, and coating the sole insert with a heat activated adhesive; (12) forming a frame from titanium, titanium alloy or a combination thereof to have a crown opening, a sole insert, and a weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the frame such that the crown insert overlies the crown opening.

Additionally, or alternatively, the body 11 and/or the frame 24 may be made of from the following materials: carbon steel, stainless steel (e.g. 17-4 PH stainless steel), alloy steel, Fe—Mn—Al alloy, nickel-based ferroalloy, cast iron, super alloy steel, aluminum alloy, magnesium alloy, copper alloy, titanium alloy or mixtures thereof. The sole insert, crown insert, and/or sliding weight track may be formed of a non-metal material with a density less than about 2 g/cm$^3$, such as between about 1 g/cm$^3$ to about 2 g/cm$^3$. The nonmetal material may be preferably comprised of a polymer or polymer reinforced composite. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyetherimide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Besides, during forming the sole insert, crown insert, and/or sliding weight track, organic short fibers, such as fiberglass, carbon fiber, or metallic fiber, can be added into the engineering plastic, so as to enhance the structural strength of the sole insert, crown insert, and/or sliding weight track. Preferably, however, the reinforcements are continuous long fibers, rather than short fibers. The most preferable thermoset would be continuous long fiber graphite epoxy composite. The most preferable thermoplastics would be either PPS or PSU polymer with continuous long fiber graphite reinforcements. One of the advantages of epoxy and PSU is both are relatively stiff with relatively low damping which produces a better sounding or more metallic sounding golf club compared to other polymers which may be overdamped. Additionally, PSU requires less post processing in that it does not require a finish or paint to achieve a final finished golf club head.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure-C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S-C6H4-O—, and other thermally stable substantially-aromatic difunctional groups known in the art of engineering thermoplastics. Also included are the so called modified polysulfones where the individual aromatic rings are further substituted in one or substituents including

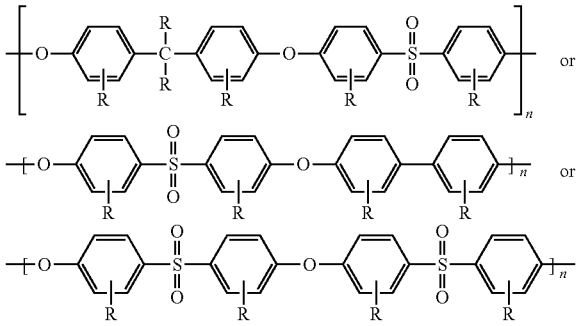

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentioned-cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

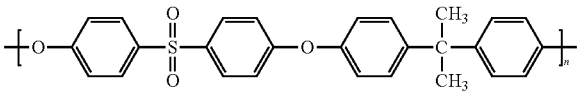

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

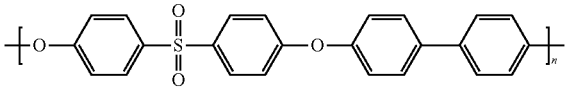

and the abbreviation PPSF and sold under the tradenames RADEL® resin; and (c) a condensation polymer made from 4,4'-dichlorodiphenyl sulfone in the presence of base and having the principle repeating structure

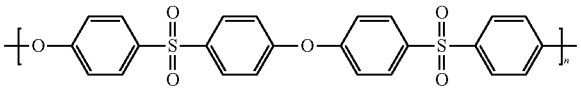

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patents application Ser. Nos. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

According to some embodiments, to use the adjustable weight systems of the golf club head 10 shown in FIGS. 1-11 and 18-20, a user will use an engagement end of a tool (such as the torque wrench) to loosen the fastening bolt of the weight assembly. Once the fastening bolt is loosened, the weight assembly may be adjusted by either sliding the weight assembly in a channel or by repositioning the weight assembly at different locations on the club head. Once the weight assembly is in the desired location, the fastening bolt may be tightened until the weight assembly is secured to the club head. In the case of a sliding weight, the weight fastening bolt may be tightened until the clamping force, between a washer and a mass member of the weight system, upon a front ledge and/or rear ledge of a weight track or channel is sufficient to restrain the weight assembly in place. In some embodiments, the golf club head may include locking projections located on the front ledge and/or rear ledge and locking notches located on the washer that cooperate to increase the locking force provided by the washer and the mass member. In other embodiments, the golf club head may include locating projections located on the front ledge and/or rear ledge and locating notches located on the washer. The locating projections or bumps are sized to have a width smaller than the width of the notches or recesses in the outer weight member or washer such that the outer weight member can move a limited amount when placed over one of the bumps. In this manner, the projections or bumps serve as markers or indices to help locate the position of the weight assembly along the channel, but do not perform a significant locking function. Instead, the weight assembly may be locked into place at a selected position along the channel by tightening the bolt.

Figure 24:
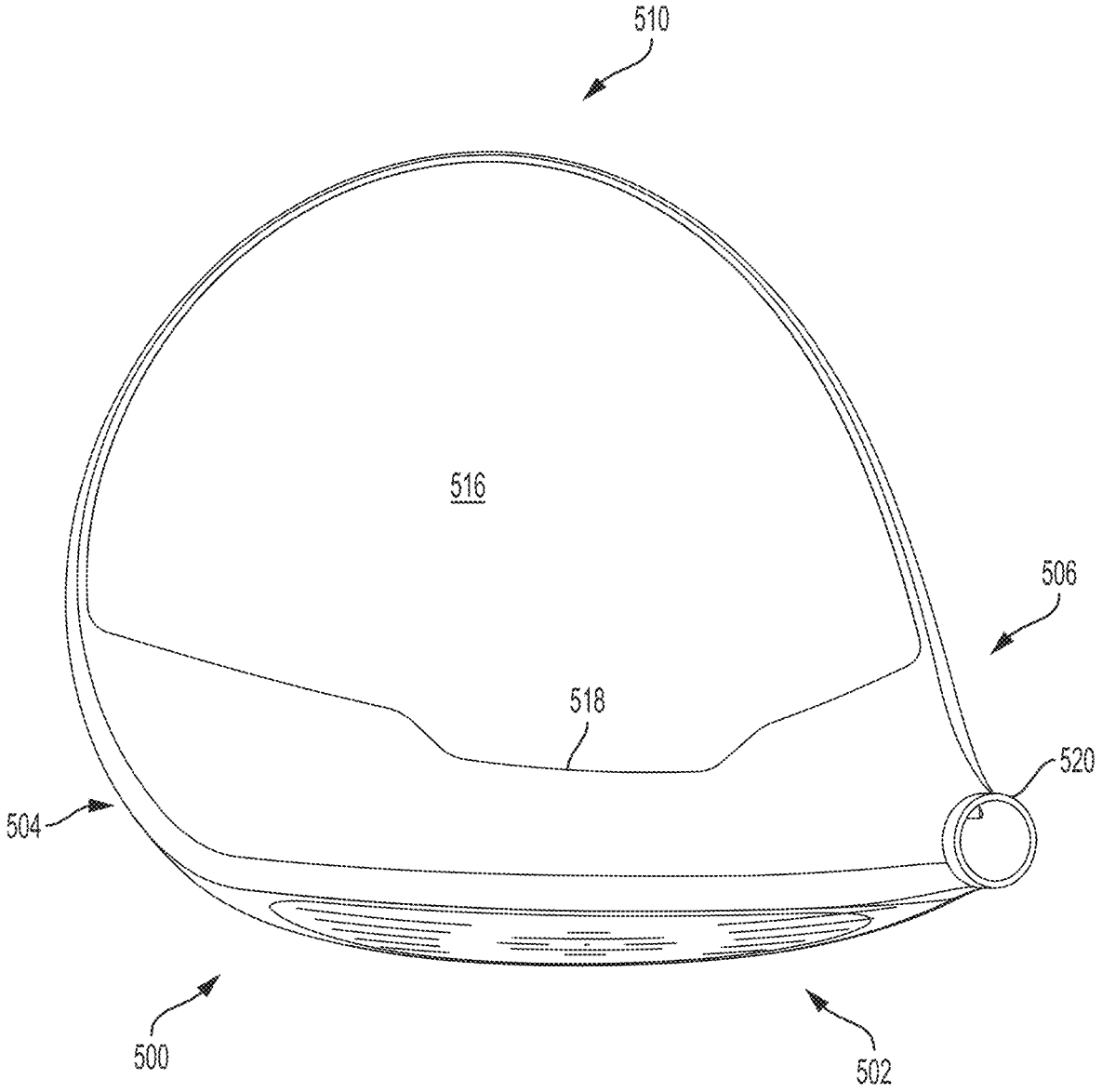
FIG. 24 is a top plan view of another golf club head, according to one or more examples of the present disclosure.
Figure 25:
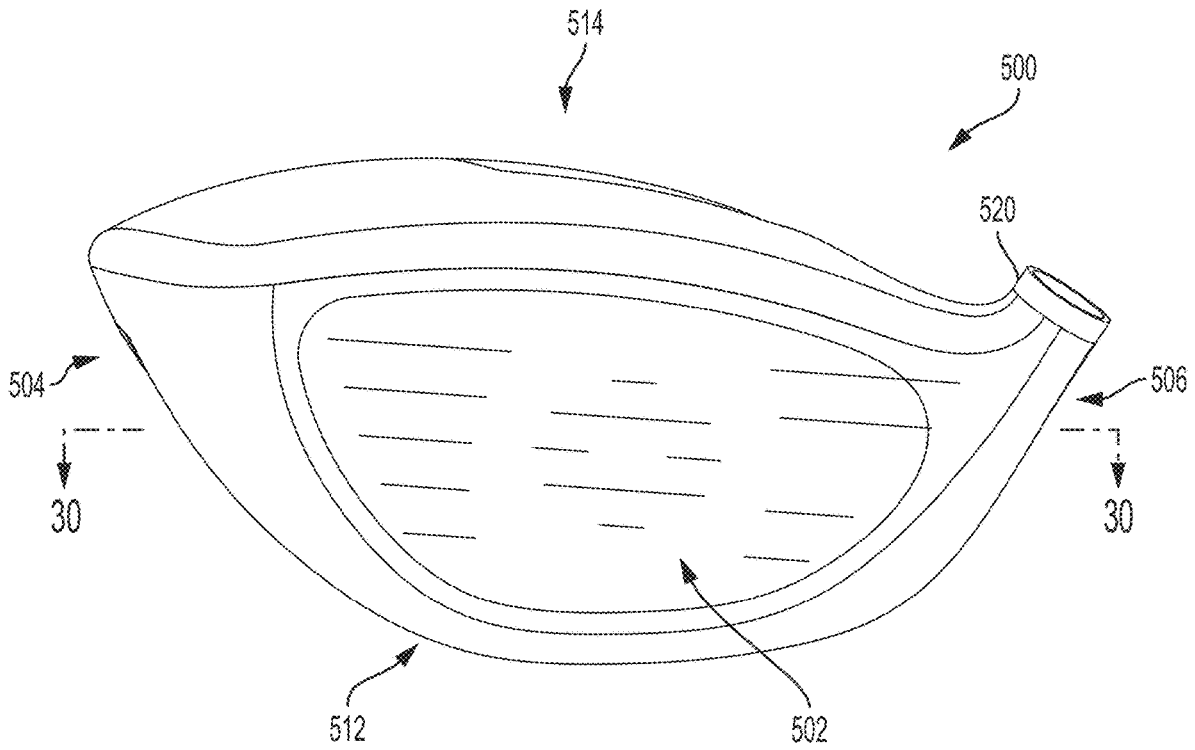
FIG. 25 is a front elevation view of the golf club head of FIG. 24, according to one or more examples of the present disclosure.

An additional embodiment of a golf club head 500 is shown in FIGS. 24-33. Referring to FIGS. 24 and 25, the head 500 includes a forward face 502, toe 504, heel 506 opposite the toe 504, and a rear or aft section 510 opposite the face 502. The head also includes a sole 512 at the bottom of the club head and crown 514 at the top, which create a surface area expanse between the toe, heel, face and aft section to form a golf club head having a generally hollow interior. The embodiment described in FIGS. 23-33 is well-suited for metal-wood type club heads, especially driver-type club heads, having a hollow interior. The volume of the club head 500 is in the range previously described and, for example, one preferred driver-type head may have a volume typical of metal-wood drivers, such as between about 375 $cm^3$ to 500 $cm^3$.

FIG. 24 further illustrates that the crown 514 includes a crown insert 516, which preferably covers a substantial portion of the crown's surface area as, for example, at least 40%, at least 60%, at least 70% or at least 80% of the crown's surface area. The crown's outer boundary generally terminates where the crown surface undergoes a significant change in radius of curvature as it transitions to the head's sole or face. In one example, the crown insert 516 is set back from the face 502 and has a forwardmost edge that generally extends between the toe and heel and defines a centrally located notch 518 which protrudes toward the face 502. The head further includes a hosel 520 on the heel side to which a golf shaft may be attached.

Figure 26:
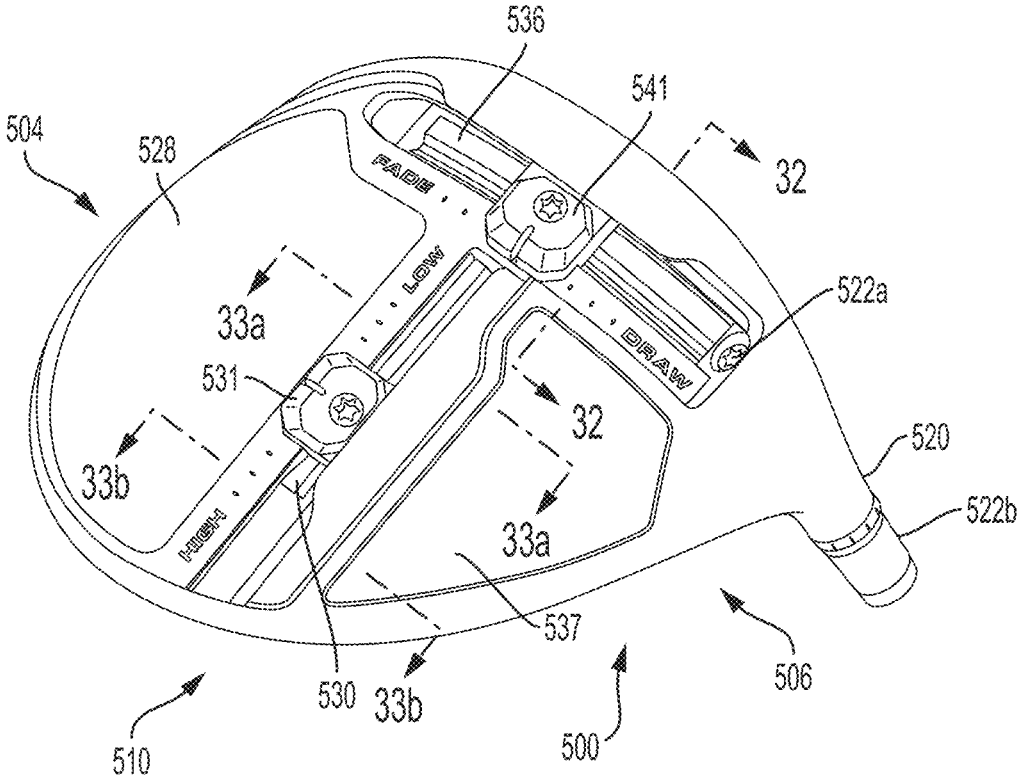
FIG. 26 is a bottom perspective view of the golf club head of FIG. 24, according to one or more examples of the present disclosure.

The bottom perspective view of FIG. 26 shows the head in one example having an adjustable FCT component 522*a*, 522*b*, as previously described, front-to-back weight track 530, and lateral weight track 536. The weight tracks 530, 536 preferably are an integral part of the frame formed by casting, metal stamping, or other known processes as described above with respect to the frame 24. The frame may be made from materials also described above with reference to frame 24 and other embodiments, but in one preferred embodiment may be made from a metal material or other material which provides a strong framework for the club head in areas of high stress. In contrast with the FIG. 2 embodiment, FIG. 26 illustrates that the sole has a heel-side portion 537 on the heel side of rear weight track 30 which may be an integral (preferably cast) part of the frame.

As described above, the lateral weight track 536 defines a track proximate and generally parallel to the face 502 for mounting one or more one-piece or multi-piece slidable weights 541. The weight(s) may be laterally adjusted in the heel-toe direction to modify the performance characteristics of the head as previously described. Similarly, the weight track 530 defines a front-to-back weight track for mounting one or more one-piece or multi-piece slidable weight(s) 531. The weight(s) 531 may be slidably adjusted fore and aft to shift the CG of the club head in the front-to-rear direction, as previously described, and thereby modify the performance characteristics of the head (especially spin characteristics and height of golf balls launched by the head). FIG. 26 also illustrates that the sole 512 includes a sole insert 528 located on a toe-side of the sole and one side of the weight track 530. The sole insert 528 (as well as the crown insert 516) may be made from a lightweight material as, for example, one of the polymers described above and in one preferred example one of the polysulfone compositions. The sole insert covers a portion of the sole's surface area as, for example, at least 10%, at least 20%, at least 40% or at least 50% of the total sole surface area, and may be located entirely on one side of the weight track 530.

Figure 27:
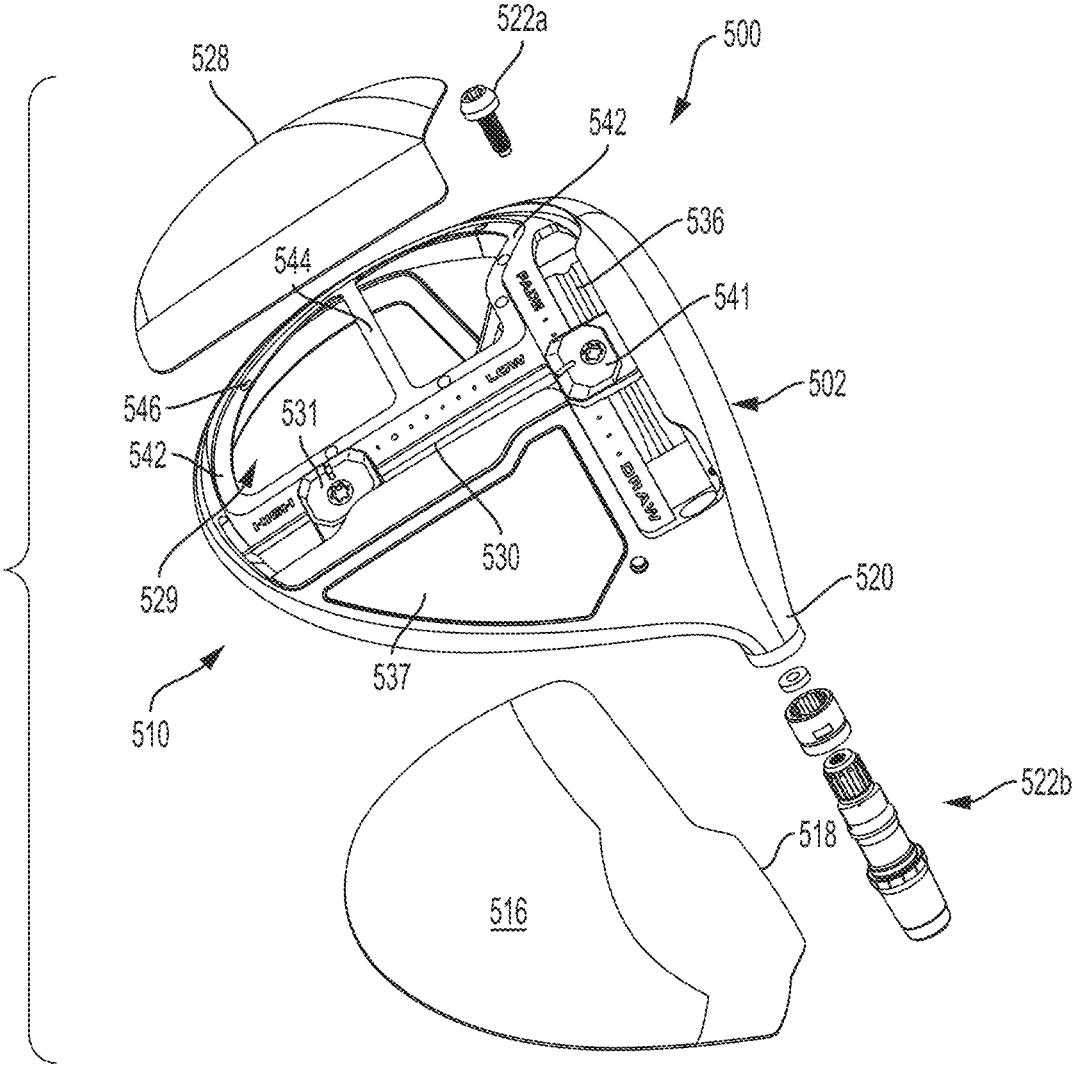
FIG. 27 is a bottom perspective exploded view of the golf club head of FIG. 24, according to one or more examples of the present disclosure.

FIG. 27 is an exploded view of the head 500 showing the crown insert 516 and sole insert 528 separated from the frame of the head. The frame provides an opening 529 in the sole which reduces the mass of the head's frame or skeletal support structure. The frame includes a recessed ledge 542 along the periphery of the opening 529, and cross-support 544 to seat and support the sole insert 528. The sole insert 528 has a geometry and size compatible with the opening 529, and may be secured to the frame by adhesion or other secure fastening technique so as to cover the opening 529. The ledge 542 may be provided with indentations 546 along its length to receive matching protrusions or bumps on the underside of the sole insert 528 to further secure and align the sole insert on the frame.

FIG. 27 provides a more detailed illustration of FCT component 522*b*, which is secured to the hosel 520 by FCT component 522*a*. Component 522*b* mounts the golf shaft to the head and may be adjustably rotated to change the orientation of the club head relative to a standard address position of the golf shaft.

Figure 28:
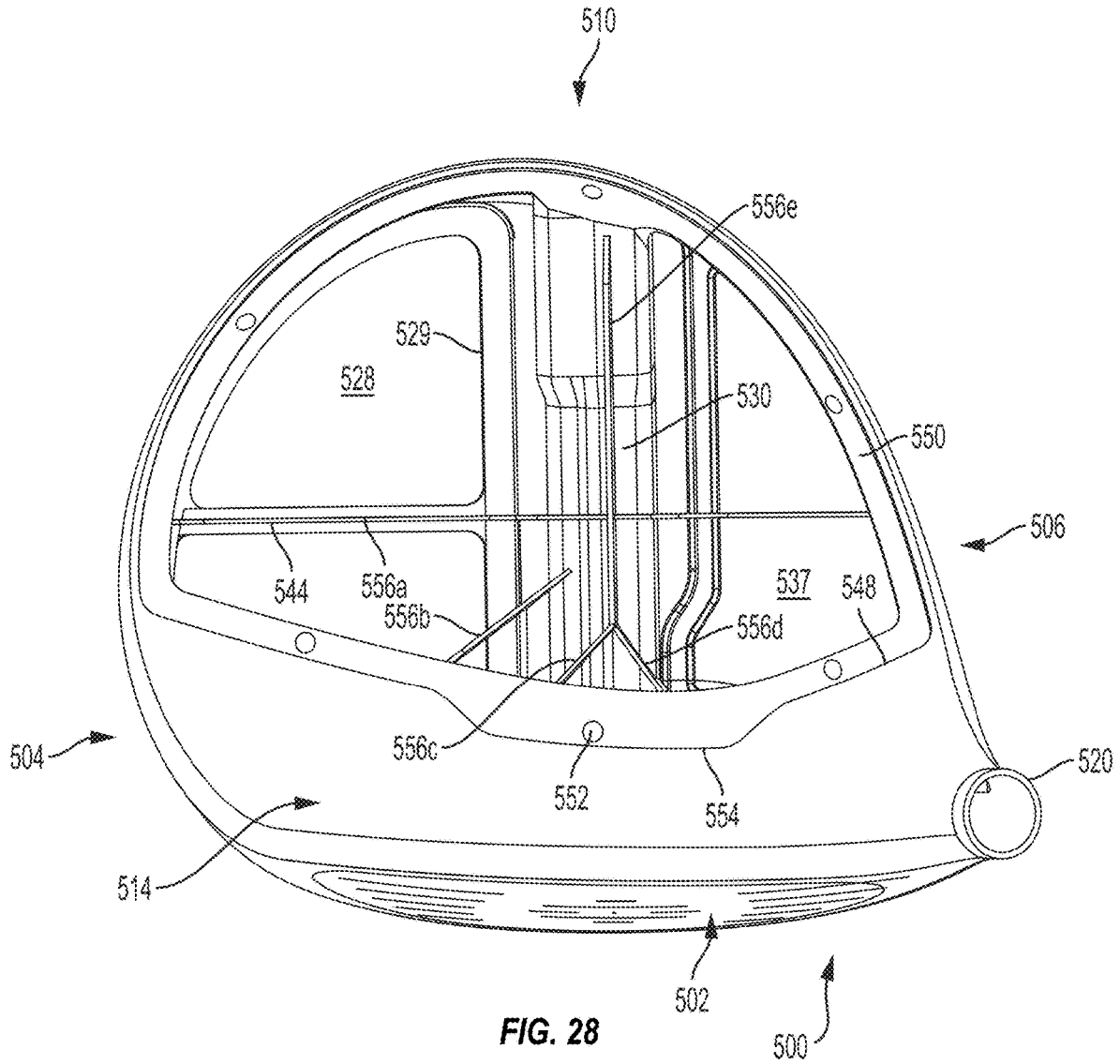
FIG. 28 is a top plan view of the golf club head of FIG. 24, shown with a crown insert removed, according to one or more examples of the present disclosure.

FIG. 28 is a top plan view of the head with the crown insert 516 removed, revealing internal structural elements of the head and its frame. Like the sole, the crown also has an opening 548 which reduces the mass of the frame, and more significantly, reduces the mass of the crown, a region of the head where increased mass has the greatest impact on raising (undesirably) the CG of the head. Along the periphery of the opening 548, the frame includes a recessed ledge 550 to seat and support the crown insert 516. The crown insert 516 (not shown in FIG. 28) has a geometry and size compatible with the crown opening 548 and may be secured to the frame by adhesion or other secure fastening technique so as to cover the opening 548. The ledge 550 may be provided with indentations 552 along its length to receive matching protrusions or bumps on the underside of the crown insert to further secure and align the crown insert on the frame. As with the sole insert, the ledge 550 alternately may be provided with protrusions to match indentations provided on the crown insert.

Typically, the ledge 550 may be made from the same metal material (e.g., titanium alloy) as the body and, therefore, can add significant mass to the golf club head 500. In some embodiments, in order to control the mass contribution of the ledge 550 to the golf club head 500, the width W can be adjusted to achieve a desired mass contribution. In some embodiments, if the ledge 550 adds too much mass to the golf club head 500, it can take away from the decreased weight benefits of a crown insert 516 made from a lighter composite material (e.g., carbon fiber or graphite). In some embodiments, the width of the ledge 550 may range from about 3 mm to about 8 mm, preferably from about 4 mm to about 7 mm, and more preferably from about 5.5 mm to about 6.5 mm. In some embodiments, the width of the ledge may be at least four times as wide as a thickness of the crown insert. In some embodiments, the thickness of the ledge 550 may range from about 0.4 mm to about 1 mm, preferably from about 0.5 mm to about 0.8 mm, and more preferably from about 0.6 mm to about 0.7 mm. In some embodiments, the depth of the ledge 550 may range from about 0.5 mm to about 1.75 mm, preferably from about 0.7 mm to about 1.2 mm, and more preferably from about 0.8 mm to about 1.1 mm. Although the ledge 550 may extend or run along the entire interface boundary between the crown insert 516 and the golf club head 500, in alternative embodiments, it may extend only partially along the interface boundary.

The periphery of opening 548 is proximate to and closely tracks the periphery of the crown on the toe-, aft-, and heel-sides of the head. The face-side of the opening 548 preferably is spaced farther from the face 502 (i.e., forward-most region of the head) than the heel-, toe- and aft-sides of the opening are spaced from the skirt of the head. In this way, the head has additional frame mass and reinforcement in the crown area just rearward of the face 502. This area and other areas adjacent to the face along the toe, heel and sole support the face and are subject to the highest impact loads and stresses due to ball strikes on the face. As previously described, the frame may be made of a wide range of materials, including high strength titanium, titanium alloys, or other metals. The opening 548 has a notch 554 which matingly corresponds to the crown insert notch 518 to help align and seat the crown insert on the crown.

FIG. 28 also illustrates sole insert opening 529, interior surface of sole insert 528, cross support 544, interior surface of front-to-back weight track 530, and interior surface of the heel-side sole portion 537. Various ribs 556*a, b, c, d, e, f* are shown located in the interior of the head to provide structural reinforcement and acoustic-modifying elements.

Figure 29:
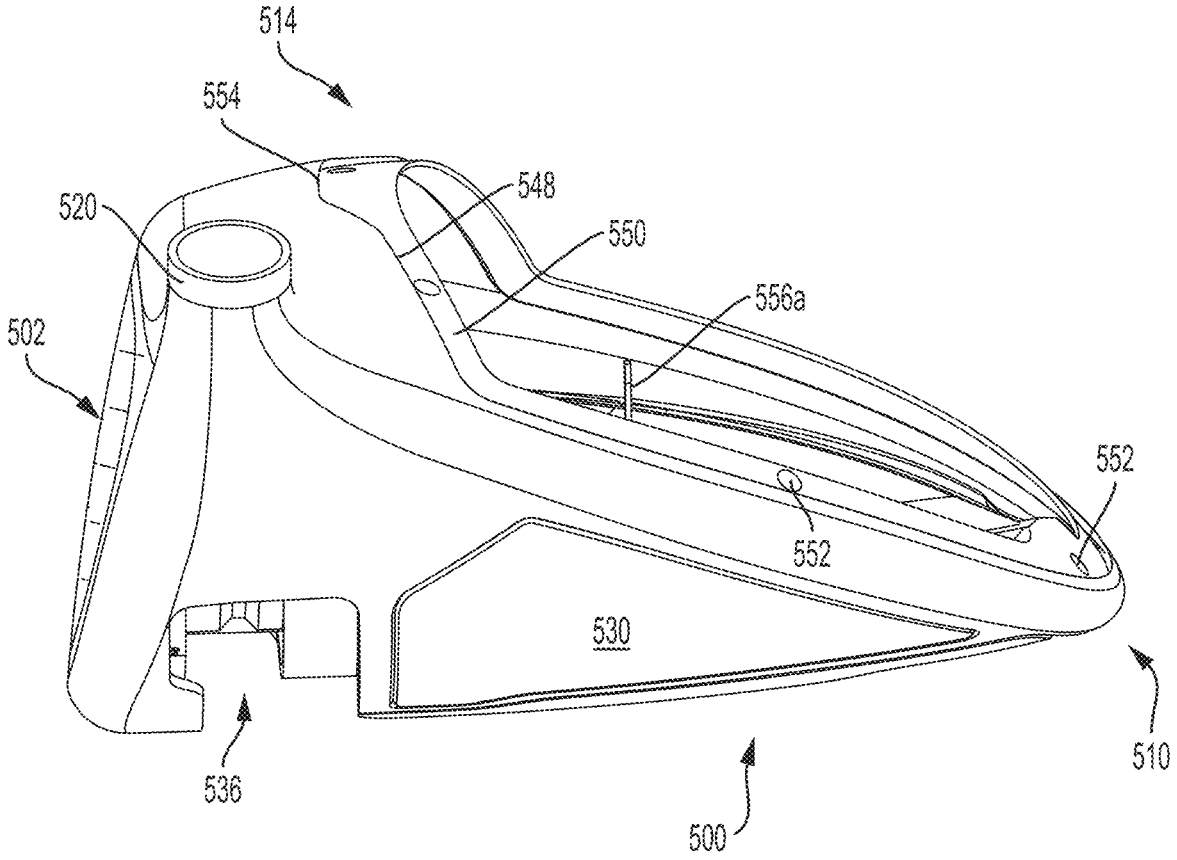
FIG. 29 is a side elevation view of the golf club head of FIG. 24, shown with the crown insert removed, according to one or more examples of the present disclosure.

FIG. 29 is a side elevation view with the crown insert removed. It illustrates how the sole wraps upon the heel-side of the head to meet the crown 514 at the skirt interface between the sole and crown. The crown opening 548 is shown encompassing a substantial portion of the surface area of the crown, such as well over 50% of the crown's surface area in the illustrated example.

Figure 30:
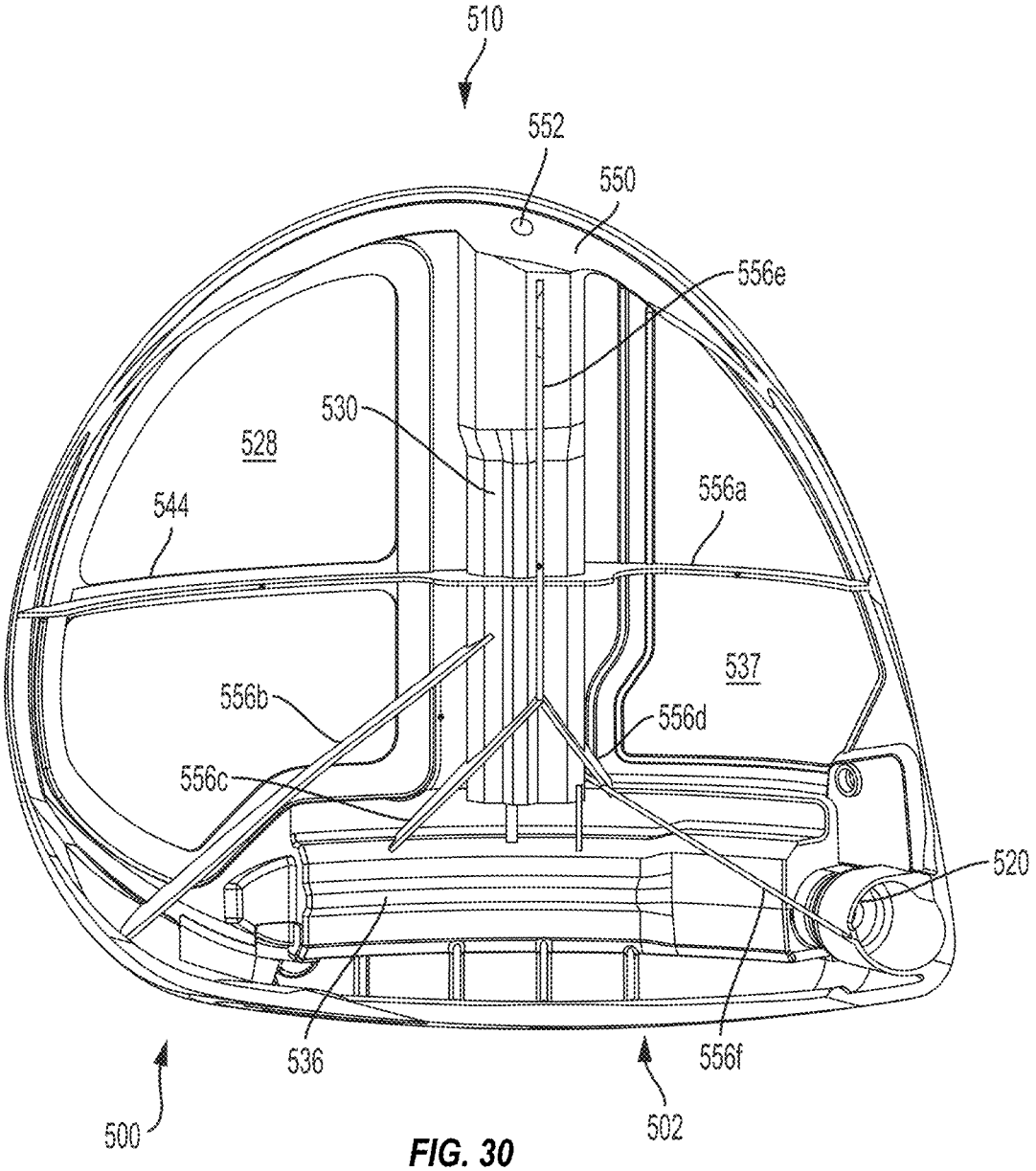
FIG. 30 is a cross-sectional top plan view of the golf club head of FIG. 24 taken along line 30-30 of FIG. 25, according to one or more examples of the present disclosure.

FIG. 30 is a horizontal cross-section of the club, below the level of the crown, showing some of the internal structure apparent in FIG. 28 but in more detail. Cross rib 556 spans the internal width of the head from toe to heel and braces weight track 530. Rib 556*e* extends in the fore-to-aft direction and may be secured to a top interior surface of weight track 530. Diagonal ribs 556*c, d* are secured at opposite ends to the weight tracks 530, 536. An additional rib 556*f* is shown joined to the hosel 520 at one end and to the weight track 530 at the other end.

Figure 31:
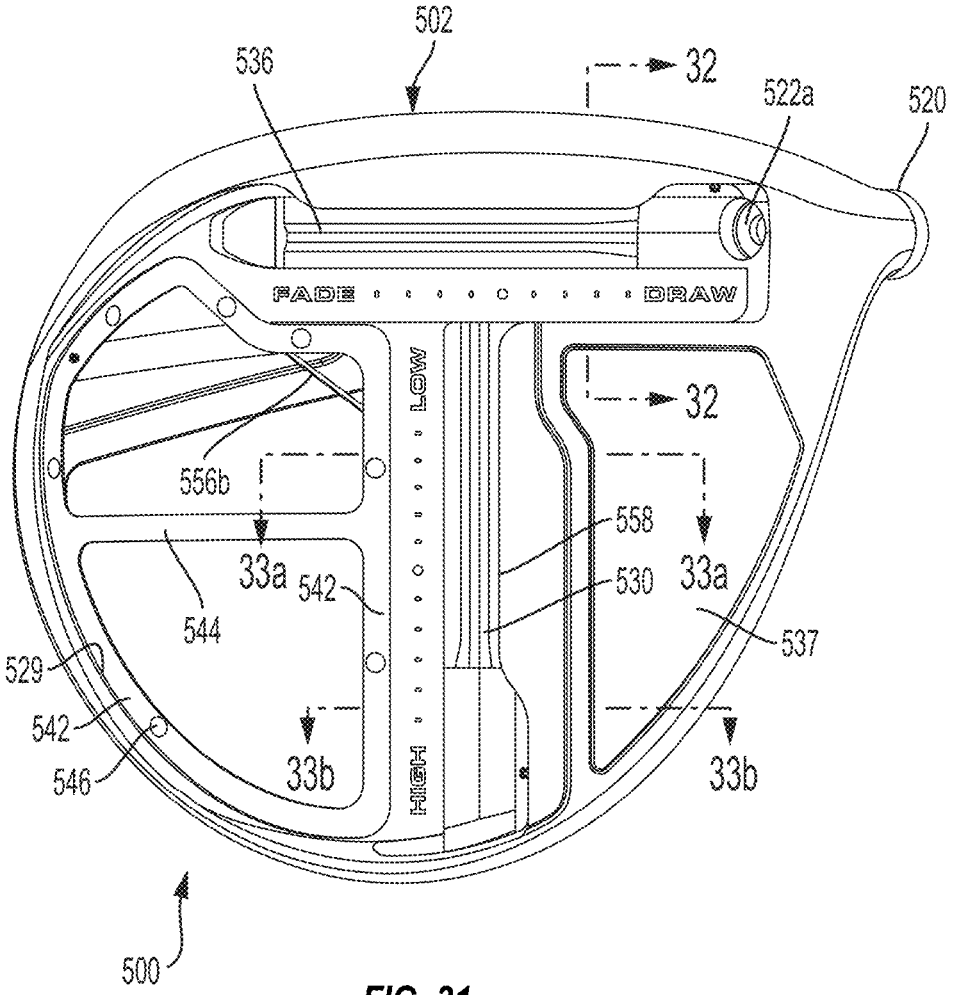
FIG. 31 is a bottom plan view of the golf club head of FIG. 24, shown with a sole insert panel removed, according to one or more examples of the present disclosure.

FIG. 31 is a bottom plan view of the head with the sole insert removed. With reference to FIGS. 26 and 31, and explained further below, the sole of the present embodiment is a two tier or drop sole construction, in which one portion of the sole is dropped or raised, depending on perspective, relative to the other portion of the sole. The sole insert 528 on the toe-side of the weight track 530 is raised (when the club head is in the address position) relative to the heel-side portion 537 of the sole. The heel-side portion 537 also can be considered a drop sole part of the sole, since it is dropped or closer to the ground when the club head is in the address position. The heel-side portion 537 has an edge or portion 558 which extends over or overhangs a portion of the weight track 530. Though the front-to-back weight(s) are not shown in FIG. 31, it will be appreciated that the overhang portion 558 helps to capture the weight(s) in the weight track 530 by providing a narrow opening or channel through which the weights may be inserted into or removed from the weight track. At the same time, the weight(s) are free to be slidably moved and re-set in the weight track by loosening and then tightening the adjustment screw (see FIG. 26) which secures the weight(s) to the weight track.

Figure 32:
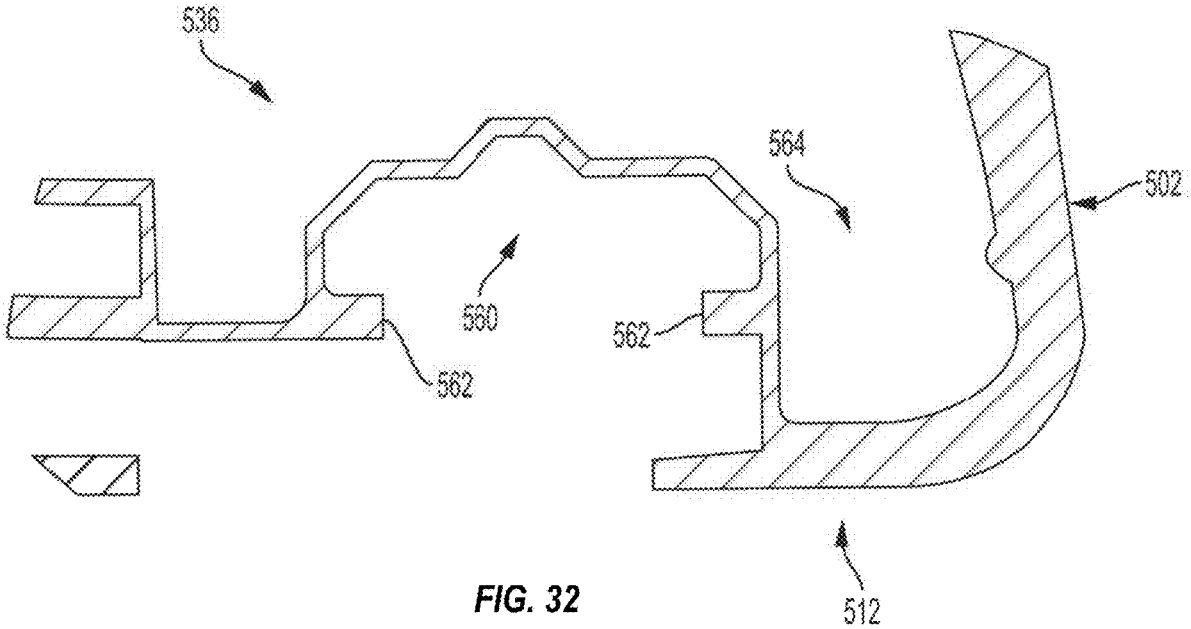
FIG. 32 is a cross-sectional view of a detail of a side-to-side weight track of the golf club head of FIG. 24 taken along line 32-32 of FIG. 31, according to one or more examples of the present disclosure.

FIG. 32 is a fore-aft vertical cross-section of lateral weight track 536 taken along line 32-32 of FIG. 31. The weight track 536 includes a laterally (heel-toe) extending channel 560 to receive one or more compatibly shaped one-piece or multi-piece weights (not shown) for adjustable sliding movement in the heel-toe direction. Opposing rails or lips 562 help retain the weight(s) in the channel. The weight track extends generally parallel and proximate to the face 502 but preferably is set back from the face by a laterally extending recess 564.

Figure 33A:
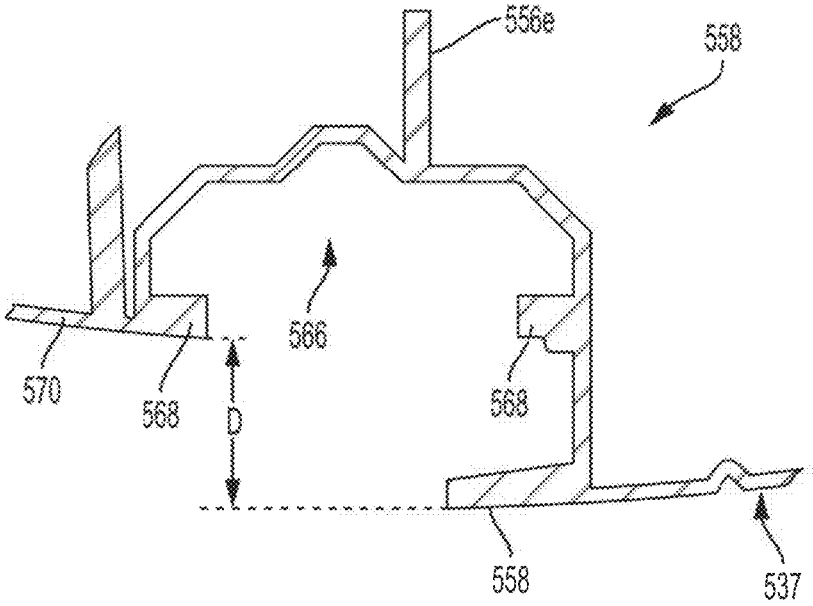
FIGS. 33*a* and 33*b* are cross-sectional views of details of the golf club head of FIG. 24 taken along line 33*a*-33*a* and line 33*b*-33*b*, respectively, of FIG. 31, according to one or more examples of the present disclosure.
Figure 33B:
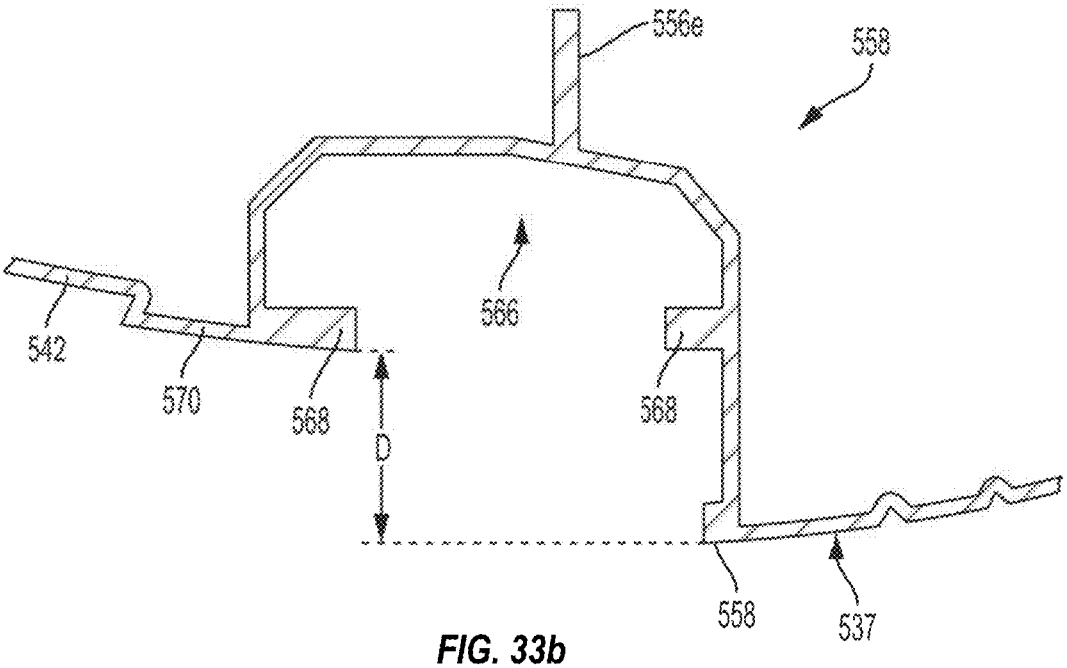

FIGS. 33*a* and 33*b* are lateral cross-sections of fore-aft weight track 558 taken along different vertical planes, represented by lines 33*a*-33*a* and 33*b*-33*b* in FIG. 31. The weight track 558 includes a fore-aft (or front-rear) extending channel 566 to receive one or more compatibly shaped one-piece or multi-piece weights (not shown) for adjustable sliding movement in the fore-aft or front-back direction. Like track 536, the track 558 includes opposing rails or lips 568 to retain and guide the weights (when adjusted) in the channel. In this regard, each weight has portions (in a one-piece construction) or different pieces (in a multi-piece weight) seated on each side of the rails 568. Thus, the rails retain or seat the weight(s) while allowing the weight(s) to slide within the track when a securing fastener is loosened.

In FIG. 33*a* it can be seen that the overhang portion 558 of the heel-side sole portion 537 extends over or overhangs the channel 566 to restrict the mouth of the channel and help retain the weight(s) within the channel. FIGS. 31 and 33*b* illustrate that the overhang portion 558 tapers or narrows as it approaches the aft portion of the sole, such that the heel-side sole portion's amount of overhang or cantilevering over the channel 566 is much smaller than is the case in FIG. 33*a* (where the channel 566 is closer to the face).

The head's sole has a centrally-located fore-aft extending section 570 adjacent the weight track 558, which may be marked with weight track indicia (such as "high" to "low" ball flight) as shown in FIG. 31. The section 570 may sit flush with the sole insert 528 and be formed as an integral part of the head frame. As shown in FIG. 33*b*, the sole section 570 terminates at the sole insert receiving ledge 542.

Referring to FIGS. 33*a* and 33*b*, the sole area on the heel side (represented by heel-side sole portion 537) is lower than the sole area on the toe side (represented by section 570 and sole insert 528 (FIG. 26)) by a distance "D" when the head is in the address position relative to a ground plane. The head has a "drop sole" construction with a portion of the sole dropped (preferably on the heel side) relative to another portion of the sole (preferably on the toe side). Put another way, a portion of the sole (e.g., toe side) is raised relative to another portion of the sole (e.g., heel side).

In one embodiment, the drop distance "D" may be in the range of about 2-12 mm, preferably about 3-9 mm, more preferably about 4-7 mm, and most preferably about 4.5-6.5 mm. In one example, the drop distance "D" may be about 5.5 mm.

The bi-level or drop sole described is counterintuitive because the raised portion of the sole is tends to raise the CG of the club, which generally is disadvantageous. However, by using a sole insert made of a relatively light material such as composite material or other polymeric material (polysulfone for example), the higher CG effect is mitigated while maintaining a stronger, heavier material on the heel side of the sole to promote a lower CG and provide added strength in the area of the sole where it is most needed (i.e., in a sole region proximate to the hosel, shaft connection and FCT components where stress is high). Additionally, the drop sole allows for a smaller radius for a portion of the sole resulting in better acoustic properties due to the increased stiffness from the geometry. This stiffness increase means fewer ribs or even no ribs are needed to achieve a first mode frequency at 3400 Hz or above. Fewer ribs provides a weight savings which allows for more discretionary mass that can be strategically placed elsewhere in the club head or incorporated into a user adjustable movable weight.

Table 8 below lists various parameters of interest, according to certain embodiments of the golf club head 10, including assembly mass or total mass of the golf club head 10, mass of the golf club head 10 above half of the head height, projected area above half of the head height or projected area of the cut body 11, and mass of the golf club head 10 above half of the head height divided by the projected area above half of the head height. The total mass of the golf club head 10 includes the hosel, or if applicable shaft sleeve, any weights or other attached features, but not the shaft or grip.

TABLE 8

| | Comp. crown + comp. sole panels | Comp. crown + comp. heel and toe sole panels | Comp. crown + comp. toe sole panel | Composite crown + Ti sole | Comp. crown + Ti sole | Comp. crown + Ti sole |
|---|---|---|---|---|---|---|
| Golf Club Head mass (grams) | 199 | 206 | 205 | 204.2 | 200 | 199 |
| Mass above half head height (grams) | 65.2 | 73.5 | 70.9 | 70 | 76.8 | 77 |
| % mass above half head height | 32.8% | 35.7% | 34.6% | 34.3% | 38.4% | 38.7% |
| Projected area above half head height ($mm^2$) | 10693 | 11997 | 11213 | 10705 | 11376 | 10867 |
| CGX of mass above half head height (mm) | 0.9 | −1.2 | 0.1 | 2.9 | −0.7 | 3.6 |
| CGY of mass above half head height (mm) | 18.5 | 25.1 | 21.7 | 20.6 | 20.7 | 20.5 |
| CGZ of mass above half head height (mm) | 14.4 | 14.4 | 15.3 | 14.4 | 14.7 | 15 |
| mass/projected area (grams/$mm^2$) | 0.00610 | 0.00613 | 0.00632 | 0.00654 | 0.00675 | 0.00709 |
| (mass/projected area)*(CGz of mass above half head height) (grams/mm) | 0.088 | 0.088 | 0.097 | 0.094 | 0.099 | 0.106 |
| Zup-0.5 $H_{PCH}$ of Golf Club Head (mm) | −9.1 to −7.9 | −8.5 to −7.2 | −7.9 to −7.2 | −7.6 to −6.8 | −5.75 | −6.3 |
| Delta 1 of Golf Club Head (mm) | 9.6 to 28.1 | 17.8 to 24.9 | 14.0 to 23.1 | 13.1 to 15.3 | 24.6 | 21 |
| Ixx of Golf Club Head (kg-$mm^2$) | 225 to 409 | 295 to 365 | 243 to 358 | 235 to 263 | 283 | 308 |
| Izz of Golf Club Head (kg-$mm^2$) | 347 to 543 | 419 to 510 | 386 to 502 | 398 to 442 | 564 | 493 |
| CG Proj-0.5 $H_{PCH}$ of Golf Club Head (mm) | −4.7 to −0.3 | −4.0 to −0.5 | −3.0 to −0.4 | −2.7 to −1.7 | 1.3 | −0.5 |

Figure 34:
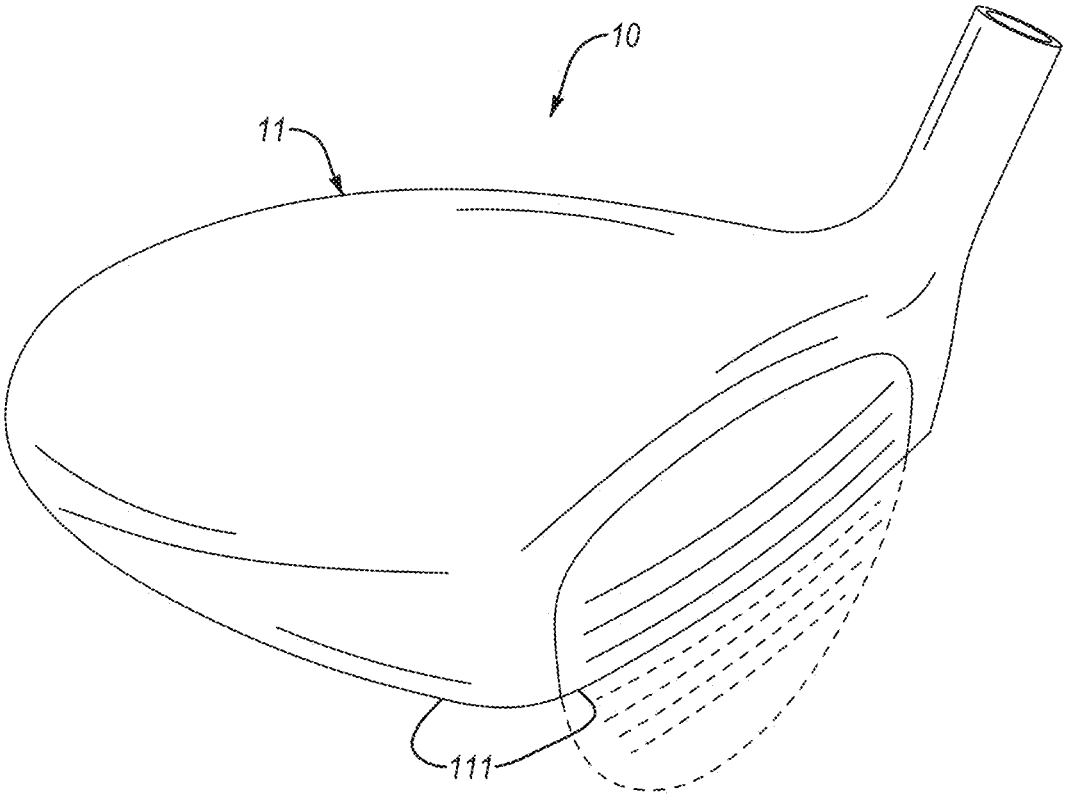
FIG. 34 is a perspective view from a top of a golf club head with the portion of the golf club head below half of the golf club head height removed, according to one or more examples of the present disclosure.
Figure 35:
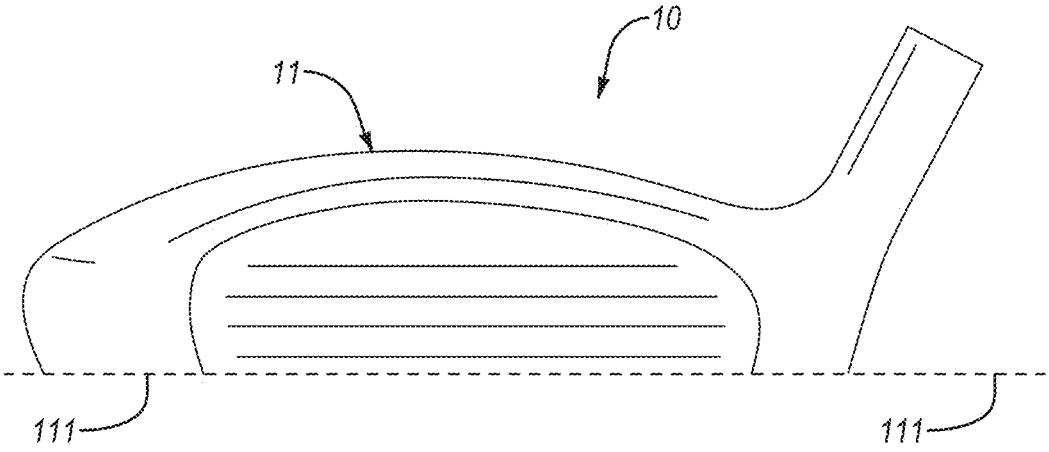
FIG. 35 is a front elevation view of the golf club head of FIG. 34, according to one or more examples of the present disclosure.

Referring to FIGS. 34 and 35, to obtain mass of the golf club head 10 above half of the head height, the club head 10 is first oriented in the address position at a 60 degree lie angle with a square face, then any portion of the club head that is below half of the head height is removed (e.g., cut away to create cut edge 111 in body 11) and the remaining portion of the club head is weighed, which is the mass above half of the head height. The following description may help to better understand the procedure for removing portions of the club head 10 below half of the club head height. First, one may create a half head height plane 113 that is horizontal and parallel to a ground plane at half of the club head height, and then one may remove any portion of the golf club head 10 that is below the half head height plane 113. Head height can be found using the USGA method or can be found by finding the lowest point on the sole and highest point on the crown when the golf club head 10 is oriented at a 60 degree lie angle with a square face. Either method should result in a similar head height, and correspondingly a half head height. FIG. 34 shows a golf club head 10 in the proper orientation i.e. 60 degree lie angle and square face (90 degrees) with the mass below half of the club head height removed.

The projected area of the cut body 11 is captured by projecting the area of the cut body 11 onto an x-y plane i.e. a horizontal plane that is perpendicular to the z-axis. The projected area can be calculated by using a digital image of the cut body as taken from directly above the cut body 11, or it can be calculated using a computer aided design program if a model of the golf club head 10 exists. The ratio of the mass of the golf club head 10 above half of the head height relative to the projected area above half of the head height is easily calculated by dividing the above parameters.

The embodiments of the club head 10 shown in Table 8 are of similar construction to the various embodiments of the golf club head 10 described herein. Additionally, similar to the embodiments of the golf club head 10 described herein, some of the embodiments of the club head 10 in Table 8 have sliding weight tracks to make a highly adjustable and customizable golf club head, while others use the discretionary mass that otherwise would be tied up in the weight tracks and weights to create a highly forgiving golf club head that maximizes MOI about the x-axis and z-axis while maintaining good CG properties. Where a range of values are given, this indicates that the golf club head 10 has at least one sliding weight track. Some embodiments include all titanium bodies, other embodiments have a composite crown insert or panel with a titanium main body, other embodiments have a composite crown insert with a titanium main body including a composite toe panel on the sole, other embodiments have a composite crown insert with a titanium main body including a composite toe panel and a composite heel panel on the sole, and still other embodiments have a composite crown insert and a composite sole insert with the rest of the body being primarily titanium. The composite inserts or panels have a density between 1 g/cc and 2 g/cc, while the titanium body has a density of about 4.5 g/cc.

Table 8 above illustrates how placement of discretionary mass (e.g., front mass and back mass) can be used to alter various club head parameters including CGx, Delta 1, Ixx, Izz, CG projection-0.5$H_{PCH}$, and Zup-0.5$H_{PCH}$. Additionally, various parameters are provided for the mass of the cut body 11 above half of the club head height. Notably, the mass above half head height may range from about 65.2 grams to about 77 grams, such as between about 65.2 grams and about 75 grams, such as between about 70 grams and about 75 grams, or such as between about 70 grams and about 74 grams. Additionally, the mass above half head may be less than about 77 grams, such as less than about 76 grams, such as less than about 75 grams, or such as less than about 74 grams.

Moreover, the percentage of mass above half head relative to the total club head mass may be less than about 39%, such as less than about 38%, such as less than about 37%, such as less than about 36%, such as less than about 35%, or such as less than about 34%. Additionally or alternatively, the percentage of mass above half head relative to the total club head mass may be between 32% and 39%, such as between 32% and 38%, such as between 34% and 38%, or such as between 34% and 39%. Furthermore, the percentage of mass above half head relative to the total club head mass may be less than 39% in combination with the mass above half head relative to the projected area above half head height between about 0.006 grams/mm$^2$ and about 0.0071 grams/mm$^2$, such as between about 0.006 grams/mm$^2$ and about 0.0068 grams/mm$^2$. In some embodiments, the mass above half head relative to the projected area above half head height may be less than 0.0071 grams/mm$^2$, such as less than 0.0070 grams/mm$^2$, such as less than 0.0069 grams/mm$^2$, or such as less than 0.0068 grams/mm$^2$. The various parameters described above relative half head height are indicator that a majority of the club head mass is located below half the club head height, which allows for better club head properties.

In some embodiments, the golf club head 10 has a Delta 1 greater than about 9.0 mm and less than about 30 mm, such as between about 11 mm and about 27 mm, such as between about 13 mm and about 25 mm, or such as between about 15 mm and about 23 mm. In some embodiments, the golf club head 10 has at least one movable weight (e.g., back mass) that can be moved from the front of the golf club head 10 to the rear of the golf club head 10 using either front and rear weight ports or a sliding weight track allowing for a Max change (Max Δ) in Delta 1 that may be greater than 2 mm, such as greater than 3 mm, such as greater than 4 mm, such as greater than 5 mm, such as greater than 6 mm, such as greater than 7 mm, or such as greater than 8 mm. In some embodiments, the golf club head 10 has at least one movable weight that can be moved from the front of the golf club to the rear of the golf club using either front and rear weight ports or a sliding weight track allowing for a Max Δ Delta 1 from a first weight position to a second weight position that may be between 1.7 mm and 18.5 mm, such as between 2 mm and 6 mm, or such as between about 2.5 mm and about 5 mm. As illustrated by Table 8, several other ranges are possible to achieve.

Another important relationship is the ratio of Ixx to Izz. Generally, it is desirable to have the ratio of Ixx to Izz be at least 0.55. As shown in Table 8, the various embodiments of the golf club head 10 were able to achieve a higher ratio than this. As shown, Ixx/Izz may be at least 0.59, such as at least 0.62, such as at least 0.65, such as at least 0.68, such as at least 0.71, or such as at least 0.74. Generally, it is desirable to have Ixx be at least 200 kg-mm$^2$ and preferably at least 250 kg-mm$^2$, and Izz be at least 350 kg-mm$^2$ and preferably at least 400 kg-mm$^2$. As shown in Table 8, the various embodiments were able to achieve a higher moment of inertia values than this. As shown, Ixx may be at least 225 kg-mm$^2$, such as at least 250 kg-mm$^2$, such as at least 275 kg-mm$^2$, such as at least 300 kg-mm$^2$, such as at least 325 kg-mm$^2$, such as at least 350 kg-mm$^2$, such as at least 375 kg-mm$^2$, such as at least 390 kg-mm$^2$, or such as at least 400 kg-mm$^2$. Similarly, as shown in Table 8 Izz may be at least 325 kg-mm$^2$, such as at least 350 kg-mm$^2$, such as at least 375 kg-mm$^2$, such as at least 400 kg-mm$^2$, such as at least 425 kg-mm$^2$, such as at least 450 kg-mm$^2$, such as at least 475 kg-mm$^2$, such as at least 490 kg-mm$^2$, or such as at least 510 kg-mm$^2$.

As shown in Table 8 and described above, the various embodiments of the golf club head 10 were able to achieve a Zup relative to half head height of less than at least −5.75 mm, such as less than at least −6.0 mm, such as less than at least −6.25 mm, such as less than at least −6.5 mm, such as less than at least −6.75 mm, such as less than at least −7.0 mm, such as less than at least −7.25 mm, such as less than at least −7.50 mm, such as less than at least −7.75 mm, such as less than at least −8.0 mm, such as less than at least −8.25 mm, such as less than at least −8.50 mm, such as less than at least −8.75 mm, or such as less than at least −9.0 mm. As shown in Table 8, the various embodiments of the golf club head 10 were able to achieve a CG projection relative to half head height of less than at least 0.5 mm, such as less than at least 0.0 mm, such as less than at least −0.50 mm, such as less than at least −0.75 mm, such as less than at least −1.0 mm, such as less than at least −1.25 mm, such as less than at least −1.50 mm, such as less than at least −1.75 mm, such as less than at least −2.0 mm, such as less than at least −2.25 mm, such as less than at least −2.5 mm, such as less than at least −2.75 mm, such as less than at least −3.0 mm, such as less than at least −3.25 mm, such as less than at least −3.5 mm, such as less than at least −3.75 mm, such as less than at least −4.0 mm, such as less than at least −4.25 mm, or such as less than at least −4.5 mm.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell of the golf club head 10 may be made of a composite material, such as, for example, a carbon fiber reinforced epoxy, carbon fiber reinforced polymer, or a polymer. Additionally, U.S. patent application Ser. Nos. 10/316,453 and 10/634,023 describe golf club heads with lightweight crowns. Furthermore, U.S. patent application Ser. No. 12/974,437 (now U.S. Pat. No. 8,608,591) describes golf club heads with lightweight crowns and soles.

In some embodiments, composite materials used to construct the crown and/or should exhibit high strength and rigidity over a broad temperature range as well as good wear and abrasion behavior and be resistant to stress cracking. Such properties include (1) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039); (2) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039); (3) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790); and (4) a Flexural Modulus at room temperature of from about 0.4 Msi to about 21 Msi, from about 0.5 Msi to about 20 Msi, more preferably of from about 10 Msi to about 19 Msi (as measured by ASTM D 790).

In certain embodiments, composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. Crown and/or sole panels may be formed of plies of composite material having a fiber areal weight of between 20 $g/m^2$ and 200 $g/m^2$. However, FAW values below 100 $g/m^2$, and more desirably 75 $g/m^2$ or less, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Some of the embodiments of the golf club head 10 discussed throughout this application may include a separate crown, sole, and/or face that may be a composite, such as, for example, a carbon fiber reinforced epoxy, carbon fiber reinforced polymer, or a polymer crown, sole, and/or face. Alternatively, the crown, sole, and/or face may be made from a less dense material, such as, for example, Titanium or Aluminum. A portion of the crown may be cast from either steel (~7.8-8.05 $g/cm^3$) or titanium (~4.43 $g/cm^3$) while a majority of the crown may be made from a less dense material, such as for example, a material having a density of about 1.5 $g/cm^3$ or some other material having a density less than about 4.43 $g/cm^3$. In other words, the crown could be some other metal or a composite. Additionally or alternatively, the face may be welded in place rather than cast as part of the sole.

By making the crown, sole, and/or face out of a less dense material, it may allow for weight to be redistributed from the crown, sole, and/or face to other areas of the club head, such as, for example, low and forward and/or low and back. Both low and forward and low and back may be possible for club heads incorporating a front to back sliding weight track.

U.S. Pat. No. 8,163,119 discloses composite articles and methods for making composite articles, which is incorporated by reference herein in the entirety. U.S. Pat. Pub. Nos. 2015/0038262 and 2016/0001146 disclose various composite crown constructions that may be used for golf club heads, which are incorporated by reference herein in their entireties. The techniques and layups described in U.S. Pat. No. 8,163,119, U.S. Pat. Pub. No. 2015/0038262 and U.S. Pat. Pub. No. 2016/0001146 may be employed for constructing a composite crown panel, composite sole panel, composite toe panel located on the sole, and/or composite heel panel located on the sole.

U.S. Pat. No. 8,163,119 discloses the usual number of layers for a striking plate is substantial, e.g., fifty or more. However, improvements have been made in the art such that the layers may be decreased to between 30 and 50 layers. Additionally, for a panel located on the sole and/or crown the layers can be substantially decreased down to three, four, five, six, seven, or more layers.

Table 9 below provides examples of possible layups. These layups show possible crown and/or sole construction using unidirectional plies unless noted as woven plies. The construction shown is for a quasi-isotropic layup. A single layer ply has a thickness ranging from about 0.065 mm to about 0.080 mm for a standard FAW of 70 g/m$^2$ with about 36% to about 40% resin content, however the crown and/or sole panels may be formed of plies of composite material having a fiber areal weight of between 20 g/m$^2$ and 200 g/m$^2$. The thickness of each individual ply may be altered by adjusting either the FAW or the resin content, and therefore the thickness of the entire layup may be altered by adjusting these parameters.

TABLE 9

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | 45 | 0/90 woven | | | 590-720 |
| 90 | 0 | 45 | −45 | 45 | 90/0 woven | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the golf club head 10 may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the golf club head 10. The thin walled titanium construction increases the manufacturing difficulty and ultimately fewer parts are cast at a time. In the past, 100+ golf club heads could be cast at a single time, however due to the thinner wall construction fewer golf club heads are cast per cluster to achieve the desired combination of high yield and low material usage.

An important strategy for obtaining more discretionary mass is to reduce the wall thickness of the golf club head 10. For a typical titanium-alloy "metal-wood" club-head having a volume of 460 cm$^3$ (i.e., a driver) and a crown area of 100 cm$^2$, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

For example, the crown may be formed of plies of composite material having a fiber areal weight of between 20 g/m$^2$ and 200 g/m$^2$. The weight of the composite crown being at least 20% less than the weight of a similar sized piece formed of the metal of the body. The composite crown may be formed of at least four plies of uni-tape standard modulus graphite, the plies of uni-tape oriented at any combination of 0°, +45°, −45° and 90°. Additionally or alternatively, the crown may include an outermost layer of a woven graphite cloth.

Figure 37A:
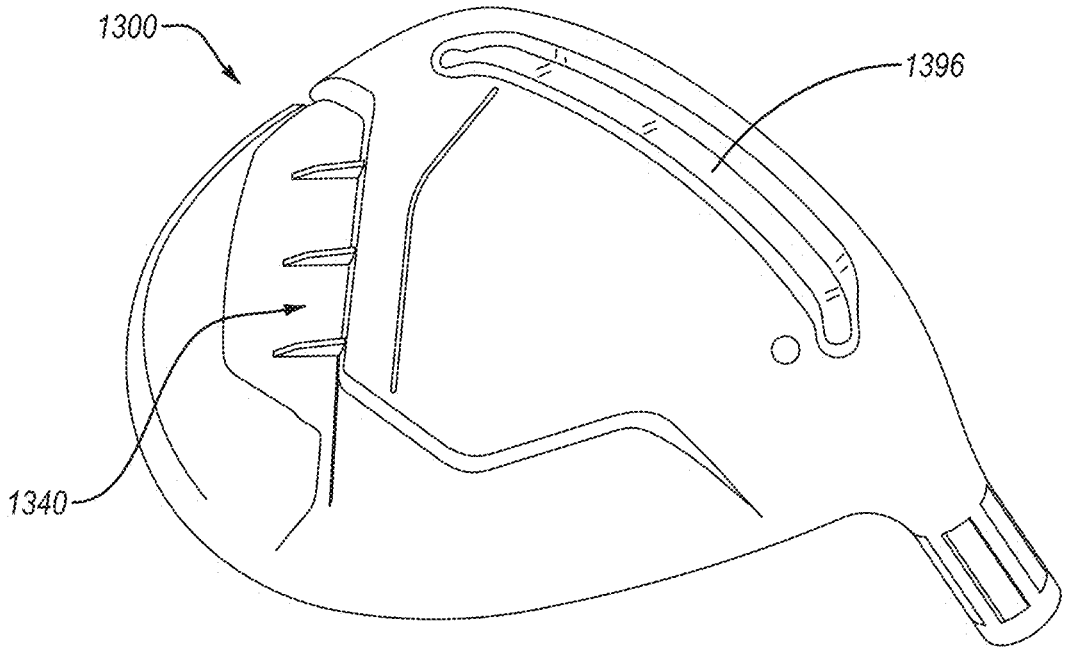
FIG. 37A is a perspective view from a bottom of another golf club head, according to one or more examples of the present disclosure.
Figure 37B:
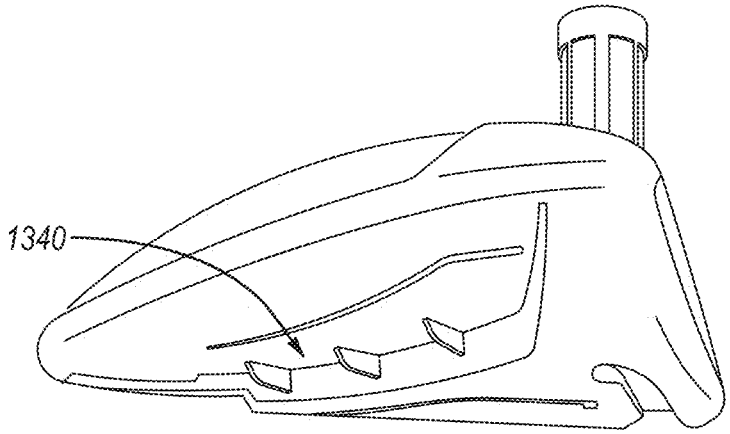
FIG. 37B is a side elevation view of the golf club head of FIG. 37A, according to one or more examples of the present disclosure.
Figure 38:
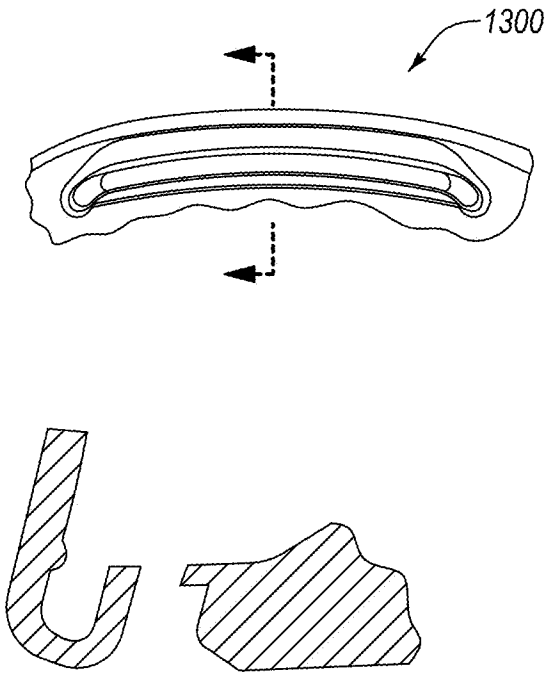
FIG. 38 is a perspective view from a bottom of another golf club head, showing a slot of the golf club head in detail, and multiple cross-sectional side views of the slot of the golf club head, according to one or more examples of the present disclosure.
Figure 39:
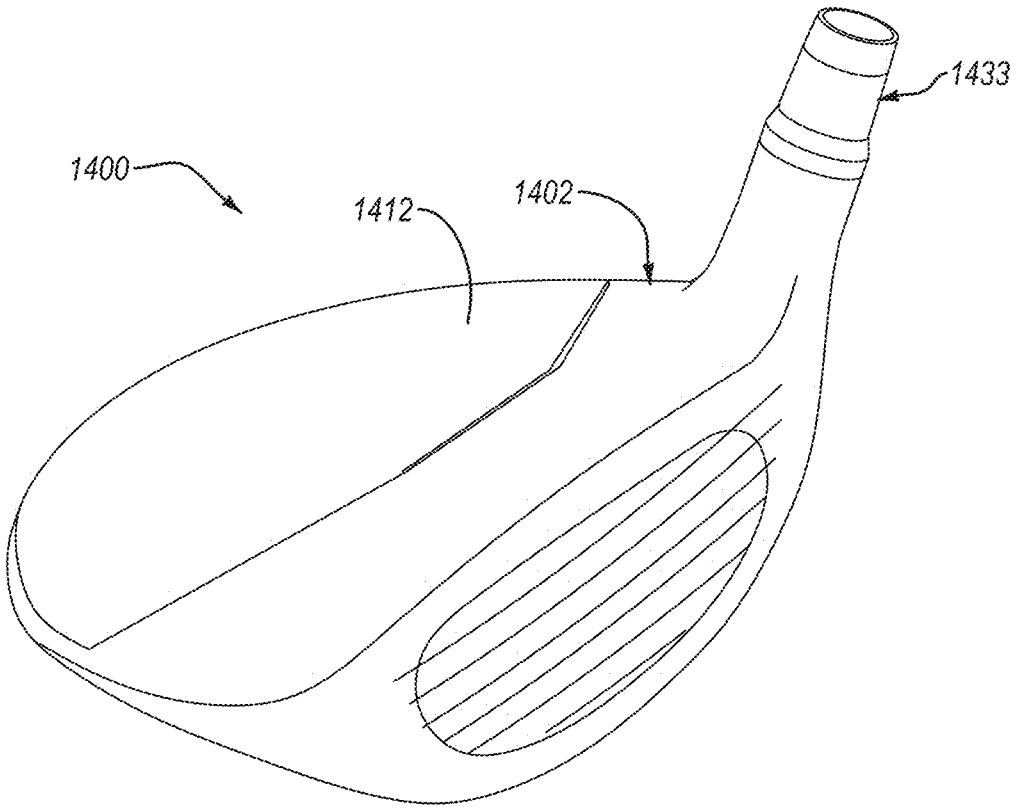
FIG. 39 is a perspective view of a golf club head from a front of the golf club head, according to one or more examples of the present disclosure.

Turning to FIGS. 36-38, another embodiment is shown having a COR feature and is similar to the embodiments shown in FIGS. 18-20. As shown, some embodiments may have a only have a COR feature, or some embodiments may include a COR feature and a sliding weight track, and/or a COR feature, a sliding weight track, and an adjustable loft/lie feature or some other combination.

As already discussed, the COR feature may have a certain length L, width W, and offset distance OS from the face. During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

The offset distance is highly dependent on the slot length. As slot length increases so do the stresses in the club head, as a result the offset distance must be increased to manage stress. Additionally, as slot length increases the first mode frequency is negatively impacted.

During development it was discovered that a ratio of COR feature length to the offset distance may be preferably greater than 4, and even more preferably greater than 5, and most preferably greater than 5.5. However, the ratio of COR feature length to offset distance also has an upper limit and is preferably less than 15, and even more preferably less than 14, and most preferably less than 13.5. For example, for a COR feature length of 30 mm the offset distance from the face would preferably be less than 7.5 mm, and even more preferably 6 mm or less from the face. However, the COR feature can be too close to the face in which the case the club head will fail due to high stresses and/or may have an unacceptably low first mode frequency. The tables below provide various non-limiting examples of COR feature length, offset distance from the face, and ratios of COR feature length to the offset distance.

TABLE 10

| offset distance (OS) in mm | COR feature length (L) in mm 30 mm L/OS ratio | COR feature length (L) in mm 40 mm L/OS ratio | COR feature length (L) in mm 50 mm L/OS ratio | COR feature length (L) in mm 60 mm L/OS ratio | COR feature length (L) in mm 70 mm L/OS ratio | COR feature length (L) in mm 80 mm L/OS ratio | COR feature length (L) in mm 90 mm L/OS ratio |
|---|---|---|---|---|---|---|---|
| 4 | 7.50 | 10.00 | 12.50 | 15.00 | 17.50 | 20.00 | 22.50 |
| 4.5 | 6.67 | 8.89 | 11.11 | 13.33 | 15.56 | 17.78 | 20.00 |
| 5 | 6.00 | 8.00 | 10.00 | 12.00 | 14.00 | 16.00 | 18.00 |
| 5.5 | 5.45 | 7.27 | 9.09 | 10.91 | 12.73 | 14.55 | 16.36 |
| 6 | 5.00 | 6.67 | 8.33 | 10.00 | 11.67 | 13.33 | 15.00 |
| 6.5 | 4.62 | 6.15 | 7.69 | 9.23 | 10.77 | 12.31 | 13.85 |
| 7 | 4.29 | 5.71 | 7.14 | 8.57 | 10.00 | 11.43 | 12.86 |
| 7.5 | 4.00 | 5.33 | 6.67 | 8.00 | 9.33 | 10.67 | 12.00 |
| 8 | 3.75 | 5.00 | 6.25 | 7.50 | 8.75 | 10.00 | 11.25 |
| 8.5 | 3.53 | 4.71 | 5.88 | 7.06 | 8.24 | 9.41 | 10.59 |
| 9 | 3.33 | 4.44 | 5.56 | 6.67 | 7.78 | 8.89 | 10.00 |
| 9.5 | 3.16 | 4.21 | 5.26 | 6.32 | 7.37 | 8.42 | 9.47 |
| 10 | 3.00 | 4.00 | 5.00 | 6.00 | 7.00 | 8.00 | 9.00 |
| 10.5 | 2.86 | 3.81 | 4.76 | 5.71 | 6.67 | 7.62 | 8.57 |
| 11 | 2.73 | 3.64 | 4.55 | 5.45 | 6.36 | 7.27 | 8.18 |
| 11.5 | 2.61 | 3.48 | 4.35 | 5.22 | 6.09 | 6.96 | 7.83 |
| 12 | 2.50 | 3.33 | 4.17 | 5.00 | 5.83 | 6.67 | 7.50 |
| 12.5 | 2.40 | 3.20 | 4.00 | 4.80 | 5.60 | 6.40 | 7.20 |
| 13 | 2.31 | 3.08 | 3.85 | 4.62 | 5.38 | 6.15 | 6.92 |
| 13.5 | 2.22 | 2.96 | 3.70 | 4.44 | 5.19 | 5.93 | 6.67 |
| 14 | 2.14 | 2.86 | 3.57 | 4.29 | 5.00 | 5.71 | 6.43 |
| 14.5 | 2.07 | 2.76 | 3.45 | 4.14 | 4.83 | 5.52 | 6.21 |
| 15 | 2.00 | 2.67 | 3.33 | 4.00 | 4.67 | 5.33 | 6.00 |
| 15.5 | 1.94 | 2.58 | 3.23 | 3.87 | 4.52 | 5.16 | 5.81 |
| 16 | 1.88 | 2.50 | 3.13 | 3.75 | 4.38 | 5.00 | 5.63 |
| 16.5 | 1.82 | 2.42 | 3.03 | 3.64 | 4.24 | 4.85 | 5.45 |
| 17 | 1.76 | 2.35 | 2.94 | 3.53 | 4.12 | 4.71 | 5.29 |

As can be seen from the tables above, for a COR feature length between 30-60 mm the offset distance is preferably 4 mm or greater and 15 mm or less, more preferably 5 mm or greater and 10 mm or less, most preferably 5.5 mm or greater and 8.5 mm or less. Additionally or alternatively, for a COR feature length between 30-60 mm a ratio of COR feature length to offset distance from the face may be preferably at least 4 and at most 15, more preferably at least 5 and at most 12.5, most preferably at least 6 and at most 12.

As can be seen from the tables above, for a COR feature length between 60-90 mm the offset distance is preferably 4 mm or greater and 15 mm or less, more preferably 5 mm or greater and 13.5 mm or less, most preferably 5.5 mm or greater and 12.5 mm or less. Additionally or alternatively, for a COR feature length between 60-90 mm a ratio of COR feature length to offset distance from the face may be preferably at least 4 and at most 15, more preferably at least 5 and at most 12.5, most preferably at least 6 and at most 12.

Importantly, as COR feature length increases it is important to increase the offset distance from the face. A COR feature length of 60 mm is in between a small COR feature and a large COR feature, which is why it was included in both of the non-limiting examples of above. The ratio is important to maintain and although not all lengths of COR features are provided in the tables above a preferred offset distance range may be calculated by applying the ratio to a given COR feature length.

The sound and feel of golf club heads are vitally important to their acceptance among golfers and especially top golfers. Sound and feel is largely dictated by the club heads first mode frequency, and preferably the club head has a first mode frequency of at least 2800 Hz, such as at least 3000 Hz, such as at least 3200 Hz, such as at least 3400 Hz, such as at least 3500 Hz.

Figure 46:
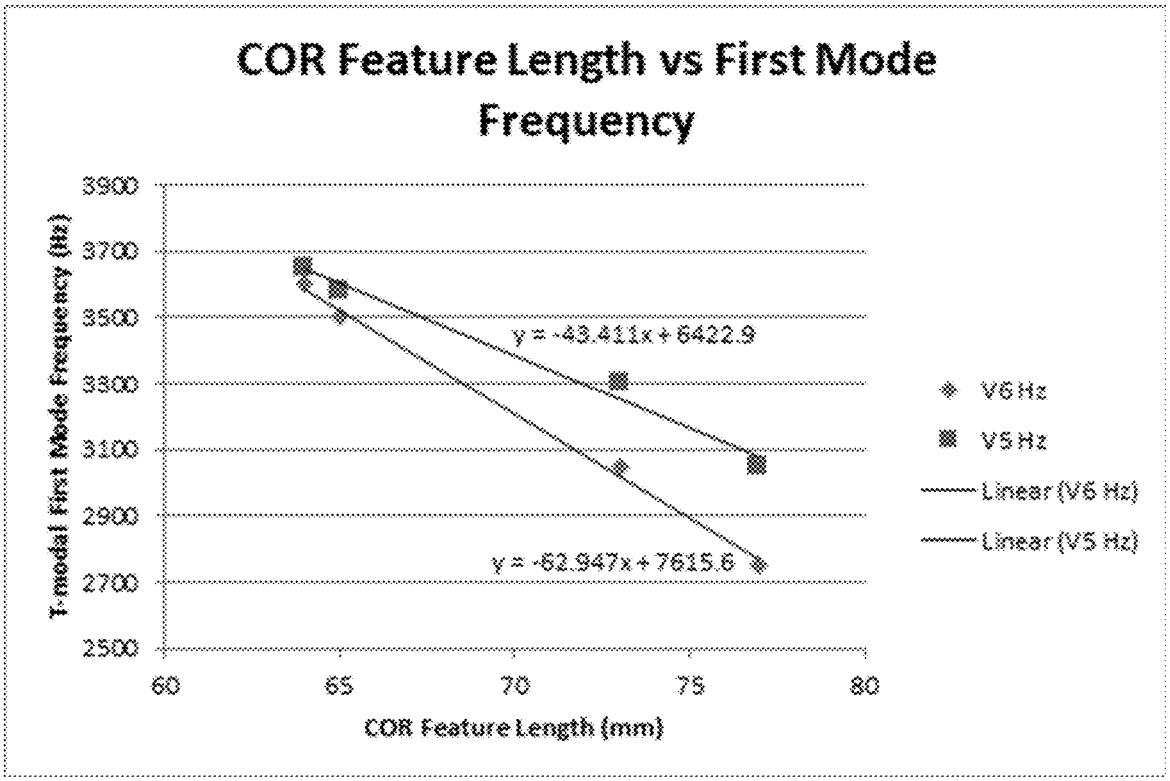
FIG. 46 is a chart showing COR feature length versus first mode frequency for golf club heads, according to one or more examples of the present disclosure.

The inventors discovered during the design stage that the COR feature length greatly effects the first mode frequency. FIG. 46 shows the first mode frequency in Hz as a function of slot or COR feature length in mm. Two different designs are shown in the chart of FIG. 46: a V5 and V6 K-N. Both designs are representative of the embodiments disclosed herein. As illustrated by the slope of the plots, for the V5 version each millimeter increase of slot length caused the first mode frequency to decreases by about 45 Hz. Similarly, for the V6 version each millimeter increase of slot length caused the first mode frequency to decreases by about 65 Hz. This information helps determine the overall slot length. Of course, the distance from the face to the slot or COR feature also plays a role in the first mode frequency. For this study the slot offset distance from the face was held constant and only slot length was varied.

TABLE 11

| COR feature length (mm) | V6 Hz | V5 Hz |
|---|---|---|
| 64 | 3600 | 3650 |
| 65 | 3500 | 3580 |
| 73 | 3050 | 3300 |
| 77 | 2750 | 3050 |

In another study, the COR feature offset distance from the face was varied and the COR was measured. A COR feature length of 40 mm was used for the study, and the results will vary depending on the COR feature length. A shorter COR feature length will decrease COR while a longer COR feature length will increase COR. In other words, a shorter COR feature length needs to be closer to the face to achieve the same COR benefits as longer COR feature length. As can be seen from the data COR increases as the COR feature approaches the face. For this particular slot length of 40 mm there is almost no COR benefit beyond 12 mm from the face.

TABLE 12

| COR feature offset distance from face in mm | COR |
|---|---|
| 6.65 | 0.816 |
| 11.65 | 0.800 |
| 15.15 | 0.793 |

The stress levels in a golf club play an important role in determining its durability. The COR feature tends to decrease stress in the face, but can enhance stress in other areas more proximate to the COR feature itself. For low face stress near the COR feature it was discovered that the COR feature offset distance drives low face stress. The inventors conducted a stress study using a COR feature length of about 70 mm. The inventors investigated increasing the sole and wall thickness by 0.3 mm to reduce low face stress by 200 MPa, however this caused the COR to decrease by 0.005 points. Next, the inventors investigated decreasing the COR feature length by 30 mm to about 40 mm to reduce low face stress by 200 MPa, however this caused the COR to decrease by 0.012 points. Finally, the inventors investigated increasing the COR feature offset distance from the face by 1 mm to reduce low face stress by 200 MPa, and this only caused the COR to decrease by 0.001 points. Accordingly, the COR feature offset distance from the face plays the biggest role in stress management and in effecting the overall COR of the club head.

The golf club head features a sliding weight track in addition to a COR feature. U.S. Publication No. 2016/0001146 A1, published Jan. 7, 2016 discloses various sliding weight track constructions that may be used for golf club heads, which is incorporated by reference herein in its entirety.

FIGS. 36A-36E illustrate yet another exemplary wood-type golf club head 1200. The head 1200 includes a weight track 1230 with at least one slidably adjustable weight assembly 1232 and a COR feature 1296. The head 1200 further comprises a crown insert. The head 1200 is similar in many ways to the head described in FIGS. 18-20.

The head 1200 comprises a body 1202, an adjustable head-shaft connection assembly 1222, the crown insert attached to the upper portion of the body, the weight assembly 1232 slidably mounted in the weight track 1230.

The crown has a crown opening 1246 that reduces the mass of the body 1202, and more significantly, reduces the mass of the crown, a region of the head where increased mass has the greatest impact on raising (undesirably) the CG of the head. Along the periphery of the opening 246, the frame includes a recessed ledge 1250 to seat and support the crown insert. The crown insert has a geometry and size compatible with the crown opening and is secured to the body by adhesion or other secure fastening technique so as to cover the opening. The crown insert may also include a forward projection that extends in to the forward crown portion of the body.

The body includes a seat region 1250 around the upper opening to receive the crown insert. FIG. 36E shows atop view of the head 1200 in various states with the crown insert removed. In various embodiments, the crown insert can cover at least about 50% of the surface area of the crown, at least about 60% of the surface area of the crown, at least about 70% of the surface area of the crown, or at least about 80% of the surface area of the crown. In another embodiment, the crown insert covers about 50% to 80% of the surface area of the crown. The crown insert contributes to a club head structure that is sufficiently strong and stiff to withstand the large dynamic loads imposed thereon, while remaining relatively lightweight to free up discretionary mass that can be allocated strategically elsewhere within the club head.

In various embodiments, the ledges of the body that receive the crown insert (e.g. ledges 1250) may be made from the same metal material (e.g., titanium alloy) as the body and, therefore, can add significant mass to the golf club head. In some embodiments, in order to control the mass contribution of the ledge to the golf club head, the width of the ledges can be adjusted to achieve a desired mass contribution. In some embodiments, if the ledges add too much mass to the golf club head, it can take away from the decreased weight benefits of a crown insert, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body, in alternative embodiments, the ledges may extend only partially along the interface boundaries.

The periphery of crown opening 1246 can be proximate to and closely track the periphery of the crown on the toe-, rear-, and heel-sides of the head 1200. In contrast, the face-side of the crown opening 1246 can be spaced farther from the face region of the head. In this way, the head can have additional frame mass and reinforcement in the crown area just rearward of the face. This area and other areas adjacent to the face along the toe, heel and sole support the face and are subject to the relatively higher impact loads and stresses due to ball strikes on the face. As described elsewhere herein, the frame may be made of a wide range of materials, including high strength titanium, titanium alloys, and/or other metals. The opening 1246 can have a notch at the front side which matingly corresponds to the crown insert projection to help align and seat the crown insert on the body.

The weight track 1230 are located in the sole of the club head and define a track for mounting the slidable weight assembly 1232 which may be fastened to the weight track by fastening means such as screws. The weight assembly can take forms other than as shown in, can be mounted in other ways, and can take the form of a single piece design or multi-piece design. The weight track allows the weight assembly to be loosened for slidable adjustment along the track and then tightened in place to adjust the effective CG and MOI characteristics of the club head.

In the illustrated embodiments, the weight track includes one weight assembly. In other embodiments, two or more weight assemblies can be mounted in either or both of the weight track to provide alternative mass distribution capabilities for the club head.

By adjusting the CG heelward or toeward via the weight track 1230, the performance characteristics of the club head can be modified to affect the flight of the ball, especially the ball's tendency to draw or fade and/or to counter the ball's tendency to slice or hook. Alternatively, if the weight track were front to back the CG could be adjusted forward or rearward. By adjusting the CG forward or rearward, the performance characteristics of the club head can be modified to affect the flight of the ball, especially the ball's tendency to move upwardly or resist falling during flight due to backspin. In alternative embodiments, the weight track may be at various angles relative to the face in which case both left right tendency and spin characteristics may be effected.

The use of two weights assemblies in either track can allow for alternative adjustment and interplay between the two weights. For example, with respect to the weight track 1230, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the weight track.

Figure 36A:
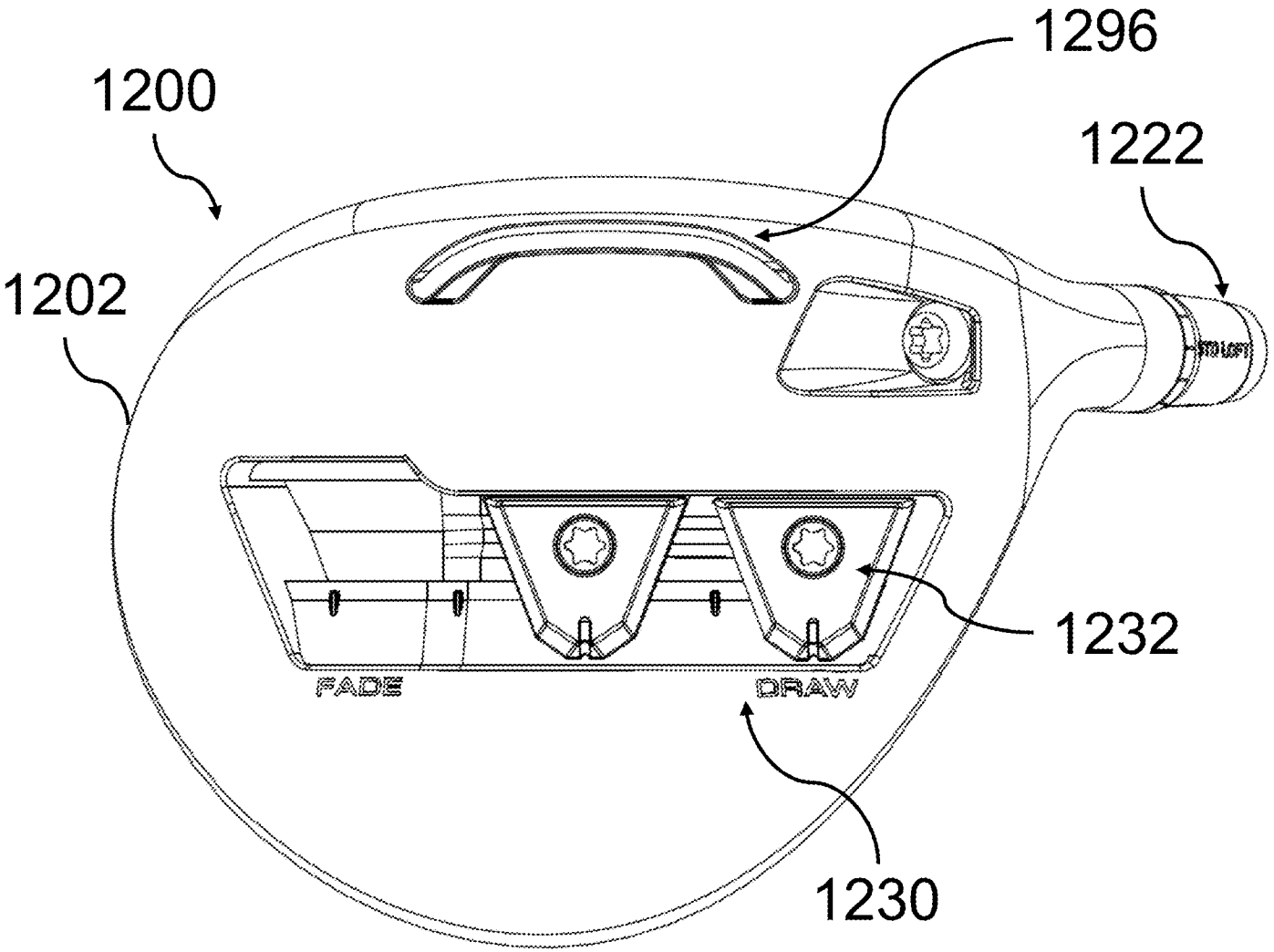
FIG. 36A is a bottom view of another golf club head, according to one or more examples of the present disclosure.
Figure 36B:
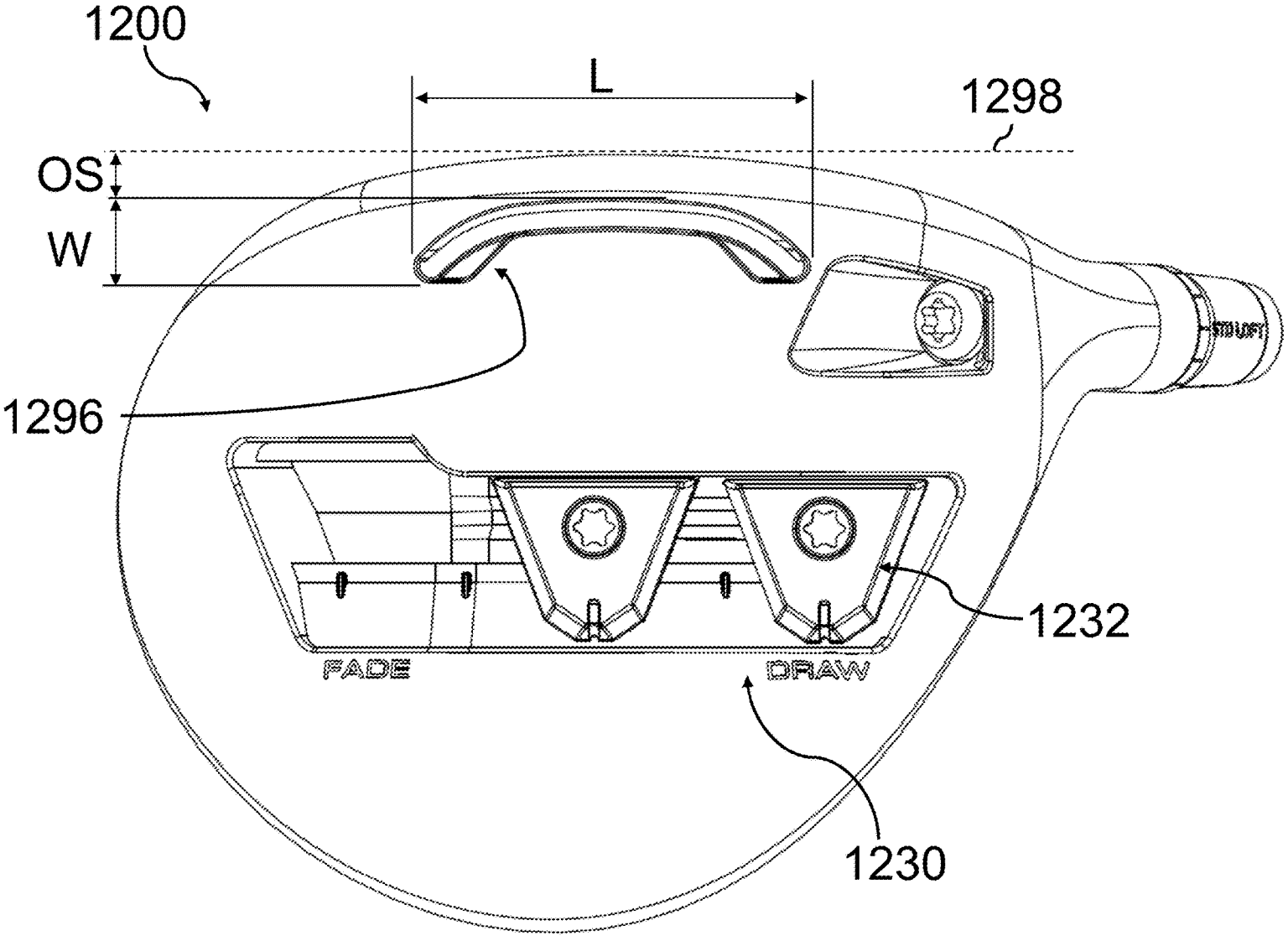
FIG. 36B is a bottom view of the golf club head of FIG. 36A, showing dimensions of various features of the golf club head, according to one or more examples of the present disclosure.
Figure 36C:
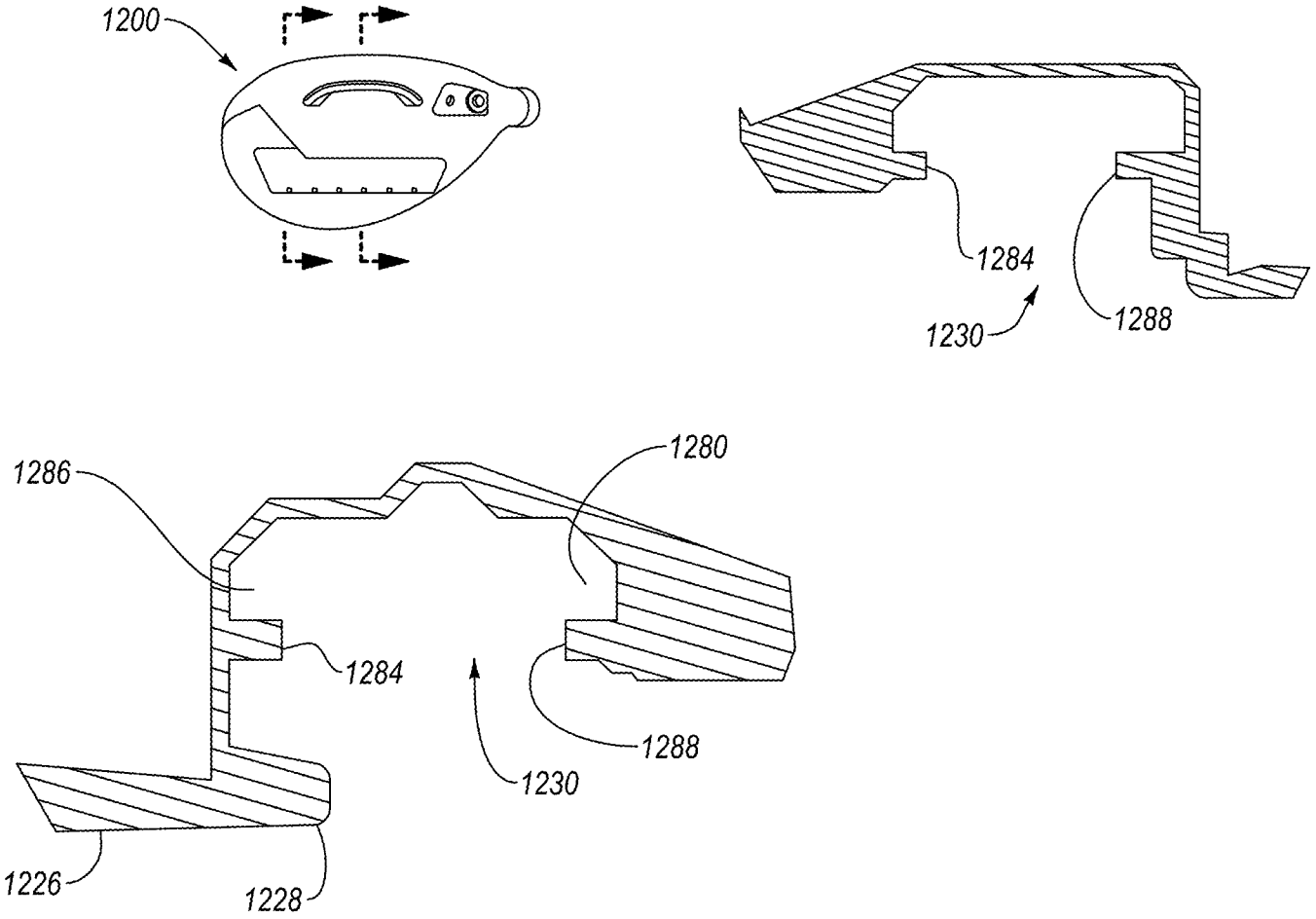
FIG. 36C is a bottom view and multiple cross-sectional side views of portions of yet another golf club head, according to one or more examples of the present disclosure.
Figure 36D:
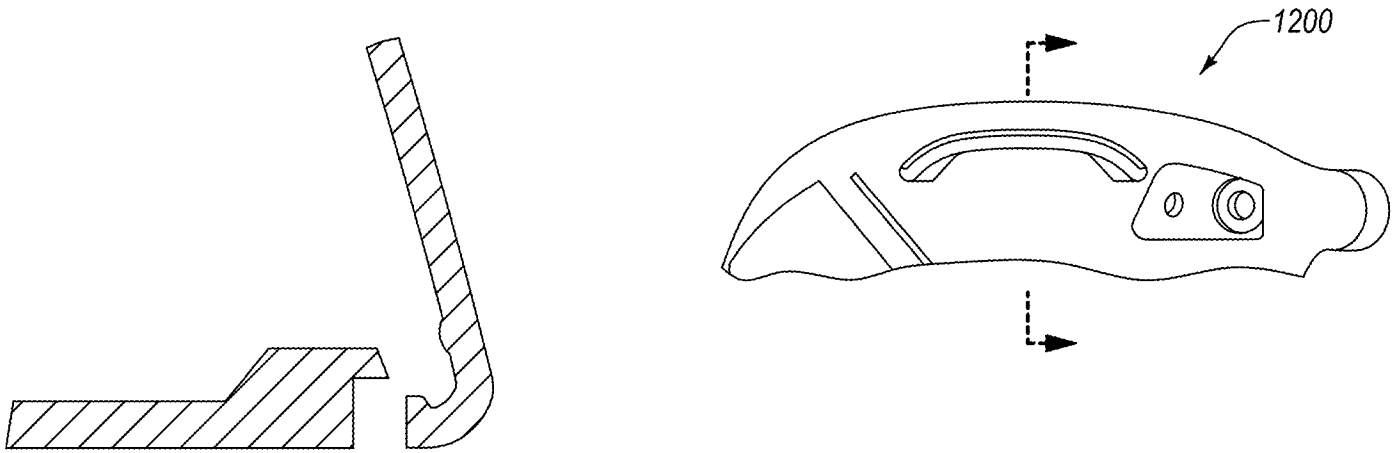
FIG. 36D is a bottom view and multiple cross-sectional side views of other portions of the golf club head of FIG. 36C, according to one or more examples of the present disclosure.
Figure 36E:
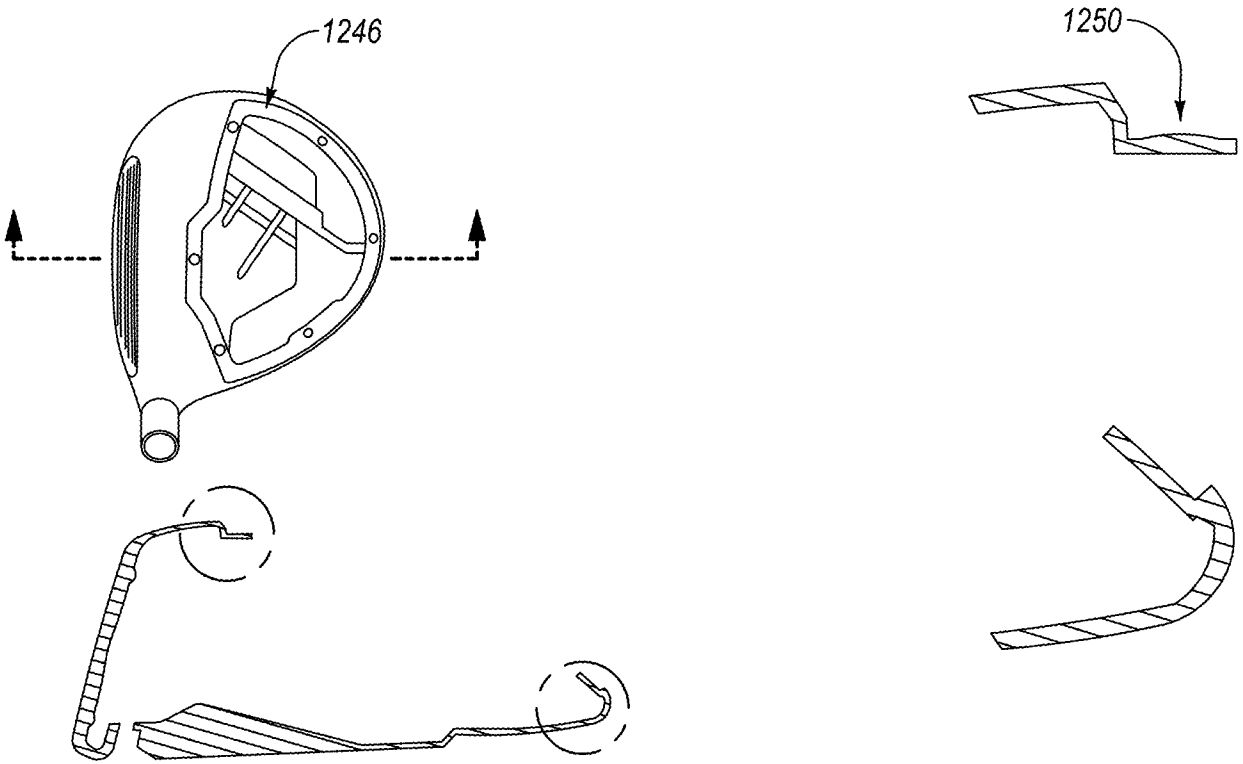
FIG. 36E is a top view and multiple cross-sectional side views of portions of yet another golf club head, according to one or more examples of the present disclosure.

As shown in FIG. 36C, the weight track 1230 preferably has a recess, which may be generally rectangular in shape, to provide a recessed track to seat and guide the weight as it adjustably slides along the track. The track includes one or more peripheral rails or ledges to define an elongate channel preferably having a width dimension less than the width of the weight placed in the channel. For example, as shown in FIG. 36C, the weight track 1230 includes opposing peripheral rails 1288 and 1284. In this way, the weights can slide in the weight track while the rails prevent them from passing out of the track. At the same time, the channels between the ledges permit the screws of the weight assembly to pass through the center of the outer weight elements, through the channels, and then into threaded engagement with the inner weight elements. The ledges serve to provide track or rails on which the joined weight assembly freely slide while effectively preventing the weight assembly from inadvertently slipping out of the track, even when loosened. In the weight track 1230, the inner weight member of the assembly 1232 sits above the rails 1284 and 1288 in inner recesses 1280 and 1286, while the outer weight member is partially seated in recess 1282 between the forward rail 1284 and the overhanging lip 1228 of the front sit pad 1226.

The weight assembly can be adjusted by loosening the screws and moving the weight to a desired location along the track, then the screws can be tightened to secure them in place. The weight assembly can also be swapped out and replaced by other weight assemblies having different masses to provide further mass adjustment options. If a second or third weight is added to the weight track, many additional weight location and distribution options are available for additional fine tuning of the head's effective CG location in the heel-toe direction and the front-rear direction, and combinations thereof. This also provides great range of adjust of the club head's MOI properties.

The weight assembly 1232 can comprise a three piece assembly including an inner weight member, an outer weight member, and a fastener coupling the two weight members together. The assembly can clamp onto front, back, or side ledges of the weight track by tightening the fastener such that the inner member contacts the inner side the ledge and the outer weight member contacts the outer side of the ledge, with enough clamping force to hold the assembly stationary relative to the body throughout a round of golf. The weight members can be shaped and/or configured to be inserted into the weight track by inserting the inner weight member into the inner channel past the ledge(s) at a usable portion of the weight track, as opposed to inserting the inner weight at an enlarged opening at one end of the weight track where the weight assembly is not configured to be secured in place. This can allow for elimination of such a wider, non-functional opening at the end of the track, and allow the track to be shorter or to have a longer functional ledge width over which the weight assembly can be secured. To allow the inner weight member to be inserted into the track in the middle of the track (for example) past the ledge, the inner weight member can be inserted at an angle that is not perpendicular to the ledge, e.g., an angled insertion. The weight member can be inserted at an angle and gradually rotated into the inner channel to allow insertion past the clamping ledge. In some embodiments, the inner weight member can have a square, rounded, oval, oblong (rectangular), arcuate, curved, or otherwise specifically shaped structure to better allow the weight member to insert into the channel past the ledge at a useable portion of the track.

In the golf club heads of the present disclosure, the ability to adjust the relative positions and masses of the slidably adjusted weights and/or threadably adjustable weights, coupled with the weight saving achieved by incorporation of the light-weight crown insert, allows for a large range of variation of a number properties of the club-head all of which affect the ultimate club-head performance including the position of the CG of the club-head, MOI values of the club head, acoustic properties of the club head, aesthetic appearance and subjective feel properties of the club head, and/or other properties.

In certain embodiments, the weight track has certain track widths. The track widths may be measured, for example, as the horizontal distance between a first track wall and a second track wall that are generally parallel to each other on opposite sides of the inner portion of the track that receives the inner weight member of the weight assembly. The width of the weight track 1230 can be the horizontal distance between opposing walls of the inner recesses 1280 and 1286. The track width may be between about 5 mm and about 20 mm, such as between about 10 mm and about 18 mm, or such as between about 12 mm and about 16 mm. According to some embodiments, the depth of the track (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm. The depth of the track can be the vertical distance from the inner surface of the overhanging lip 1228 to the upper surface of the inner recess 1280 (FIG. 36C).

The weight track has a certain track length. Track length may be measured as the horizontal distance between the opposing longitudinal end walls of the track. Track length may be between about 30 mm and about 120 mm, such as between about 50 mm and about 100 mm, or such as between about 60 mm and about 90 mm. Additionally, or alternatively, the length of the track may be represented as a percentage of the striking face length. For example, the track may be between about 30% and about 100% of the striking face length, such as between about 50% and about 90%, or such as between about 60% and about 80% mm of the striking face length. The track depth, width, and length properties described above can also analogously also be applied to a front channel or other COR feature.

FIGS. 37A, 37B, and 38 show yet another embodiment of a club head 1300 having a COR feature 1396 similar to those already discussed. Additionally, there is a raised sole portion with three ribs connecting the raised sole portion to the rest of the sole of the body. The ribs are to stiffen the overall structure and provide better acoustics. FIG. 38 shows some section views of the COR feature. These views are similar to those shown in FIG. 36D, but for a longer length COR feature. The discussion above related to COR feature length and offset distance applies equally to this embodiment.

Below are some additional ranges of parameters for club heads 1200 and 1300.

TABLE 13

| ranges | Embodiment 1200 FIG. 36 | Embodiment 1300 FIG. 37 |
|---|---|---|
| length of slot (mm) | 25-100, 25-60, 30-50, 35-45, 75-95, 60-80 | 25-100, 25-60, 30-50, 35-45, 75-95, 60-80 |
| Zup (mm) | 12-16 | 12-16 |
| delta 1 (mm) | 8-12 | 8-12 |
| distance from leading edge to mass pad or end of slot (mm) | 7 mm-13 mm | 7 mm-13 mm |
| Zup vs half head height (steel) (mm) | −5.7, −5.8, −5.9 | −5.7, −5.8, −5.9 |
| zup vs half head height (Ti) (mm) | −5.9, −6.0, −6.10 | −5.9, −6.0, −6.10 |

Referring to FIGS. 39-45, a golf club head 1400 according to another embodiment is shown. Similar in many ways to the golf club head 1200 and 1300 of FIGS. 36A-38, the golf club head 1400 is a wood-type (e.g., fairway wood or fairway metal) or hybrid type golf club head. For example, the golf club head 1400 may have a volume between 130 $cm^3$ and 220 $cm^3$ or between 80 $cm^3$ and 220 $cm^3$. Moreover, in the same or another example, the golf club head 1400 has a mass (or weight) between about 210 grams and 240 grams, a Delta 1 value less than 14 mm, and a CGz less than-3 mm. Additionally, the golf club head 1400 can be considered similar in many ways to the golf club head described in FIGS. 18-20. The golf club head 1400 includes a weight track 1430 with at least one slidably adjustable weight assembly 1432 and a COR feature 1496. Like the golf club head 1200 and the golf club head 1300, the golf club head 1400 further includes a crown insert 1412. However, unlike the golf club head 1200 and the golf club head 1300, the golf club head 1400 also includes a sole insert 1414.

The golf club head 1400 comprises a body 1402 and a hosel coupled to the body 1402. The body 1402 may include a heel opening 1491 that is configured to receive a fastening member 1493. The golf club head 1400 also includes an adjustable head-shaft connection assembly 1433. The head-shaft connection assembly 1433 includes a sleeve that is secured by the fastening member in a locked position. Generally, the head-shaft connection assembly 1433 is configured to allow the golf club head 1400 to be adjustably attachable to a golf club shaft in a plurality of different positions resulting in an adjustability range of different combinations of loft angle, face angle, or lie angle.

The crown insert 1412 is attached to the upper portion of the body, over a crown opening formed in a frame of the body 1402. The sole insert 1414 is attached to the lower portion of the body, over a sole opening formed in the frame of the body 1402. The weight assembly 1432 is slidably mounted in the weight track 1430. The configuration of the weight assembly 1432 and the weight track 1430 can be similar to those described above. The frame of the body 1402 or the body 1402, exclusive of the crown and sole inserts, is made of titanium, steel, or the like.

The crown portion of the frame of the golf club head 1400 has a crown opening that reduces the mass of the body 1402, and more significantly, reduces the mass of the crown, a region of the head where increased mass has the greatest impact on raising (undesirably) the CG of the head. Along the periphery of the crown opening, the frame includes a recessed ledge to seat and support the crown insert 1412. The crown insert 1412 has a geometry and size compatible with the crown opening and is secured to the body by adhesion or other secure fastening technique so as to cover the crown opening. The crown insert 1412 may also include a forward projection that extends in to the forward crown portion of the body 1402. In various embodiments, the crown insert can cover at least about 50% of the surface area of the crown, at least about 60% of the surface area of the crown, at least about 70% of the surface area of the crown, or at least about 80% of the surface area of the crown. In another embodiment, the crown insert covers about 50% to 80% of the surface area of the crown.

The sole portion of the frame of the golf club head 1400 has a sole opening that reduces the mass of the body 1402, and more significantly, reduces the mass of the sole of the head. Along the periphery of the sole opening, the frame includes a recessed ledge to seat and support the sole insert 1414. The sole insert 1414 has a geometry and size compatible with the sole opening and is secured to the body by adhesion or other secure fastening technique so as to cover the sole opening. In various embodiments, the sole insert can cover at least about 10% of the surface area of the sole, at least about 20% of the surface area of the sole, at least about 30% of the surface area of the sole, or at least about 40% of the surface area of the sole. In another embodiment, the sole insert covers about 40% to 60% of the surface area of the sole.

The crown insert 1412 and the sole insert 1414 can be made of any of various materials and have any of various thicknesses. According to one embodiment, the crown insert 1412 is formed from a composite material having a density between 1 g/cc and 2 g/cc. In one embodiment, the sole insert 1414 is formed from a composite material having a density between 1 g/cc and 2 g/cc. According to an embodiment, the crown insert 1412 has a thickness ranging from about 0.195 mm to about 0.9 mm. In an embodiment, the sole insert 1414 has a thickness ranging from about 0.195 mm to about 0.9 mm, between about 0.4 mm and 1.0 mm, between about 0.4 mm and about 0.8 mm, or between about 0.4 mm and about 0.65 mm. The crown insert 1412 includes at least four plies of uni-tape standard modulus graphite in some implementations. For example, the at least four plies of the crown insert 1412 can be oriented at any combination of 0°, +45°, −45° and 90°. The sole insert 1414 includes at least four plies of uni-tape standard modulus graphite in some implementations. For example, the at least four plies of the sole insert 1414 can be oriented at any combination of 0°, +45°, −45° and 90°. In one particular example, where 0-deg direction is front-to-back, 90-deg direction is heel-to-toe, first ply is inside, and last ply is outside, the layup of each of the crown insert 1412 and the sole insert 1414 may be screen/0/90/45/−45/45/Cloth (0/90 direction). In some implementations, a fiber areal weight of the at least one of the crown insert 1412 or the sole insert 1414 is between 20 GSM and 200 GSM or between 50 GSM and 100 GSM.

In some implementations, the crown insert 1412 has a mass between about 3 grams and about 8 grams, such as for a golf club head 1400 with a volume between 80 cc and 220 cc, and the sole insert 1414 has a mass between about 1 gram and about 3 grams, such as for a golf club head 1400 with a volume between 80 cc and 220 cc. The mass of the sole insert 1414 is less than 3.0 grams, less than 2.5 grams, less than 2.0 grams, or less than 1.75 grams is some implementations. According to certain implementations, the area of the sole insert 1414 is at least 1,250 $mm^2$, 1,500 $mm^2$, 1,750 $mm^2$, or 2,000 $mm^2$. The mass of the crown insert 1412 is less than 8.0 grams, less than 7.0 grams, less than 6.5 grams, less than 6.0 grams, less than 5.5 grams, less than 5.0 grams, or less than 4.5 grams is some implementations. According to certain implementations, the area of the crown insert 1412 is at least 3,000 $mm^2$, 3,500 $mm^2$, 3,750 $mm^2$, or 4,000 $mm^2$.

The crown insert 1412 and the sole insert 1414 contribute to a club head structure that is sufficiently strong and stiff to withstand the large dynamic loads imposed thereon, while remaining relatively lightweight to free up discretionary mass that can be allocated strategically elsewhere within the club head 1400.

In various embodiments, the ledges of the body 1402 that receive the crown insert 1412 and the sole insert 1414 may be made from the same metal material (e.g., titanium alloys and steel alloys) as the body and, therefore, can add significant mass to the golf club head. In some embodiments, in order to control the mass contribution of the ledge to the golf club head 1400, the width of the ledges can be adjusted to achieve a desired mass contribution. In some embodiments, if the ledges add too much mass to the golf club head 1400, it can take away from the decreased weight benefits of a crown insert, which can be made from a lighter materials (e.g., carbon fiber or graphite composites and/or polymeric materials). In some embodiments, the width of the ledges may range from about 3 mm to about 8 mm, preferably from about 4 mm to about 7 mm, and more preferably from about 4.5 mm to about 5.5 mm. In some embodiments, the width of the ledges may be at least four times as wide as a thickness of the respective insert. In some embodiments, the thickness of the ledges may range from about 0.4 mm to about 1 mm, preferably from about 0.5 mm to about 0.8 mm, and more preferably from about 0.6 mm to about 0.7 mm. In some embodiments, the thickness of the ledges may range from about 0.5 mm to about 1.75 mm, preferably from about 0.7 mm to about 1.2 mm, and more preferably from about 0.8 mm to about 1.1 mm. Although the ledges may extend or run along the entire interface boundary between the respective insert and the body 1402, in alternative embodiments, the ledges may extend only partially along the interface boundaries.

The periphery of crown opening can be proximate to and closely track the periphery of the crown on the toe-, rear-, and heel-sides of the head 1400. Similarly, the periphery of sole opening can be proximate to and closely track the periphery of the sole on at least the rear-side of the head 1400. In contrast, the face-side of the crown opening and the sole opening can be spaced farther from the face region of the head 1400. In this way, the head 1400 can have additional frame mass and reinforcement in the crown area and/or sole area just rearward of the face. These areas adjacent to the face along the toe, heel and sole support the face and are subject to the relatively higher impact loads and stresses due to ball strikes on the face. Additionally, because the sole opening is spaced farther from the face region of the head 1400, the COR feature 1496 and the weight track 1430 can be located in the sole area just rearward of the face or intermediate the face and the sole opening. As described elsewhere herein, the frame may be made of a wide range of materials, including high strength titanium, titanium alloys, steel alloys, and/or other metals. The crown opening and/or the sole opening can have a notch at the front side which matingly corresponds to a crown insert projection and sole insert projection to help align and seat the crown insert 1412 and/or the sole insert 1414 on the body 1402.

The weight track 1430 is located in the sole of the club head 1400 and defines a track for mounting the slidable weight assembly 1432, which may be fastened to the weight track by fastening means such as screws. The weight assembly 1432 can take forms other than as shown in, can be mounted in other ways, and can take the form of a single piece design, a two-piece design (such as disclosed in U.S. patent application Ser. No. 15/859,297, filed Dec. 29, 2017, which is incorporated herein by reference in its entirety), or multi-piece design. The weight track 1430 allows the weight assembly 1432 to be loosened for slidable adjustment along the track 1430 and then tightened in place to adjust the effective CG and MOI characteristics of the club head 1400. For example, in one implementation, adjusting the position of the weight assembly 1432 within the sliding weight track 1430 produces a change in the head origin y-axis (CGy) coordinate of between 2.0 mm and 6.0 mm throughout the adjustability range. In another example, adjusting the position of the weight assembly 1432 within the sliding weight track 1430 produces a change in the head origin y-axis (CGy) coordinate of less than 1.0 mm throughout the adjustability range, and produces a change in the head origin x-axis (CGx) coordinate of at least 4.0 mm throughout the adjustability range In the illustrated embodiments, the weight track 1430 includes one weight assembly 1432. In other embodiments, two or more weight assemblies can be mounted in either or both of the weight track to provide alternative mass distribution capabilities for the club head 1400.

By adjusting the CG heelward or toeward via the weight track 1430, the performance characteristics of the club head 1400 can be modified to affect the flight of the ball, especially the ball's tendency to draw or fade and/or to counter the ball's tendency to slice or hook. Alternatively, if the weight track were front to back the CG could be adjusted forward or rearward. By adjusting the CG forward or rearward, the performance characteristics of the club head can be modified to affect the flight of the ball, especially the ball's tendency to move upwardly or resist falling during flight due to backspin. In alternative embodiments, the weight track may be at various angles relative to the face in which case both left right tendency and spin characteristics may be effected.

The use of two weights assemblies in either track can allow for alternative adjustment and interplay between the two weights. For example, with respect to the weight track 1430, two independently adjustable weight assemblies can be positioned fully on the toe side, fully on the heel side, spaced apart a maximum distance with one weight fully on the toe side and the other fully on the heel side, positioned together in the middle of the weight track, or in other weight location patterns. With a single weight assembly in a track, as illustrated, the weight adjustment options are more limited but the effective CG of the head still can be adjusted along a continuum, such as heelward or toeward or in a neutral position with the weight centered in the weight track.

Figure 40:
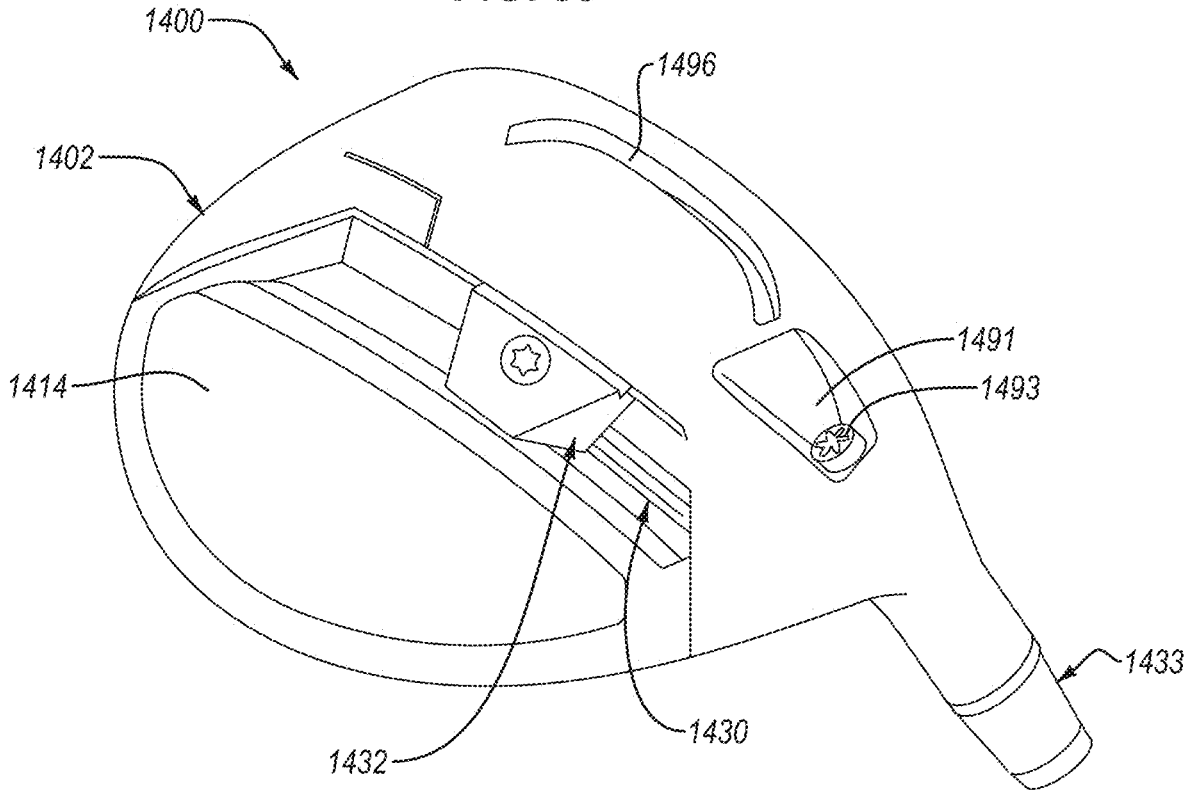
FIG. 40 is a perspective view of the golf club head of FIG. 39 from a rear of the golf club head, according to one or more examples of the present disclosure.
Figure 41:
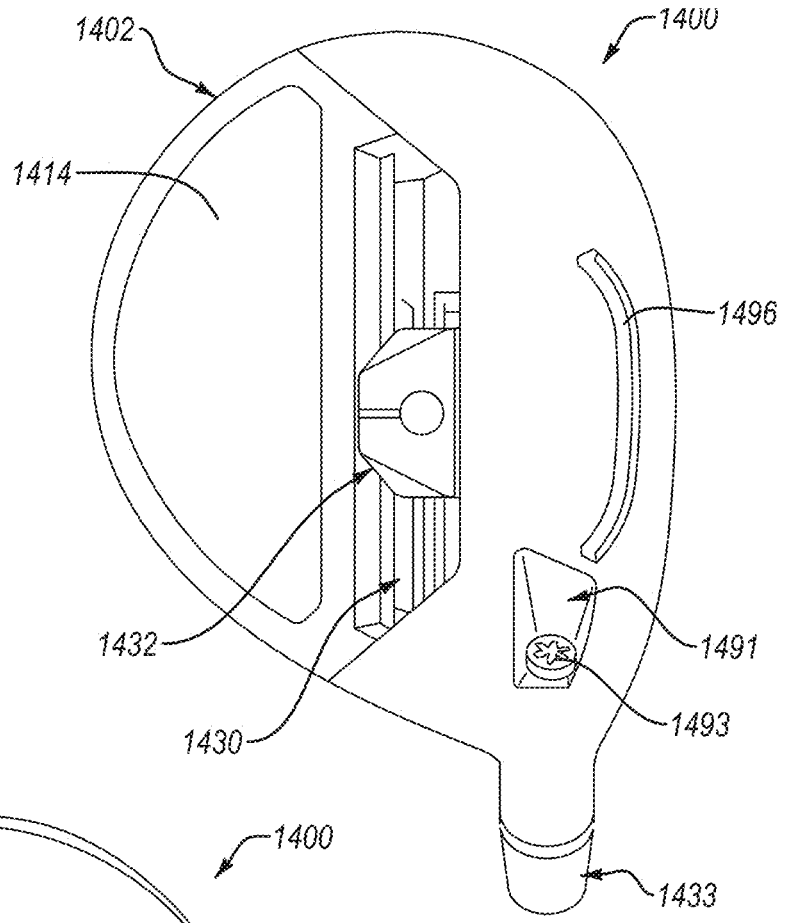
FIG. 41 is a bottom plan view of the golf club head of FIG. 39, according to one or more examples of the present disclosure.
Figure 42:
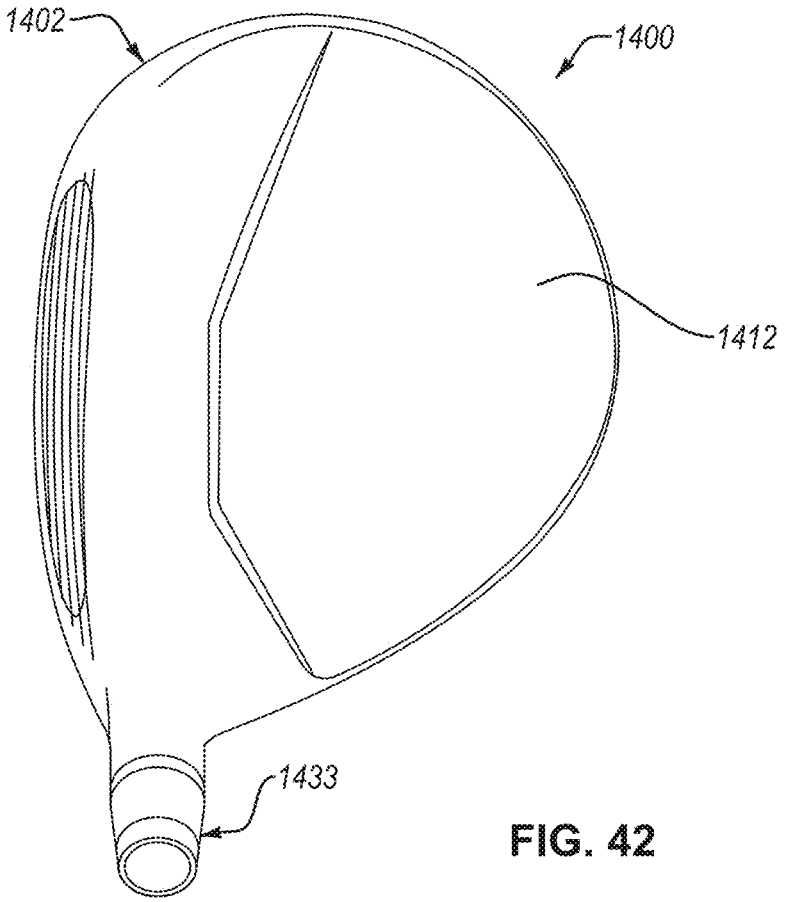
FIG. 42 is a top plan view of the golf club head of FIG. 39, according to one or more examples of the present disclosure.
Figure 43:
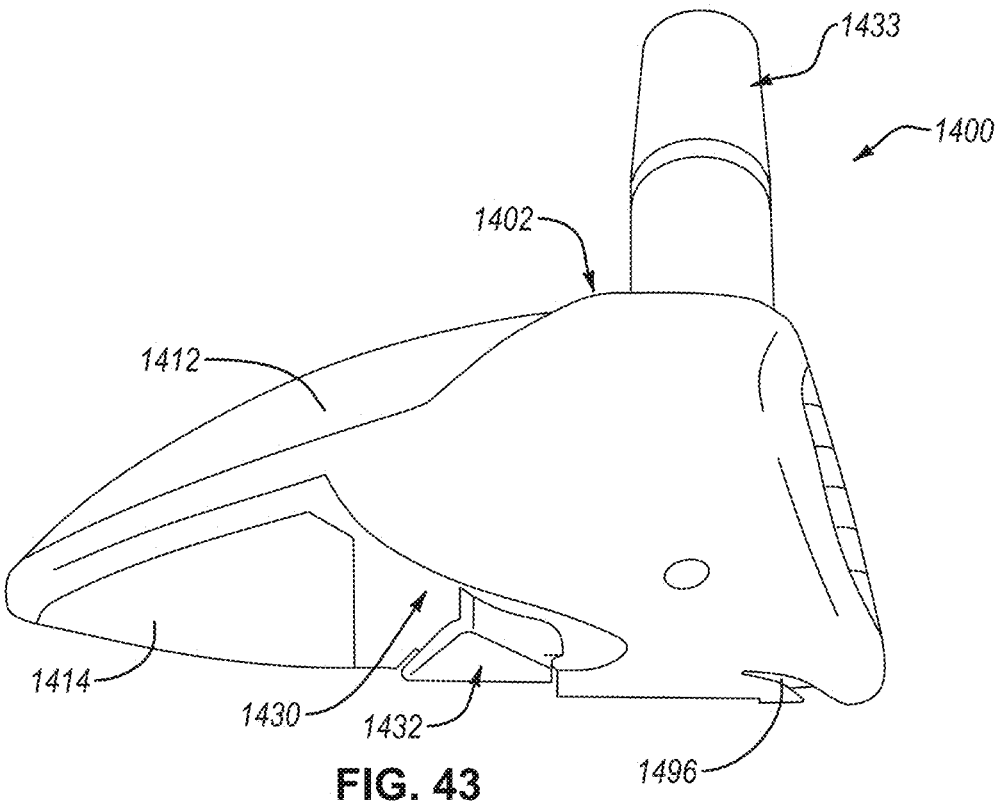
FIG. 43 is a first side elevation view of the golf club head of FIG. 39, according to one or more examples of the present disclosure.
Figure 44:
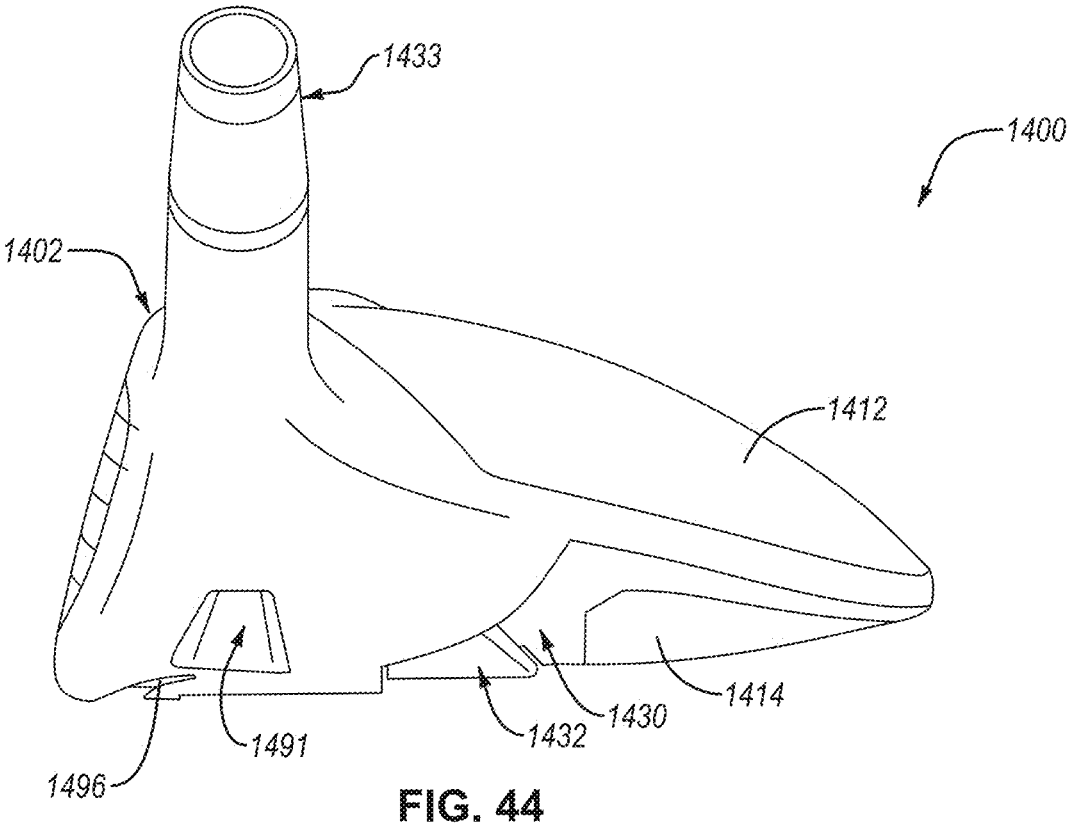
FIG. 44 is a second side elevation view of the golf club head of FIG. 39, according to one or more examples of the present disclosure.
Figure 45:
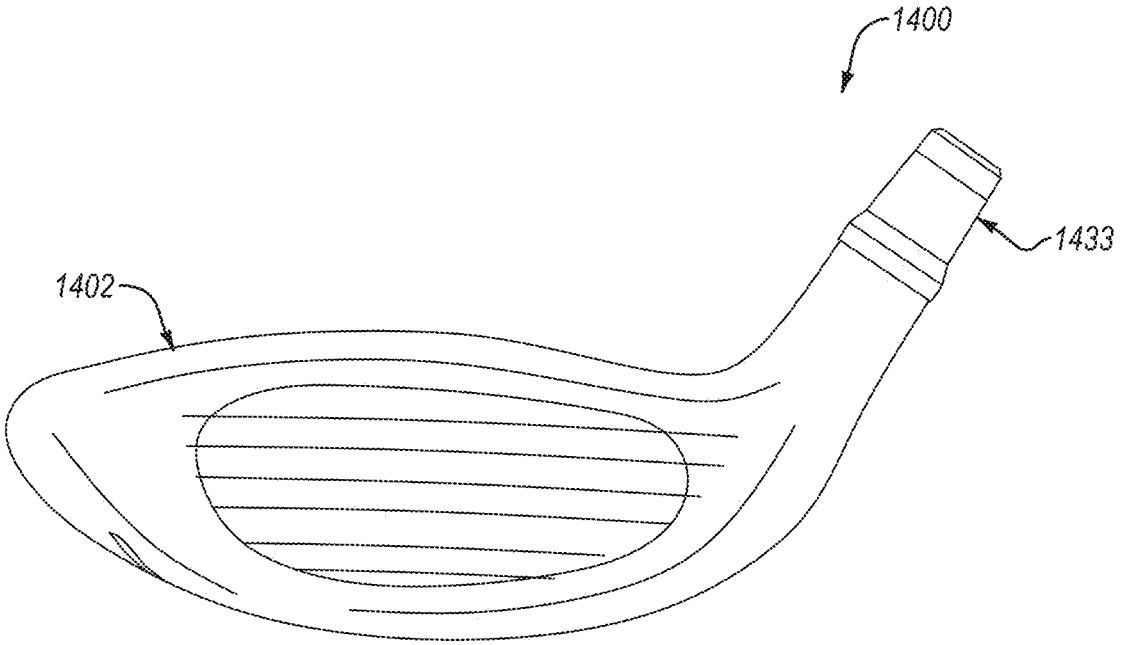
FIG. 45 is a front view of the golf club head of FIG. 39, according to one or more examples of the present disclosure.

As shown in FIG. 40, the weight track 1430 preferably has a recess, which may be generally rectangular in shape, to provide a recessed track to seat and guide the weight assembly 1432 as it adjustably slides along the track 1430. The track 1430 includes one or more peripheral rails or ledges to define an elongate channel preferably having a width dimension less than the width of the weight placed in the channel. In this way, the weight assembly 1432 can slide in the weight track 1430 while the rails prevent it from passing out of the track 1430. At the same time, the channels between the ledges permit the screws of the weight assembly 1432 to pass through the center of the outer weight elements, through the channels, and then into threaded engagement with the inner weight elements. The ledges serve to provide track or rails on which the joined weight assembly freely slide while effectively preventing the weight assembly from inadvertently slipping out of the track, even when loosened.

The weight assembly 1432 can be adjusted by loosening the screws and moving the weight assembly 1432 to a desired location along the track 1430, then the screws can be tightened to secure them in place. The weight assembly 1432 can also be swapped out and replaced by other weight assemblies having different masses to provide further mass adjustment options. If a second or third weight is added to the weight track 1432, many additional weight location and distribution options are available for additional fine tuning of the head's effective CG location in the heel-toe direction and the front-rear direction, and combinations thereof. This also provides great range of adjust of the club head's MOI properties.

In certain embodiments, the weight track 1430 has certain track widths. The track widths may be measured, for example, as the horizontal distance between a first track wall and a second track wall that are generally parallel to each other on opposite sides of the inner portion of the track that receives the inner weight member of the weight assembly. The width of the weight track 1430 can be the horizontal distance between opposing walls of the inner recesses of the weight track 1430. The track width may be between about 5 mm and about 20 mm, such as between about 10 mm and about 18 mm, between about 12 mm and about 16 mm, or between about 8 mm and about 20 mm. According to some embodiments, the depth of the track 1430 (i.e., the vertical distance between the uppermost inner wall in the track and an imaginary plane containing the regions of the sole adjacent the outermost lateral edges of the track) may be between about 6 mm and about 20 mm, such as between about 8 mm and about 18 mm, or such as between about 10 mm and about 16 mm.

The weight track 1430 has a certain track length. Track length may be measured as the horizontal distance between the opposing longitudinal end walls of the track 1430. Track length may be between about 30 mm and about 120 mm, such as between about 50 mm and about 100 mm, or such as between about 60 mm and about 90 mm. Additionally, or alternatively, the length of the track 1430 may be represented as a percentage of the striking face length. For example, the track 1430 may be between about 30% and about 100% of the striking face length, such as between about 50% and about 90%, or such as between about 60% and about 80% mm of the striking face length. The track depth, width, and length properties described above can also analogously also be applied to a front channel or other COR feature.

The COR feature 1496 may be similar to those already discussed. For example, the COR feature 1496 can be channel, slot (e.g., through-slot), and the like. The discussion above related to COR feature length and offset distance applies equally to this embodiment. Below are some additional ranges of parameters for club head 1400.

TABLE 14

| ranges | Embodiment 1400 FIGS. 39-45 |
|---|---|
| length of slot (mm) | 25-100, 25-60, 30-50, 35-45, 75-95, 60-80 |
| Zup (mm) | 12-16 |
| delta 1 (mm) | 8-12 |
| distance from leading edge to mass pad or end of slot (mm) | 7 mm-13 mm |
| Zup vs half head height (steel) (mm) | −5.7, −5.8, −5.9 |
| zup vs half head height (Ti) (mm) | −5.9, −6.0, −6.10 |

A golf club head 1500, according to one example, is shown in FIGS. 47-50. The golf club head 1500 includes a body 1510, which is substantially hollow. The body 1510 has a toe region 1514 and a heel region 1516, opposite the toe region 1514. The body 1510 also has a forward region 1512 and a rearward region 1518, opposite the forward region 1512. The body 1510 of the golf club head 1500 additionally includes a sole portion 1517, defining a bottom of the golf club head 1500, and a crown portion 1519, opposite the sole portion 1517 and defining a top of the golf club head 1500. Furthermore, the body 1510 includes a face portion 1542 at the forward region 1512 of the body 1510. Described in more detail below, the face portion 1542 includes a strike plate 1522 with a strike face 1531, which is a forward-facing surface of the strike plate 1522 that impacts a golf ball during a proper golf swing. Also, the body 1510 of the golf club head 1500 includes a skirt portion 1521 that defines a transition region where the body 1510 of the golf club head 1500 transitions between the crown portion 1519 and the sole portion 1517. Accordingly, the skirt portion 1521 is located between the crown portion 1519 and the sole portion 1517.

Figure 47:
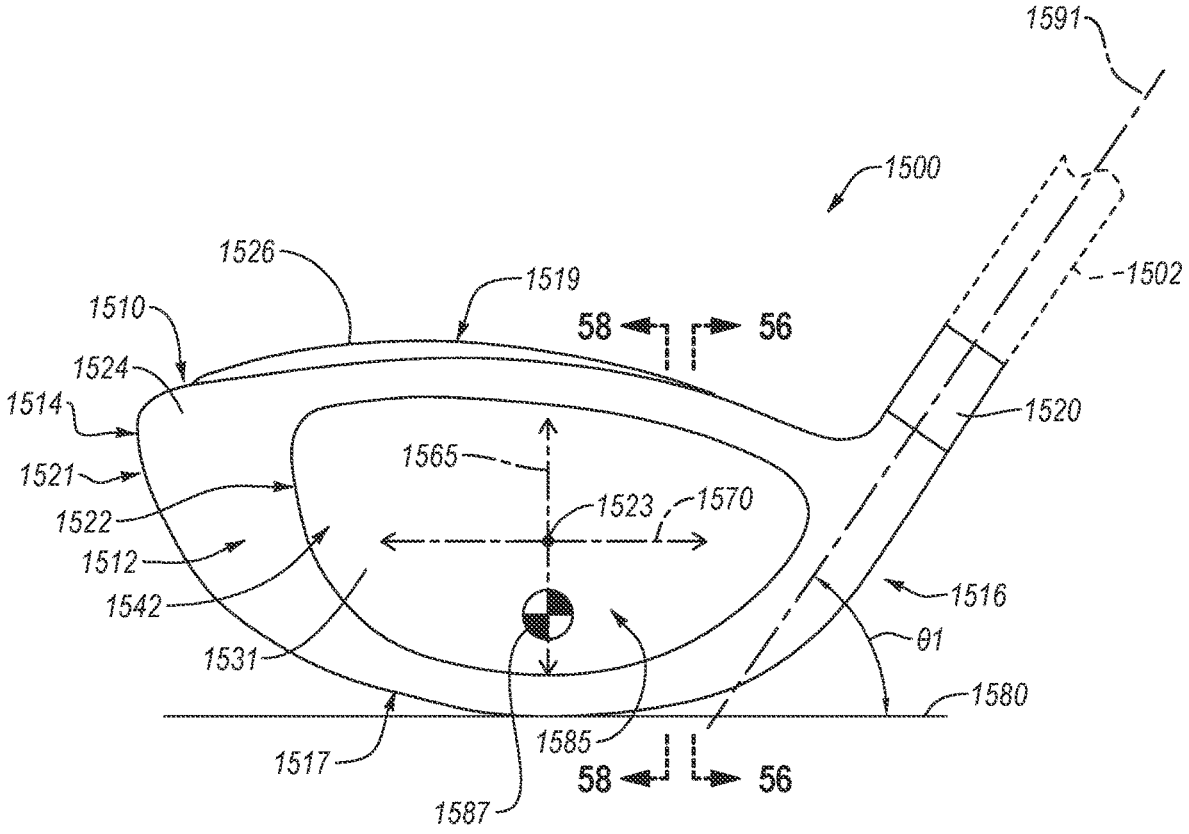
FIG. 47 is a front elevation view of a golf club head, according to one or more examples of the present disclosure.
Figure 48:
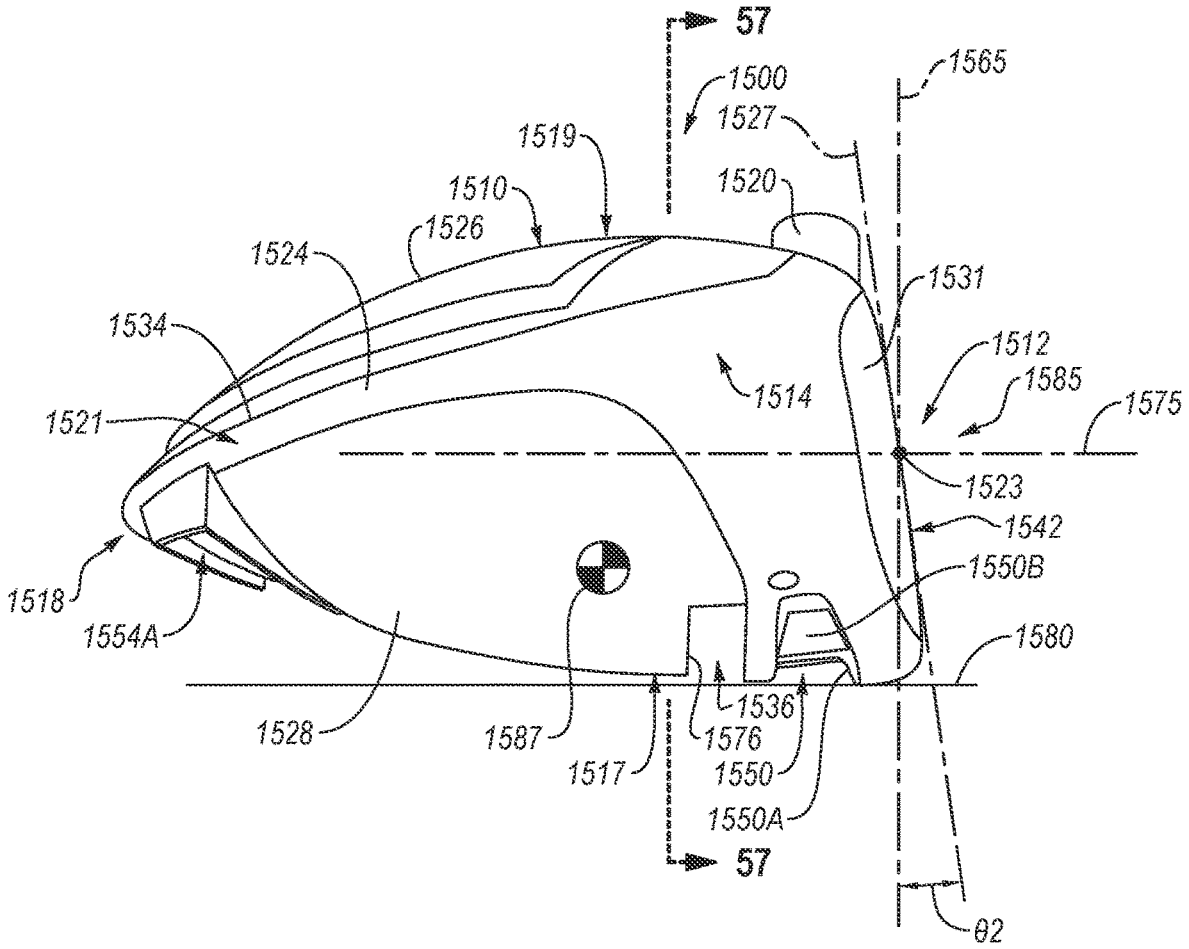
FIG. 48 is a side elevation view of the golf club head of FIG. 47, according to one or more examples of the present disclosure.

As used herein, "crown portion" means an upper portion of the golf club head 1500 above a periphery 1534 of the club head 1500 as viewed from a top-down direction (see, e.g., FIG. 49) and rearward of the topmost portion of the strike face 1531. As used herein, "sole portion" means a lower portion of the golf club head 1500 extending upwards from a lowest point of the golf club head 1500 when the golf club head is at the normal address position. In some implementations, the sole portion 1517 extends approximately 50% to 60% of the distance from the lowest point of the golf club head 1500 to the crown 1519. In other implementations, the sole portion 1517 extends upwardly from the lowest point of the golf club head 1500 a shorter distance. Further, the sole portion 1517 can define a substantially flat portion extending substantially horizontally relative to the ground plane 1580 when in normal address position or can have an arced or convex shape as shown in FIGS. 47 and 48. As used herein, "skirt portion" means a side portion of the golf club head 1500 between the crown portion 1519 and the sole portion 1517 that extends across a periphery 1534 of the golf club head 1500, excluding the strike face 1531, from the toe region 1514, around the rearward region 1518, to the heel region 1516. As used herein, "strike face" means a front or external surface of the strike plate 1522 of the face portion 1542 configured to impact a golf ball. In some embodiments, the strike plate 1522 can be attached to the body 1510 using known attachment techniques, such as welding, or co-formed with the body 1510 to form a one-piece, unitary and monolithic, construction with the body 1510. Further, the strike face 1531 can have a variable thickness. In certain embodiments, the strike face 1531 has a bulge and roll curvature (discussed more fully below).

The golf club head 1500 also includes a hosel 1520 extending from the heel region 1516 of the body 1510 of the golf club head 1500. As shown in dashed line in FIG. 47, a shaft 1502 of a golf club may be attached directly to the hosel 1520 or, alternatively, attached indirectly to the hosel 1520, such as via a flight control technology (FCT) component (e.g., an adjustable lie/loft assembly) coupled with the hosel 1520. The golf club includes a grip (not shown) fitted around a distal end or free end of the shaft 1502. The grip of the golf club helps promote the handling of the golf club by a user during a golf swing. The golf club head 1500 defines a hosel axis 1591, which is coaxial with the shaft 1502 and defines a central axis of the hosel 1520.

Figure 49:
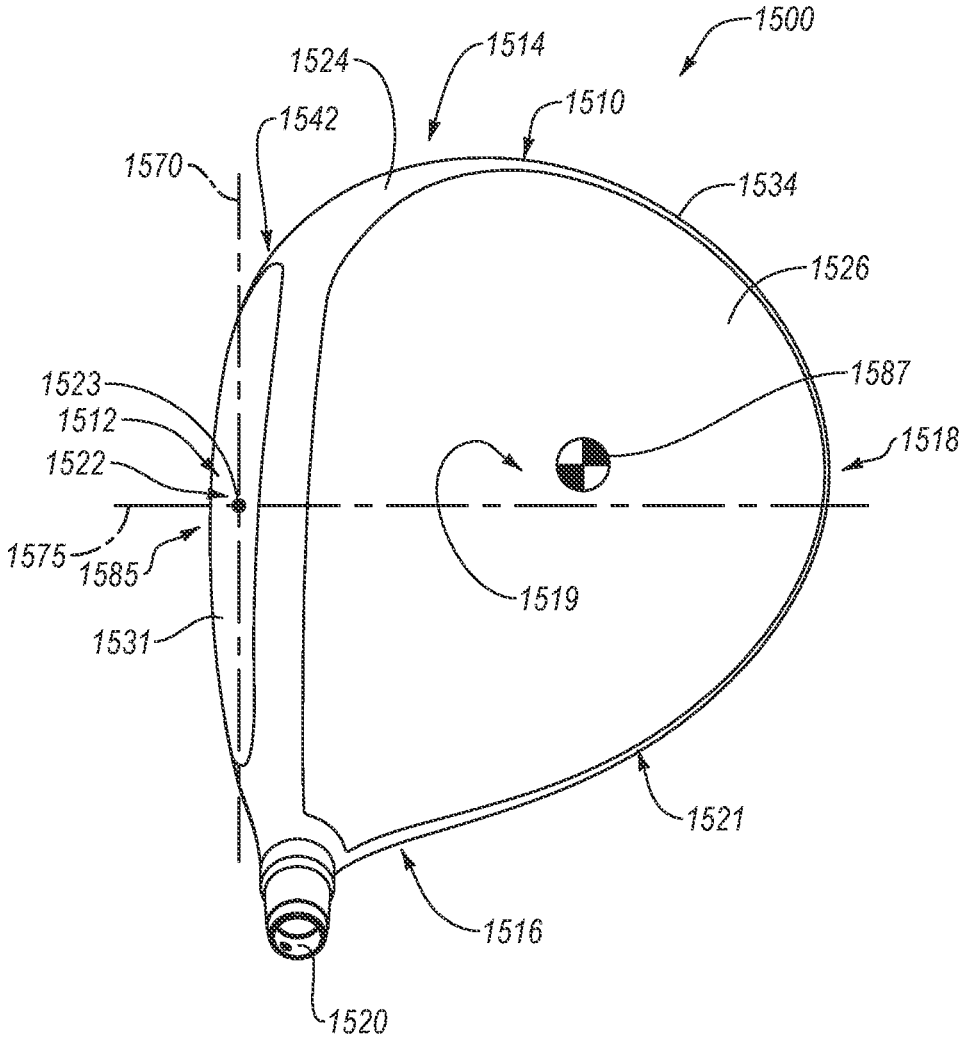
FIG. 49 is top plan view of the golf club head of FIG. 47, according to one or more examples of the present disclosure.
Figure 50:
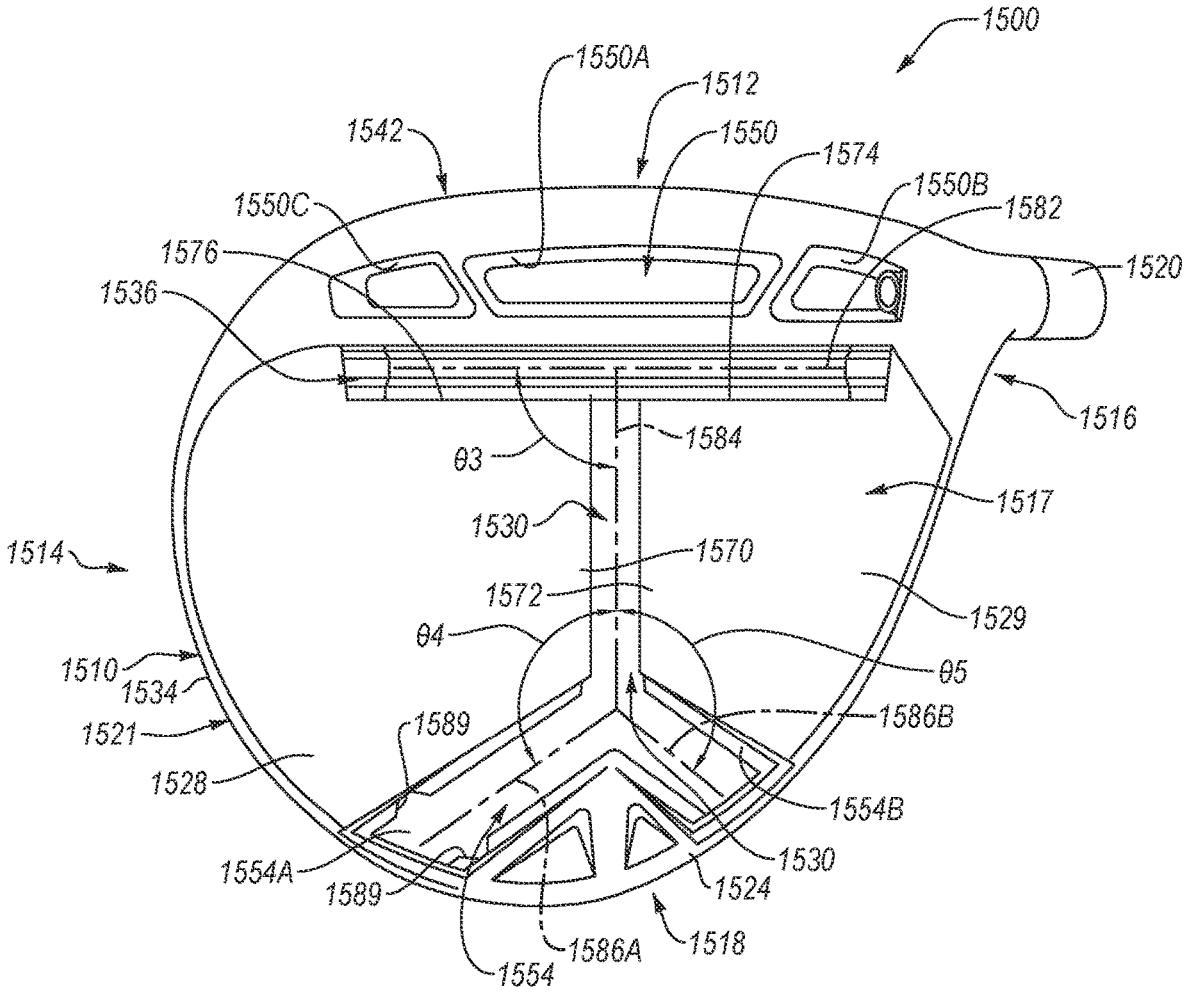
FIG. 50 is a bottom view of the golf club head of FIG. 47, according to one or more examples of the present disclosure.
Figure 51:
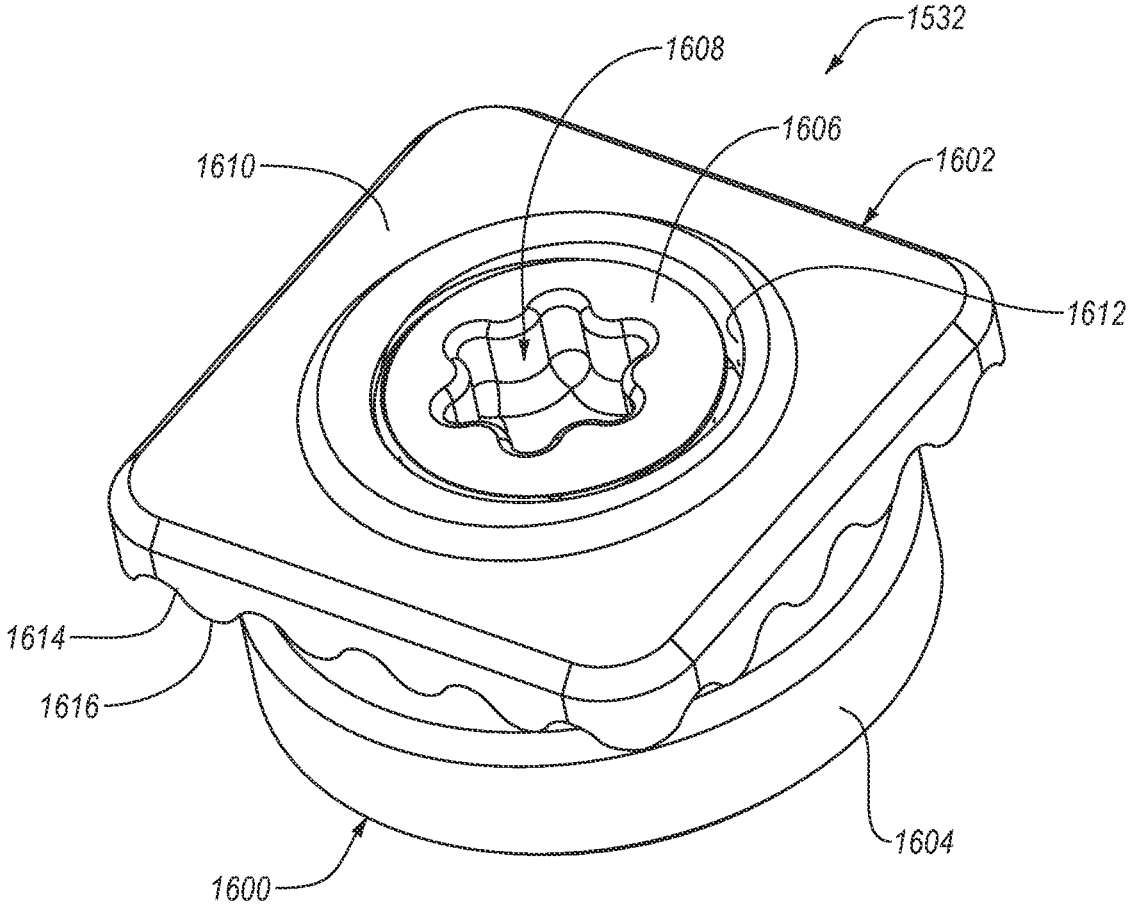
FIG. 51 is a perspective view of a weight assembly of a golf club head, according to one or more examples of the present disclosure.
Figure 52:
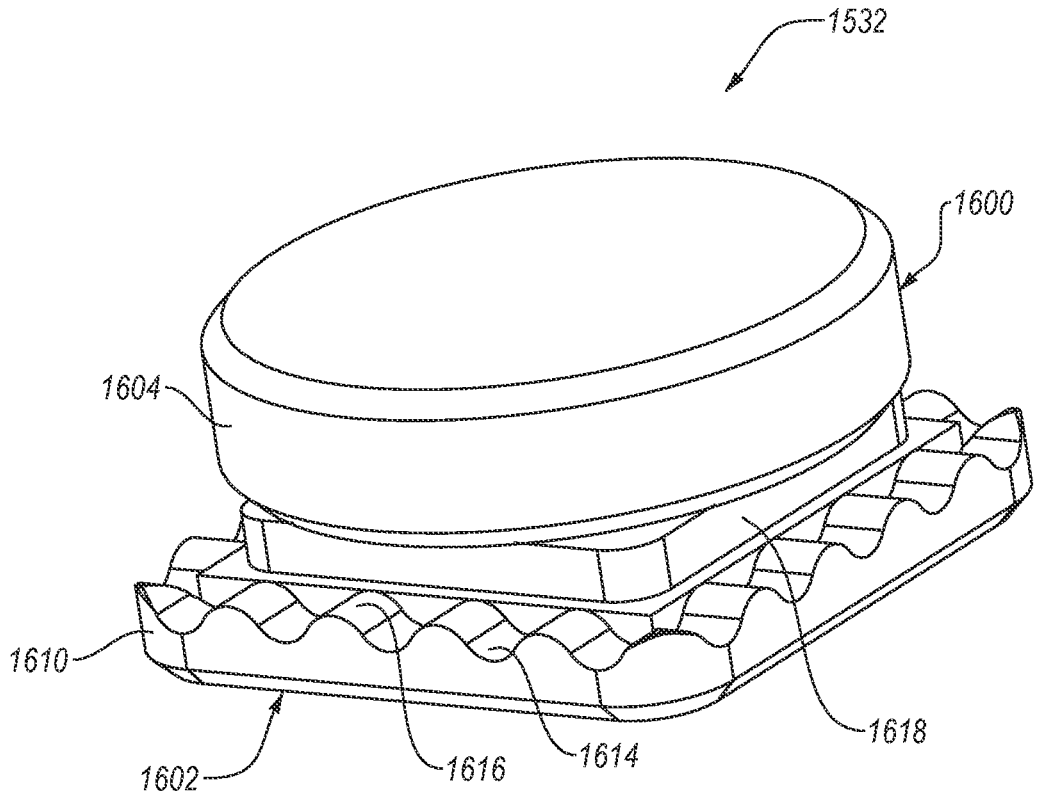
FIG. 52 is another perspective view of the weight assembly of FIG. 51, according to one or more examples of the present disclosure.
Figure 53:
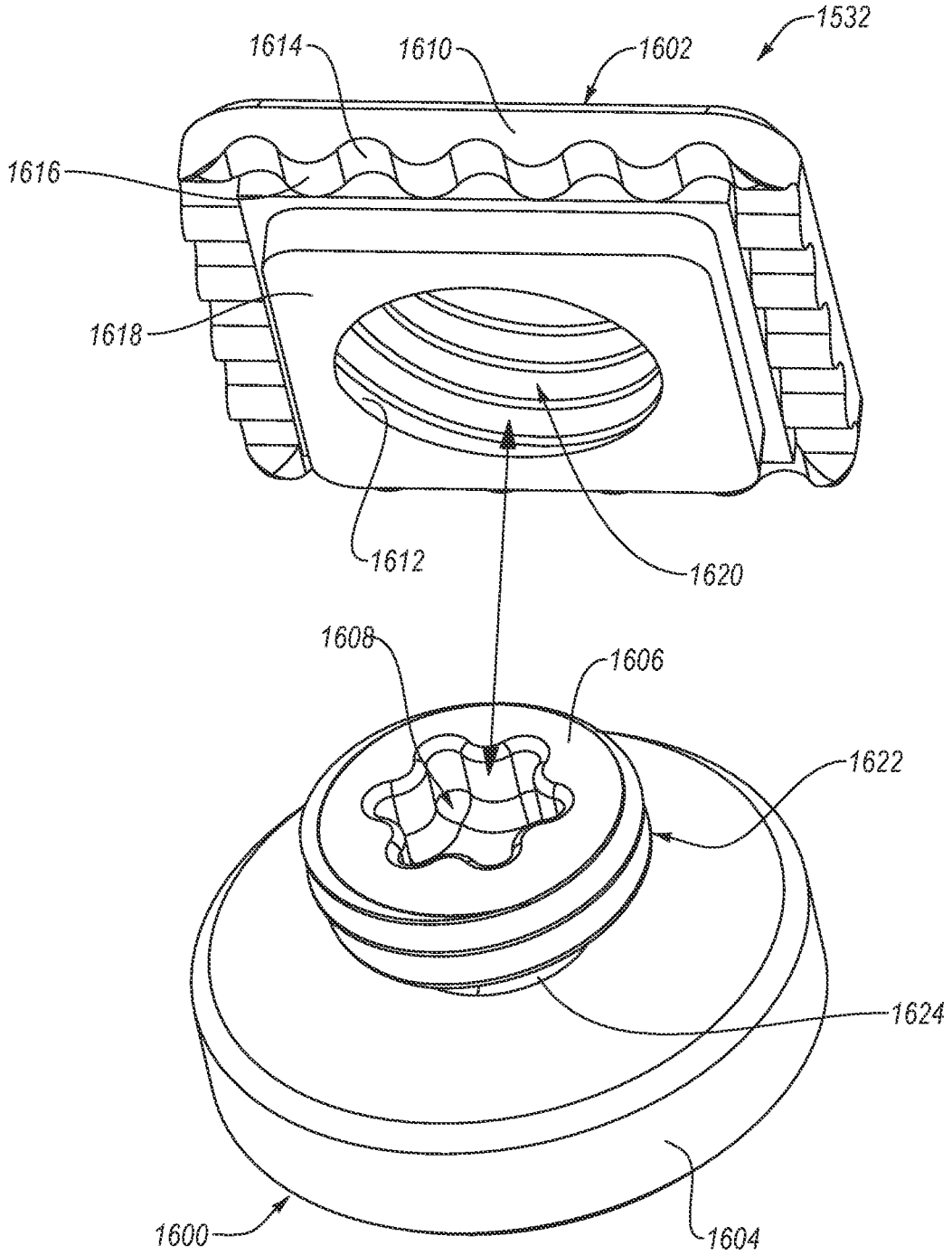
FIG. 53 is an exploded perspective view of the weight assembly of FIG. 51, according to one or more examples of the present disclosure.
Figure 54:
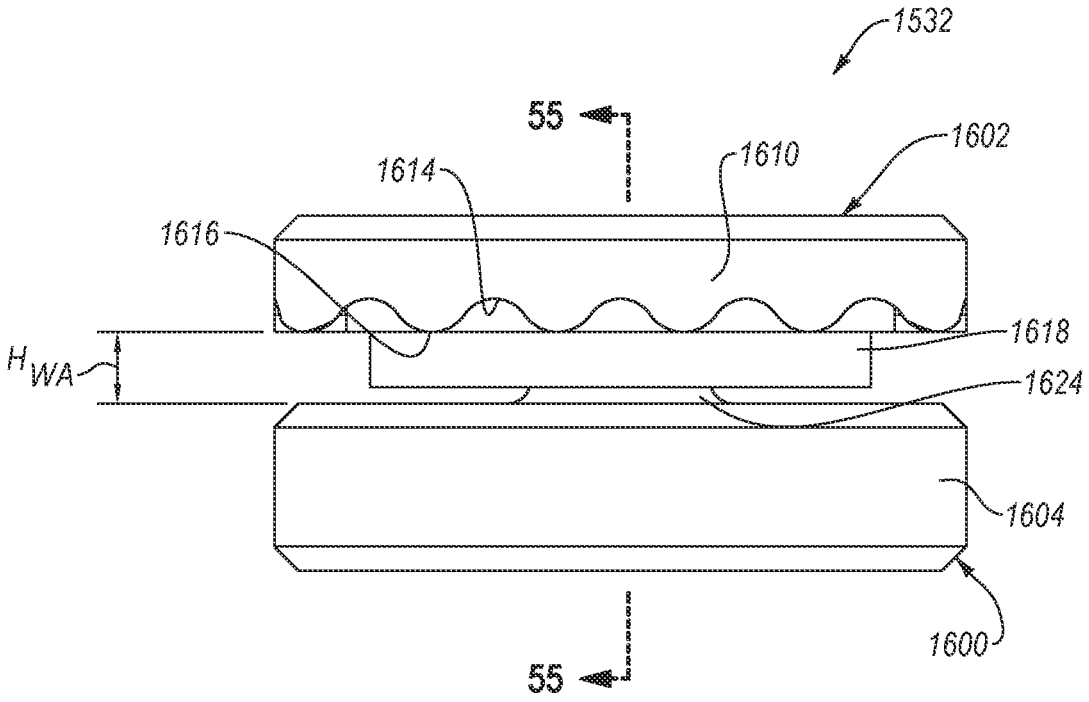
FIG. 54 is a side elevation view of the weight assembly of FIG. 51, according to one or more examples of the present disclosure.

The golf club head 1500 and many of its physical characteristics disclosed herein will be described using "normal address position" as the club head reference position, unless otherwise indicated. FIGS. 47-49 illustrate the golf club head 1500 at normal address position. As used herein, "normal address position" means the position of the golf club head 1500 when a vector normal to a center 1523 of the strike face 1531 lies in a first vertical plane (a vertical plane is perpendicular to a ground plane 1580 or horizontal plane), the hosel axis 1591 lies in a second vertical plane, and the first vertical plane and the second vertical plane perpendicularly intersect. For purposes of this description, the center 1523 is also referred to as the "geometric center" of the strike face 1531 (see also USGA "Procedure for Measuring the Flexibility of a Golf Clubhead," Revision 2.0, for a methodology to measure the geometric center of the strike face 1531).

When at normal address position, the hosel axis 1591 is disposed at a lie angle θ1 relative to the ground plane 1580 (as shown in FIG. 47) and the strike face 1531 has a loft angle θ2 (as shown in FIG. 49). The loft angle θ2 refers to the angle between a tangent line 1527 tangent to the strike face 1531, at the center 1523, and a z-axis 1565 normal to the ground plane 1580 at normal address position.

As shown in FIGS. 47-49, in the normal address position the golf club head 1500 is positioned such that the lie angle θ1 is approximately 60-degrees and the strike face 1531 is square relative to an imaginary target line. Positioning the golf club head 1500 in the reference position lends itself to using a club head origin coordinate system 1585 for making various measurements. Additionally, the USGA methodology may be used to measure various parameters of the golf club head 1500 described in this application, such as head height, head width, strike face height, strike face width, center of gravity (CG) location, and the like. Accordingly, reference to the measurement methods described in the '946 App and the USGA procedure is advised. Notably, however, the origin and axes used in this application may not necessarily be aligned or oriented in the same manner as those described in the '946 App or the USGA procedure. Further details are provided below on locating the club head origin coordinate system 1585.

U.S. Patent Application Publication No. 2014/0302946 A1 ('946 App), published Oct. 9, 2014, describes a reference position similar to the normal address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the golf club head 1500 in the reference position.

Referring still to FIGS. 47-49, the club head origin coordinate system 1585 is defined such that the location of various features of the club head (including a CG 1587 of the golf club head 1500) can be determined. The center 1523 of the strike face 1531 is defined as the origin of the golf club head 1500 and thus the center of the origin coordinate system 1585. The origin coordinate system 1585 includes three axes: the z-axis 1565 extending through the center 1523 of the strike face 1531 in a generally vertical direction relative to the ground plane 1580 when the golf club head 1500 is at the normal address position; an x-axis 1570 extending through the center 1523 of the strike face 1531 in a toe-to-heel direction generally parallel to the strike face 1531 (e.g., generally tangential to the strike face 1531 at the center 1523) and generally perpendicular to the z-axis 1565; and a y-axis 1575 extending through the center 1523 of the strike face 1531 in a front-to-back direction and generally perpendicular to the x-axis 1570 and to the z-axis 1565. The x-axis 1570 and the y-axis 1575 both extend in generally horizontal directions relative to the ground plane 1580 when the golf club head 1500 is at the normal address position. The x-axis 1570 extends in a positive direction from the center 1523 towards the heel region 1516 of the golf club head 1500. The y-axis 1575 extends in a positive direction from the center 1523 towards the rearward region 1518 of the golf club head 1500. The z-axis 1565 extends in a positive direction from the center 1523 towards the crown portion 1519.

Generally, the CG 1587 of the golf club head 1500 is the point at which the entire weight of the golf club head 1500 may be considered as concentrated so that if supported at this point the head would remain in equilibrium in any position. As shown in FIGS. 47-49, the CG 1587 is shown as a point inside the body 1510 of the golf club head 1500. The location of the CG 1587 can also be defined with reference to the club head origin coordinate system 1585. For example, the location of the CG 1587 along the x-axis 1570, the y-axis 1575, and the z-axis 1565 can be defined as the CGx, CGy, and CGz of the CG 1587. The position of other features of the golf club head 1500 can similarly defined.

The golf club head 1500 disclosed herein may have a volume equal to the volumetric displacement of the body 1510. In other words, for a golf club head with one or more weight ports or other features formed into the body 1510 and located within the head, it is assumed that the weight ports or other features are either not present or are "covered" by regular, imaginary surfaces, such that the club head volume is not affected by the presence or absence of ports or other such features. The golf club head 1500 of the present application can be configured to have a head volume between about 110 $cm^3$ and about 600 $cm^3$ in some embodiments. In more particular embodiments, the head volume may be between about 250 $cm^3$ and about 500 $cm^3$. In yet more specific embodiments, the head volume may be between about 300 $cm^3$ and about 500 $cm^3$, between about 300 $cm^3$ and about 360 $cm^3$, between about 300 $cm^3$ and about 420 $cm^3$ or between about 420 $cm^3$ and about 500 $cm^3$.

In the case of a driver, the golf club head 1500 may have a volume between about 300 $cm^3$ and about 460 $cm^3$, and a total mass between about 145 g and about 245 g. In the case of a fairway wood, the golf club head 1500 may have a volume between about 100 $cm^3$ and about 250 $cm^3$, and a total mass between about 145 g and about 260 g. In the case of a utility or hybrid club, the golf club head 1500 may have a volume between about 60 $cm^3$ and about 150 $cm^3$, and a total mass between about 145 g and about 280 g.

In some embodiments, such as shown in FIGS. 48 and 50-52, the body 1510 of the golf club head 1500 includes a frame 1624 to which one or more inserts (e.g., crown insert 1526, first sole insert 1528, and second sole insert 1529) of the body 1510 are coupled. For example, the crown portion 1519 of the body 1510 includes the crown insert 1526 coupled to a top side of the frame 1524. Similarly, the sole portion 1517 of the body 1510 includes the first sole insert 1528 and the second sole insert 1529 coupled to a bottom side of the frame 1524. Although the crown insert 1526 is shown as a single piece, in other embodiments, the crown insert 1526 may include two or more pieces.

The frame 1524 of the golf club head 1500 also includes a front weight track 1536 (or toe-to-heel weight track), an intermediate weight track 1530 (or front-to-rear weight track), and a rear weight track 1536 located in the sole portion 1517 of the body 1510 of the golf club head 1500. The front weight track 1536, the intermediate weight track 1530, and the rear weight track 1536 each defines a track to which a weight assembly 1532 is selectively slidably mounted. Details of the weight assembly 1532 are described in more detail below with regards to FIGS. 51-58.

Figure 56:
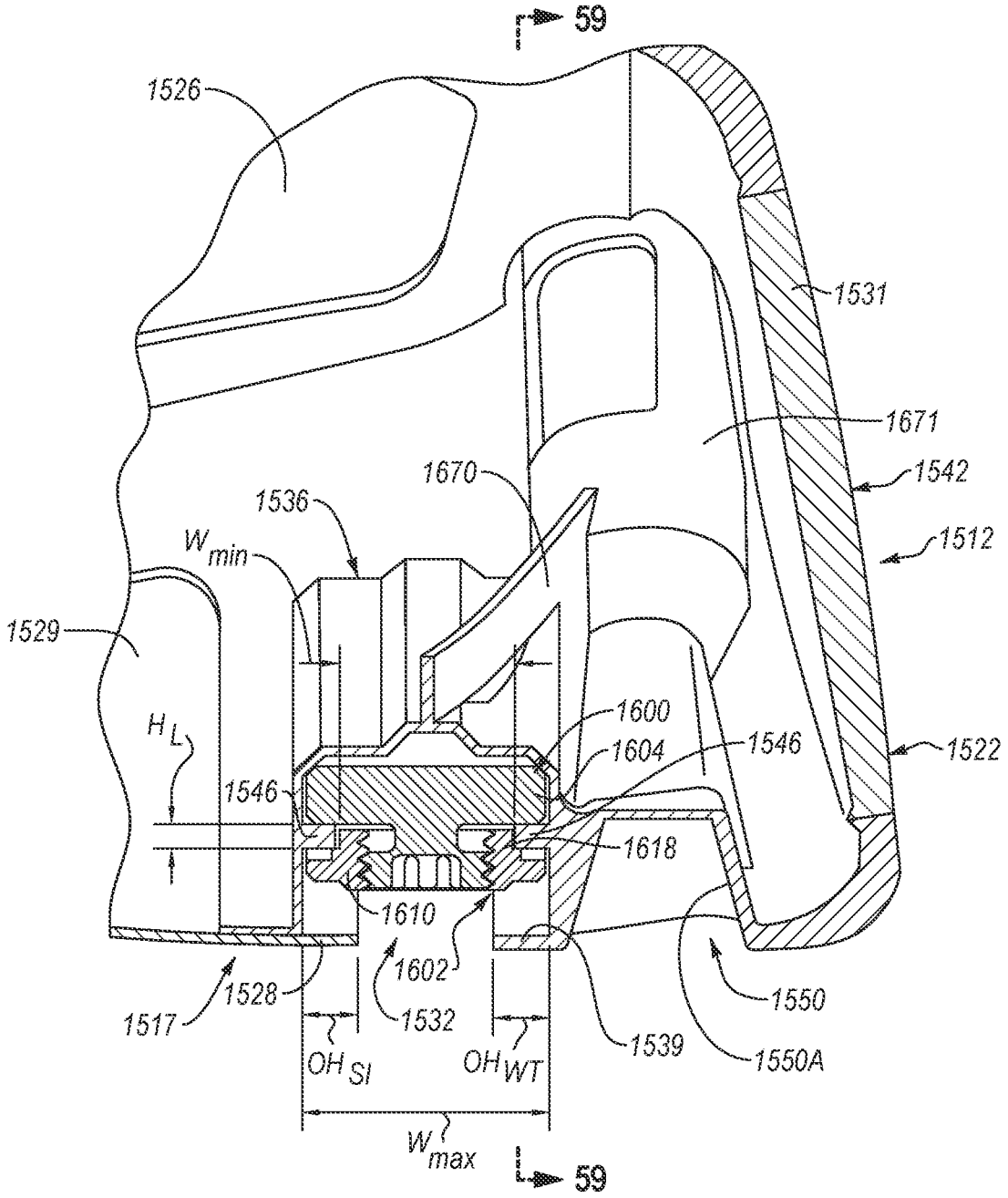
FIG. 56 is a cross-sectional side elevation view of a portion of the golf club head of FIG. 47, taken along the line 56-56 of FIG. 47, according to one or more examples of the present disclosure.

The front weight track 1536 is integrally formed with the frame 1524 at the forward region 1512 and along the sole portion 1517 of the body 1510. The front weight track 1536 extends generally parallel to, but offset from, the face portion 1542 of the golf club head 1500 and generally perpendicular to the intermediate weight track 1530. The intermediate weight track 1530. For example, the front weight track 1536 defines a first weight assembly path 1582 that is parallel to the x-axis 1570 of the origin coordinate system 1585. The front weight track 1536 and the first weight assembly path 1582 may be curved to follow a curvature of the sole portion 1517. In some implementations, as shown in FIG. 56, the frame 1524 includes an overhang 1539 formed in the sole portion 1517. The overhang 1539 overhangs a forward portion of the front weight track 1536 by a distance $OH_{WT}$. In some implementations, the distance $OH_{WT}$ is between about 5% and about 40% of the maximum width of the front weight track 1536. According to one implementation, the distance $OH_{WT}$ is about 25% of the maximum width of the front weight track 1536. An exterior surface of the overhang 1539 forms an exterior (e.g., exterior-most) surface of the sole portion 1517.

In some embodiments, the front weight track 1536 is offset from the face portion 1542 by an offset distance, which is the minimum distance between a first vertical plane passing through the center 1523 of the strike face 1531 and the front weight track 1536 at the same x-axis coordinate as the center 1523, between about 5 mm and about 50 mm, such as between about 5 mm and about 35 mm, such as between about 5 mm and about 30 mm, such as between about 5 mm and about 20 mm, or such as between about 5 mm and about 15 mm. The offset distance accommodates locating a channel 1550, formed into the sole portion 1517, between the face portion 1542 and the front weight track 1536. However, in some implementations, the golf club head 1500 does not include the front weight track 1536, such that the channel 1550 is directly between the face portion 1542 and the intermediate weight track 1530. For example, the intermediate weight track 1530 may terminate at the channel 1550.

The channel 1550 is a coefficient of restitution (COR) feature configured to improve and/or increase the COR across the strike face 1531. The COR of the golf club head 10 is a measurement of the energy loss or retention between the golf club head 10 and a golf ball when the golf ball is struck by the golf club head 10. Desirably, the COR of the golf club head 10 is high to promote the efficient transfer of energy from the golf club head 10 to the ball during impact with the ball. Accordingly, the COR feature of the golf club head 10 promotes an increase in the COR of the golf club head 10. In some implementations, the channel 1550 can be a closed channel or an open channel, such as a through-slot. As described above, the channel 1550 acts as a COR feature to help increase the COR of the golf club head 10 by increasing or enhancing the perimeter flexibility of the strike face 1531 of the golf club head 1500. According to certain implementations, the COR feature may be located in the forward region 1512 of the sole portion 1517 of the body 1510, adjacent to or near to a forwardmost edge of the sole portion 1517.

The channel 1550 may be a through-slot as discussed above and in U.S. patent application Ser. No. 13/839,727. Moreover, the channel 1550 may have a width (W), length (L), and perimeter. In some embodiments, the width of the channel 1550 may be between about 5 mm and about 20 mm, such as between about 10 mm and about 18 mm, such as between about 12 mm and about 16 mm, or it may be larger or smaller. The length of the channel 1550 may be between about 30 mm and about 120 mm, such as between about 50 mm and about 100 mm, such as between about 60 mm and about 90 mm, or it may be larger or smaller. Additionally, or alternatively, the length of the channel 1550 may be represented as a percentage of a length of the strike face 1531. For example, the channel 1550 may be between about 30% and about 100% of the striking face length, such as between about 50% and about 90%, or such as between about 60% and about 80% mm of the length of the strike face 1531. The perimeter of the channel 1550 may be between about 70 mm and about 280 mm, such as between about 120 mm and about 240 mm, such as between about 160 mm and about 200 mm, or it may be larger or smaller.

The channel 1550 may be made up of curved sections, or several segments that may be a combination of curved and straight segments. Furthermore, the channel 1550 may be machined or cast into the head. Although shown in the sole portion 1517 of the golf club head 1500, the channel 1550 may be incorporated into the crown portion 1519 of the golf club head 1500.

The channel 1550 or channel may be filled with a material to prevent dirt and other debris from entering the channel 1550 and possibly the cavity of the golf club head 1500 when the channel 1550 is a through-slot. The filling material may be any relatively low modulus materials including polyurethane, elastomeric rubber, polymer, various rubbers, foams, and fillers. The filling material should not substantially prevent deformation of the golf club head 1500 when in use as this would counteract the perimeter flexibility.

Further details concerning the channel 1550 or the COR feature of the golf club head 1500 can be found in U.S. patent application Ser. Nos. 13/338,197, 13/469,031, 13/828,675, filed Dec. 27, 2011, May 10, 2012, and Mar. 14, 2013, respectively. Additional details concerning a COR feature in the form of a slot, instead of a channel, can be found in U.S. patent application Ser. No. 13/839,727, filed Mar. 15, 2013. Yet further details concerning the COR feature of the golf club head 1500 can be found in U.S. Pat. No. 8,235,844, filed Jun. 1, 2010, U.S. Pat. No. 8,241,143, filed Dec. 13, 2011, U.S. Pat. No. 8,241,144, filed Dec. 14, 2011.

The intermediate weight track 1530 is integrally formed with the frame 1524 along the sole portion 1517 between the front weight track 1536 and the rearward region 1518. The intermediate weight track 1530, and a second weight assembly path 1584 defined by the intermediate weight track 1530, defines an angle θ3 with the first weight assembly path 1582. In one implementation, the angle θ3 is approximately 90-degrees. However, in other implementations, the angle θ2 is less than 90-degrees or more than 90-degrees, such as between 20-degrees and 90-degrees, between 40-degrees and 90-degrees, between 60-degrees and 90-degrees, between 70-degrees and 90-degrees, between 90-degrees and 160-degrees, between 90-degrees and 140-degrees, or between 90-degrees and 110-degrees. The particular angle of angle θ2 may depend on the geometry of the golf club head 1500. In some embodiments, angling the intermediate weight track 1530 relative to the front weight track 1536 at an angle less than or more than 90-degrees may help reduce any draw or fade bias compared to an angle of 90-degrees especially when shifting the weight along the intermediate weight track 1530.

The rear weight track 1554 is integrally formed with the frame 1524 along the sole portion 1517 between the intermediate weight track 1530 and the rearward region 1518 (i.e., a rearward-most edge of the body 1510. The rear weight track 1554 extends away from the intermediate weight track 1530 a direction from the front portion 1542 towards the rearward region 1518. In one embodiment, as shown, the rear weight track 1554 includes two diverging branches. For example, the rear weight track 1554 includes a first branch 1554A and a second branch 1554B. The first branch 1554A extends away from the second weight assembly path 1584 toward the toe region 1514 and the second branch 1554B extends away from the second weight assembly path 1584 toward the heel region 1516. The first branch 1554A of the rear weight track 1554, and a third weight assembly path 1586A defined by the first branch 1554A, defines an angle θ4 with the second weight assembly path 1584. Similarly, the second branch 1554B of the rear weight track 1554, and a fourth weight assembly path 1586B defined by the second branch 1554B, defines an angle θ5 with the second weight assembly path 1584.

In one implementation, each of the angle θ4 and the angle θ5 is between 0-degrees and approximately 180-degrees. In some implementations, the angle θ4 and/or the angle θ5 is less than 90-degrees, such as between 20-degrees and 60-degrees, between 30-degrees and 50-degrees, or about 45-degrees. Alternatively, the angle θ4 and/or the angle θ5 is more than 90-degrees, such as between 70-degrees and 150-degrees, between 80-degrees and 140-degrees, or about 135-degrees. The particular angle of angle θ4 and angle θ may depend on the geometry of the golf club head 1500. In some embodiments, angling the first branch 1554A and/or the second branch 1554B of the rear weight track 1554 may help reduce any draw or fade bias especially when shifting the weight along the rear weight track 1554. The angle θ4 and the angle θ5 can be the same or different. Although the first branch 1554A and the second branch 1554B of the rear weight track 1554 extend linearly away from the intermediate weight track 1530 in the illustrated embodiment, in other embodiments, the first branch 1554A and the second branch 1554B may be curved. For example, intermediate weight track 1530 may terminate at the rearmost portion of the sole portion 1517 and the first branch 1554A and the second branch 1554B may curve to match a curvature of the rearmost portion of the sole portion 1517. In fact, in some implementations, the first branch 1554A and the second branch 1554B may be curved so as to extend from the intermediate weight track 1530 at least partially forwardly.

Each of the front weight track 1536, the intermediate weight track 1530, and the rear weight track 1554 includes opposing rails or ledges 1546, along a length of the weight tracks, that facilitate retention of the weight assembly 1532 within the respective weight tracks. Generally, for each of the weight tracks, the weight assembly 1532 clamps down on the opposing ledges 1546 to releasably couple the weight assembly 1532 to the weight track. The weight assembly 1532 and the interaction with the ledges 1546 is described in more detail below.

In some embodiments, the intermediate weight track 1530 is contiguous with the front weight track 1536, and the rear weight track 1554 is contiguous with the front weight track 1536, such that the weight assembly 1532 can be continuously selectively slidable between the front weight track 1536 and the intermediate weight track 1530 and between the intermediate weight track 1530 and the rear weight track 1554 without removing the weight assembly 1532 from any one weight track. In this manner, the intermediate weight track 1530 can be considered an extension of the front weight track 1536 and the rear weight track 1554 can be considered an extension of the intermediate weight track 1530. For example, the ledges 1546 of the weight tracks may be seamlessly interconnected together. In one implementation, at least one ledge 1546 of at least one of the weight tracks includes a notch 1589 to help facilitate insertion of the weight assembly 1532 into the weight tracks. The notch 1589 effectively widens the gap (i.e., minimum track width Wmin (see, e.g., FIG. 56)) between opposing ledges 1546 at a single discrete location along the weight tracks. Alternatively, or in addition, the weight track can have closed ends and a depth of at least one of the weight tracks can be increased in a useable portion of the weight track to facilitate insertion of the weight assembly 1532 into the weight tracks. In yet another implementation, at least one of the weight tracks can have an open end through which the weight assembly 1532 can be installed into the weight tracks.

As shown in FIG. 56, the front weight track 1536, the intermediate weight track 1530, and the rear weight track 1554 have a certain maximum track width $W_{max}$ and a certain minimum track width $W_{min}$. Maximum track width $W_{max}$ is measured as the horizontal distance between a first channel wall and a second channel wall. For the front weight track 1536, the intermediate weight track 1530, and the rear weight track 1554, the maximum track width may be between about 5 mm and about 20 mm, such as between about 10 mm and about 18 mm, or such as between about 12 mm and about 16 mm. Minimum track $W_{min}$ width is the horizontal distance between opposing ledges 1546 of a given weight track. The minimum track width is less than the maximum track width. According to some embodiments, a depth of the weight tracks (i.e., the vertical distance between the bottom channel wall and an imaginary plane containing the regions of the sole portion 1517 adjacent the front and rear edges of the channel) may be between about 6 mm and about 20 mm, such as between about 8 mm and about 18 mm, or such as between about 10 mm and about 16 mm.

Additionally, the front weight track 1536, the intermediate weight track 130, and the rear weight track 1554 each has a track length. Track length may be measured as the horizontal distance between end walls of the weight tracks. The track length of one of more of the front weight track 1536, the intermediate weight track 1530, and the rear weight track 1554 can be between about 30 mm and about 120 mm, such as between about 50 mm and about 100 mm, or such as between about 60 mm and about 90 mm. Additionally, or alternatively, the length of the front weight track 1536 may be represented as a percentage of the length of the strike face 1531. For example, the front weight track 1536 may be between about 30% and about 100% of the length of the strike face 1531, such as between about 50% and about 90%, or such as between about 60% and about 80% mm of the length of the strike face 1531.

Referring to FIGS. 51-55, according to one embodiment, the weight assembly 1532 includes just two components. In other words, unlike some conventional weight assemblies for golf club heads that include three components (i.e., a three-piece weight assembly), the weight assembly 1532 includes only two components (i.e., is a two-piece weight assembly). The weight assembly 1532 is configured to be selectively adjustably secured to one of the weight tracks of the golf club head 1500. Generally, the weight assembly 1532 can be selectively loosened and allowed to slide along the weight tracks and selectively tightened, at a desired location along the weight tracks, to non-movably fix the weight assembly 1532 to the weight tracks. The weight assembly 1532 consists of an inner component 1600 and an outer component 1602. The inner component 1600 is rotatably coupled to the outer component 1602. For example, the inner component 1600 and the outer component 1602 are rotatable relative to each other in a first rotational direction to selectively loosen the weight assembly 1532 in a weight track and rotatable relative to each other in a second rotational direction, opposite the first rotational direction, to selectively tighten the weight assembly 1532 in a weight track. The inner component 1600 is so-termed because, when coupled with a weight track, the inner component 1600 is positioned interiorly of the outer component 1602. In contrast, the outer component 1602 is so-termed because, when coupled with a weight track, the outer component 1600 is positioned exteriorly of the inner component 1600.

The inner component 1600 includes an anchor element 1604, a mating element 1606, and a neck 1624. The neck 1624 is interposed between and couples together the anchor element 1604 and the mating element 1606. In one implementation, the anchor element 1604, the mating element 1606, and the neck 1624 are concentric. A maximum width $W_{AE}$ of the anchor element 1604 is greater than a maximum width $W_{ME}$ of the mating element 1606. Moreover, a maximum width $W_N$ of the neck 1624 is less than the maximum width $W_{ME}$ of the mating element 1606. The relatively narrow width of the neck 1624 helps to place the weight assembly 1532 in tension when tightened to the weight track and thus helps to keep the weight assembly 1532 tight against the weight track during use of the golf club head 1500.

In the illustrated embodiment, the anchor element 1604 of the inner component 1600 is a disc and the maximum width $W_{AE}$ of the anchor element 1604 is a diameter of the disc. The anchor element 1604, being circular shaped, promotes maneuverability within the weight tracks, can be manufactured via a lathing process, and optimizes volume and mass of the anchor element 1604. However, in other embodiments, the anchor element 1604, while being substantially flat and thin like a disc, has a non-round cross-sectional shape, such as a square shape where the maximum width $W_{AE}$ is a diagonal of the square. In some implementations, the anchor element 1604 has beveled edges to facilitate smoother movement along the weight tracks.

According to the illustrated embodiment, the neck 1624 of the inner component 1600 is a cylinder with a substantially circular cross-sectional shape. However, in other implementations, the neck 1624 may have a cross-sectional shape other than circular. The neck 1624 spans between the anchor element 1604 and the mating element 1606 such that a gap is defined between the anchor element 1604 and the mating element 1606.

The mating element 1606 of the inner component 1600 is configured to rotatably mate with the outer component 1602 and an adjustment tool (not shown) for rotating the inner component 1600 relative to the outer component 1602. To facilitate rotatable mating with the outer component 1602, the mating element 1606 includes external threads 1622 in one implementation. However, in other embodiments, the mating element 1606 may include other types of features that facilitate a frictional engagement between the inner component 1600 and the outer component 1602, such as a friction cam feature or a friction leaf spring feature. In one implementation, the mating element 1606 includes a socket 1608 configured to matingly receive an adjustment tool. The socket 1608 can be any of various types of sockets, such as a Torx™ drive socket, a hex drive socket, a square drive socket, and the like, depending on the type of adjustment tool.

The outer component 1602 of the weight assembly 1532 includes a head element 1610 and a boss 1618. The boss 1618 protrudes from an underside of the head element 1610. Accordingly, when the inner component 1600 is rotatably mated to the outer component 1602, the boss 1618 is interposed between, or positioned within a gap defined between, the head element 1610 of the outer component 1602 and the anchor element 1604 of the inner component 1600. Additionally, the outer component 1602 includes an aperture 161612 extending entirely through the head element 1610 and the boss 1618. The aperture 1612 includes internal threads 1620 configured to threadably engage the external threads 1622 of the mating element 1606. However, in other embodiments, aperture 1612 may include other types of features that facilitate a frictional engagement between the inner component 1600 and the outer component 1602, such as a friction cam feature or a friction leaf spring feature.

In one implementation, the head element 1610, the boss 1618, and the aperture 1612 are concentric. However, in other implementations, one or more of the head element 1610 or the boss 1618 can be non-concentric with the aperture 1612. A maximum width $W_{HE}$ of the head element 1610 is greater than a maximum width $W_B$ of the boss 1618.

Figure 55:
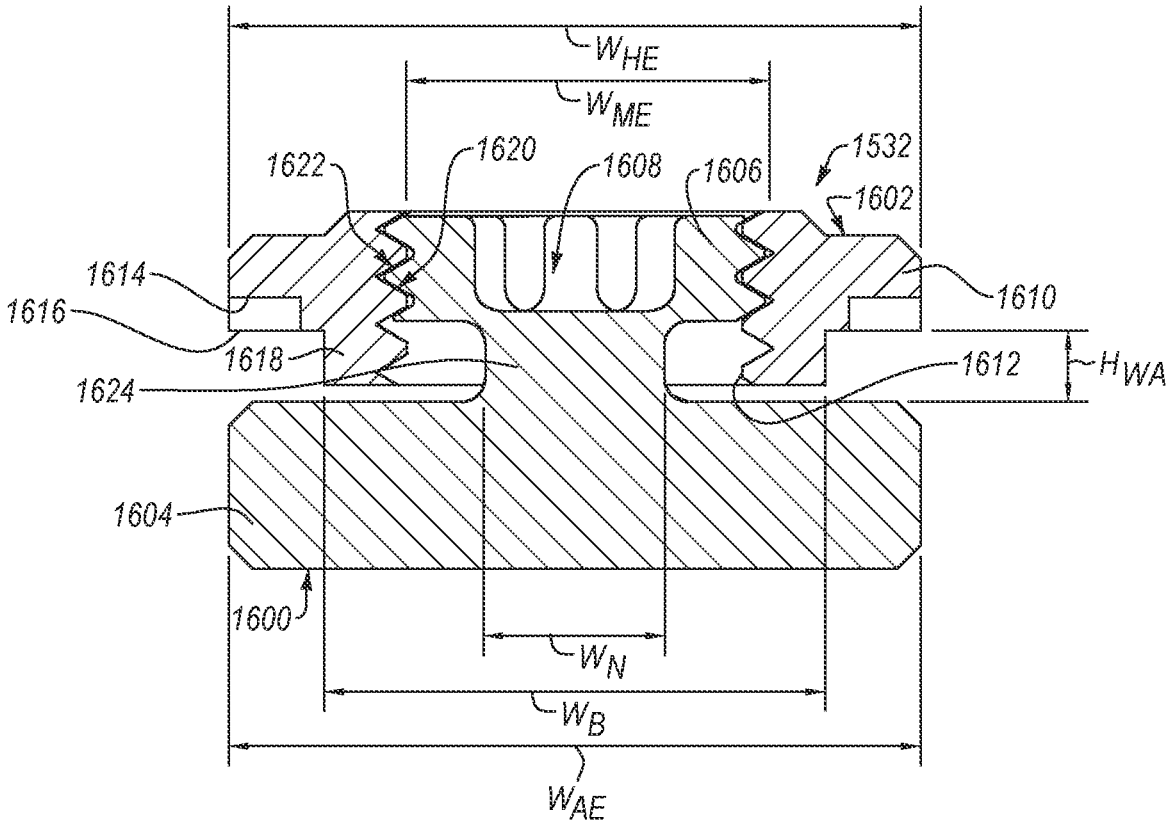
FIG. 55 is a cross-sectional side elevational side view of the weight assembly of FIG. 51, taken along the line 55-55 of FIG. 54, according to one or more examples of the present disclosure.

In the illustrated embodiment, the outer peripheral shape of the head element 1610 of the outer component 1602 is non-round. For example, as shown, the head element 1610 can be square shaped such that the maximum width $W_{HE}$ of the head element 1610 is a length of a side, or a diagonal, of the head element 1610. In other examples, the head element 1610 can be ovular, triangular, rectangular, or another non-circular shape. The head element 1610, being non-circular shaped, helps prevent the outer component 1602 from rotating within the weight tracks. More specifically, as shown in FIGS. 55 and 56 for example, with the maximum width $W_{HE}$ of the head element 1610 being equal to or greater than the maximum width $W_{max}$ of the weight tracks, the sidewalls of the weight tracks act as a stop to restrain rotation of the head element 1610, and thus the outer component 1602, relative to the weight tracks. For a square-shaped head element 1610, the maximum width $W_{HE}$ is the diagonal dimension head element 1610. However, as shown in the illustrated embodiment, the minimum width of the head element 1610, or the length of a side of the head element 1610, is equal to or just smaller than the maximum width $W_{max}$ of the weight tracks.

Figure 59:
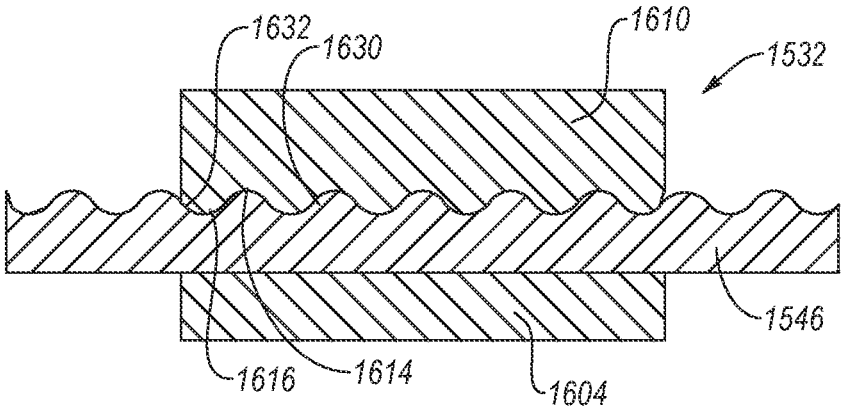
FIG. 59 is a schematic cross-sectional side elevation view of a weight assembly engaged with a ledge of a weight track, according to one or more examples of the present disclosure.
Figure 61:
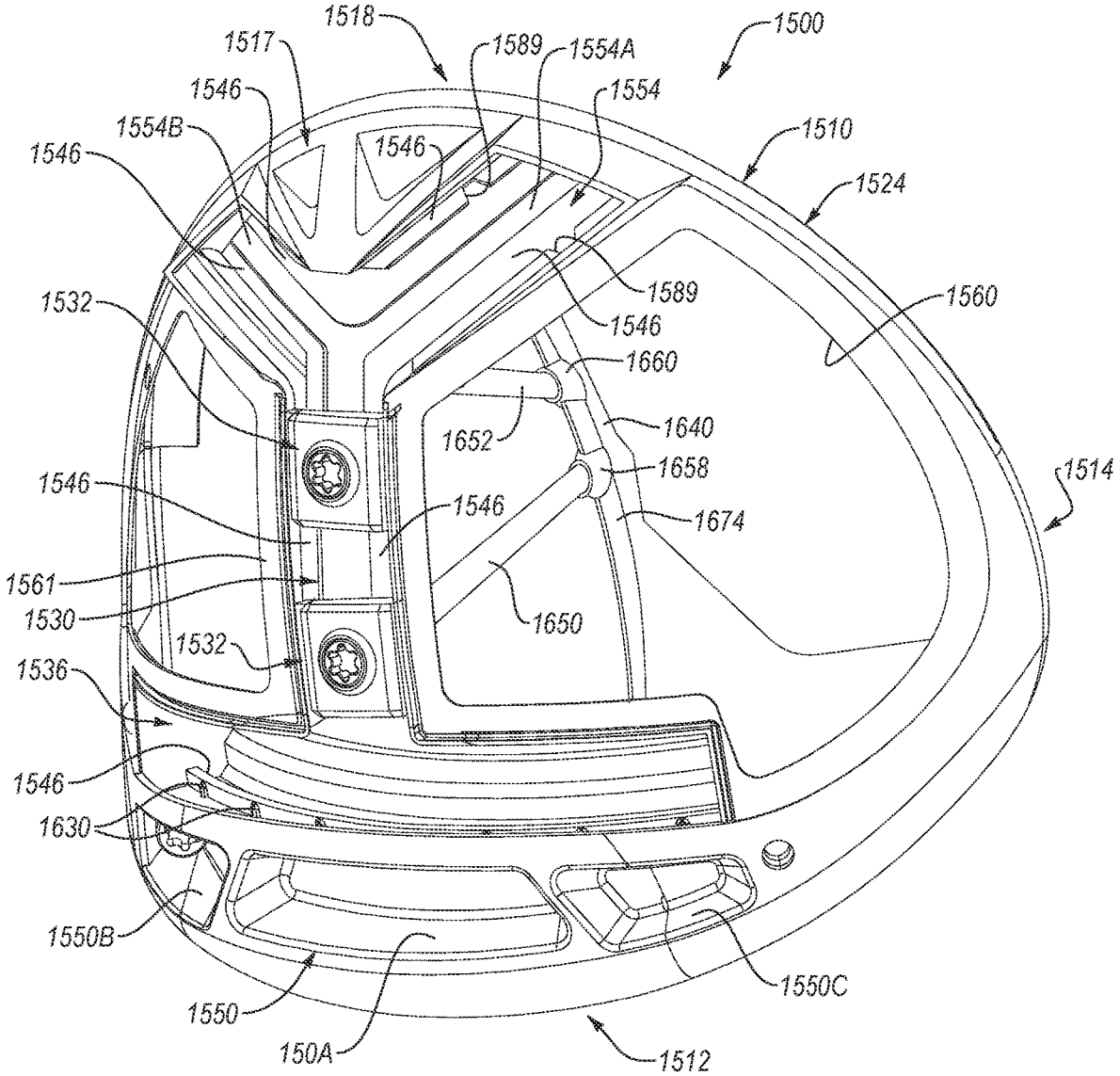
FIG. 61 is a perspective view of the golf club head of FIG. 47, shown with sole inserts removed, according to one or more examples of the present disclosure.

In some embodiments, the head element 1610 may include track engagement features configured to matingly engage corresponding weight engagement features formed in the weight tracks. For example, the head element 1610 in the illustrated implementation includes a plurality of tabs 1616 and a plurality of recesses 1614 or notches alternatingly formed into the underside of the head element 1610 adjacent the outer periphery of the head element 1610. Correspondingly, as shown in FIGS. 59 and 61, an outwardly facing surface of each ledge 1546 may include a plurality of tabs 1630 and a plurality of recesses 1632. Each recess 1632 of the ledge 1546 receives a respective one of the tabs 1616 of the head element 1610 and each tab 1630 of the ledge 1546 is received within a respective one of the recesses 1614 of the head element 1610. Engagement between corresponding recesses and tabs of the ledge 1546 and the head element 1610 can help promote non-movable fixation of the head element 1610 within the weight tracks when the weight assembly 1532 is clamped to the weight tracks. Additionally, the recesses and tabs of the ledge 1546 and the head element 1610 help promote proper and predictable positioning of the weight assembly 1532 along the weight tracks by associating each of the recesses and/or tabs of the ledge 1546 with indicia graphically identifying predetermined locations along the weight tracks. For example, the recesses and/or tabs in the ledges can serve as markers or indices to help locate the position of the weight assembly 1532 along the weight tracks.

Although the track engagement features shown are formed into the head element 1610 and the weight engagement features are formed into the outwardly facing surface of the ledges 1546, in other embodiments, the track engagement features can be formed into an outward side of the anchor element 1610 and the weight engagement features can be formed into the inwardly facing surface of the ledges 1546. Furthermore, although the recesses and tabs are shown to be substantially semi-circular shaped, in other implementations, the recesses and tabs can have other shapes, such as triangular, rectangular, and the like.

The outer peripheral shape of the boss 1618 may also have a non-circular shape. For example, as shown, the boss 1618 can be square shaped such that the maximum width $W_B$ of the boss 1618 is a length, or a diagonal, of a side of the boss 1618. When the outer peripheral shape of the boss 1618 is circular, the maximum width $W_B$ of the boss 1618 is a diameter of the boss 1618. The boss 1618, being non-circular shaped, helps prevent the outer component 1602 from rotating within the weight tracks. More specifically, as shown in FIG. 55 for example, with the maximum width $W_B$ of the boss 1618 being equal to or greater than the gap between the ledges 1546 of the weight tracks, the ledges 1546 of the weight tracks act as stops to restrain rotation of the boss 1618, and thus the outer component 1602, relative to the weight tracks.

The anchor element 1604, the mating element 1606, and the neck 1624 are co-formed as a one piece, unitary and seamless, one-piece construction. However, in some implementations, one or more of the anchor element 1604, the mating element 1606, and the neck 1624 are separately formed and attached to each other, such as via a welding or bonding technique. Similarly, the head element 1610 and the boss 1618 of the outer component 1602 can be co-formed as a one piece, unitary and seamless, one-piece construction. Alternatively, in some implementations, the head element 1610 and the boss 1618 are separately formed and attached to each other, such as via a welding or bonding technique. Each of the inner component 1600 and outer component 1602 can be made from any of various materials, such as metal (e.g., aluminum, tungsten, titanium, steel, associated alloys, etc.), plastic, composites, and the like. In one implementation, one or both of the inner component 1600 and the outer component 1602 is made from a high-density metal, such as tungsten. According to one implementation, the inner component 1600 is made of a different material than the outer component 1602. For example, the material of the outer component 1602 can be denser or heavier than that of the inner component 1600, or vice versa. The combined mass of the inner component 1600 and the outer component 1602 is between 3 grams and 32 grams in some implementations.

Figure 57:
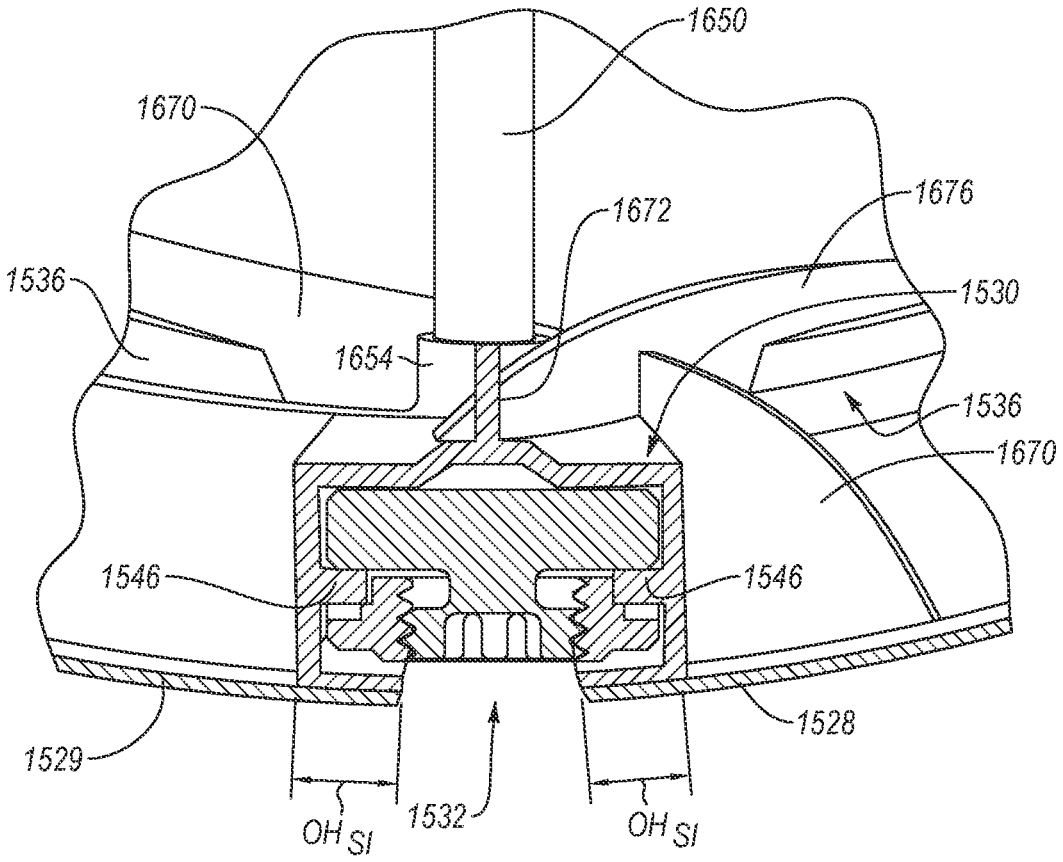
FIG. 57 is a cross-sectional front elevation view of a portion of the golf club head of FIG. 47, taken along the line 57-57 of FIG. 48, according to one or more examples of the present disclosure.
Figure 58:
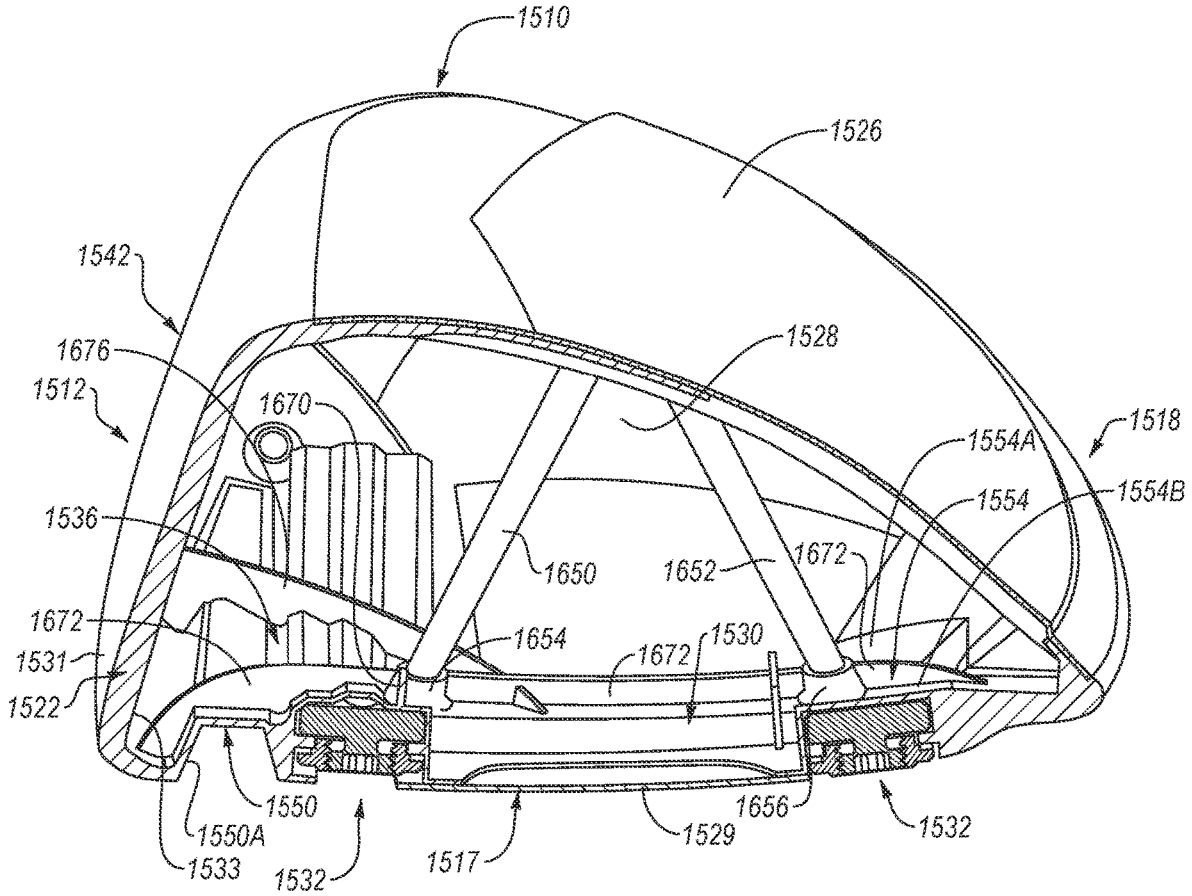
FIG. 58 is a cross-sectional side view of a portion of the golf club head of FIG. 47, taken along the line 58-58 of FIG. 47, according to one or more examples of the present disclosure.

Referring to FIGS. 56-58, weight assemblies 1532 are shown installed in and non-movably fixed to the weight tracks of the golf club head 1500. More specifically, a weight assembly 1532 is installed and non-movably fixed in the front weight track 1536 in FIG. 56, a weight assembly 1532 is installed and non-movably fixed in the intermediate weight track 1530 in FIG. 57, and respective weight assemblies 1532 are installed and non-movably fixed in the front weight track 1536 and the rear weight track 1554, respectively, in FIG. 58. The weight assembly 1532 is non-movably fixed in each of the weight tracks in the same manner. More specifically, with the anchor element 1604 positioned within the weight track on one side of the ledges 1546 of the weight track, the head element 1610 positioned within the weight track on the opposite side of the ledges 1546, and the mating element 1606 of the inner component 1600 threadably engaged with the head element 1610 of the outer component 1602, the outer component 1602 can be rotated (such as with an adjustment tool) relative to the inner component 1600 to draw the guide element 1604 and the head element 1610 together until the inner component 1600 and the outer component 1602 clamp down onto the ledges 1546. The compressive force of the inner component 1600 and the outer component 1602 applied to the ledges 1546 exceeds the external forces acting on the weight assembly 1532 during use such that the weight assembly 1532 stays in place during use. In some implementations, the square shape of the head element 1610 increases the surface area in contact with the ledges 1546, compared to a circular shape, and thus helps to improve the frictional engagement between the weight assembly 1532 and the ledges 1546.

In an alternative embodiment, the weight assembly 1532 can be configured for installation into the weight track in a reversed manner. For example, although the anchor element 1604 is shown installed on an interior side of the ledge 1546 and the head element 1610 is shown installed on an exterior side of the ledge 1546, in one embodiment, the weight assembly 1532 is flipped such that the head element 1610 is installed on the interior side of the ledge 1546 and the anchor element 1604 is installed on the exterior side of the ledge 1546. In such an embodiment, the socket 1608 is formed in the anchor element 1604 instead of, or in addition, to the head element 1610.

The weight assembly 1532 can be moved along a weight track into a different position by rotating (such as via an adjustment tool) the outer component 1600 in an opposite rotational direction to urge the outer component 1600 and the inner component 1602 away from each other to effectively unclamp the ledges 1546. With the weight assembly 1532 unclamped from the ledges 1546, the weight assembly 1532 can be slid along the same weight track into a new position on the same weight track or moved into another weight track. Because the maximum width $W_{AE}$ of the anchor element 1604 is greater than the gap or minimum width $W_{min}$ between the ledges 1546, the anchor element 1604 helps retain the weight assembly 1532 within the weight track as the weight assembly 1532 is slid along the weight track.

Adjustment of the positions of the weight assembly 1532 or assemblies 1532 along the weight tracks adjusts the performance characteristics of the golf club head 1500. For example, the intermediate weight track 1530 allows the weight assembly 1532 to be selectively loosened and tightened for slidable adjustment forward and rearward along the intermediate weight track 1530 to adjust the CG 1587 of the golf club head 1500 in a forward-to-rearward direction. By adjusting the CG 1587 of the golf club head 1500 forward or rearward, the performance characteristics of the golf club head 1500 are adjusted, which promotes an adjustment to the flight characteristics of a golf ball struck by the golf club head 1500, such as the spin characteristics of the golf ball. More specifically, moving the weight assembly 1532 closer to the strike face 1531 may produce a lower spinning ball due to a lower and more forward CG. This would also allow a user to increase club head loft, which in general higher lofted clubs are considered to be "easier" to hit. Moving the weight assembly 1532 rearward towards the rear of the golf club head 1500 allows for increased MOI and a higher spinning ball. Golf club heads with higher MOI are generally considered "easier" to hit. Accordingly, the intermediate weight track 1530 allows for at least both spin and MOI adjustment.

Each of the weight tracks may include more than one weight assembly 1532. For example, as shown in FIG. 61, the intermediate weight track 1530 includes two spaced-apart weight assemblies 1532.

The front weight track 1536 allows one or more weight assemblies 1532 to be selectively loosened and tightened for slidable adjustment laterally, in the heel-to-toe direction, to adjust the effective CG 1587 of the golf club head 1500 in the heel-to-toe direction. By adjusting the CG 1587 of the golf club head 1500 laterally, the performance characteristics of the golf club head 1500 are adjusted, which promotes an adjustment to the flight characteristics of a golf ball struck by the golf club head 1500, such as the sidespin characteristics of the golf ball. Notably, the use of two weight assemblies 1532 in the front weight track 1536, which are independently adjustable relative to each other, allows for adjustment and interplay between the weight assemblies 1532. For example, both weight assemblies 1532 can be positioned fully in the toe region 1514, fully in the heel region 1516, spaced apart a maximum distance from each other, with one weight fully in the toe region 1514, and the other weight fully in the heel region 1516, positioned together in the center or intermediate location of the front weight track 1536, or in other weight location patterns. Additionally or alternatively, multiple weight assemblies 1532 may be secured to the rear weight track 1554 such that there may be two or more weight assemblies 1532 located in the rear weight track 1554. In some implementations, the one or more weight assemblies 1532 are adjustable within the weight tracks 1530, 1532, 1554 to promote a range of adjustability of the CGy coordinate of the golf club head 1500 of between 3 mm and 8 mm and a range of adjustability of the CGx coordinate of the golf club head 1500 of between 2 mm and 8 mm, but a range of adjustability of the CGz coordinate of the golf club head 1500 of no more than 2 mm, 1.5 mm, or 1.0 mm. The weight assemblies and weight tracks of the golf club head 1500 as disclosed herein can achieve other CGx, CGy, and CGz ranges of adjustability, such as those disclosed in U.S. patent application Ser. No. 14/789,838, filed Jul. 1, 2015, which is incorporated herein in its entirety. For example, by moving one or more weights along the intermediate weight track the CGy of the golf club head may be adjusted by at least 3.5 mm, such as at least 4.0 mm, such as at least 4.5 mm, such as at least 5.0 mm, such as at least 5.5 mm, such as at least 6.0 mm, such as at least 6.5 mm, such as at least 7.0 mm, such as at least 7.5 mm.

Although the golf club head 1500 includes at least one weight assembly 1532 with a two-piece construction, in other embodiments, the golf club head 1500 instead employs at least one assembly with at least a three-piece construction or a single-piece construction.

Figure 60:
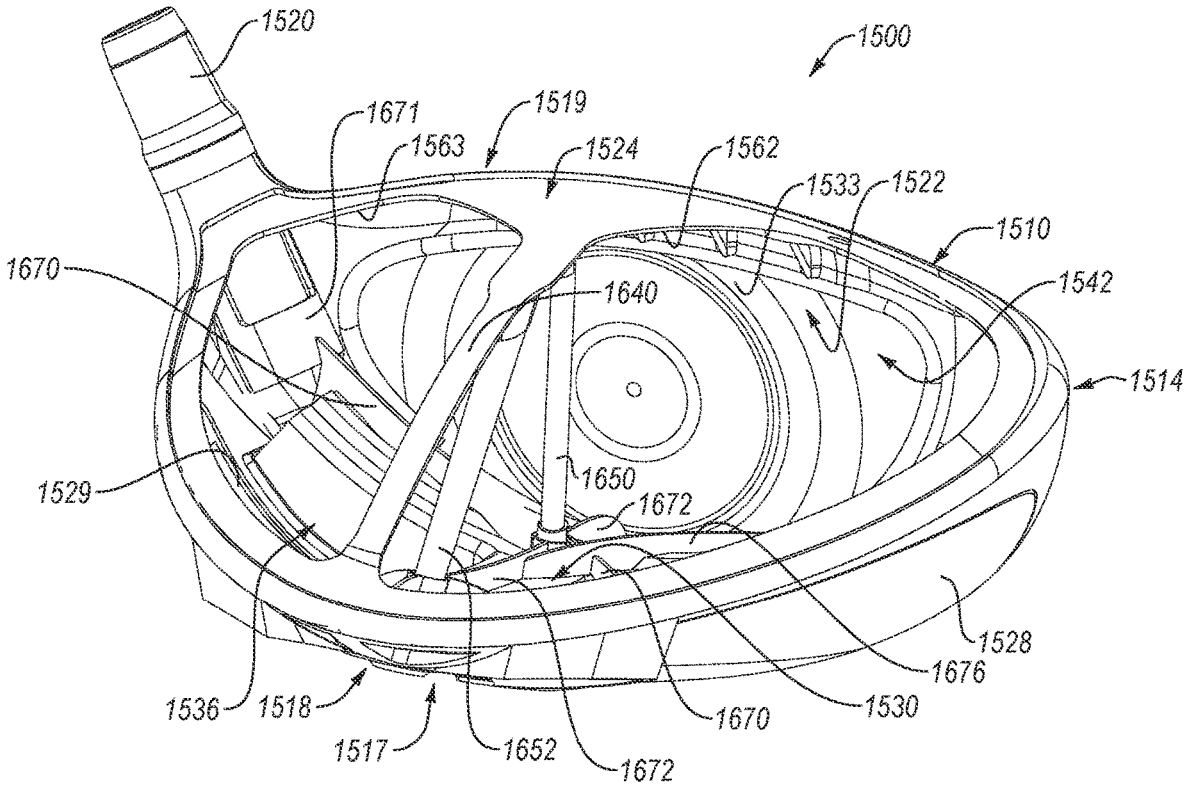
FIG. 60 is a perspective view of the golf club head of FIG. 47, shown with a crown insert removed, according to one or more examples of the present disclosure.

Although in some examples of the golf club head 1500, the body 1510 does not include inserts (e.g., the entirety of the body 1510 forms a one-piece monolithic construction), according to certain examples of the golf club head 1500, the body 1510 includes one or more inserts fixedly secured to the frame 1524. The frame 1524 of the body 1510 may have at least one sole opening and/or at least one crown opening. For example, referring to FIGS. 60 and 61, the frame 1524 includes a first sole opening 1560, a second sole opening 1561, a first crown opening 1562, and a second crown opening 1563. The first sole opening 1560 is sized and configured to fixedly receive the first sole insert 1528. The second sole opening 1561 is sized and configured to fixedly receive the second sole insert 1529. The first crown opening 1562 and the second crown opening 1563 are sized and configured to collectively fixedly receive the crown insert 1526. The frame 1524 includes respective edges or seats extending about the periphery of and defining the first sole opening 1560, the second sole opening 1561, the first crown opening 1562, and the second crown opening 1563. In other words, the frame 1524 includes a seated region adjacent each of the first sole opening 1560, the second sole opening 1561, the first crown opening 1562, and the second crown opening 1563. Each insert is received within and adhered directly to the seated region corresponding with the opening covered by the insert. In some implementations, the seated regions allow the inserts to be seated flush with the frame 1524 to provide a smooth seamless outer surface or, alternatively, slightly recessed outer surface.

Referring to FIGS. 56-58, the first sole insert 1528 and the second sole insert 1529 may be sized to partially overhang the intermediate weight track 1530 and/or the front weight track 1536. As shown in FIG. 56, each one of the first sole insert 1528 and the second sole insert 1529 overhangs a rearward portion of the front weight track 1536 a distance $OH_{SI}$. In some implementations, the distance $OH_{SI}$ overhanging the front weight track 1536 is between about 5% and about 40% of the width of the front weight track 1536. According to one implementation, the distance $OH_{SI}$ overhanging the front weight track 1536 is about 25% of the width of the front weight track 1536. As shown in FIG. 57, each of the first sole insert 1528 and the second sole insert 1529 also overhangs a portion of the intermediate weight track 1530 a distance $OH_{SI}$. In some implementations, the distance $OH_{SI}$ overhanging the intermediate weight track 1530 is between about 5% and about 40% of the width of the intermediate weight track 1530. According to one implementation, the distance $OH_{SI}$ overhanging the intermediate weight track 1530 is about 25% of the width of the intermediate weight track 1530. With the distance $OH_{SI}$ less than half of the width of the weight tracks, the weight assemblies 1532 installed within the weight tracks are still accessible for adjusting the position of the weight assemblies 1532. Overhanging the front weight track 1536 and the intermediate weight track 1530 with the overhang 1539 of the frame 1524, the first sole insert 1528, and the second sole insert 1529 helps improve the visual appearance and/or the aerodynamics of the golf club head 1500. Although the first sole insert 1528 and the second sole insert 1529 are shown to not overhang the rear weight track 1554, in some implementations, the first sole insert 1528 and the second sole insert 1529 are sized to partially overlap the second branch 1554B and the first branch 1554A, respectively, of the rear weight track 1554 in a manner similar to that described above. In some implementations, the first sole insert 1528 and/or the second sole insert 1529 are sized such the distance $OH_{SI}$ is zero or such that there is no overhang over the weight tracks. According to one example, the first sole insert 1528 may have no overhang, but the second sole insert 1529 may have some overhang.

The first crown opening 1562 and the second crown opening 1563 are partially defined by a spine portion 1640 of the frame 1524. The spine portion 1640 is a narrow and elongated thin-walled portion of the frame 1524 that extends, in a substantially front-to-back direction, across the crown portion of the body 1510 from the face portion 1542 to the rearward region 1518. The spine portion 1640 effectively divides the first crown opening 1562 from the second crown opening 1563. Moreover, the spine portion 1640 partially defines the seated regions of the frame 1524. The crown insert 1526 is supported on and adhered to the spine portion 1640. In this manner, the spine portion 1640 helps to strengthen the frame 1524, improve the rigidity of the frame 1524, and promote attachment of the crown insert 1526 to the frame 1524. The spine portion 1640 is parallel to the y-axis 1575 of the club head origin coordinate system 1585 in some implementations. However, in other implementations, the spine portion 1640 is non-parallel relative to the y-axis. For example, the spine portion 1640 may include two narrow and elongated thin-walled portions that are angled relative to the y-axis 1575 and diverge away from each other in a front-to-rear direction. In such an example, the two thin-walled portions define three separate crown openings in the frame 1524.

Though not shown, the frame 1524 may have a face opening, at a forward region 1512 of the body 1510, to receive and fixedly secure the strike face of the golf club head 1500. The strike face can be fixedly secured to the face opening of the frame 1524 by welding, braising, soldering, screws, or other coupling means. The strike face can be made from any of various materials, such as, for example, metals, metal alloys, fiber-reinforced polymers, and the like. Alternatively, in some implementations, the face portion 1542 may be integrally formed with the frame 1524.

The frame 1524 of the body 1510 may be made from a variety of different types of materials. According to one example, the frame 1524 may be made from a metal material, such as a titanium or titanium alloy (including but not limited to 9-1-1 titanium, 6-4 titanium, 3-2.5, 6-4, SP700, 15-3-3-3, 10-2-3, or other alpha/near alpha, alpha-beta, and beta/near beta titanium alloys), aluminum and aluminum alloys (including but not limited to 3000 series alloys, 5000 series alloys, 6000 series alloys, such as 6061-T6, and 7000 series alloys, such as 7075), or the like. The frame 1524 may be formed by conventional casting, metal stamping, or other known manufacturing processes. In certain examples, the frame 1524 may be made of non-metal materials. Generally, the frame 1524 provides a framework or skeleton of the golf club head 1500 to strengthen the golf club head 1500 in areas of high stress caused by the impact of a golf ball with the face portion 1542. Such areas include a transition region where the golf club head 1500 transitions from the face portion 1542 to the crown portion 1519, the sole portion 1517, and the skirt portion 1521 of the body 1511.

In one embodiment, each of the first sole insert 1528, the second sole insert 1529, and/or the crown insert 1526 (collectively "the inserts") may be made from a polymer or fiber-reinforced polymer (e.g., composite material). The polymer can be any of various polymers, such as thermoplastic or thermoset materials. The fibers of the fiber-reinforced polymer or composite material can be any of various fibers, such as carbon fiber or glass fiber. One exemplary material from which the inserts may be made from is a thermoplastic continuous carbon fiber composite laminate material having long, aligned carbon fibers in a PPS (polyphenylene sulfide) matrix or base.

The composite material of the sole and crown inserts may have any of some possible layups as shown in the table below. The 0-degree direction is front-to-back and 90-degree direction is heel-to-toe. The first ply is inside and the last ply is outside. By making the crown, sole, and/or face out of a less dense material, it may provide cost savings or it may allow for weight to be redistributed from the crown, sole, and/or face to other areas of the club head, such as, for example, low and/or forward. U.S. Pat. No. 8,163,119 discloses composite articles and methods for making composite articles, which is incorporated by reference herein in the entirety. This patent discloses the usual number of layers for a striking plate is substantial, e.g., fifty or more. However, improvements have been made in the art such that the layers may be decreased to between 30 and 50 layers. As already discussed for a sole and/or crown the layers can be substantially decreased down to three, four, five, six, seven, or more layers. These layups show possible crown and/or sole construction using unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| 0 | 90 | +45 | −45 | 0/90 woven | | | | 490-720 |
| 0 | 90 | +45 | −45 | +45 | 0/90 woven | | | 490-720 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

Referring to the above table, one embodiment of the composite inserts having a 0/90/45/−45/(0/90 woven) layup has a mass of about 8.2 g and a final thickness of 0.58 mm. Another embodiment of the composite inserts having a 0/90/45/−45/45/(0/90 woven) has a mass of 9.3 g and/or a final thickness of 0.65 mm or 0.58 mm.

The Area Weight (AW) is calculated by multiplying the density times the thickness. For the plies shown above made from composite material the density is about 1.5 g/cm$^3$ and for titanium the density is about 4.5 g/cm$^3$. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly the main body of the club may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A commercial example of a fiber-reinforced polymer from which the inserts may be made is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$.

Another commercial example of a fiber-reinforced polymer from which the inserts is made is TEPEX® DYNALITE 208. This material also has a carbon fiber volume range of 42 to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the inserts. After the inserts are formed (separately, in some implementations) by the thermoforming process, each is cooled and removed from the matched die. In some implementations, the inserts are shown as having a uniform thickness, which facilitates use of the thermoforming process and ease of manufacture. However, in other implementations the one or more of the inserts may have a variable thickness to strengthen select local areas of the insert by, for example, adding additional plies in select areas to enhance durability, acoustic properties, or other properties of the respective inserts.

In some embodiments, each of the inserts has a complex three-dimensional shape and curvature corresponding generally to a desired shape and curvature of the crown portion 1519 and the sole portion 1517 of the golf club head 1500. It will be appreciated that other types of club heads, such as fairway wood-type clubs, may be manufactured using one or more of the principles, methods, and materials described herein.

In an alternative embodiment, one or more of the inserts can be made by a process other than thermoforming, such as injection molding or thermosetting. In a thermoset process, the inserts may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the inserts. Each insert is cooled and removed from its respective mold.

The carbon fiber reinforcement material for the inserts, made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California.

In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

After the inserts are formed, they are joined to the frame 1524 in a manner that creates a strong integrated construction adapted to withstand normal stress, loading, and wear and tear expected of commercial golf clubs. For example, each of the inserts may be bonded to the frame 1524 using epoxy adhesive, with the crown insert 1526 seated in and overlying the first crown opening 1562 and the second crown opening 1563 and the first sole insert 1528 and the second sole insert 1529 seated in and overlying the first sole opening 1560 and the second sole opening 1561, respectively. Alternative attachment methods include bolts, rivets, snap fit, adhesives, and other known joining methods or any combination thereof may be used to couple the inserts with the frame 1524.

In alternative embodiments, the first sole insert 1528 and the second sole insert 1529 of the golf club head 1500 are not made from a fiber-reinforced polymer. Rather, in one implementation, the first sole insert 1528 and the second sole insert 1529 are made from a metal or metal alloy, such as titanium, and in another implementation, the sole portion 1517 includes a one-piece monolithic construction, made from a metal or metal alloy, such as titanium, instead of separately attachable sole inserts. Accordingly, in at least one embodiment, the crown portion 1519 of the golf club head 1500 may be made from a first material, such as a fiber-reinforced polymer, and the sole portion 1517 may be made from a metal or metal alloy, such as titanium. Moreover, in such an embodiment, more than between about 60% and 80% (e.g., about 70%) of the crown portion 1519 of the body 1510 of the golf club head 1500 has a thickness less than about 0.75 mm.

Moreover, in some embodiments, the crown insert 1526 of the crown portion 1519 of the golf club head 1500 is not made from a fiber-reinforced polymer. Rather, in one implementation, the crown insert 1526 of the crown portion 1519 is made from a metal or metal alloy, such as titanium, and in another implementation, the crown portion 1519 includes a one-piece monolithic construction, made from a metal or metal alloy, such as titanium, instead of a separately attachable crown insert. Accordingly, in at least one embodiment, an entirety of the golf club head 1500 may be made from a metal or metal alloy, such as titanium. Moreover, in such an embodiment, more than between about 60% and 80% (e.g., about 70%) of the crown portion 1519 of the body 1510 of the golf club head 1500 has a thickness less than about 0.75 mm.

Based on the foregoing, the body 1510 of the golf club head 1500 of the present disclosure can have at least one of a crown portion 1519 at least partially made from a fiber-reinforced polymer, a sole portion 1517 at least partially made from a fiber-reinforced polymer, or a crown portion 1519 and a sole portion 1517 made entirely from a metal or metal alloy.

Referring to FIGS. 56-58, 60, and 61, views of various portions of the hollow interior of the body 1510 golf club head 1500 are shown. In the illustrated embodiments, the golf club head 1500 includes various features located within the hollow interior of the body 1510 to promote various characteristics of the golf club head 1500. For example, several internal ribs and brace bars are coupled to the body 1510 within the hollow interior to provide structural support and additional rigidity for the golf club head 10. The internal ribs and/or brace bars may also modify and even fine tune the acoustic properties of the golf club head 1500. The sound and modal frequencies emitted by the golf club head 1500 when striking a golf ball can be important to the sensory experience of the golfer and provide functional feedback as to where on the strike face 1531 the impact with the golf ball occurs (and whether the golf ball is well struck).

As shown in FIGS. 57, 58, 60, and 61, the golf club head 1500 includes a forward brace bar 1650 and a rearward brace bar 1652 coupled to the body 1510 within the hollow interior of the body 1510. The forward brace bar 1650 and a rearward brace bar 1652 extend from the weight tracks to the spine portion 1640. Each of the forward brace bar 1650 and the rearward brace bar 1652 is an elongated hollow or solid tubular member having any of various cross-sectional shapes, such as circular (see, e.g., FIG. 62H). However, a brace bar can be more generally defined as a structure having any of various shapes and sizes projecting or extending from any portion of the golf club head 1500 to provide structural support to, improved performance of, and/or acoustical enhancement of the golf club head 1500.

According to some implementations, as shown in FIGS. 60 and 62A-62I, each of the forward brace bar 1650 and the rearward brace bar 1652 has a length $L_{BB}$ and a width $W_{BB}$ transverse to the length $L_{BB}$. The length $L_{BB}$ of a brace bar is the maximum distance between a bottom end of the brace bar and a top end of the brace bar. The width $W_{BB}$ of a brace bar is the minimum distance from a given point on one elongated side of the brace bar to the opposite elongated side of the brace bar in a direction substantially parallel with the x-axis 1570 (e.g., heel-to-toe direction). For a circular bridge bar, the width $W_{BB}$ is a diameter of the bridge bar. The width $W_{BB}$ of a brace bar is significantly less than the length $L_{BB}$ of the brace bar. The width $W_{BB}$ of one or both of the forward brace bar 1650 and the rearward brace bar 1652 can be greater at the bottom end than at the top end to promote a lower Z-up. Alternatively, the width $W_{BB}$ of one or both of the forward brace bar 1650 and the rearward brace bar 1652 can be greater at the top end than at the bottom end to promote a higher Z-up. In yet some implementations, the width $W_{BB}$ of one or more of the forward brace bar 1650 and the rearward brace bar 1652 is constant from the top end to the bottom end.

According to some implementations, the width $W_{BB}$ of one or both of the forward brace bar 1650 and the rearward brace bar 1652 at a bottom end and at a top end is between 1 mm and 5 mm, such as 2 mm. In some implementations, the length $L_{BB}$ of the bridge bar 1540 is between 50 mm and 60 mm, such as about 53 mm.

Referring to FIGS. 62A-62I, the forward brace bar 1650 and the rearward brace bar 1652 each has a depth $D_{BB}$ less than the length $L_{BB}$ of the corresponding brace bar. The depth $D_{BB}$ of the forward brace bar 1650 and the rearward brace bar 1652 is the minimum distance from a given point on a rearward side of the corresponding brace bar to a forward side of the corresponding brace bar in a direction substantially parallel with the y-axis 1575 (e.g., front-to-rear direction). In certain implementations, the depth $D_{BB}$ of a brace bar is between 1 mm and 5 mm, such as 2 mm. The depth $D_{BB}$ of one or both of the forward brace bar 1650 and the rearward brace bar 1652 can be greater at a bottom end than at a top end.

Additionally, in some implementations, each of the forward brace bar 1650 and the rearward brace bar 1652 includes one or more webs 1543 or flanges 1541 (e.g., arms). For example, referring to FIG. 62A, one or both of the forward brace bar 1650 and the rearward brace bar 1652 includes a flange 1541 and a web 1543, perpendicular to the flange 1541, to form a T-shape and one or both of the forward brace bar 1650 and the rearward brace bar 1652 in FIG. 62E includes two flanges 1541 and one web 1543, perpendicular to the flanges 1541, to form an I-shape. Each flange 1541 and each web 1543 of the brace bar has a corresponding thickness T less than the width $W_{BB}$ and depth $D_{BB}$ of the bridge bar. In some implementations, the thickness T is between 0.5 mm and 5.0 mm, between 0.7 mm and 3.0 mm, between 1.0 mm and 2.0 mm, or between 1.2 mm and 1.75 mm. In one implementation, the thickness T is about 1.5 mm.

Figure 62A:
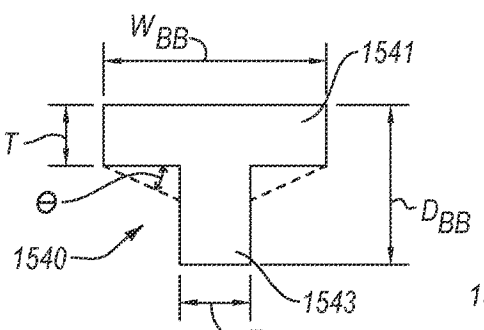
FIGS. 62A-62I are cross-sectional views of a brace bar of a golf club head, according to one or more examples of the present disclosure.
Figure 62B:
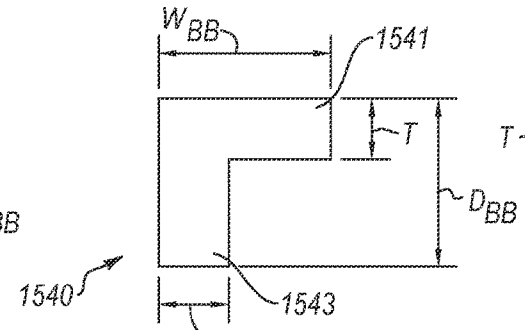
Figure 62C:
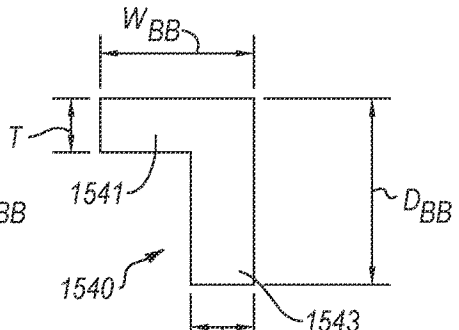
Figure 62D:
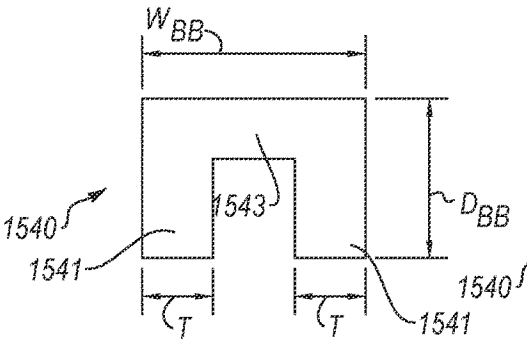
Figure 62E:
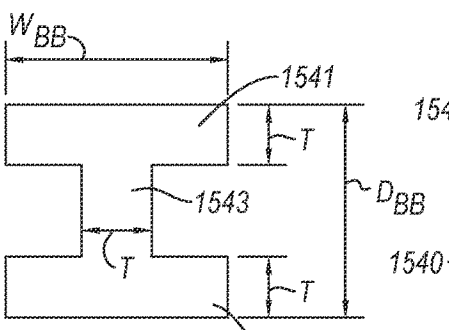
Figure 62F:
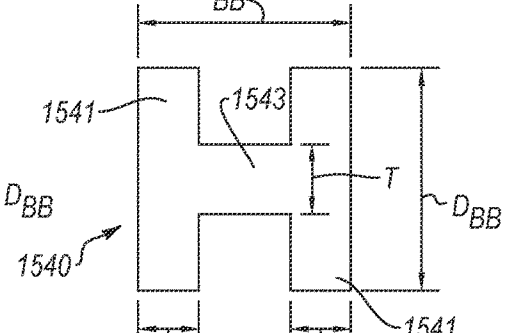
Figure 62G:
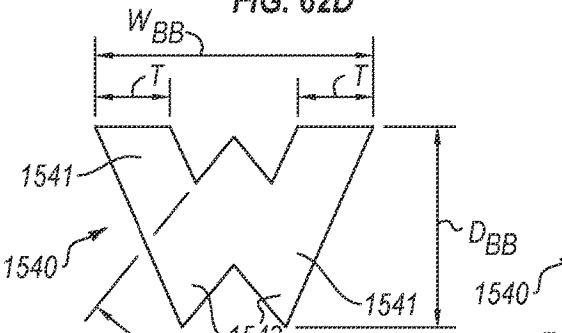
Figure 62H:
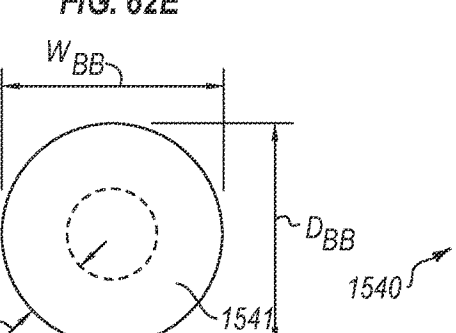
Figure 62I:
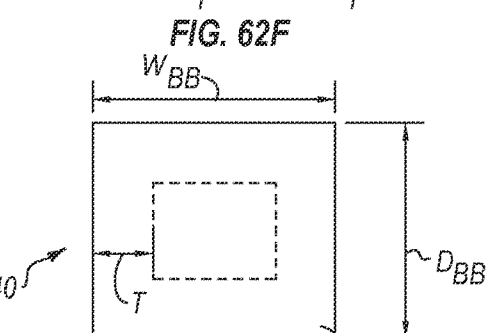

The forward brace bar 1650 and the rearward brace bar 1652 can have a cross-section, which is parallel to the x-y plane, that has any of various shapes. Referring to FIG. 62A, in one embodiment, the brace bar has a substantially T-shaped cross-section. More specifically, the brace bar includes a flange 1541, substantially parallel with the X-axis 1570, and a web 1543, substantially parallel with the Y-axis 1575. The flange 1541 is co-formed with the web 1543. The flange 1541 can be forward of the web 1543 when installed within the golf club head. However, in other implementations, the brace bar can be oriented differently, such as, for example, rotated 180-degrees relative to that shown so that the flange 1541 is rearward of the web 1543.

The forward brace bar 1650 and the rearward brace bar 1652 can have a cross-sectional shape different than a T-shape (e.g., FIG. 62A), such as an L-shape (e.g., FIGS. 62B and 62C), U-shape (e.g., FIG. 62D), I-shaped (e.g., FIG. 62E), H-shape (e.g., FIG. 62F), W-shape (e.g., FIG. 62G), circular-shape (e.g., FIG. 62H), square-shape or rectangular-shape (e.g., FIG. 62I), and the like. Also, the cross-sectional shape and/or size of the forward brace bar 1650 and the rearward brace bar 1652 may change over the length of the brace bar. For example, while the cross-sectional shape of the forward brace bar 1650 and the rearward brace bar 1652 is constant over the length of the brace bar, the cross-sectional size of the brace bar may decrease from the sole portion 1517 toward the crown portion 1519. The forward brace bar 1650 and the rearward brace bar 1652 can be constructed to be solid or hollow. For example, the circular and square shaped brace bars of FIGS. 62H and 62I can be solid or optionally have a hollow interior channel as shown in dashed line. As shown in dashed lines, the T-shape of the forward brace bar 1650 and the rearward brace bar 1652 of FIG. 62A can be modified such that a thickness of the flange 1541 decreases away from the web 1543. In other words, the flange 1541 can be thicker nearer the web 1543 than further away from the web 1543. The angle of divergence $\theta_D$ of the flange 1541 can be greater at a bottom end (e.g., 15-degrees) of a brace bar than at a top end (e.g., 5-degrees) of the brace bar. Additionally, the shape, size, or other characteristic of the forward brace bar 1650 can be different than that of the rearward brace bar 1652. For example, the forward brace bar 1650 may be thicker or more massive than the rearward brace bar 1652.

In certain implementations, the forward brace bar 1650 and the rearward brace bar 1652 have an outer diameter of from about 2 mm to about 7 mm, such as from about 3 mm to about 6 mm, or about 4 mm to about 5 mm. According to some implementations, the forward brace bar 1650 and the rearward brace bar 1652 have a wall thickness of from about 0.25 mm to about 2.5 mm, such as from about 0.3 mm to about 1.5 mm, or from about 0.4 mm to about 1.0 mm, or about 0.5 mm.

The forward brace bar 1650 and the rearward brace bar 1652 can be co-formed with, coupled to, secured to, or attached to, the golf club head 1500. Moreover, each of the forward brace bar 1650 and the rearward brace bar 1652 is attached at a first end to the sole portion 1517 of the body 1510 and at a second end to the crown portion 1519 of the body 1510. More specifically, in the illustrated embodiments, each of the forward brace bar 1650 and the rearward brace bar 1652 is attached at the first end to the weight tracks of the body 1510 and at a second end to the spine portion 1640 of the body 1510. In some implementations, the first end of both the forward brace bar 1650 and the rearward brace bar 1652 are attached at only the intermediate weight track 1530. However, as shown, in certain implementations, the first end of the forward brace bar 1650 is attached at both the intermediate weight track 1530 and the front weight track 1536 (e.g., including an intersection of the intermediate weight track 1530 and the front weight track 1536) and the rearward brace bar 1652 is attached at both the intermediate weight track 1530 and the rear weight track 1554 (e.g., including an intersection of the intermediate weight track 1530 and the rear weight track 1554). Although not shown, in some implementations, the first end of the forward brace bar 1650 is attached at only the front weight track 1536 and/or the rearward brace bar 1652 is attached at only the rear weight track 1554. In some implementations, each of the forward brace bar 1650 and the rearward brace bar 1652 is attached at the second end to the spine portion 1640 at a top of the crown portion 1519 at locations approximately half way between the face portion 1542 and the rearward region 1518. In some embodiments, the forward brace bar 1650 is attached at a first end to the sole portion 1517 of the body 1510 at a location forward of the CG 1587 and the rearward brace bar 1652 is attached at a first end to the sole portion 1517 of the body 1510 at a location rearward of the CG 1587.

In some embodiments, the forward brace bar 1650 and the rearward brace bar 1652 are aligned substantially parallel with the y-axis 1575 of the club head origin coordinate system 1585. In other words, the forward brace bar 1650 and the rearward brace bar 1652 can be spaced apart in a direction parallel to the y-axis 1575 and have the same x-axis coordinate. However, as shown in FIG. 58, the forward brace bar 1650 and the rearward brace bar 1652 are angled with respect to the z-axis 1565 of the club head origin coordinate system 1585 or a vertical axis. For example, the forward brace bar 1650 is angled rearwardly and the rearward brace bar 1652 is angled forwardly. In one implementation, the forward brace bar 1650 and the rearward brace bar 1652 define an angle between 10-degrees and 60-degrees with the z-axis 1565.

In the embodiment shown, the forward brace bar 1650 and the rearward brace bar 1652 are attached to the body 1510 via respective internal receptacles or brackets formed in the body 1510. In the illustrated embodiment, the body 1510 includes a forward sole receptacle 1654, a rearward sole receptacle 1656, a forward crown receptacle 1658, and a rearward crown receptacle 1660. The forward sole receptacle 1654 and the rearward sole receptacle 1656 are coupled to (e.g., co-formed with) the intermediate weight track 1530 and the forward crown receptacle 1658 and the rearward crown receptacle 1660 are coupled to (e.g., co-formed with) the spine portion 1640. Each receptacle is configured to matingly receive a respective end of one of the brace bars. For example, the first end of the forward brace bar 1650 is matingly received within the forward sole receptacle 1654, the second end of the forward brace bar 1650 is matingly received within the forward crown receptacle 1658, the first end of the rearward brace bar 1652 is matingly received within the rearward sole receptacle 1656, and the second end of the rearward brace bar 1652 is matingly received within the rearward crown receptacle 1660. In some embodiments of the golf club head 1500, the forward brace bar 1650 and the rearward brace bar 1652 are secured to the respective receptacles via any of various techniques, such as welding, adhering, bonding, fastening, co-forming, co-casting, co-molding, and the like.

The body 1510, the forward brace bar 1650, and the rearward brace bar 1652 may be constructed of the same or similar materials. However, in some implementations, the forward brace bar 1650 and the rearward brace bar 1652 may be constructed of materials different than those of the body 1510. In one example, the forward brace bar 1650 and the rearward brace bar 1652 are constructed of a polymer-fiber composite material. Alternatively, the forward brace bar 1650 and the rearward brace bar 1652 may be formed of a metallic alloy (e.g., titanium alloy, aluminum alloy, steel alloy). The material, size and shape of the forward brace bar 1650 and the rearward brace bar 1652 results in a mass per unit length of the forward brace bar 1650 and the rearward brace bar 1652 between 0.005 g/mm and 0.40 g/mm in some embodiments. In certain implementations, for a composite material the mass per unit length of the forward brace bar 1650 and the rearward brace bar 1652 is between 0.012 g/mm and 0.024 g/mm or between 0.012 g/mm and 0.018 g/mm. For titanium, the mass per unit length of the forward brace bar 1650 and the rearward brace bar 1652 is about three times these amounts. For steel, the mass per unit length of the forward brace bar 1650 and the rearward brace bar 1652 is more than five times these amounts. For aluminum, the mass per unit length of the forward brace bar 1650 and the rearward brace bar 1652 is nearly two times these amounts.

In some embodiments, the forward brace bar 1650 and the rearward brace bar 1652 are attached to the golf club head 1500 so as not to be under a compression or tension load when the golf club head is not in use. In other words, the forward brace bar 1650 and the rearward brace bar 1652 have supporting dimensions (e.g., lengths) that are the same as the corresponding dimensions of the hollow interior of the body 1510 so that the dimensions of the hollow interior would not substantially change (when the golf club head is not in use) even if the brace bars were removed from the body 1510.

Although in the illustrated embodiment, the golf club head 1500 includes two brace bars extending between the weight tracks and the spine portion 1640, the golf club head 1500 can include only one or more than two brace bars extending between the weight tracks and the spine portion 1640.

Preferably, the overall frequency of the golf club head 1500, e.g., the average of the first mode frequencies of the crown, sole and skirt portions of the golf club head 1500, generated upon impact with a golf ball is greater than 3,000 Hz. Frequencies above 3,000 Hz provide a user of the golf club head 1500 with an enhanced feel and satisfactory auditory feedback. However, a golf club head 1500 having a larger volume and/or having relatively thin walls can reduce the first mode vibration frequencies to undesirable levels. The addition of one or both of the forward brace bar 1650 and the rearward brace bar 1652 described herein can increase the first mode vibration frequencies, thus allowing the first mode frequencies to approach a more desirable level and improving the feel of the golf club head 1500 to a user.

Referring to FIGS. 56-58, 60, and 61, the golf club head 1500 includes multiple internal reinforcement ribs to provide additional structural support and/or acoustic property tuning. The ribs can have a wide variety of shapes, sizes, orientations, and locations on the interior surface of the body 1510. Generally, the ribs are thin-walled structures having a height and length much greater than a thickness. Although the golf club head 1500 includes many internal reinforcement ribs, only a few of the internal reinforcement ribs will be described and focused on in more detail herein.

The internal reinforcement ribs of the golf club head 1500 include a hosel-brace reinforcement rib 1670 that extends continuously between, and is coupled to, a hosel cavity 1671 of the hosel 1520 and the forward sole receptacle 1654. Additionally, the hosel-brace reinforcement rib 1670 extends along, and is coupled to, the intermediate weight track 1530 and the front weight track 1532. In this manner, the hosel-brace reinforcement rib 1670 structurally ties together and rigidifies the hosel 1520, the intermediate weight track 1530, and the forward brace bar 1650. As shown in FIGS. 56 and 58, the hosel-brace reinforcement rib 1670 is angled relative to the strike face 1531. More specifically, the hosel-brace reinforcement rib 1670 is angled rearwardly from the hosel cavity 1671 to the forward sole receptacle 1654.

The internal reinforcement ribs of the golf club head 1500 also include an intermediate reinforcement rib 1672 that extends along, and is coupled to, the intermediate weight track 1530. A portion of the intermediate reinforcement rib 1672 extends continuously between, and is coupled to, the forward sole receptacle 1654 and the rearward sole receptacle 1656. The intermediate reinforcement rib 1672 also extends across, and is coupled to, the front weight track 1536 and the rear weight track 1554. In this manner, the intermediate reinforcement rib 1672 structurally ties together and rigidifies the front weight track 1536, the intermediate weight track 1530, the rear weight track 1554, the forward brace bar 1650, and the rearward brace bar 1652. In one implementation, the intermediate reinforcement rib 1672 extends longitudinally in the same direction as the intermediate weight track 1530. According to some implementations, the intermediate reinforcement rib 1672 can be parallel to the y-axis 1575 of the club head origin coordinate system 1585.

The internal reinforcement ribs of the golf club head 1500 further include a spine reinforcement rib 1674 (see, e.g., FIG. 61) that extends along, and is coupled to, the spine portion 1640 of the frame 1524. A portion of the spine reinforcement rib 1674 extends continuously between, and is coupled to, the forward crown receptacle 1658 and the rearward crown receptacle 1660. The spine reinforcement rib 1674 may also extend forwardly of the forward crown receptacle 1658 and rearwardly of the rearward crown receptacle 1660. In this manner, the spine reinforcement rib 1672 structurally ties together and rigidifies the forward brace bar 1650, the rearward brace bar 1652, and the spine portion 1640. In one implementation, the spine reinforcement rib 1674 extends longitudinally in the same direction as the spine portion 1640. Accordingly, the spine reinforcement rib 1674 can be parallel to the y-axis 1575 of the club head origin coordinate system 1585.

The internal reinforcement ribs of the golf club head 1500 additionally include a toe-track reinforcement rib 1676 that is directly coupled to the intermediate weight track 1530, the front weight track 1532, and the sole portion 1517 at the toe region 1514. In this manner, the toe-track reinforcement rib 1676 structurally ties together and rigidifies the intermediate weight track 1532 and the front weight track 1532. As shown, the toe-track reinforcement rib 1676 is angled relative to the strike face 1531. More specifically, the toe-track reinforcement rib 1676 is angled rearwardly from the front weight track 1532 to the intermediate weight track 1530. The toe-track reinforcement rib 1676 may be directly coupled to the hosel-brace reinforcement rib 1670 and the intermediate reinforcement rib 1672 at the intermediate weight track 1530.

The golf club head 1500 of the present disclosure may include other features to promote the performance characteristics of the golf club head 1500. For example, the golf club head 1500, in some implementations, includes alternative movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426.

In certain implementations, for example, the golf club head 1500 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015.

According to some implementations, the golf club head 1500 includes aerodynamic shape features similar to those described in more detail in U.S. Patent Application Publication No. 2013/0123040A1.

In certain implementations, the golf club head 1500 includes removable shaft features similar to those described in more detail in U.S. Pat. No. 8,303,431.

According to yet some implementations, the golf club head 1500 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No. 13/686,677.

Additionally, in some implementations, the golf club head 1500 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677.

According to certain implementations, the golf club head 1500 includes variable thickness face portion features similar to those described in more detail in U.S. patent application Ser. No. 12/006,060; and U.S. Pat. Nos. 6,997,820; 6,800,038; and 6,824,475.

In some implementations, the golf club head 1500 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620.

According to one embodiment, a method of making a golf club head, such as the golf club head 1500, includes one or more of the following steps: (1) forming a frame having sole openings, forming a composite laminate sole inserts, injection molding a thermoplastic composite head component over the sole inserts to create a sole insert unit, and joining the sole insert unit to the frame; (2) providing a composite head component, which is a weight track capable of supporting one or more slidable weights; (3) forming sole inserts from a thermoplastic composite material having a matrix; (4) forming a sole insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (5) forming both a sole insert from thermoplastic composite materials having a compatible matrix; (6) forming a sole insert from a thermosetting material, coating a sole insert with a heat activated adhesive, and forming a weight track from a thermoplastic material capable of being injection molded over the sole insert after the coating step; (7) forming a frame from a material selected from the group consisting of titanium, one or more titanium alloys, aluminum, one or more aluminum alloys, steel, one or more steel alloys, and any combination thereof; (8) forming a frame with one or more crown openings, forming a crown insert from a composite laminate material, and joining the crown insert to the frame such that the crown insert overlies the crown opening(s); (9) selecting a composite head component from the group consisting of one or more ribs to reinforce the head, one or more ribs to tune acoustic properties of the head, one or more weight ports to receive a fixed weight in a sole portion of the golf club head, one or more brace bars, one or more weight tracks to receive a slidable weight, and combinations thereof; (10) forming a sole insert and a crown insert from a continuous carbon fiber composite material; (11) forming a sole insert and a crown insert by thermosetting using materials suitable for thermosetting, and coating the sole insert with a heat activated adhesive; (12) forming a frame from titanium, titanium alloy or a combination thereof to have a crown opening, a sole insert, and a weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the frame such that the crown insert overlies the crown opening.

Additionally, or alternatively, the body 1510 and/or the frame 1524 may be made of from the following materials: carbon steel, stainless steel (e.g. 17-4 PH stainless steel), alloy steel, Fe—Mn—Al alloy, nickel-based ferroalloy, cast iron, super alloy steel, aluminum alloy, magnesium alloy, copper alloy, titanium alloy or mixtures thereof. The sole insert, crown insert, and/or sliding weight track may be formed of a non-metal material with a density less than about 2 g/cm$^3$, such as between about 1 g/cm$^3$ to about 2 g/cm$^3$. The nonmetal material may be preferably comprised of a polymer or polymer reinforced composite. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyetherimide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Besides, during forming the sole insert, crown insert, and/or sliding weight track, organic short fibers, such as fiberglass, carbon fiber, or metallic fiber, can be added into the engineering plastic, so as to enhance the structural strength of the sole insert, crown insert, and/or sliding weight track. Preferably, however, the reinforcements are continuous long fibers, rather than short fibers. The most preferable thermoset would be continuous long fiber graphite epoxy composite. The most preferable thermoplastics would be either PPS or PSU polymer with continuous long fiber graphite reinforcements. One of the advantages of epoxy and PSU is both are relatively stiff with relatively low damping which produces a better sounding or more metallic sounding golf club compared to other polymers which may be overdamped. Additionally, PSU requires less post processing in that it does not require a finish or paint to achieve a final finished golf club head.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure-C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S-C6H4-O—, and other thermally stable substantially-aromatic difunctional groups known in the art of engineering thermoplastics. Also included are the so called modified polysulfones where the individual aromatic rings are further substituted in one or substituents including

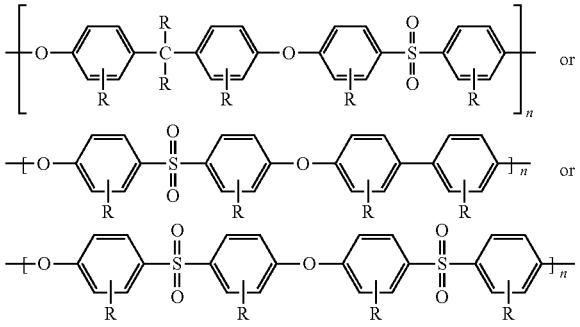

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyland hexenyl groups. As specific examples of the C3-C20 cycloalkyl group, there can be mentioned-cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

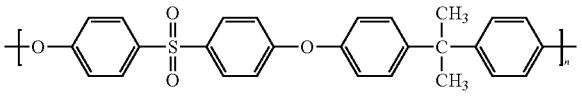

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure

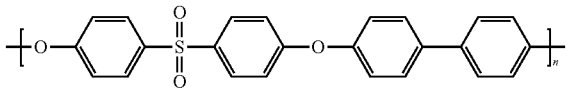

and the abbreviation PPSF and sold under the tradenames RADEL® resin; and (c) a condensation polymer made from 4,4'-dichlorodiphenyl sulfone in the presence of base and having the principle repeating structure

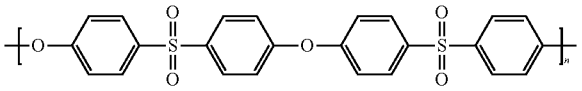

and the abbreviation PPSF and sometimes called a "polyether sulfone" and sold under the tradenames Ultrason® E, LNP™, Veradel®PESU, Sumikaexce, and VICTREX® resin," and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. patents application Ser. Nos. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference. The composite material may be manufactured according to the methods described at least in U.S. patent application Ser. No. 11/825,138, which is incorporated herein by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

According to some embodiments, to use the adjustable weight systems of the golf club head 1500, a user will use an engagement end of a tool (such as the torque wrench) to loosen the weight assembly 1532. Once the weight assembly 1532 is loosened, the weight assembly may be adjusted by either sliding the weight assembly in a channel or by repositioning the weight assembly at different locations on the club head. Once the weight assembly is in the desired location, the weight assembly may be tightened until the weight assembly is secured to the club head. In the case of a sliding weight, the weight fastening bolt may be tightened until the clamping force, between inner and outer components, upon a front ledge and/or rear ledge of a weight track or channel is sufficient to restrain the weight assembly in place. In some embodiments, the golf club head 1500 may include locking projections located on the front ledge and/or rear ledge and locking notches located on the washer that cooperate to increase the locking force provided by the inner component and the outer component. In other embodiments, the golf club head 1500 may include locating projections located on the front ledge and/or rear ledge and locating notches located on the inner and/or outer component. The locating projections or bumps are sized to have a width smaller than the width of the notches or recesses in the outer component such that the outer weight member can move a limited amount when placed over one of the bumps. In this manner, the projections or bumps serve as markers or indices to help locate the position of the weight assembly along the channel, but do not perform a significant locking function. Instead, the weight assembly may be locked into place at a selected position along the channel by tightening the weight assembly.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. A golf club head comprising:

a body comprising a face, a crown, and a sole together defining an interior cavity of the golf club head, wherein the body further comprises:

a crown opening and a crown insert covering the crown opening, wherein the crown insert is made of a fiber-reinforced composite material;

a sole opening and a sole insert covering the sole opening, wherein the sole insert is made of a fiber-reinforced composite material;

a recess located on the sole between the face and the sole opening; and a weight port formed in the sole at a location rearward of the sole opening;

a first weight made of a first material having a first density greater than a density of the body, wherein the first weight is at least partially positioned within the recess; and a second weight made of a second material having a second density greater than the density of the body, wherein the second weight is seated within the weight port, wherein a ratio of Ixx to Izz, where Ixx is a moment of inertia of the golf club head about a horizontal x-axis of the golf club head that passes through a center of gravity (CG) of the golf club head and Izz is a moment of inertia of the golf club head about a vertical z-axis of the golf club head that passes through the CG of the golf club head, is at least 0.62.

2. The golf club head according to claim 1, wherein a surface area of the crown insert is greater than a surface area of the sole insert.

3. The golf club head according to claim 1, wherein:

the body is made of a titanium alloy; and the first weight is made of a steel alloy.

4. The golf club head according to claim 1, wherein:

the body further comprises:

a hosel; and a heel opening formed in the sole of the body and located in a heel portion of the golf club head, wherein the heel opening is configured to receive a fastening member; and the golf club head further comprises a head-shaft connection system including a sleeve and the fastening member, wherein the sleeve is configured to be secured by the fastening member in a locked position, and wherein the head-shaft connection system is configured to allow the golf club head to be adjustably attachable to a golf club shaft in a plurality of different positions resulting in an adjustability range of different combinations of loft angle, face angle, or lie angle.

5. The golf club head according to claim 1, wherein a combined mass of the first weight and the second weight exceeds a combined mass of the crown insert and the sole insert.

6. The golf club head according to claim 1, wherein the first weight has a square shape.

7. The golf club head according to claim 1, wherein the recess comprises a channel and the first weight is at least partially positioned within the channel.

8. The golf club head according to claim 1, wherein the recess comprises a through-slot open to the interior cavity and the first weight is at least partially positioned within the through-slot.

9. The golf club head according to claim 1, further comprising a polymeric material at least partially filling the recess.

10. The golf club head according to claim 9, wherein the first weight is non-movably fixed relative to the recess so that a position of the first weight relative to the recess is not adjustable.

11. The golf club head according to claim 10, wherein the second weight is non-movably fixed relative to the weight port so that a position of the second weight relative to the weight port is not adjustable.

12. The golf club head according to claim 1, wherein:

the body further comprises a hosel that defines a hosel axis; and a plane, parallel to a heel-to-toe direction along the golf club head, perpendicular to a forward-to-rearward direction along the golf club head, and in which the hosel axis lies, intersects the recess.

13. The golf club head according to claim 1, wherein:

the body further comprises a hosel that defines a hosel axis; and at least a portion of the recess is forward of a plane parallel to a heel-to-toe direction along the golf club head, perpendicular to a forward-to-rearward direction along the golf club head, and in which the hosel axis lies.

14. The golf club head according to claim 1, wherein:

the body further comprises a crown-opening recessed ledge extending about crown opening; and the crown insert is in seated engagement with the crown-opening recessed ledge.

15. The golf club head according to claim 14, wherein:

the body further comprises a sole-opening recessed ledge extending about sole opening; and the sole insert is in seated engagement with the sole-opening recessed ledge.

16. The golf club head according to claim 15, wherein:

each one of the crown insert and the sole insert has a thickness ranging from about 0.195 mm to about 0.9 mm; and each one of the crown insert and the sole insert is comprised of at least four plies of uni-tape standard modulus graphite being oriented at any combination of 0°, +45°, −45° and 90°.

17. The golf club head according to claim 1, wherein:

the recess has a length and is offset an offset distance from a leading edge of the golf club head;

the offset distance is a minimum distance from the leading edge of the golf club head to the recess; and a ratio of the length of the recess to the offset distance is greater than 4 and less than 15 and the offset distance is no less than 4 mm and no more than 12.5 mm.

18. The golf club head according to claim 1, wherein a total length of the recess is between, and inclusive of, 75 mm and 95 mm.

19. The golf club head according to claim 1, wherein a surface area of the crown insert is greater than a surface area of the sole insert.

20. The golf club head according to claim 1, wherein the ratio of Ixx to Izz is no more than 0.75.

21. The golf club head according to claim 1, wherein:

a surface area of the crown insert is greater than a surface area of the sole insert;

a combined mass of the first weight and the second weight exceeds a combined mass of the crown insert and the sole insert;

the recess comprises a channel and the first weight is at least partially positioned within the channel; and the golf club head further comprises a polymeric material at least partially filling the recess.

22. The golf club head according to claim 1, wherein:

the body further comprises a hosel that defines a hosel axis;

a plane, parallel to a heel-to-toe direction along the golf club head, perpendicular to a forward-to-rearward direction along the golf club head, and in which the hosel axis lies, intersects the recess; and at least a portion of the recess is forward of the plane parallel to a heel-to-toe direction along the golf club head, perpendicular to the forward-to-rearward direction along the golf club head, and in which the hosel axis lies.

* * * * *